US005133153A

United States Patent [19]

Kamitaka

[11] Patent Number: 5,133,153

[45] Date of Patent: Jul. 28, 1992

[54] OPENING/CLOSING DEVICE OF A DOOR MEMBER

[75] Inventor: Masuo Kamitaka, Nara, Japan

[73] Assignee: Sharp Kabushiki Kaisha, Osaka, Japan

[21] Appl. No.: 681,067

[22] Filed: Apr. 5, 1991

Related U.S. Application Data

[62] Division of Ser. No. 523,330, May 14, 1990, Pat. No. 5,052,151, which is a division of Ser. No. 347,924, May 5, 1989, Pat. No. 4,947,583.

[30] Foreign Application Priority Data

| | | | |
|---|---|---|---|
| May 10, 1988 | [JP] | Japan | 63-114248 |
| Jun. 22, 1988 | [JP] | Japan | 63-154055 |
| Sep. 24, 1988 | [JP] | Japan | 63-239362 |
| Nov. 21, 1988 | [JP] | Japan | 63-294150 |
| Dec. 5, 1988 | [JP] | Japan | 63-158259[U] |
| Dec. 5, 1988 | [JP] | Japan | 63-158260[U] |
| Dec. 5, 1988 | [JP] | Japan | 63-158352[U] |
| Dec. 5, 1988 | [JP] | Japan | 63-169228[U] |
| Dec. 5, 1988 | [JP] | Japan | 63-307118 |
| Dec. 5, 1988 | [JP] | Japan | 63-307168 |
| Dec. 26, 1988 | [JP] | Japan | 63-329930 |

[51] Int. Cl.[5] ..... E06B 3/00

[52] U.S. Cl. ..... 49/501; E06B/3/00

[58] Field of Search ..... 49/501, 193, 382

[56] References Cited

U.S. PATENT DOCUMENTS

| | | | |
|---|---|---|---|
| 3,048,898 | 8/1962 | Davis | 49/193 |
| 3,733,749 | 5/1973 | Parera | 49/382 X |
| 3,889,419 | 6/1975 | Maleck | 49/193 |
| 4,503,582 | 3/1985 | Gurubathan | 49/193 X |
| 4,811,518 | 3/1989 | Ladisa | 49/193 |

*Primary Examiner*—Philip C. Kannan

[57] ABSTRACT

An opening/closing device of a door for a refrigerator or the like will open/close the door member at a desired side, namely, at the right side or at the left side, without requiring a movable operating handle. The device is simple in construction, has a high adiabatic efficiency, and can be easily incorporated in the door member. Therefore, no special mechanism is necessary in the door member and no structural change is required inside the door member.

11 Claims, 98 Drawing Sheets

OPENING/CLOSING DEVICE OF A DOOR MEMBER

This application is a divisional of copending application Ser. No. 07/523/330, filed on May 14, 1990, now U.S. Pat. No. 5,052,151 which is a divisional of copending application Ser. No. 07/347,924, filed on May 5, 1989, now U.S. Pat. No. 4,947,583, the entire contents of which are hereby incorporated by reference.

BACKGROUND OF THE INVENTION

1. Field of the Invention

The present invention generally relates to an opening/closing device mainly for use in a door member and more particularly, to an opening/closing device of a door member of a refrigerator which is arranged to open or close the door member at either desired side of the door member.

2. Description of the Prior Art

A door member of a refrigerator has been generally designed to be opened or closed only at one side, namely, either at the right side or at the left side thereof. In other words, the door member has been already destined to be operable only at the right side or only at the left side when it was manufactured.

Therefore, a user has been obliged to select one of the two types of a refrigerator, one provided with the right-operable door member or the other provided with the left-operable door member, while taking considerations into the place where the refrigerator is placed. Moreover, after the purchase of the refrigerator, if it occurs that the user wishes to change the place locations for the refrigerator inconveniences would be brought about such that the door member would hit the wall of the room, resulting in difficulties of opening/closing of the door member, and therefore the placing position of the refrigerator has been limited in prior arts.

Further, in the case where many people use the refrigerator, it may be difficult for those at the different side of their able arm to open or close the door member of the refrigerator.

To avoid such inconveniences as above, various types of an opening/closing device for the door member by which the door member can be opened/closed at the desired side, that is, the double-side-operable device have been proposed up to now.

FIGS. 141 and 142 illustrate respectively a representative double-side operable device of the type referred to above.

In the device of FIG. 141, hinge pins 20 and 20 are provided at the right and left corners of respective opposite upper and lower end portions of a door member 10. The hinge pins 20 are freely projectable upward or downward. Moreover, the hinge pins 20 are received by respective bearing recessed portions 40 each formed in a part of a main body 30 confronting to the upper or lower end portion of the door member 10. When either one of operating handles 50 provided in the door member 10 is rotated, either of the right and left hinge pins 20 are slipped off from the corresponding bearing recessed portions 40, so that the door member 10 becomes operable.

Referring to the double-side-operable device shown in FIG. 142, the refrigerator has a middle frame 80 which is bored at the central part thereof and sandwiched between a main body 60 and a door member 70. The middle frame 80 is pivotally fixed to the main body 60 at one lateral side of the right and left sides thereof, and also pivotally fixed to the door member 70 at the other side thereof. When one of right and left operating handles provided in the door member 70 is rotated, only the door member 70 can be rendered openable at one side, while the door member 70 and the middle frame 80 are all together rendered openable at the other side.

SUMMARY OF THE INVENTION

In the device of FIG. 141, however, a pair of the movable handles 50 are required to switch the opening side of the door member 10, and accordingly the construction of the door member becomes disadvantageously complicated. Moreover, since the door member 10 cannot be opened from inside, a dangerous accident such as an infant being confined within the main body 30 cannot be avoided. Furthermore, a coupling mechanism is incorporated in the door member 10 for the operating handles 50 and the hinge pins 20, and therefore the adiabatic efficiency of the door member is deteriorated.

Meanwhile, in the device of FIG. 142, two packings, namely, one between the main body 60 and the middle frame 80, and the other between the middle frame 80 and the door member 70 are necessitated, and consequently the whole door member becomes thick, thereby causing the deterioration of the adiabatic efficiency of the door member.

Accordingly, the present invention has been developed with a view to substantially eliminating the above-described disadvantages inherent in the prior art devices, and has for its essential object to provide an opening/closing device for a door member of a refrigerator which is, without requiring a movable operating handle and accordingly without necessities for the operating handle to be moved, arranged to open/close the door member at one's desired side, in simple construction and with high adiabatic efficiency of the door member.

In accomplishing the above-described object, according to the present invention, an opening/closing device is comprised of a pair of right and left hinge pins protrudingly provided at the opposite right and left side portions of either one of a door member and a main body in which said door member is mounted; a fixed plate provided in the other one of said door member and said main body which has engaging grooves to be detachably engaged with said corresponding hinge pins from the opening side of the door member; a pair of latch plates rotatably provided at the opposite right and left side portions of said fixed plate each of which has a latch groove opening to the outer-diameter side of said latch plate so as to detachably engage said latch plate with said corresponding hinge pin for restricting said hinge pin in said engaging groove a pair of springs each for urging said latch plate both in a restricting position where said latch plate restricts said hinge pin and in a restriction-releasing position where said latch plate releases the restriction of said hinge pin; and a coupling means provided between said pair of latch plates which prohibits the rotation of said one latch plate in association with the rotation of said the other latch plate in the restriction-releasing direction.

The above-described coupling means includes a pair of links each pivotally fixed to the fixed plate in the vicinity of corresponding latch plate and, a coupling link coupling one end portions of the links, so that each link and the corresponding latch plate are linked with each other by the engagement of a lock groove having a bend with a lock pin.

According to a modified example, the coupling means is formed into a single lever-like means and pivotally fixed to the middle portion of the fixed plate in the longitudinal direction. The coupling means is linked at its right and left end portions with corresponding latch plates through the engagement of a bent lock groove with a lock pin.

According to a further modified example, the coupling means is formed by a single lever-like means which is provided with lock pins at opposite right and left end portions thereof. The coupling means is associated through slide grooves formed in a crooked configuration in the fixed plate with which the lock pins are engaged and, lock grooves formed in latch plates.

According to a still further modified example, the coupling means consists of a pair of coupling levers. Respective one end portions of the right and left coupling levers are pivotally fixed to the peripheral portion of the latch plate at the reverse side, and at the respective other end portions of the coupling means, a lock pin is protrudingly provided in which is guided by a slide groove formed in the fixed plate and detachably engaged with a lock groove formed in the corresponding latch plate.

According to the present invention, the door member can be opened only by pulling the door member from the desired right or left side, without necessities for rotating an operating handle therefor. Therefore, the door member can be freely designed according to the present invention with no restrictions. Moreover, the door member can be opened/closed from the inside of the refrigerator according to the present invention, whereby a dangerous accident such as a child be confined in the refrigerator can be prevented.

Moreover, the device according to the present invention can be incorporated in the upper and lower edge portions of the door member, or in the corresponding parts of the main body, and no special mechanism is required to be provided inside the door member. Accordingly, the inner construction of the door member is unchanged, and the adiabatic efficiency is never deteriorated.

As a preferred embodiment, the present invention provides an opening/closing device of a door member which comprises: a pair of right and left hinge pins protruding provided at the opposite right and left side portions of either one of a door member and a main body on which said door member is mounted; a fixed plate provided in the other one of said door member and said main body which has engaging grooves to be detachably engaged with said corresponding hinge pins from the opening side of the door member; a pair of latch plates rotatably provided at the opposite right and left side portions of said fixed plate each of which has a latch groove opening to the outer-diameter side of said latch plate so as to detachably engage said latch plate with said corresponding hinge pin for restricting said hinge pin in said engaging groove; a pair of springs each for urging said latch plate both in a restricting position where said latch plate restricts said hinge pin and in a restriction-releasing position where said latch plate releases the restriction of said hinge pin; and a coupling means provided between said pair of latch plates which prohibits the rotation of said one latch plate in association with the rotation of the other latch plate in the restriction-releasing direction; said coupling means including a pair of links each pivotally fixed to said fixed plate in the vicinity of said right or left latch plate and, a coupling link coupling one end portions of said pair of links, wherein a lock groove consisting of a slide guide portion and a stopper portion is formed generally in L-shaped configuration in either one of said link and said latch plate, and a lock pin is protrudingly provided in the other one of said link and said latch plate for restricting the rotation of the latch plate through engagement with said lock groove.

Also, as another preferred embodiment, the present invention provides an opening/closing device of a door member which comprises; hinge pins protrudingly provided at four corner portions, upper, lower, right and left corner portions of a main body on which the door member is mounted; a fixed plate provided in said door member and having engaging grooves which are detachably engageable with said hinge pins from the opening side of the door member; latch plates rotatably provided at the opposite right and left side portions of said fixed plate, each of which has a latch groove opening to the outer-diameter side of said latch plate so as to detachably engage said latch plate with said hinge pin thereby to restrict said hinge pin within said engaging groove; a coupling means for prohibiting the rotation of said one latch plate in association with the rotation of the other latch plate of the restriction releasing direction, and a safety means each actuated in the vicinity of said latch plate at the other side than the opening side of the door member so as to control the rotation of said latch plate at the other side than the opening side when said door member is kept opened.

In addition, as a modified embodiment, the present invention provides an opening/closing device of a door member which comprises a pair of hinge pins members projected in a vertical direction from the right, left end portions of either one from the door or a main body on which said door member is mounted, a load receiving member for supporting the door member through contact with the tip ends of the hinge pin members during the door member closure and disposed on the either one of the door member or the main body, the door being supported for its opening or closing operations with the one between the right and left hinge pin members as a center, and an engagement pair which is mounted on each of the door member and the main body, and which is immediately engaged before the door member is fully closed so as to raise the door member up to a position where the hinge pin members do not interfere with the load receiving member.

As another modified embodiment, the present invention provides an opening/closing device of a door member which comprises hinge means composed of hinge plates and hinge pins projected from the hinge plates and mounted through a mounting plate for hinge use on both the right and left end portions of a main body on which said door member is mounted, engaging grooves provided in the door member into which the hinge pins are detachably engaged from the open side of the door member, the door member being opened or closed from the optional right or left side, a reinforced member extending along the vertical direction of the main body and mounted on the inner wall portion of the main body external shell, and a mounting plate for hinge use secured onto the reinforced member.

Also, as yet another modified embodiment, the present invention an opening/closing device of a door member which comprises hinge pins projected from and mounted on both the right and left end portions of a main body on which said door member is mounted and engaging grooves provided in the door member into which the hinge pins are detachably engaged from the open side of the door, the door member being opened or closed from the optional right or left side, and the door member including frame members composed of two pairs of opposed sashes, which, the adjacent sash pair are respectively secured through an engagement member, and at least more than three sashes are integrally secured with the use of engagement member.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

These and other objects and features of the present invention will become apparent from the following description taken in conjunction with preferred embodiments thereof with reference to the accompanying drawings, which are given by way of illustration only, and thus are not limitative of the present invention; and throughout which like parts are designated by like reference numerals, and in which:

FIG. 1 is a perspective view showing the external appearance of a refrigerator provided with the opening/closing device of a door member of the present invention;

FIG. 2 is a perspective view showing the door member of the refrigerator of FIG. 1;

FIG. 3 is an exploded perspective view of the opening/closing device;

FIG. 4 is a plane view of the device when the door member is kept closed;

FIG. 5 is a plane view of the device when the door member is kept opened;

FIG. 6 is a front elevational view showing the upper and lower portions of the device when the door member is kept closed;

FIG. 7 is a plane view showing a portion of a screening plate provided in the device when the door member is kept closed;

FIG. 8 is a similar view of FIG. 7 showing the screening plate when the door member is kept opened;

FIG. 9 is an exploded front view showing the portion of the screening plate provided in the device;

FIG. 58 is a perspective view showing the external appearance of a refrigerator provided with the device according to the second embodiment of the present invention;

FIG. 59 is a plane view of the device, when the door member is kept closed, in accordance with the second embodiment;

FIG. 60 is a similar view to FIG. 59, but showing the device when the door member is kept opened;

FIG. 61 is an exploded perspective view of the device of FIG. 59;

FIG. 62 is an enlarged schematic view showing the lock groove provided in the latch plate of the device of FIG. 59;

FIG. 64 is a plane view of the device when the door member is kept closed;

FIG. 65 is a plane view of the device when the door member is kept opened;

FIG. 66 is an exploded perspective view of the device;

FIG. 67 is a plane view of the device when the door member is kept closed;

FIG. 68 is a plane view of the device when the door member is kept opened;

FIG. 69 is an exploded perspective view of the device;

FIG. 70 is a plane view of the device when the door member is kept closed;

FIG. 71 is a plane view of the device when the door member is kept opened;

FIG. 72 is an exploded perspective view of the device of FIG. 70;

FIG. 73 is a plane view of the device when the door member is kept closed;

FIG. 74 is a plane view of the device when the door member is kept opened;

FIG. 75 is an exploded perspective view of the device of FIG. 73;

FIG. 76 is a plane view of the device when the door member is kept closed;

FIG. 77 is a plane view of the device when the door member is kept opened;

FIG. 78 is an exploded perspective view of the device of FIG. 76; . ,

FIG. 79 is a plane view of the device when the door member is kept/closed; FIG. 80 is a plane view of the device when the door member is kept opened;

FIG. 81 is an exploded perspective view of the device of FIG. 74;,

FIG. 82 is a plane view of the device when the door member is kept closed;

FIG. 83 is a plane view of the device when the door member is kept opened;

FIG. 84 is an exploded perspective view of FIG. 82;

FIG. 85 is a plane view of the device when the door member is kept closed;

FIG. 86 is a plane view of the device when the door member is kept opened;

FIG. 87 is an exploded perspective view of the device of FIG. 85;

FIG. 88 is a plane view of the device when the door member is kept closed;

FIG. 89 is a plane view of the device when the door member is kept opened;

FIG. 90 is an exploded perspective view of the device of FIG. 88;

FIG. 91 is a plane view of the device when the door member is kept closed;

FIG. 92 is a plane view of the device when the door member is kept opened;

FIG. 93 is an exploded perspective view of the device of FIG. 91;

FIG. 94 is a plane view of the device when the door member is kept closed;

FIG. 95 is a plane view of the device when the door member is kept opened;

FIG. 96 is an exploded perspective view of the device of FIG. 94;

FIG. 97 is a plane view of the device when the door member is kept closed;

FIG. 98 is a plane view of the device when the door member is kept opened;

FIG. 99 is an exploded perspective view of the device of FIG. 97;

FIG. 100 is a plane view of the device when the door member is kept closed;

FIG. 101 is a plane view of the device when the door member is kept opened;

.FIG. 102 is an exploded perspective view of the device of FIG. 100;

FIG. 103 is a plane view of the device when the door member is kept closed;

FIG. 104 is a plane view of the device when the door member is kept opened;

FIG. 105 is an exploded perspective view of the device of FIG. 103;

FIG. 106 is a plane view of the device when the door member is kept closed;

FIG. 107 is a plane view of the device when the door member is kept opened;

FIG. 108 is an exploded perspective view of the device of FIG. 106;

Figure 109:
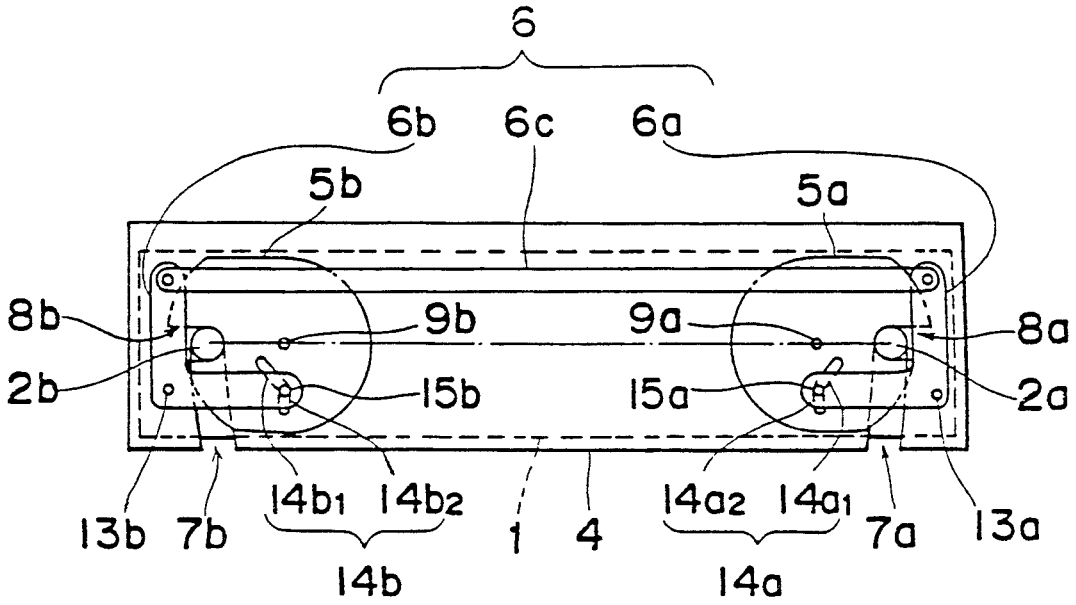
Figure 110:
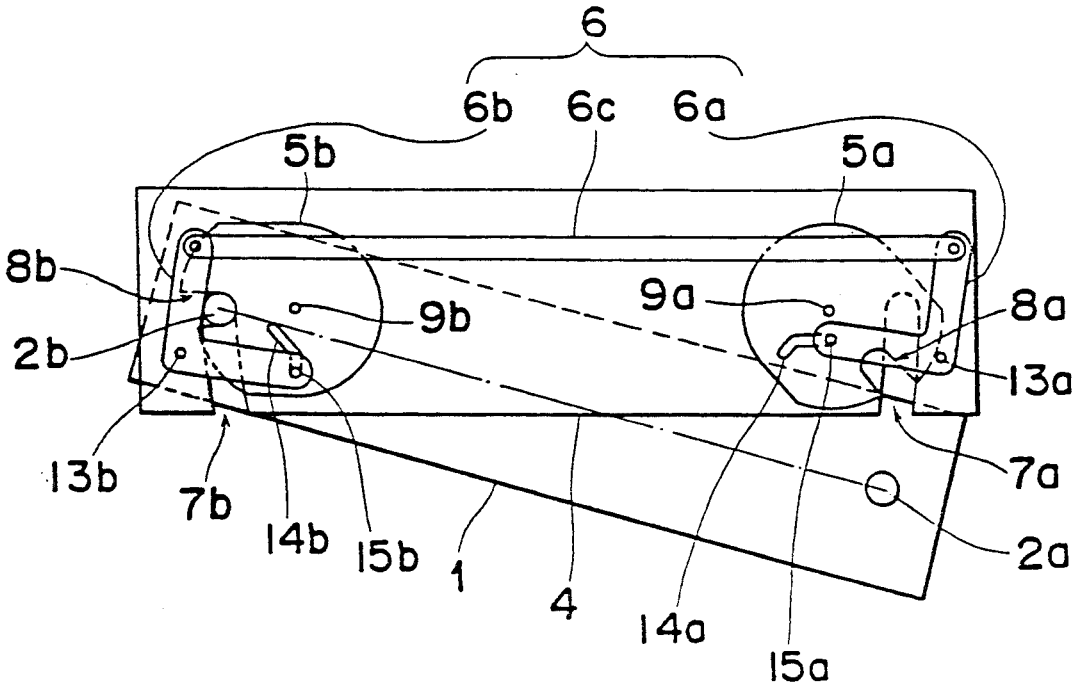
Figure 111:
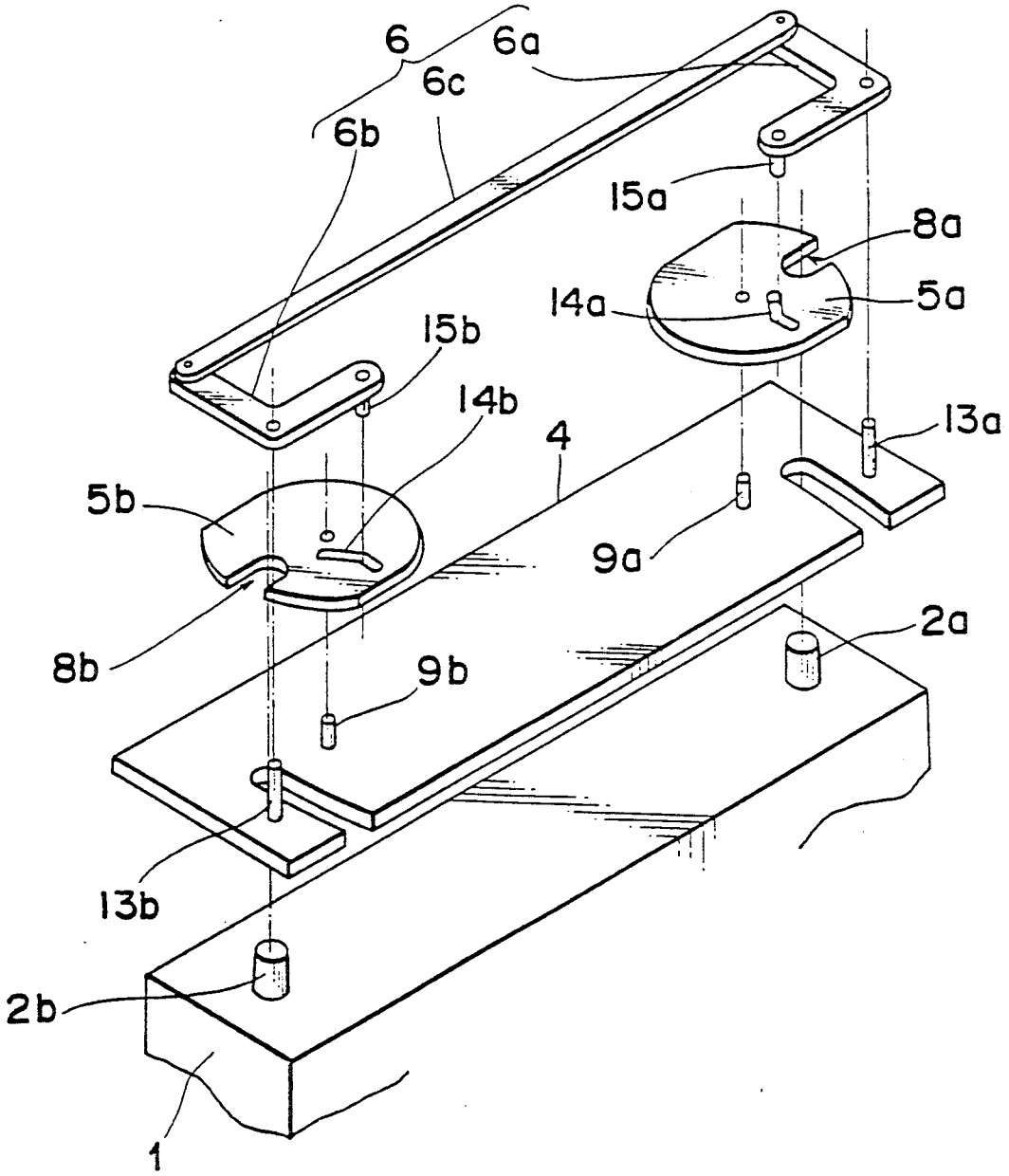
Figure 112:
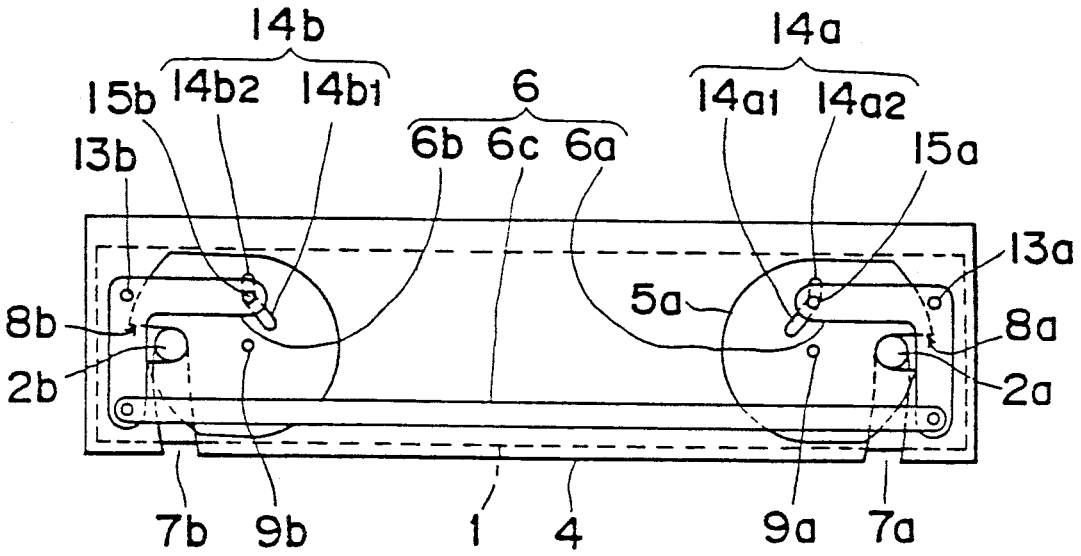
Figure 113:
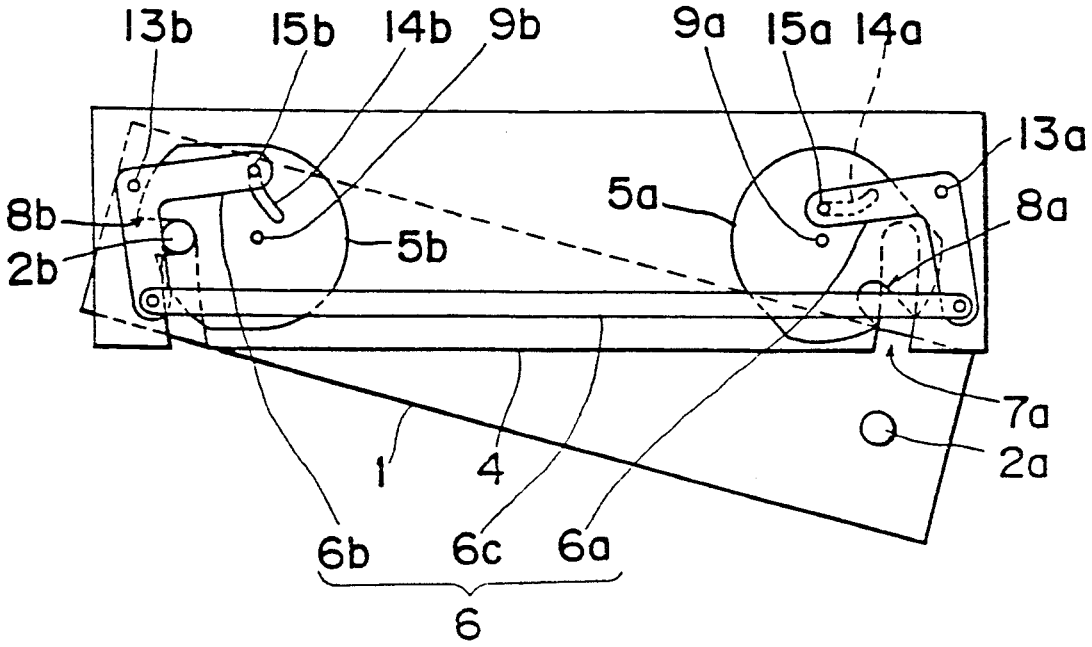
Figure 114:
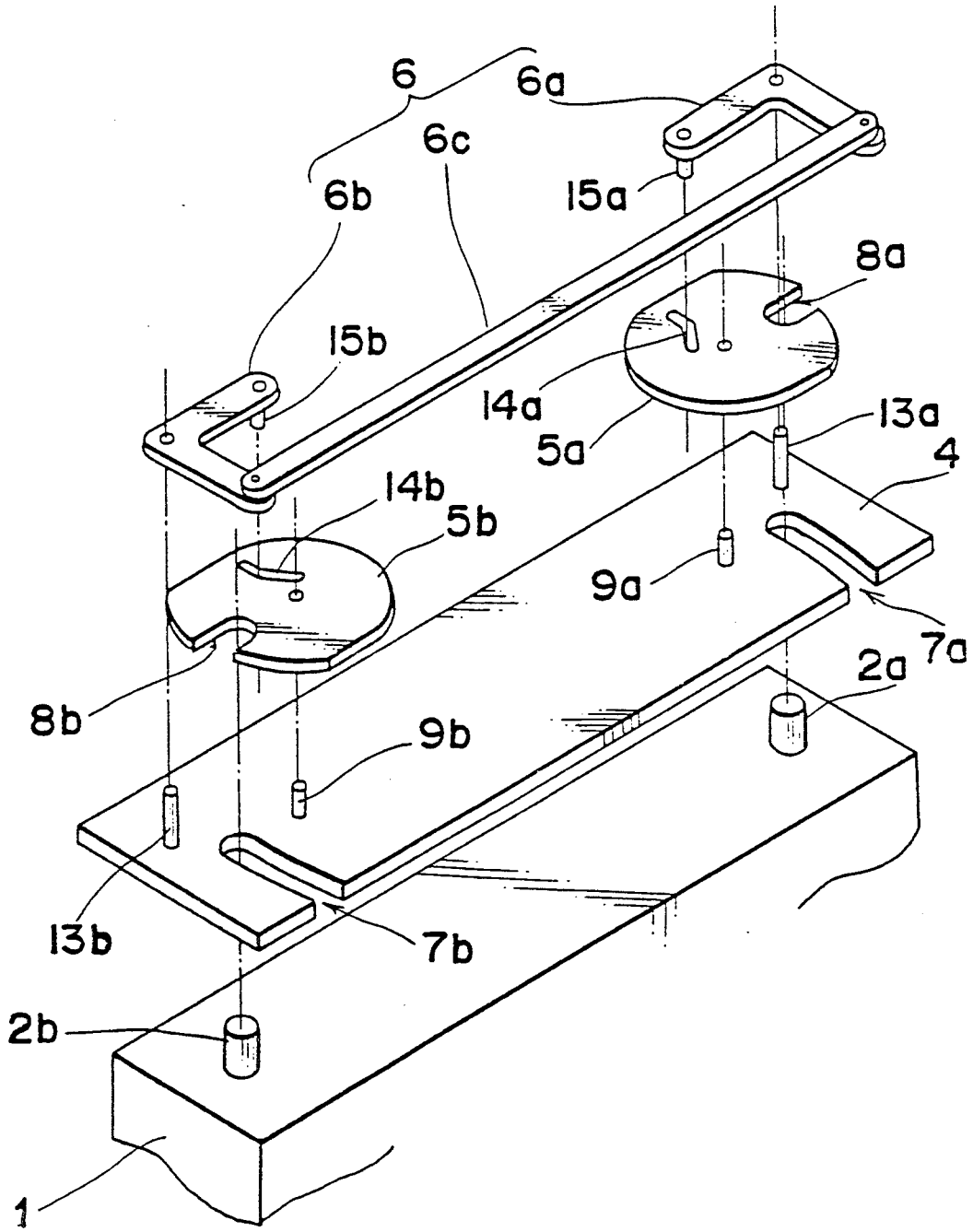
Figure 115:
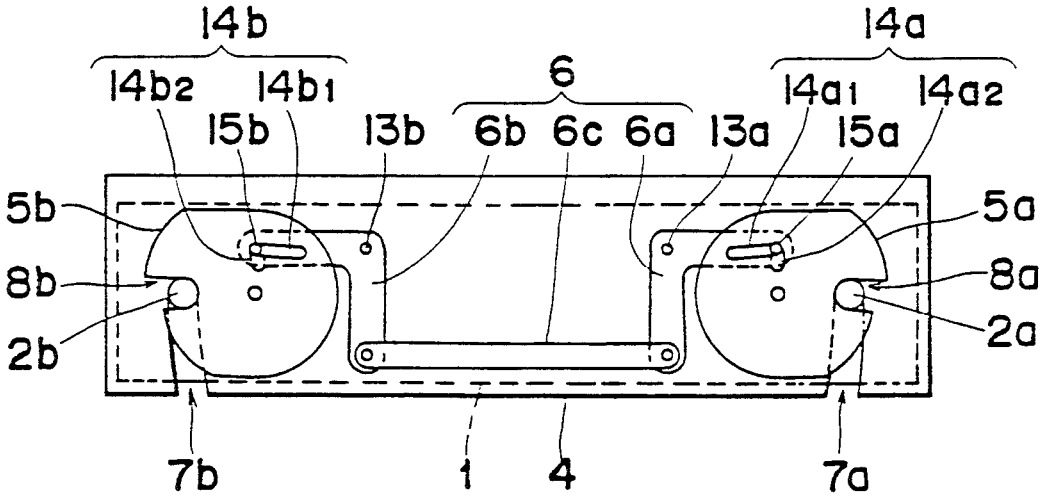
Figure 116:
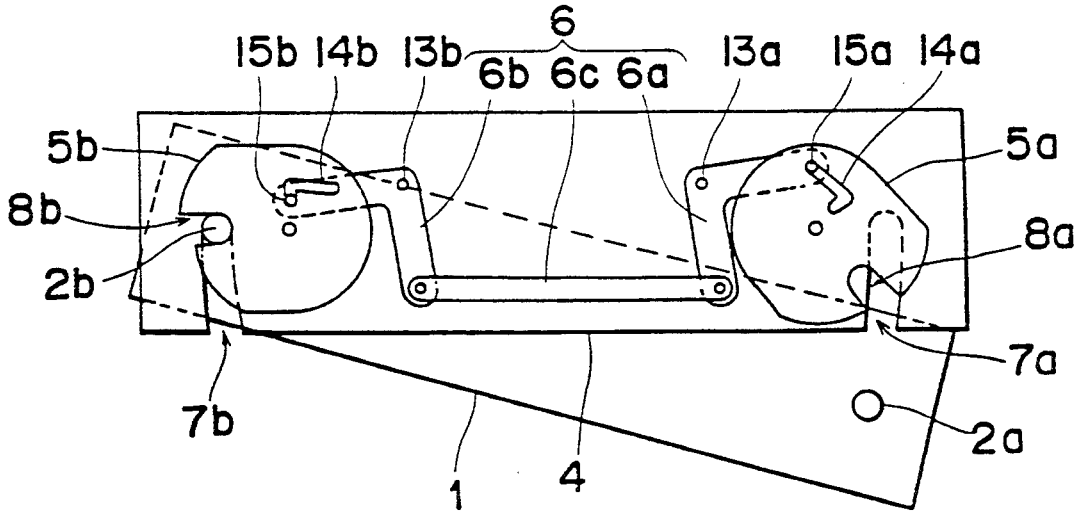
Figure 117:
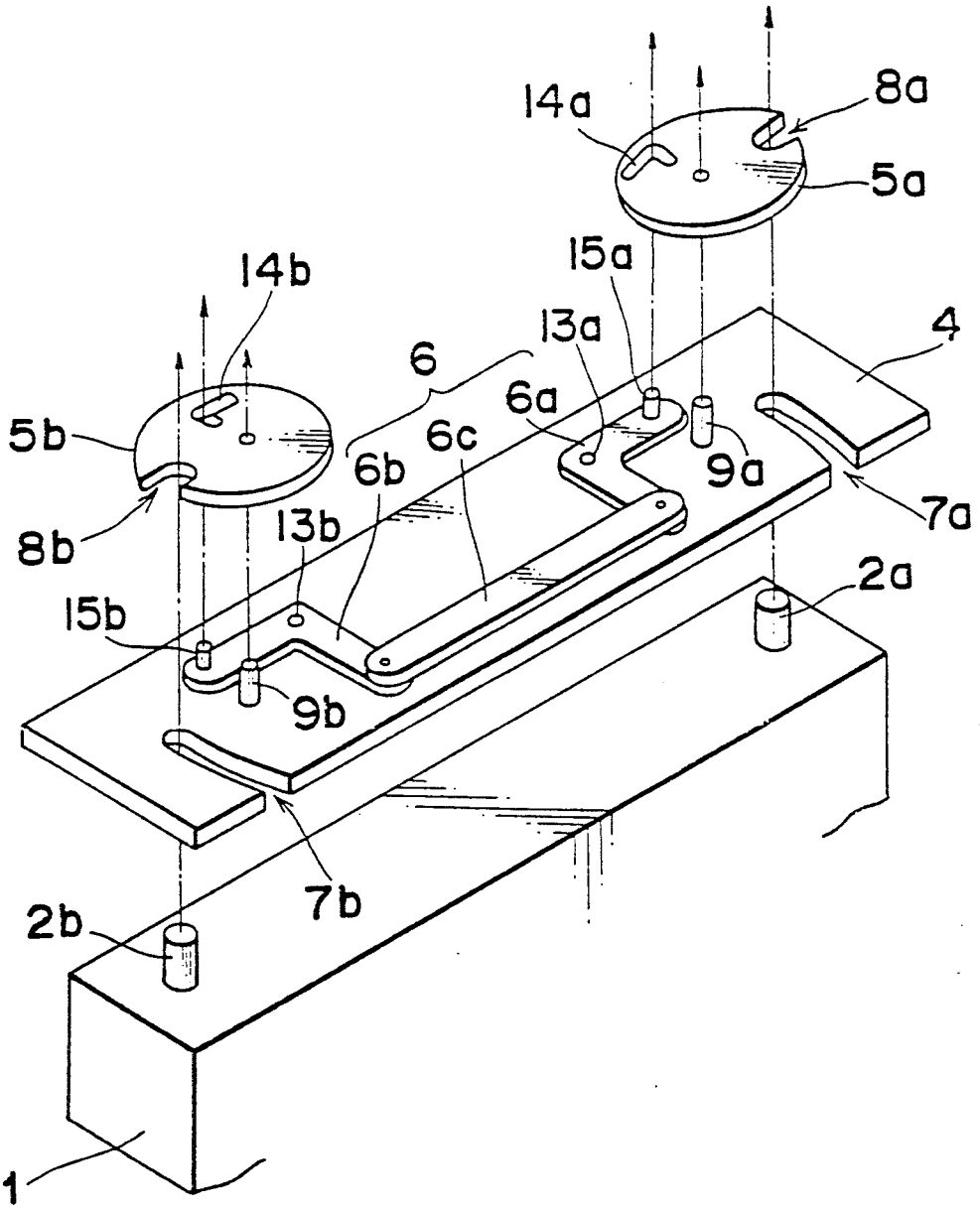
Figure 118:
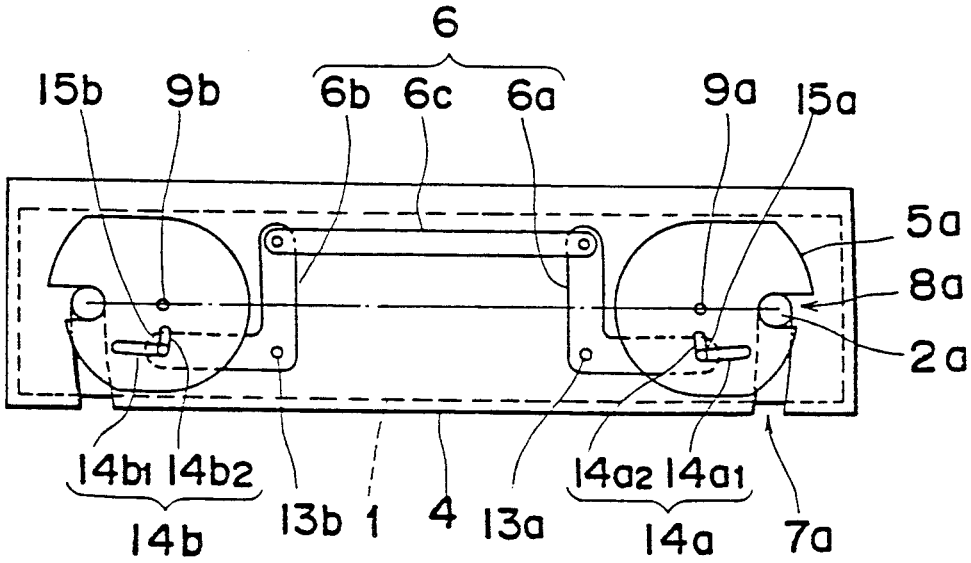
Figure 119:
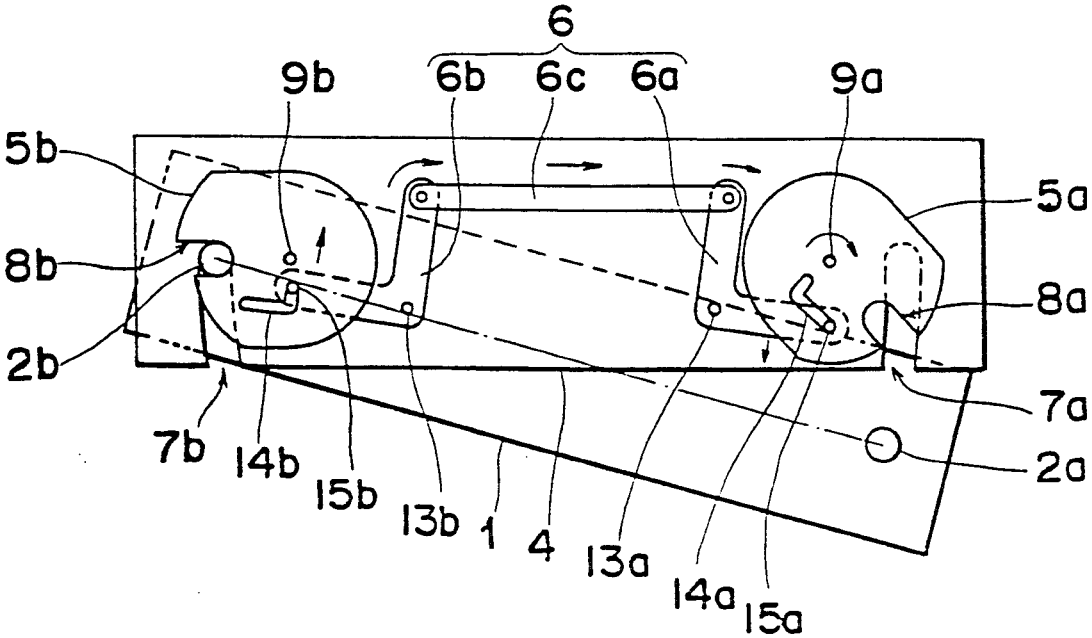
Figure 120:
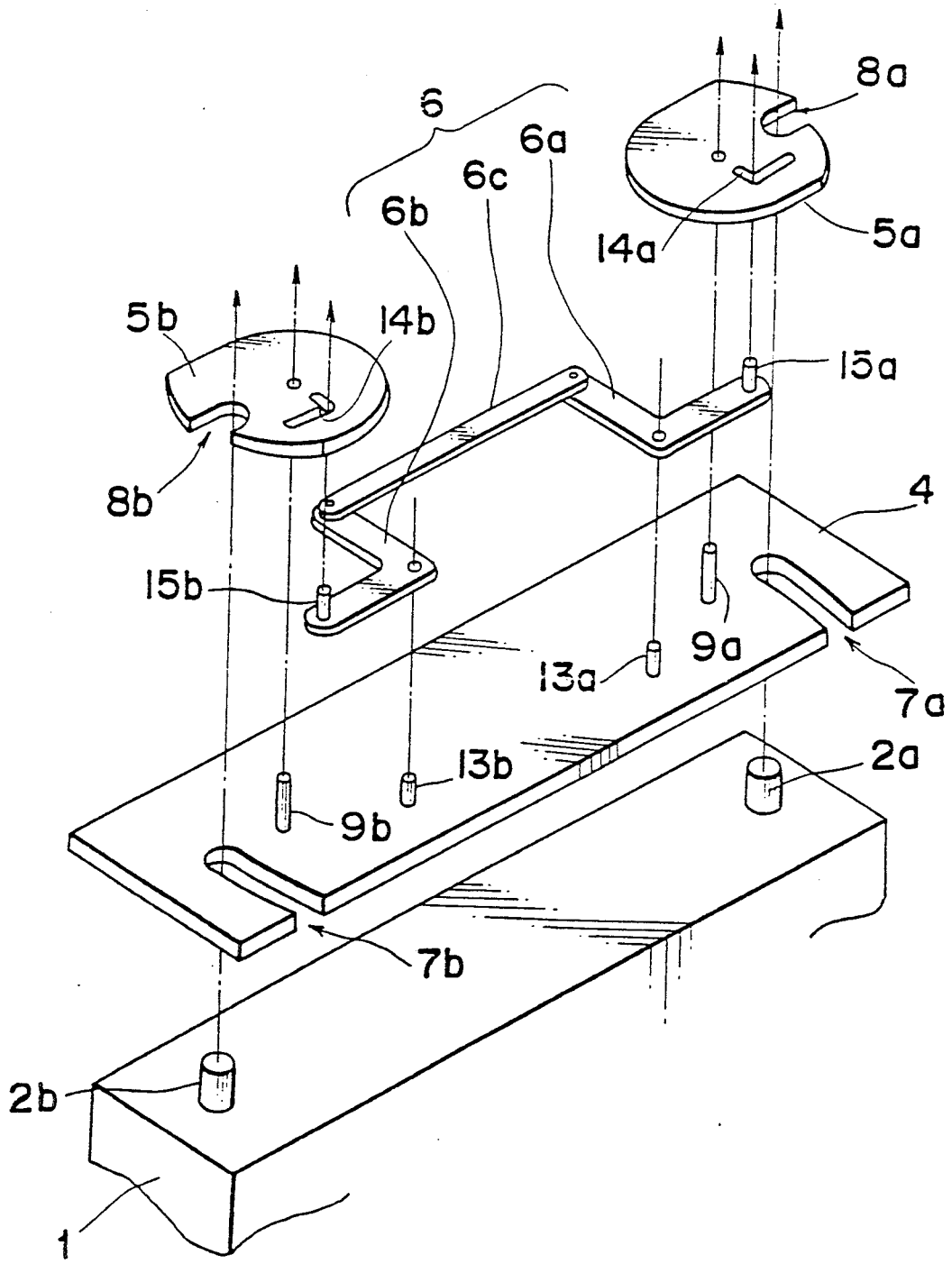
Figure 121:
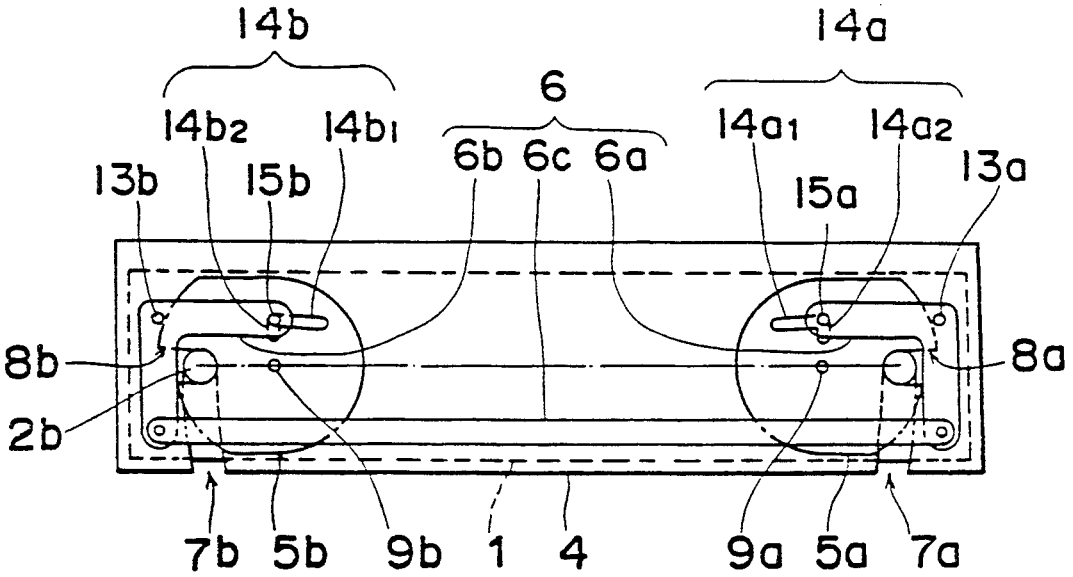
Figure 122:
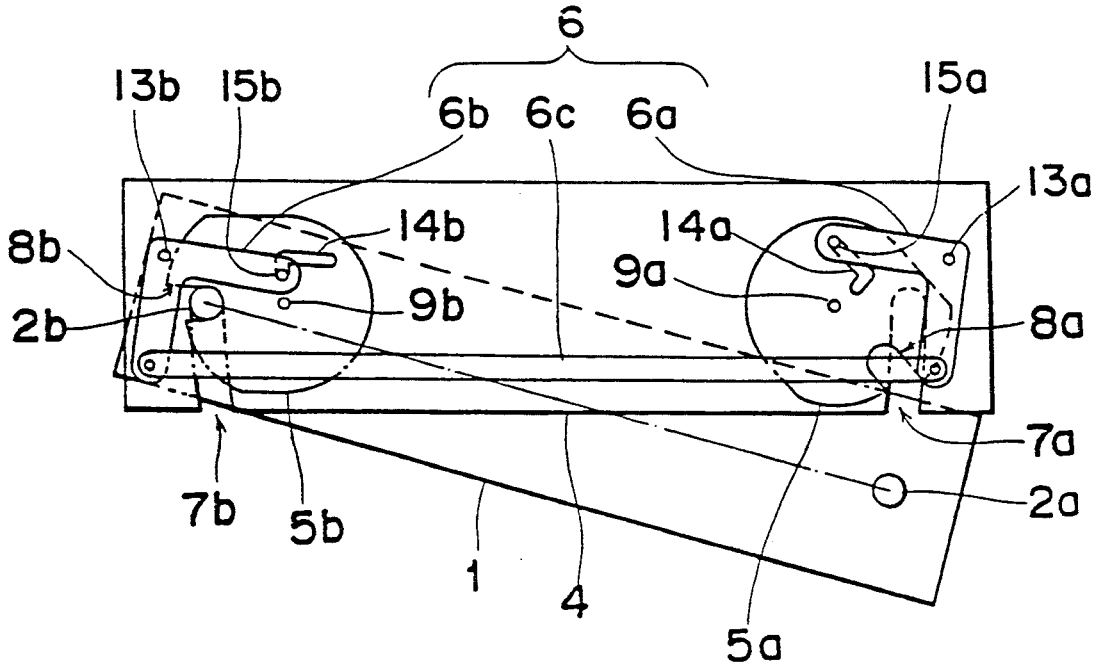
Figure 123:
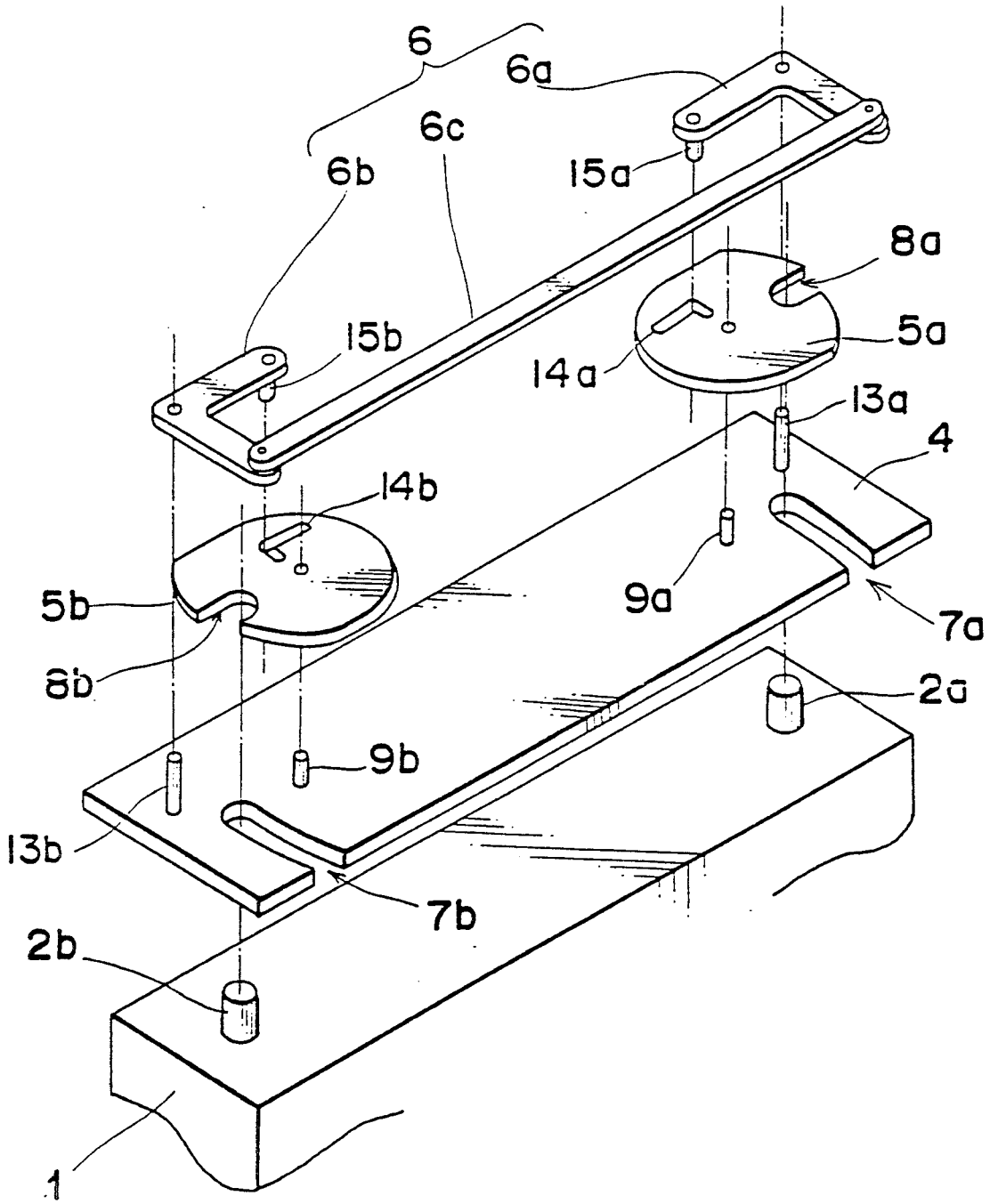
Figure 124:
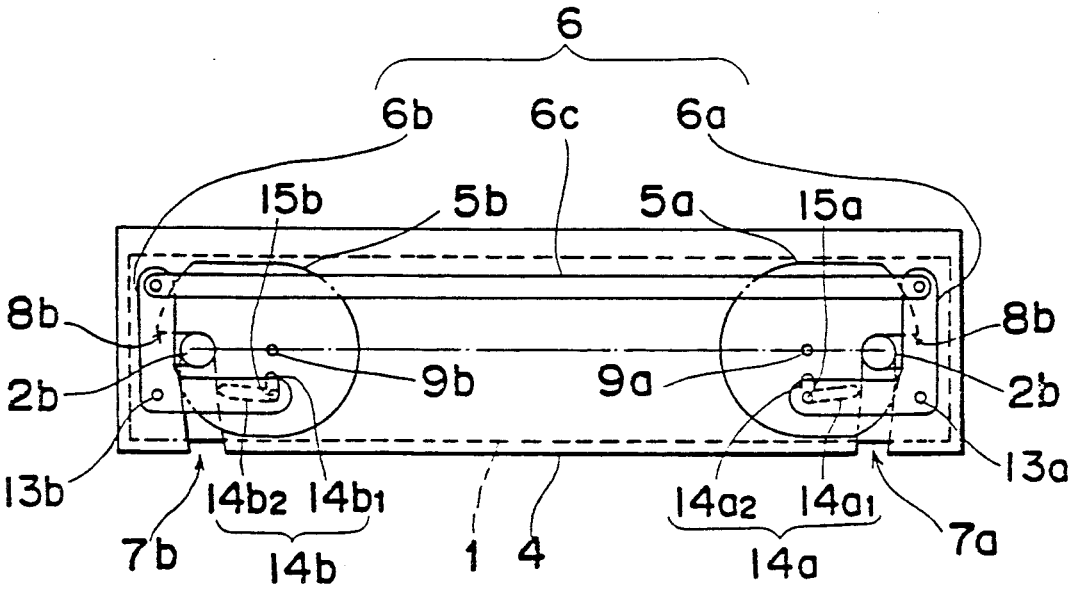
Figure 125:
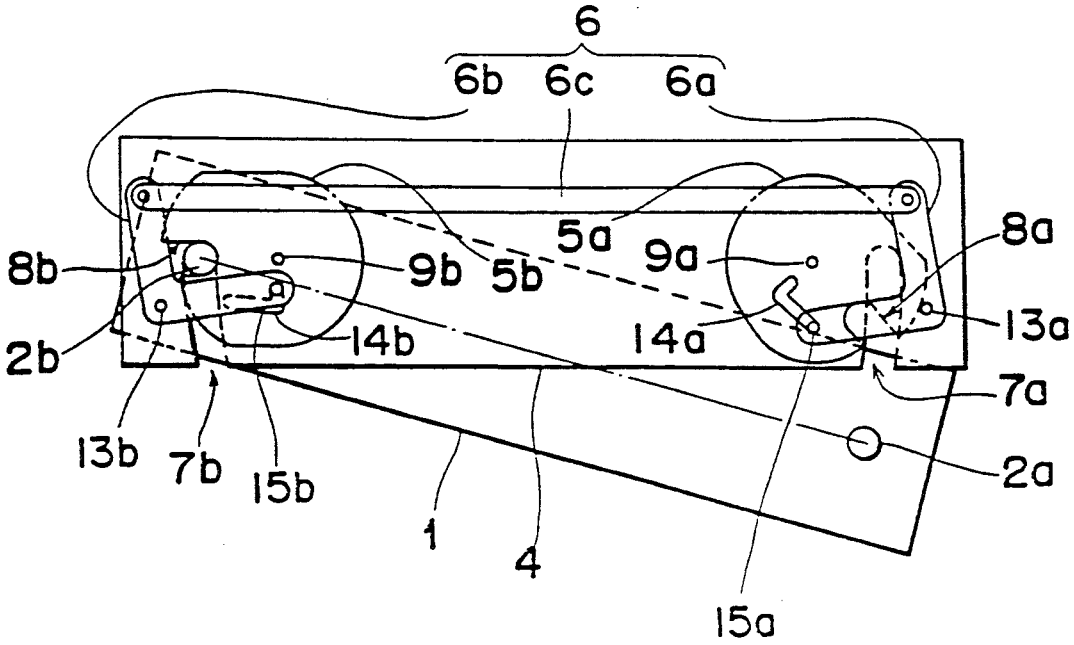
Figure 126:
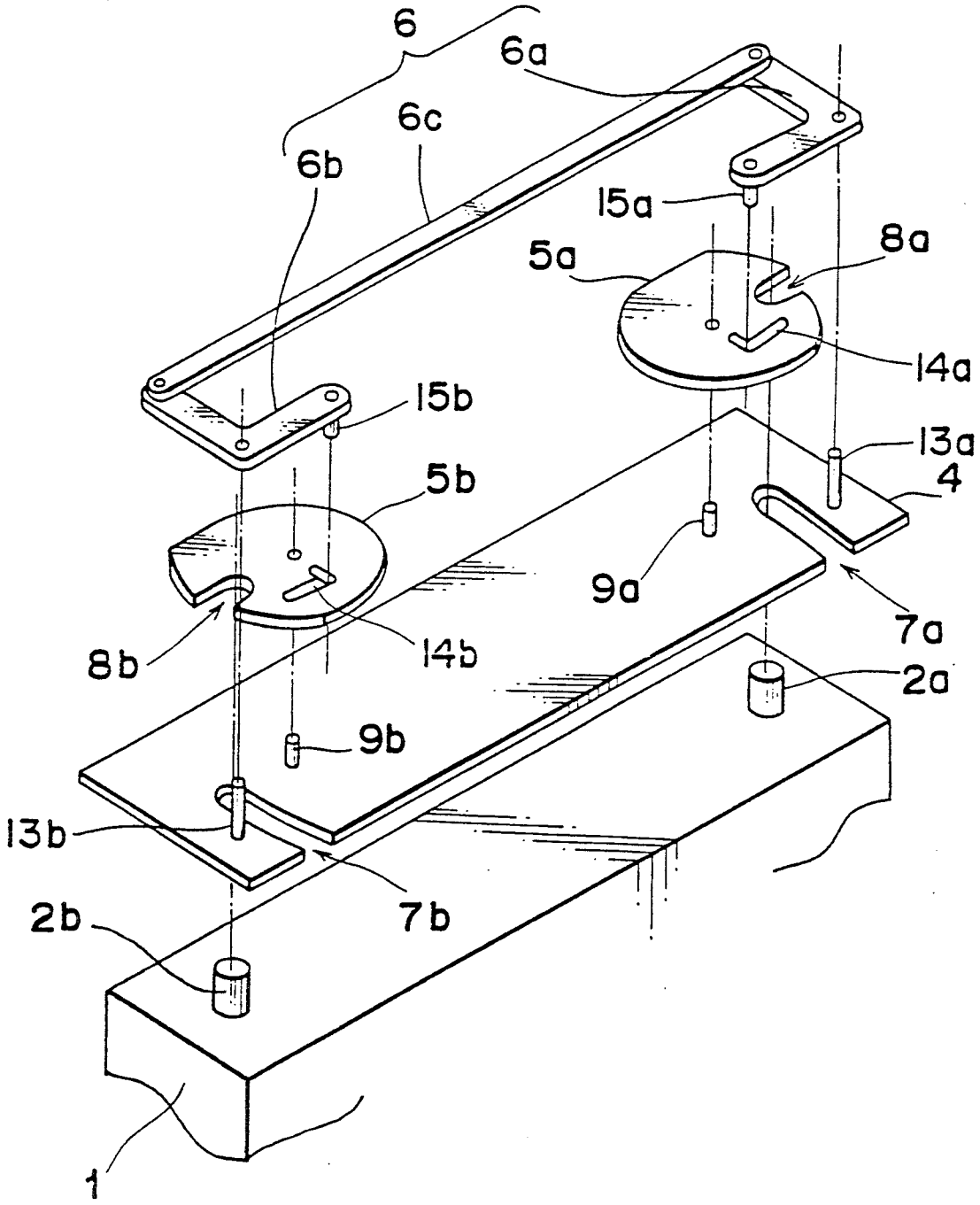
Figure 127:
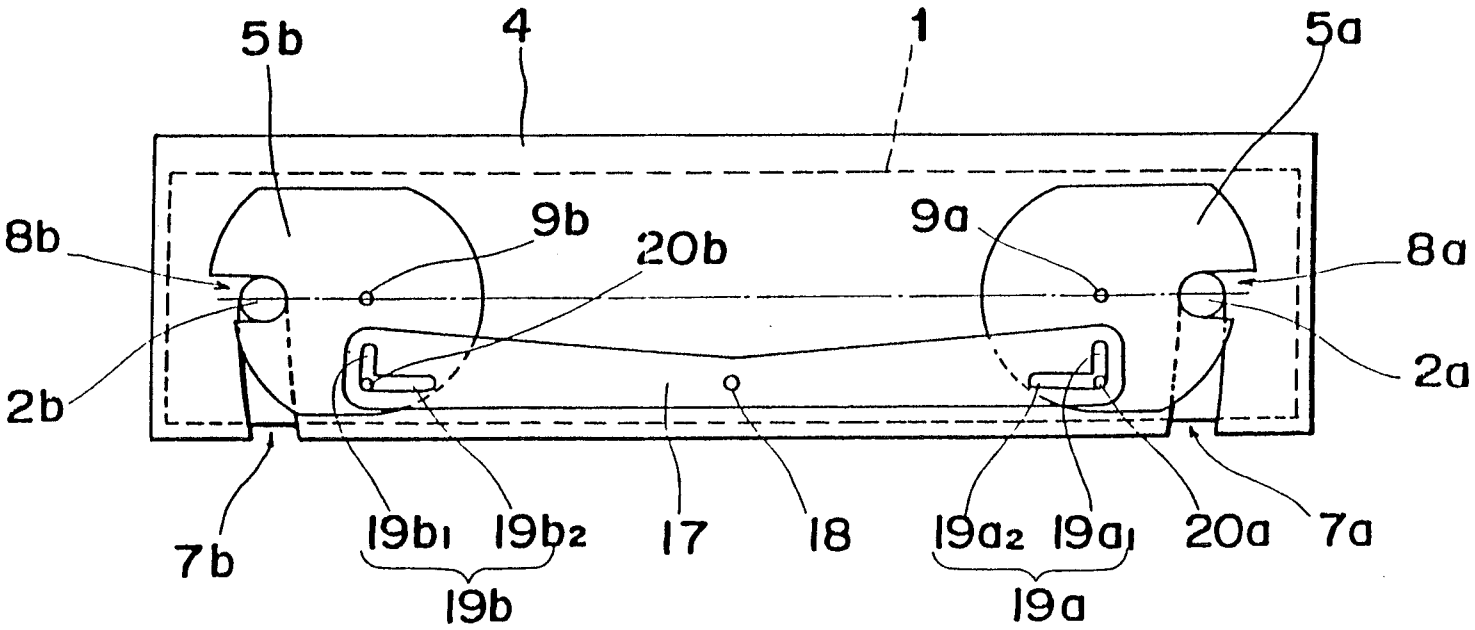
Figure 128:
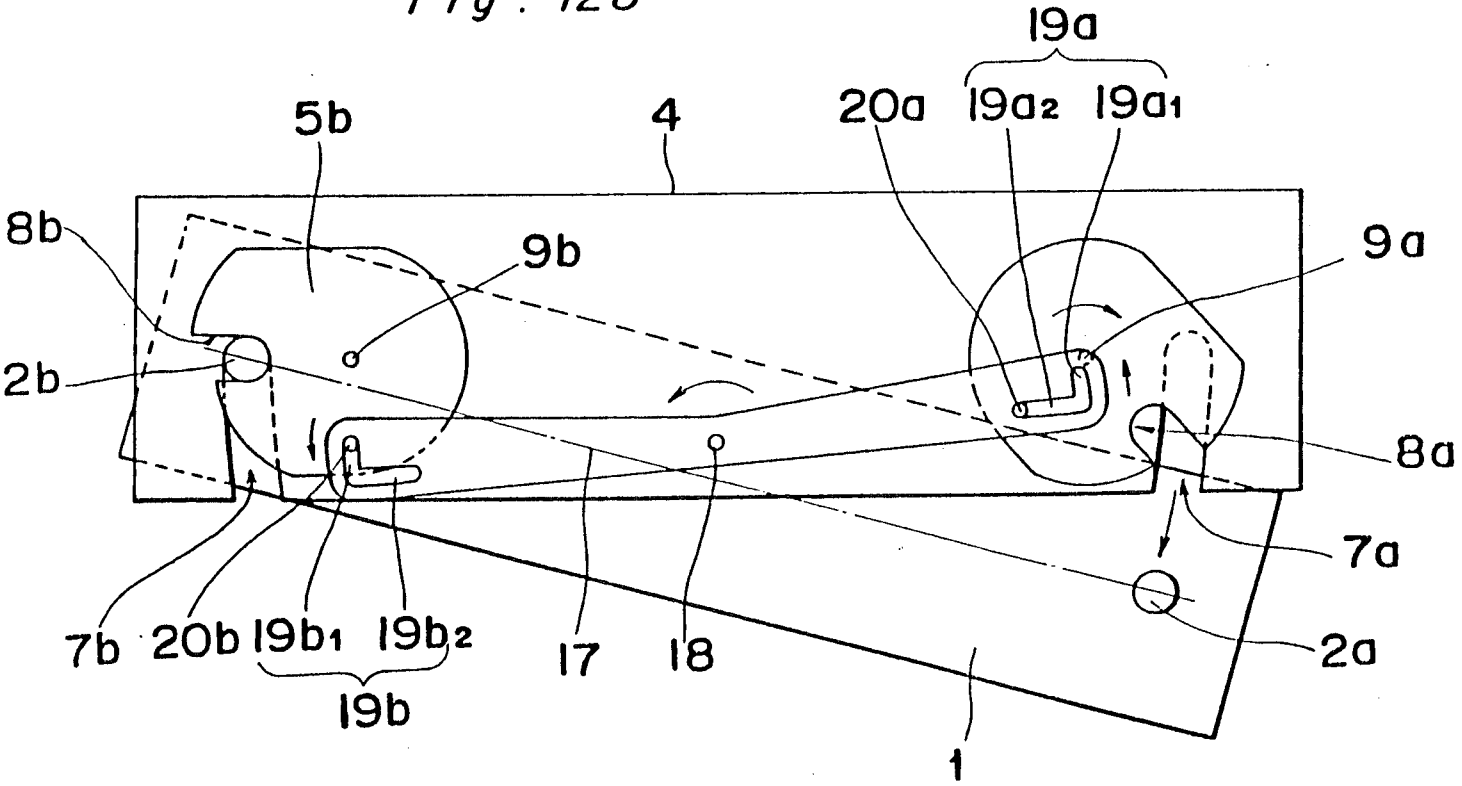
Figure 129:
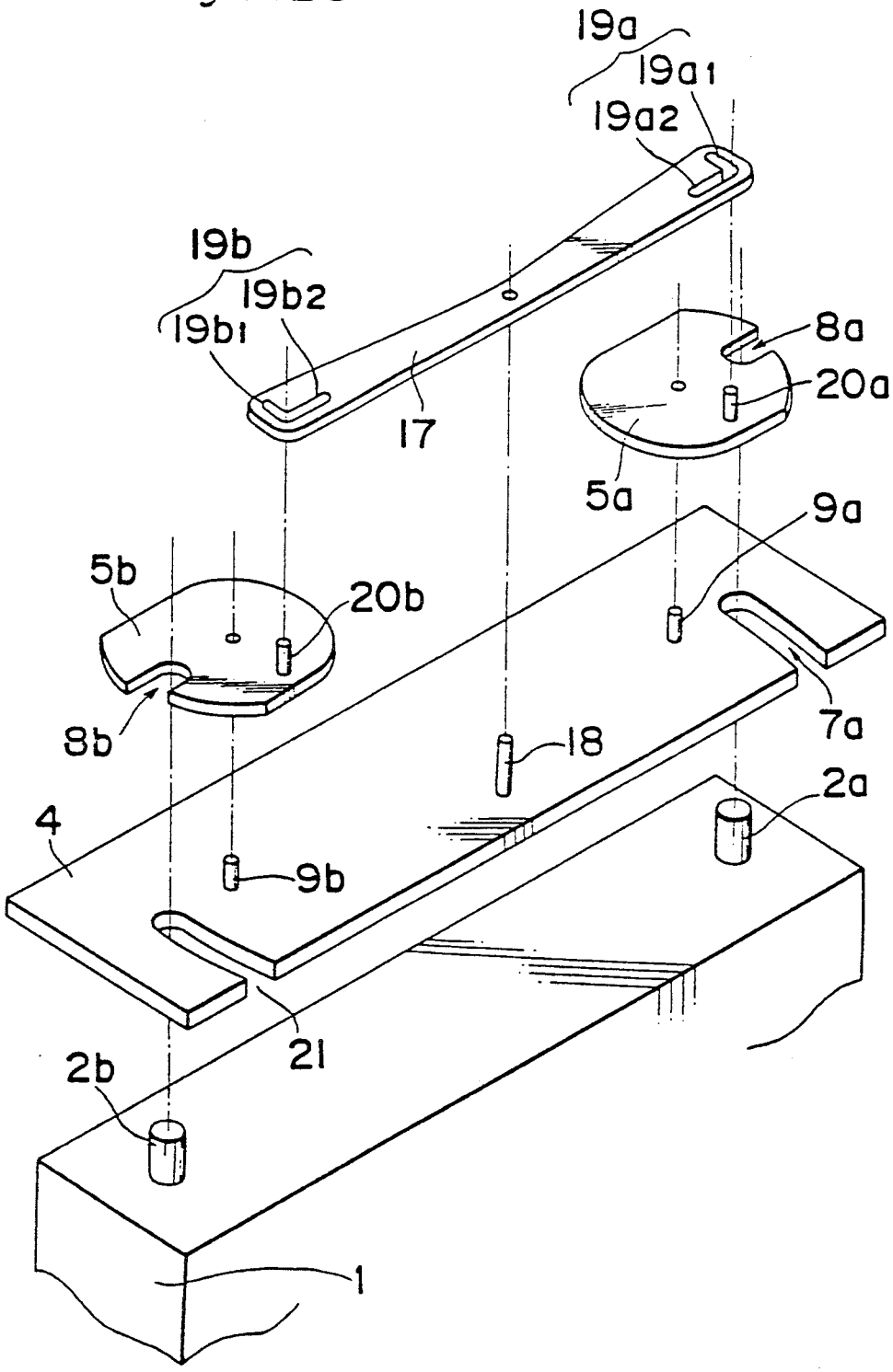
Figure 130:
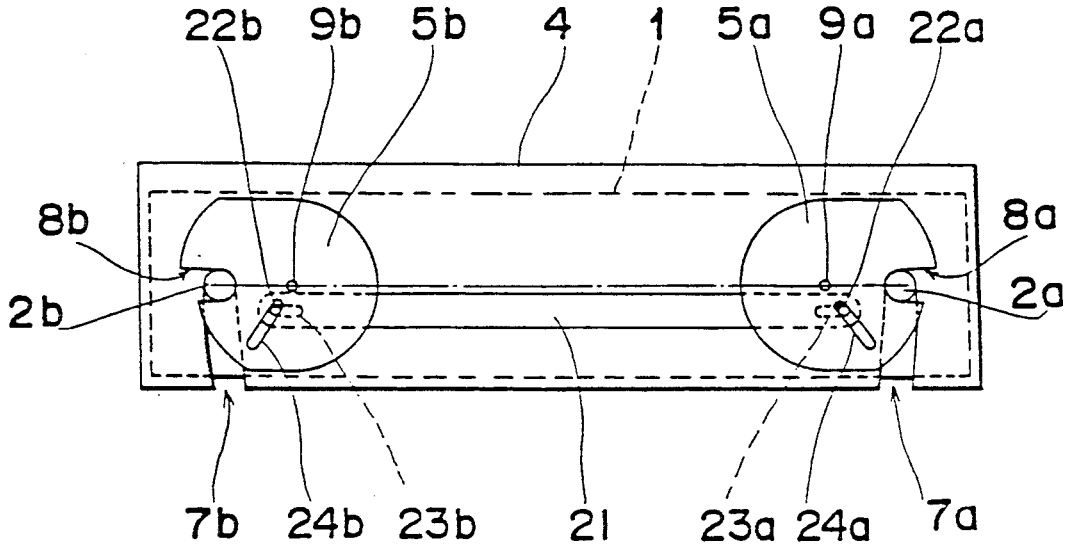
Figure 131:
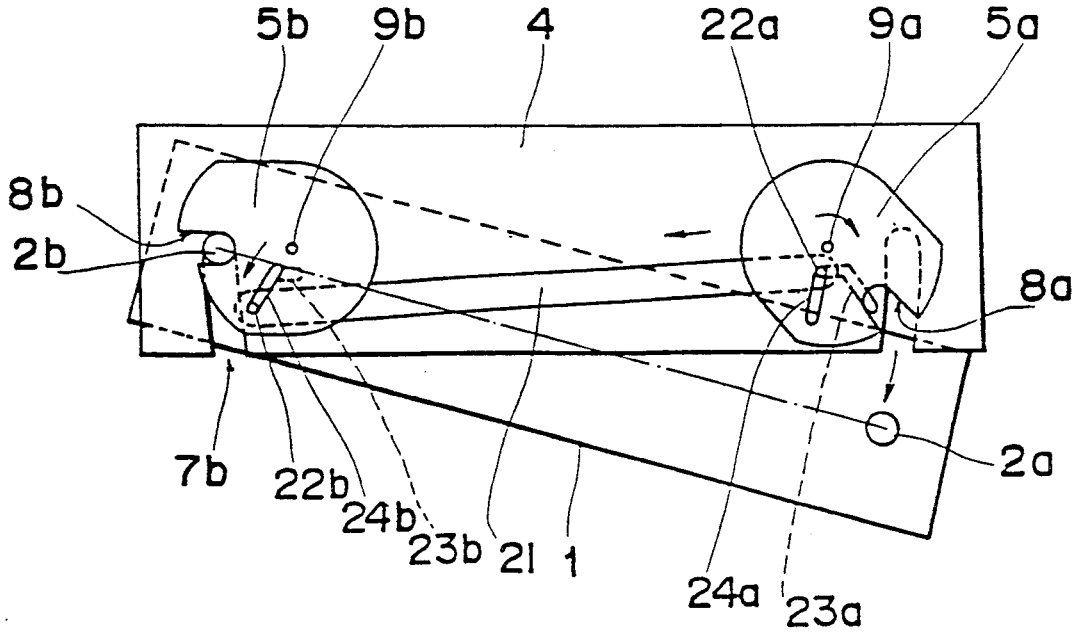
Figure 132:
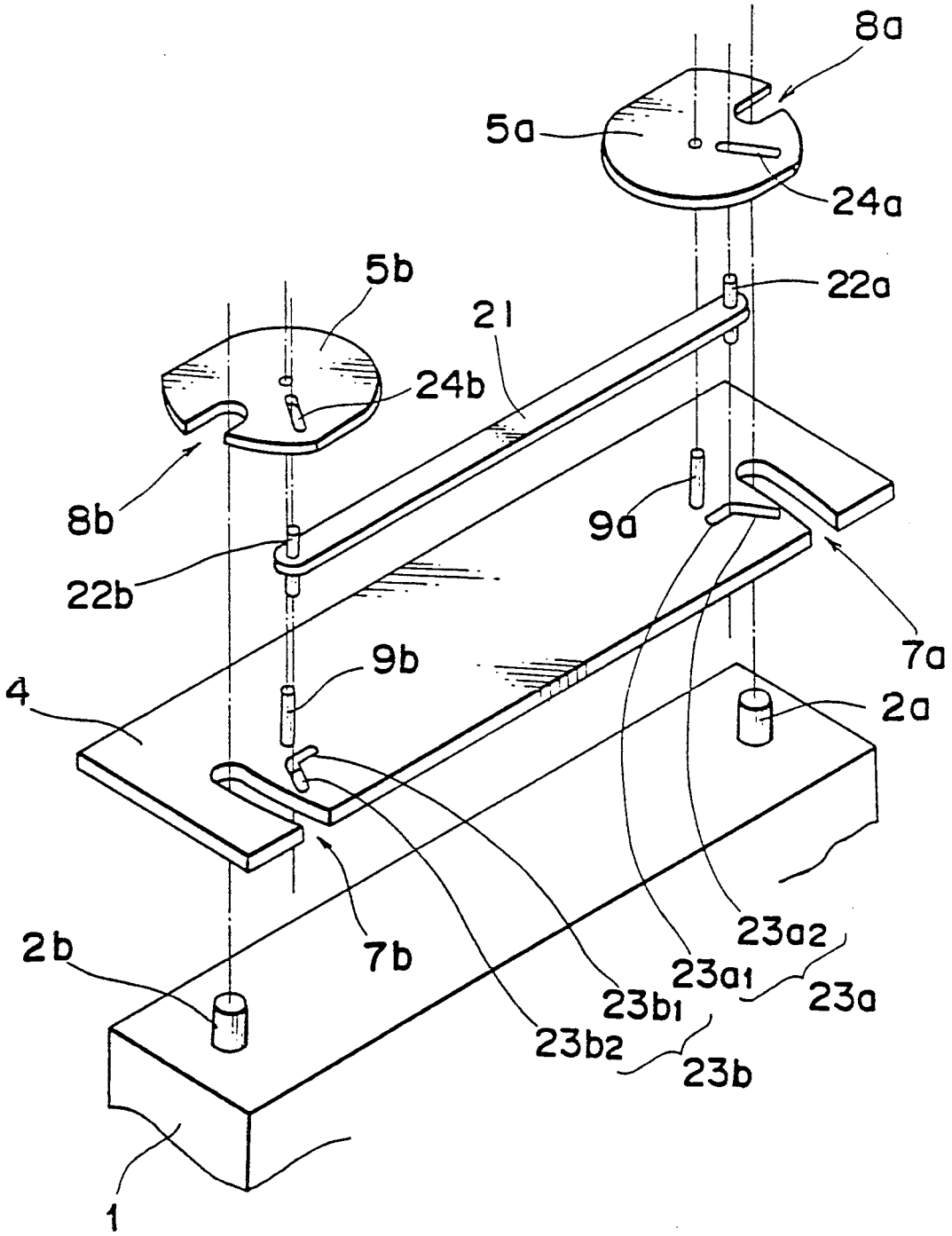
Figure 133:
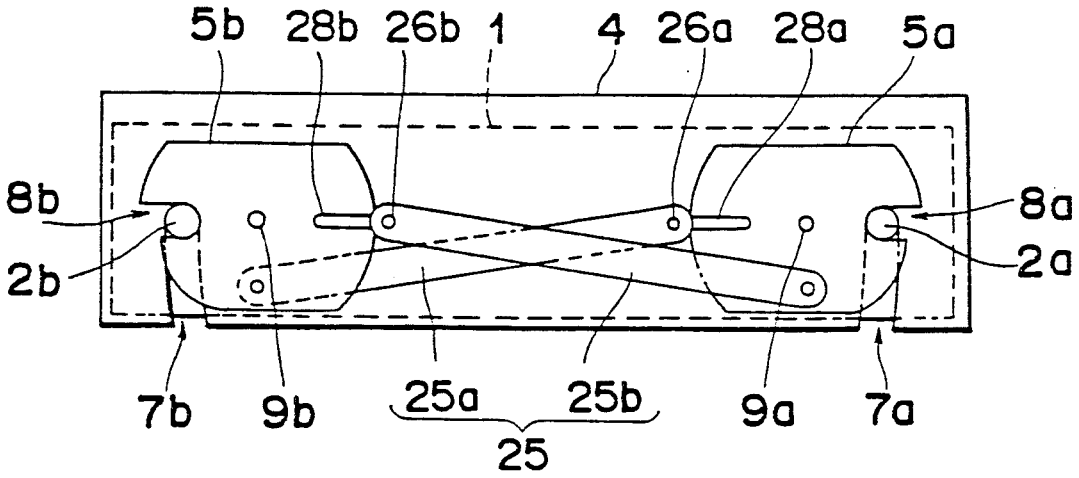
Figure 134:
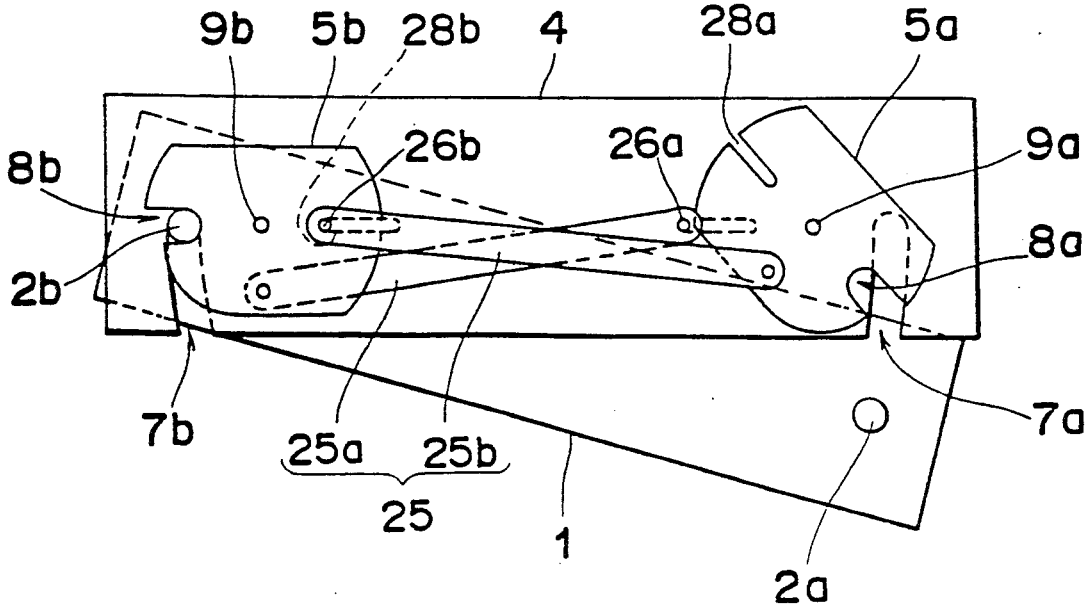
Figure 135:
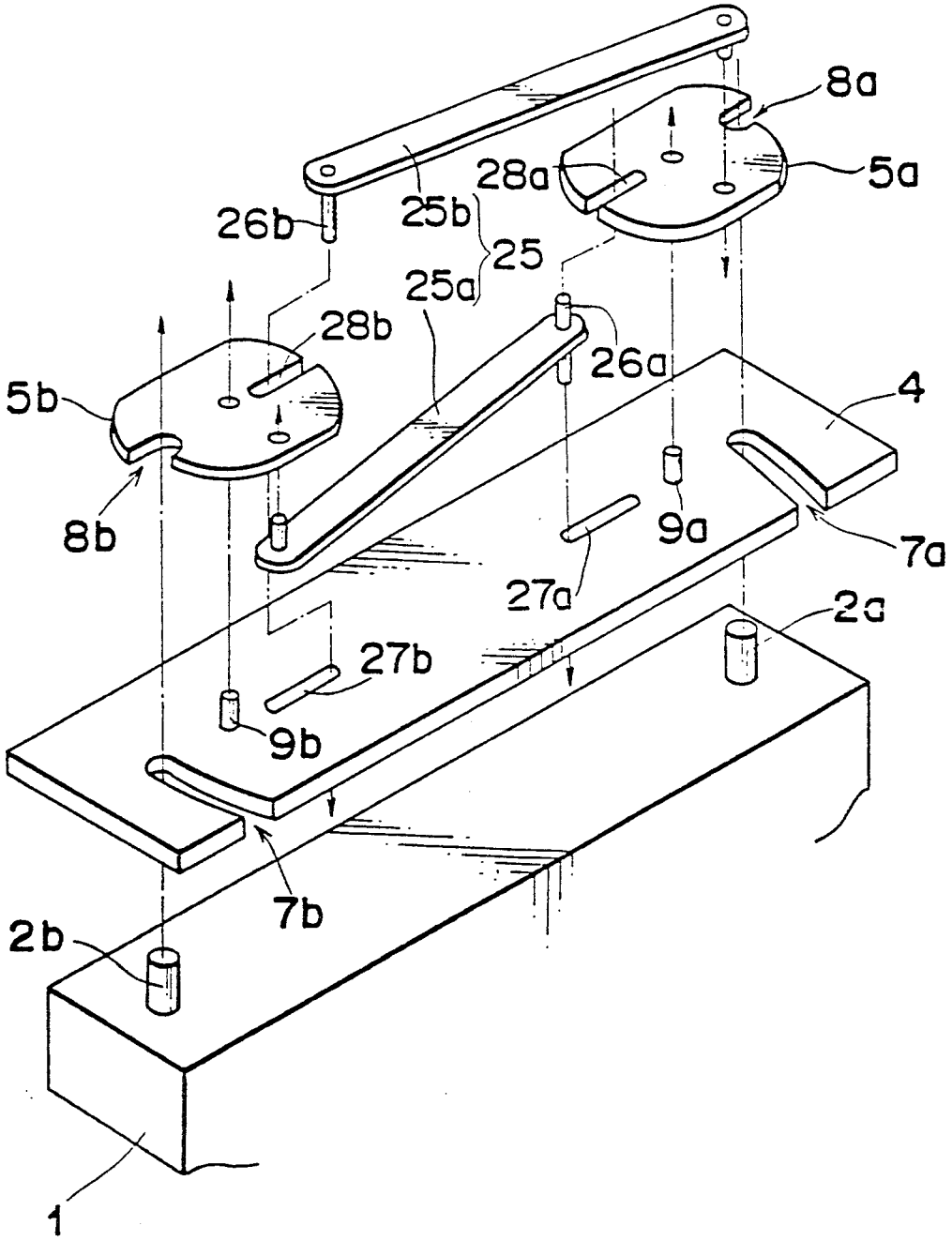
Figure 136:
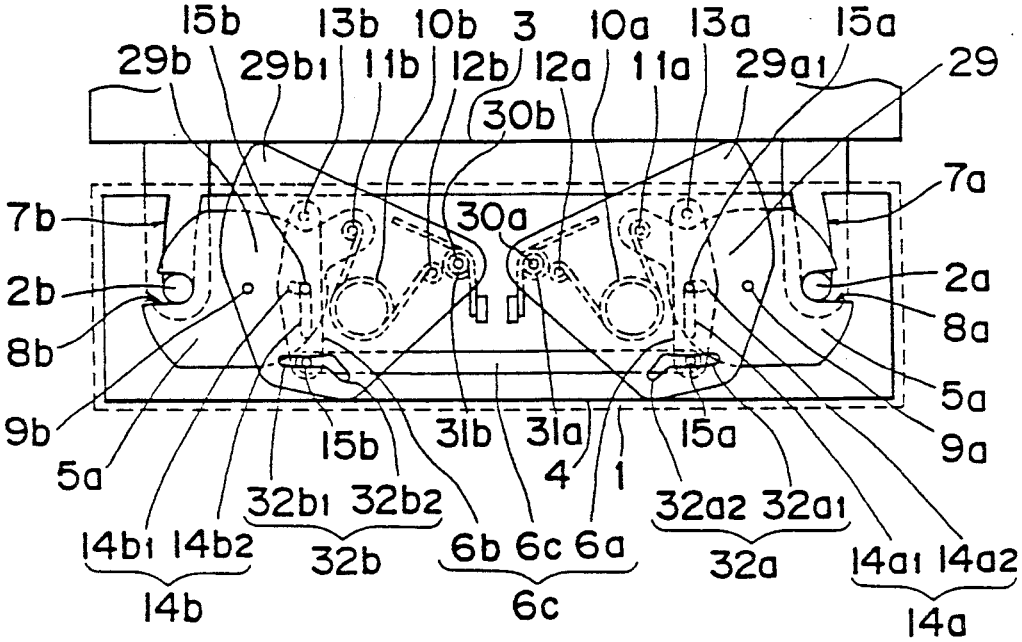
Figure 137:
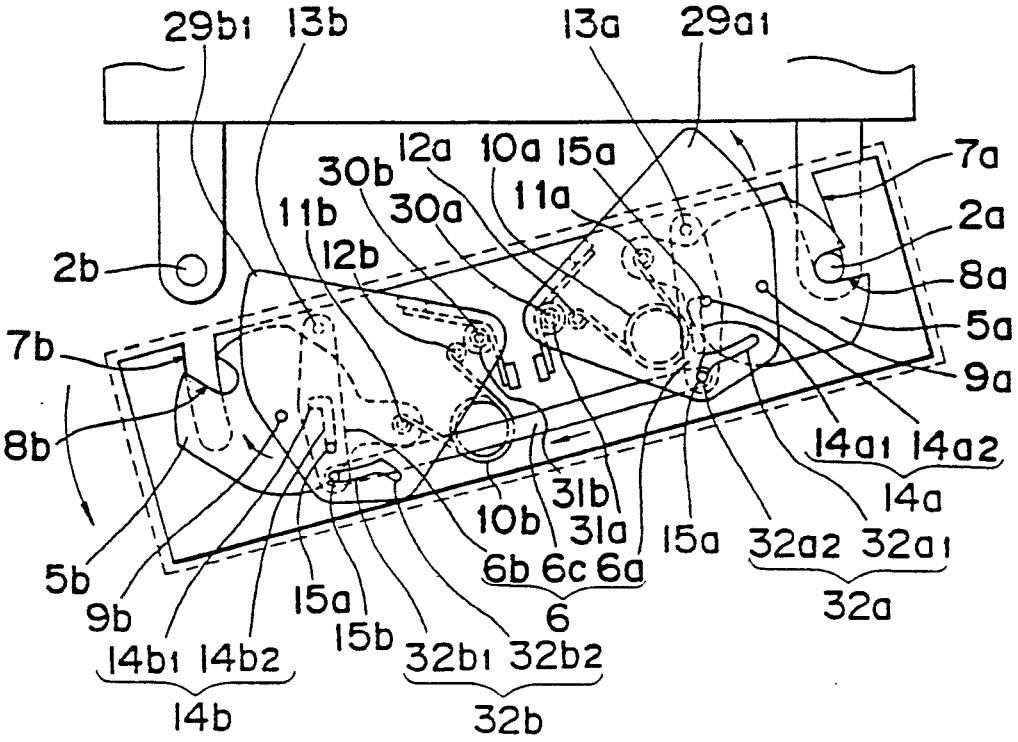
Figure 138:
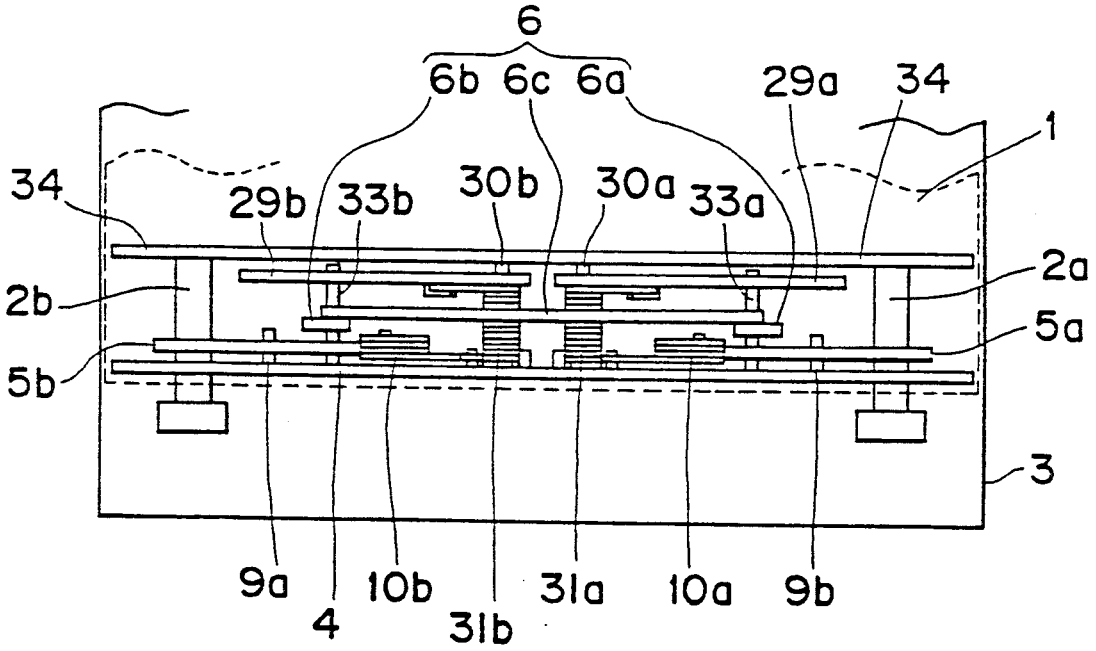
Figure 139:
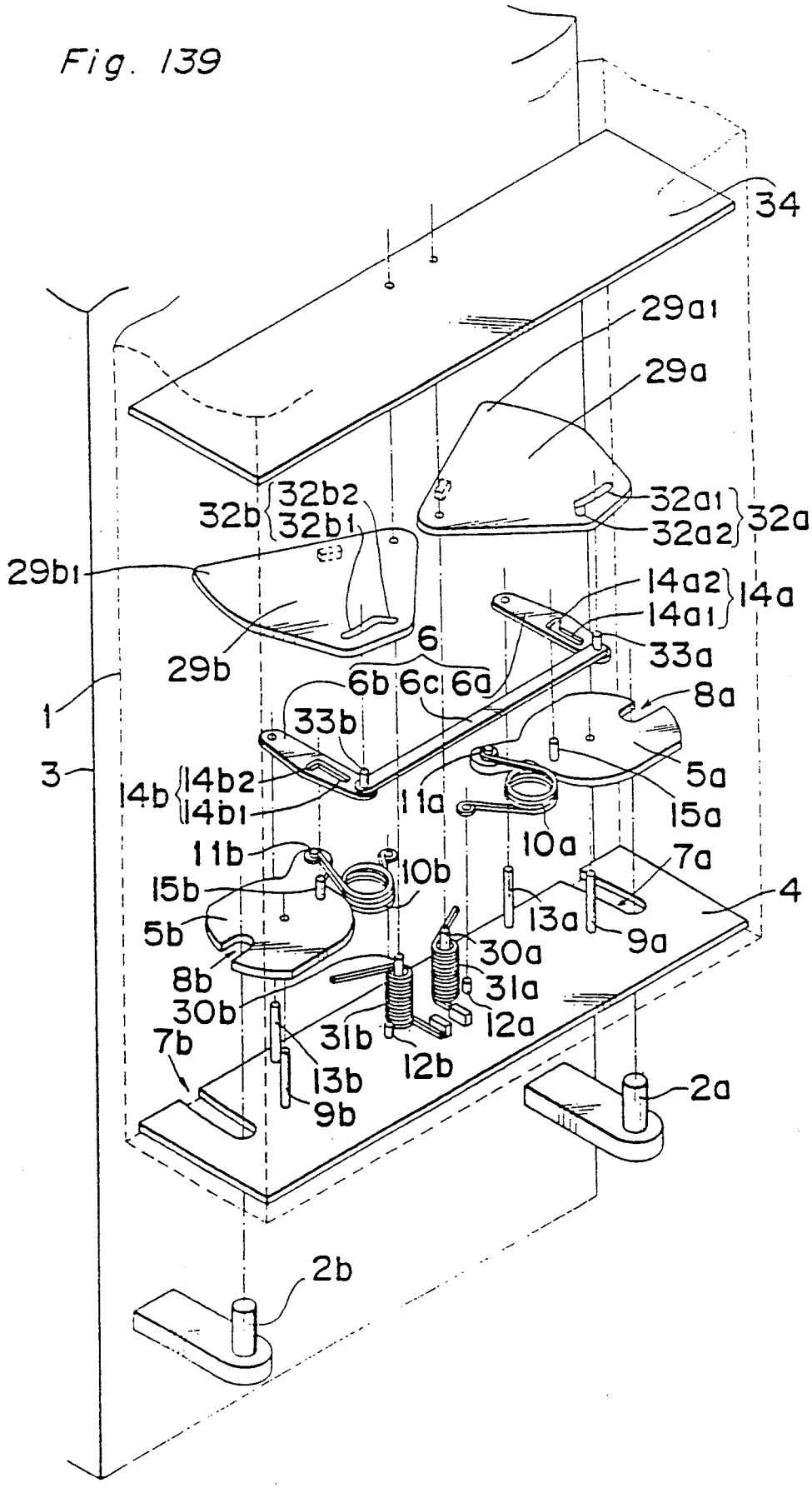
Figure 140:
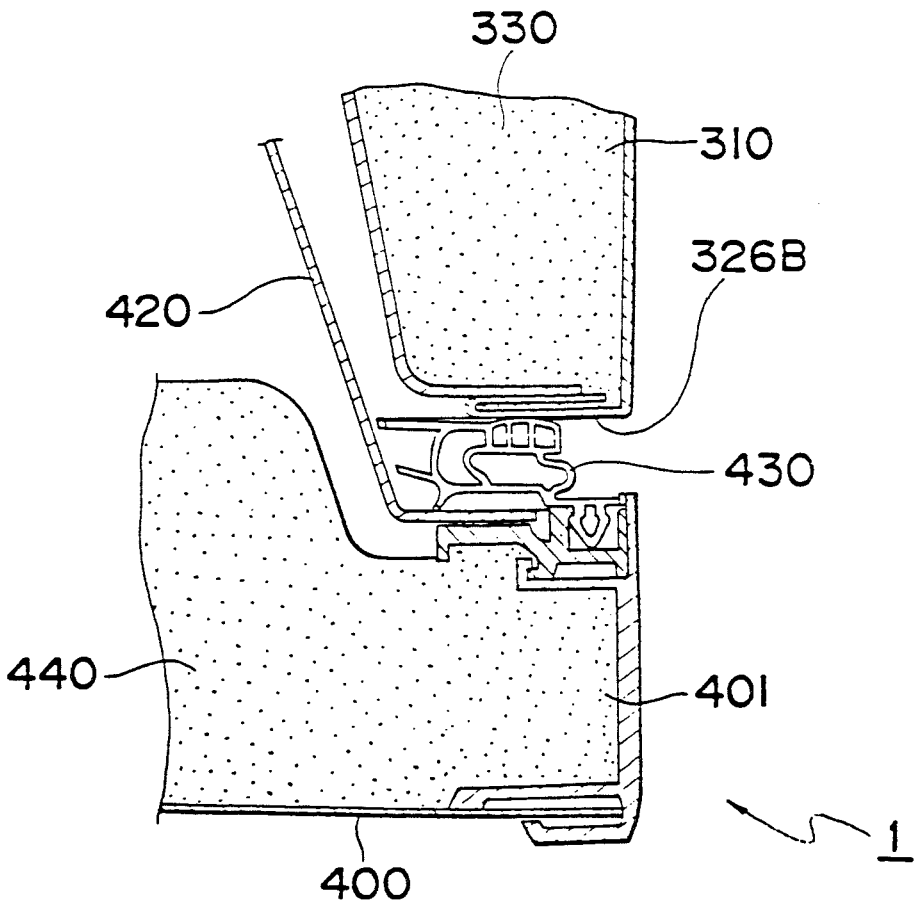
Figure 141:
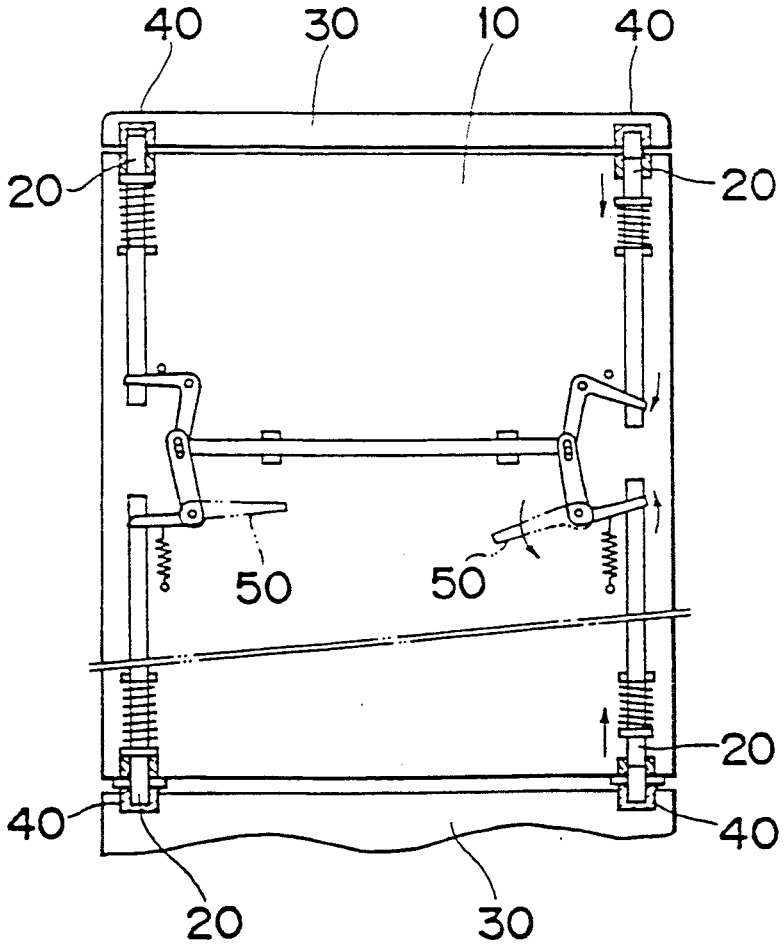
Fig. 141 PRIOR ART
Figure 142:
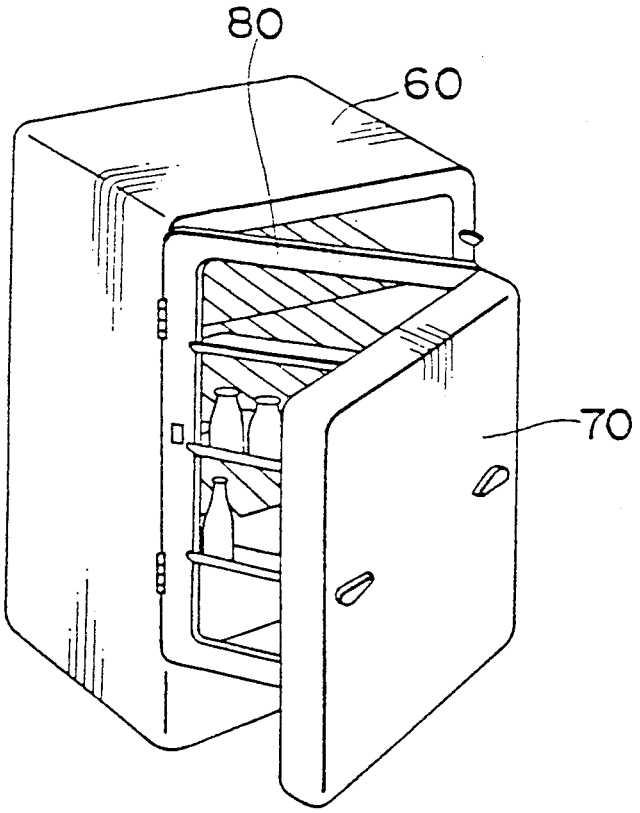
Fig. 142 PRIOR ART

FIGS. 109 to 111 relate to an opening/closing device of a door member according to another modified embodiment of the fourth embodiment;

FIG. 109 is a plane view of the device when the door member is kept closed;

FIG. 110 is a plane view of the device when the door member is kept opened;

FIG. 111 is an exploded perspective view of the device of FIG. 109;

FIGS. 112 to 114 relate to an opening/closing device of a door member according to a further modified embodiment of the fourth embodiment;

FIG. 112 is a plane view of the device when the door member is kept closed;

FIG. 113 is a plane view of the device when the door member is kept opened;

FIG. 114 is an exploded perspective view of the of FIG. 112;

FIGS. 115 to 117 relate to an opening/closing device of a door member according to a still further modified embodiment of the fourth embodiment;

FIG. 115 is a plane view of the device when the door member is kept closed;

FIG. 116 is a plane view of the device when the door member is kept opened;

FIG. 117 is an exploded perspective view of the device of FIG. 115;

FIGS. 118 to 120 relate to an opening/closing device of a door member according to another further modified embodiment of the fourth embodiment;

FIG. 118 is a plane view of the device when the door member is kept closed;

FIG. 119 is a plane view of the device when the door member is kept opened;

FIG. 120 is an exploded perspective view of the device of FIG. 118;

FIGS. 121 to 123 relate to an opening/closing device of a door member according to yet another modified embodiment of the fourth embodiment;

FIG. 121 is a plane view of the device when the door member is kept closed;

FIG. 122 is a plane view of the device when the door member is kept opened;

FIG. 123 is an exploded perspective view of the device of FIG. 121;

FIGS. 124 to 126 relate to an opening/closing device of a door member according to a still further modified embodiment of the fourth embodiment;

FIG. 124 is a plane view of the device when the door member is kept closed;

FIG. 125 is a plane view of the device when the door member is kept opened;

FIG. 126 is an exploded perspective view of the device of FIG. 124;

FIGS. 127 to 129 relate to an opening/closing device of a door member according to a modified embodiment of the fifth embodiment;

FIG. 127 is a plane view of the device when the door member is kept closed;

FIG. 128 is a plane view of the device when the door member is kept opened;

FIG. 129 is an exploded perspective view of the device of FIG. 127;

FIGS. 130 to 132 relate to an opening/closing device of a door member according to a modified embodiment of the sixth embodiment;

FIG. 130 is a plane view of the device when the door member is kept closed;

FIG. 131 is a plane view of the device when the door member is kept opened;

FIG. 132 is an exploded perspective view of the device of FIG. 130;

FIGS. 133 to 135 relate to an opening/closing device of a door member according to a modification of the seventh embodiment;

FIG. 133 is a plane view of the device when the door member is kept closed;

FIG. 134 is a plane view of the device when the door member is kept opened;

FIG. 135 is an exploded perspective view of the device of FIG. 133;

FIGS. 136 to 139 relate to an opening/closing device of a door member according to a modified embodiment of the first embodiment;

FIG. 136 is a plane view of the device when the door member is kept closed;

FIG. 137 is a plane view of the device when the door member is kept opened;

FIG. 138 is a front elevational view of the device;

FIG. 139 is an exploded perspective view of the device of FIG. 136;

FIG. 140 is a cross-sectional view showing a packing provided on the inner side of the door member to be attached on the surface of the main body of the refrigerator in accordance with the first embodiment;

FIG. 141 is a cross sectional view of a conventional opening/closing device of a door member; and FIG. 142 is a perspective view of a different conventional opening/closing device of a door member.

DETAILED DESCRIPTION OF THE EMBODIMENTS

Before the description of the present invention proceeds, it is to be noted that like parts are designated by like reference numerals throughout the accompanying drawings.

1) First Embodiment

Figure 1:
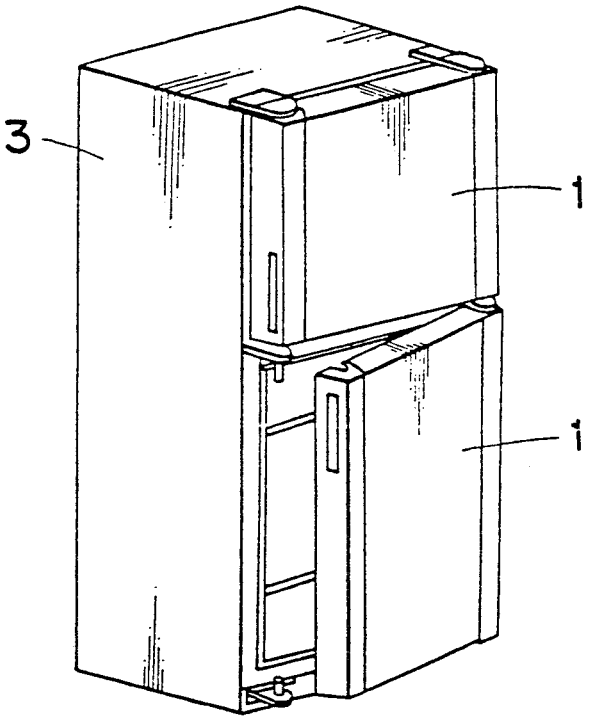
FIGS. 1–9 relate to an opening/closing device of a door member according to a first embodiment of the present invention.

FIGS. 1-9 show an opening/closing device of a door member of a refrigerator according to the first embodiment of the present invention. FIG. 1 is a perspective view of an outer appearance of a refrigerator which is provided with the opening/closing device of FIG. 1.

The opening/closing device according to the first embodiment has a pair of right and left hinge pins 2A and 2B protruding at the right and left opposite portions of a door member 1, a fixed plate 4 provided in a main body 3 in a manner to confront to the upper and lower portions of the door member 1, a pair of right and left latch plates 5A and 5B rotatably provided at the right and left sides of the fixed plate 4, and a coupling means 6 installed between the pair of the latch plates 5A and 5B.

The hinge pins 2A, 2B are projected from hingeplates 102A, 102B (see FIG. 6), which are disposed in four upper, lower locations of both the left, right portions of the main body 3 (equivalent to the cabinet in a refrigerator or the like) with a door 1 being mounted thereon, a rectangular fixing plate 4B (see FIG. 6) disposed oppositely on the upper, lower portions of the door 1, a pair of left, right latch plates 5A, 5B disposed in the right, left positions of the fixing plate 4B, a coupling member 6 disposed between a pair of latch plates 5A and 5B. Furthermore, among the fixing plate 4B and the latch plates 5A, 5B, springs 10A, 10B disposed which are adapted to effect the urging operation so as to retain both the positions, where the latch plates 5A, 5B restrain the hinge pins 2A, 2B and the position, where they release the restraint thereof.

Figure 4:
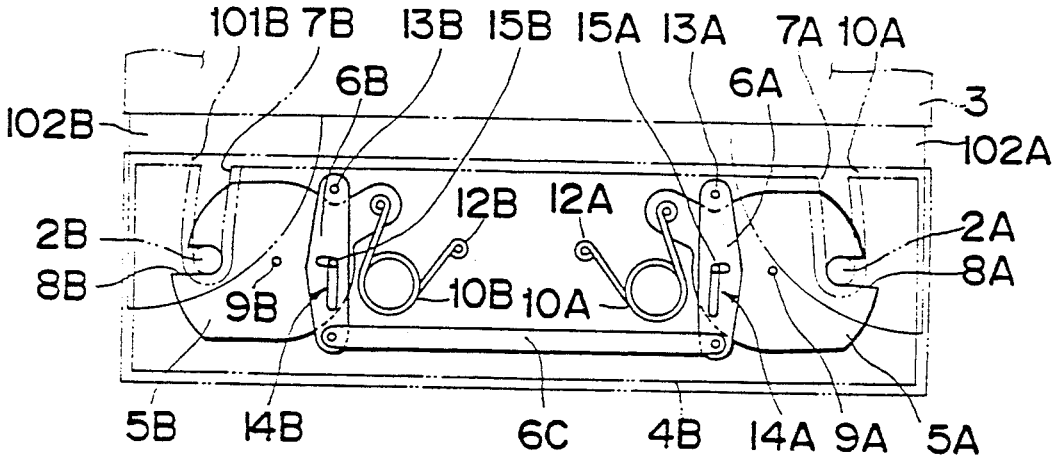
Figure 5:
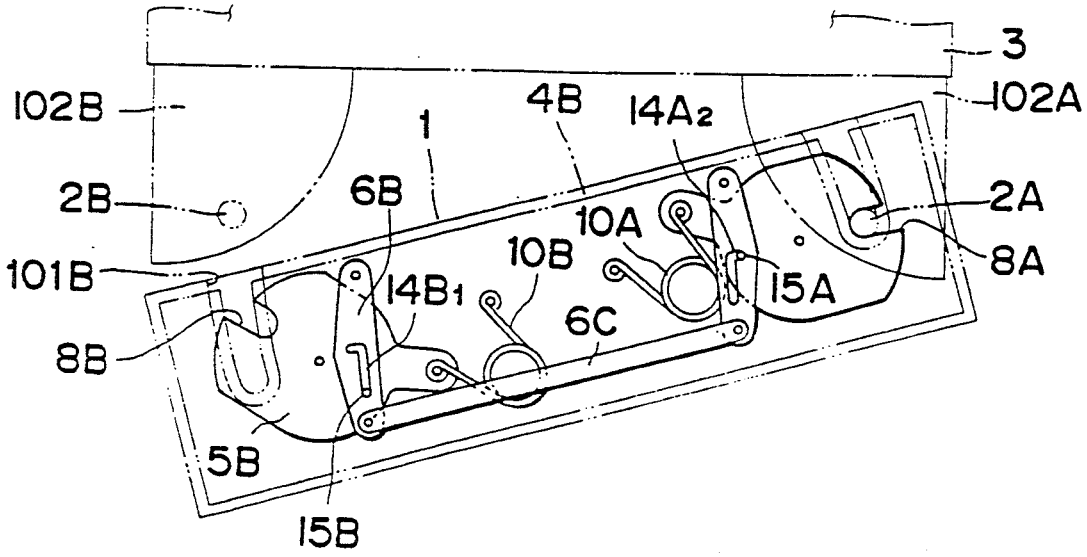

In the four locations in total of the respective left, right positions of the upper, lower portions of the door 1, there are provided notch portions 101A, 101B (only the upper side are shown in FIG. 4 and FIG. 5) which engage and disengage the hinge pins 2A, 2B during the opening, shutting operations. The notch portions 101A, 101B are formed from the top face to the inner side face in the upper portion of the door 1, and are formed from the lower side to the inner side face in lower portion thereof.

The fixing plate 4B has stage portions 103A, 103B disposed on the both the left, right portions, with engagement grooves 7A, 7B being formed respectively on the stage portions 103A, 103B. These engagement grooves 7A, 7B are open towards the side of the main body 3, with the inserting operation being effected for engagement from the opening side with respect to the hinge pins 2A, 2B on the corresponding side.

On one of the fixing plates 4B to be placed on the top portion of the door 1, oscillating approximately triangle-shaped screening plates 106A, 106B are respectively mounted on the top faces of the stage portions 103A, 103B. The downwardly. projected engagement pins 108A, 108B respectively engage from the respective one corners of the screening plates 106A, 106B are engaged into the circular through holes 105A, 105B. Holes 105A and 105B are respectively drilled between the opening sides of the engagement grooves 7A, 7B and the stage walls 104A, 104B in the top faces of the stage portions 103A, 103B. Springs 107A, 107B are wound around the engagement pins 108A, 108B, with each one end of the springs 107A, 107B being inserted into receiving concave 109A, 109B respectively projected from the screening plates 106A, 106B, and the other ends being disposed against the stage walls 104A, 104B of the fixing plate 4B, so that both ends are compressed so as to be spread. Namely, the springs 107A, 107B urge in one oscillating direction the screening plates 106A, 106B by the extending force thereof so as to block the engagement grooves 7A, 7B and the notch portions 101A, 101B of the door 1.

The latch plates 5A, 5B have latch grooves 8A, 8B opened onto the outer diameter side of the circular portion so that the hinge pins 2A, 2B may be engaged and disengaged from. The latch plates 5A, 5B rotatably pivoted on the fixing plates 4A, 4B absent the shafts 9A, 9B in the inner side positions of the engagement grooves 7A, 7B. As shown in FIG. 4, the latch grooves 8A, 8B intersect the engagement grooves 7A, 7B so as to restrain the hinge pins 2A, 2B within the intersection portions in the left, right outwardly directed angular positions. When they are rotated in the restraint releasing direction, for instance, (clockwise direction with respect to the latch plate 5B on the left-hand side in the drawing, or counter-clockwise direction with respect to the latch plate 5A on the right-hand side), by a constant angle form the angular position, the openings of the latch grooves 8A, 8B conform with the openings of the engagement grooves 7A, 7B so as to allow the hinge pins 2A, 2B to be disengaged from the engagement grooves 7A, 7B.

Each one end of the springs 10A, 10B are rotatably pivoted on the mounting pins 11A, 11B projected from the end portions which are located on the opposite sides to the latch grooves 8A, 8B of the latch plates 5A, 5B, while the other ends thereof are rotatably pivoted on the mounting pins 12A, 12B projected from the fixing plate 4A. The mounting pins 12A, 12B are provided in positions which become almost the central portion of the angular range produced by the mounting pins 11A, 11B and the support shafts 9A, 9B of the latch plates 5A, 5B when the latch plates 5A, 5B are rotated between positions for restraining the hinge pins 2A, 2B and the positions for releasing the restraint thereof. The springs 10A, 10B apply their forces in the directions along which both the ends thereof are always tried to be spread, so that they have a function of bringing the door 1 into close adherence with the main body 3 during the closure of the door 1.

The coupling member 6 prevents the rotation of the other latch plate 5A or 5B during the rotation of one latch plate 5B or 5A in the restraint releasing direction. The coupling member is composed of a pair of I-shaped oscillating links 6A, 6B and a coupling link 6C which is adapted to combine the respective one-end portions of these oscillation links 6A, 6B. The oscillation links 6A, 6B are oscillably pivoted at the other end portions on the shafts 13A, 13B projected from the fixing plates 4A, 4B. Also, the oscillation links 6A, 6B have approximately L-shaped lock grooves 14A, 14B formed therein. The lock grooves 14A, 14B are composed of slide guide portions $14A_1$, $14B_1$ each extending in the direction away from the support shafts 13A, 13B of the oscillation links 6A, 6B, and stopper portions $14A_2$, $14B_2$ each disposed along the circular arc with the support shafts 13A, 13B as the centers. Lock pins 15A, 15B projected from the latch plates 5A, 5B are engaged into the lock grooves 14A, 14B.

Figure 6:
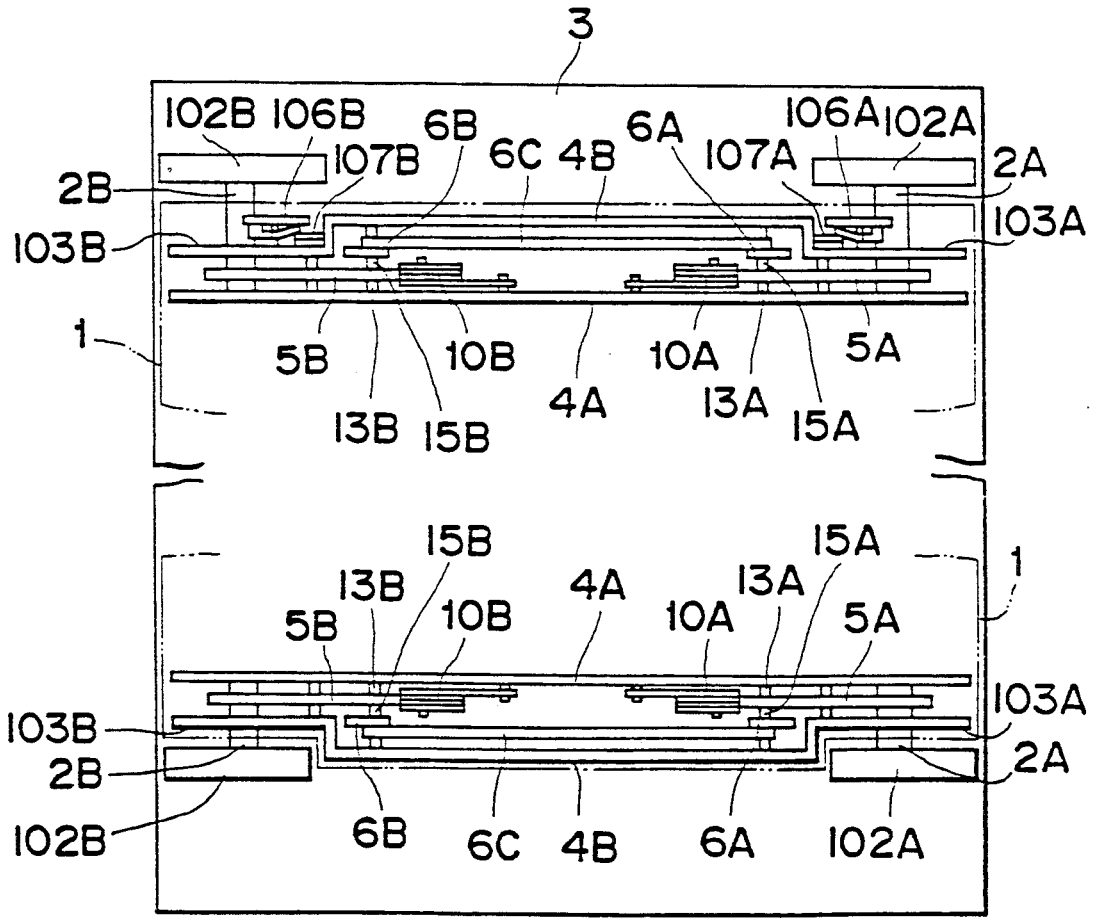

As shown in FIG. 6, screening plates 106A, 106B are not mounted on the opening, shutting apparatus of the door to be provided in the lower portion of the door 1, with the door opening, shutting apparatus to be provided on the door top portion being mounted overturned so that the fixing plate 4B may be located lower. In this case, hinge plates 102A, 102B may be made flush with the bottom face of the door 1 with the stage portions 103A, 103B of the fixing plate 4B for better appearance, so that the degree of freedom of the design may be increased. Here, the screening plates 106A, 106B are assumed not to be provided on the notch portions 101A, 101B on the side of the lower portion of the door 1, but, needless to say, the screening plates 106A, 106B may be provided on the side of the lower portion of the door 1.

The opening, closing operations of the door 1 of such construction as described hereinabove will be described hereinafter. The plane of the opening, closing apparatus to be disposed on the top portion of the door 1 will be described with reference to FIG. 4 and FIG. 5.

Figure 7:
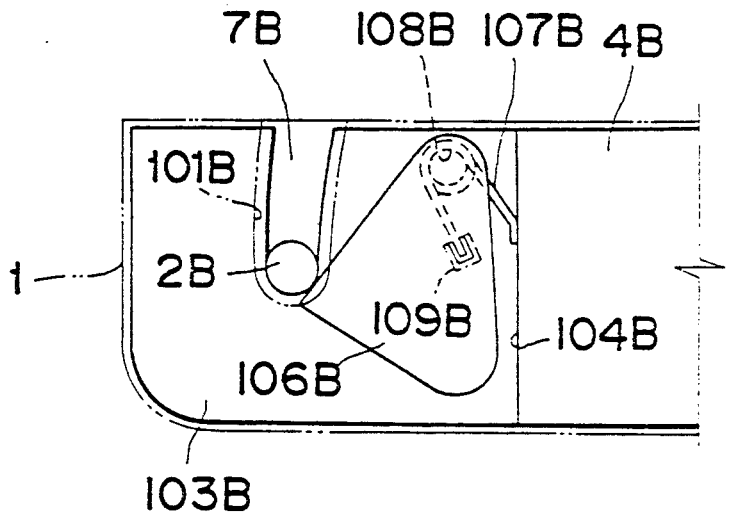
Figure 8:
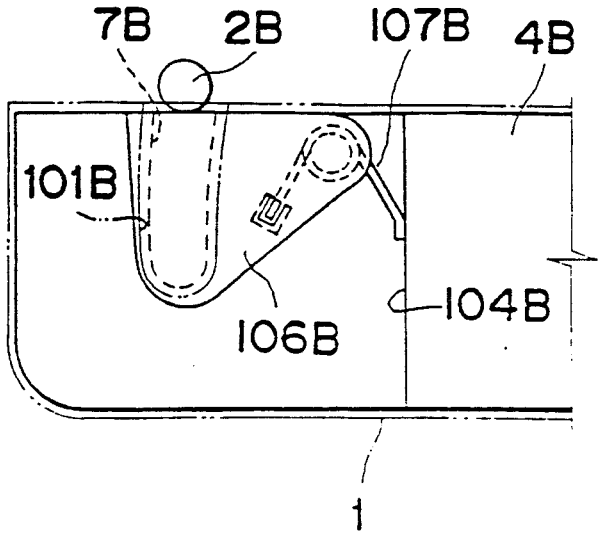
Figure 9:
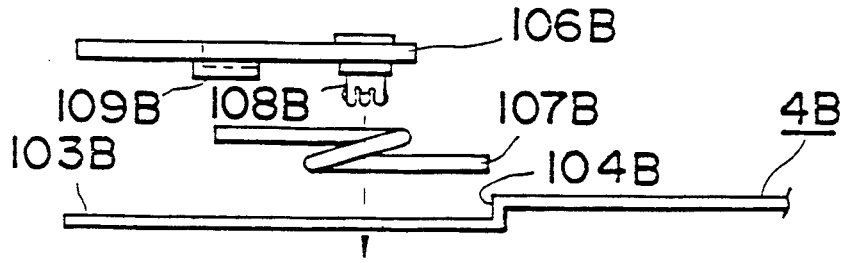
Figure 10:
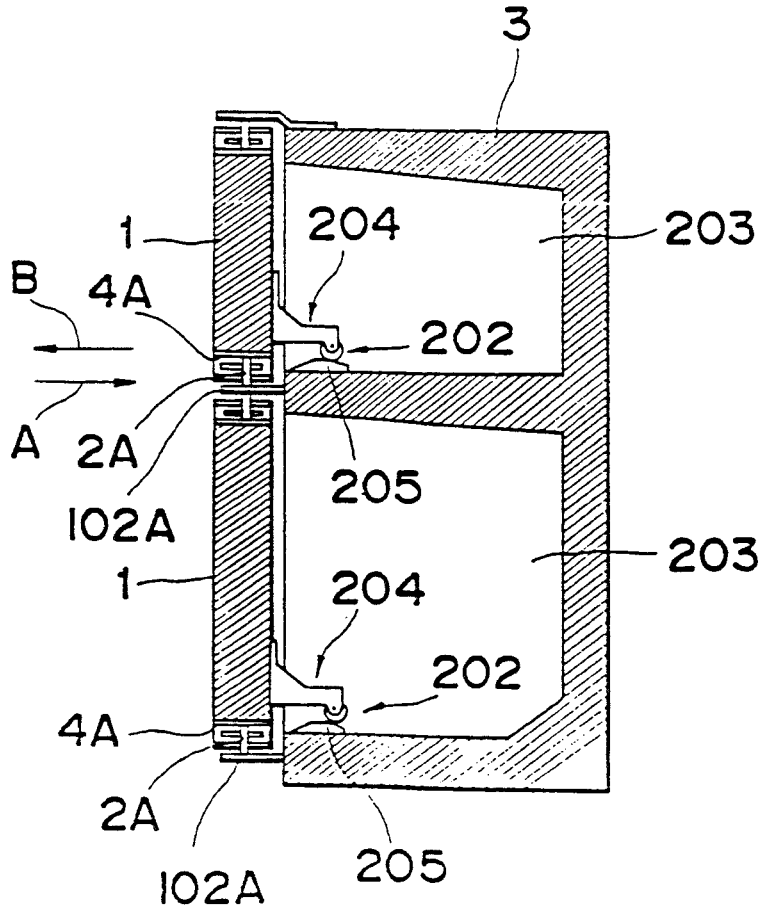
FIG. 10 is a cross-sectional view of a refrigerator having a door member provided with the device in accordance with the first embodiment.

As shown in FIG. 4 in a condition where the openings of the latch grooves 8A, 8B of the respective latch plates 5A, 5B are externally directed to the left, to the right, the latch grooves 8A, 8B are cross to the engagement grooves 7A, 7B, with hinge pins 2A, 2B being restrained within the intersection portions so that the condition is maintained with the spreading forces of the springs 10A, 10B, thus resulting in the closed condition of the door 1. As the hinge pins 2A, 2B are respectively positioned in the recesses of the engagement grooves 7A, 7B under this condition, the screening plates 106A, 106B compresses the springs 107A, 107B, as shown in FIG. 7, by the hinge pins 2A, 2B and are driven into clockwise and counter-clockwise rotated positions so as to open the notch portions 101A, 101B of the door 1. In this condition, as the notch portions 101A, 101B of the door 1 are covered by the hinge plates 102A, 102B, foreign materials such as dust, etc. are prevented from being intruded from the notch positions 101A, 101B.

Figure 2:
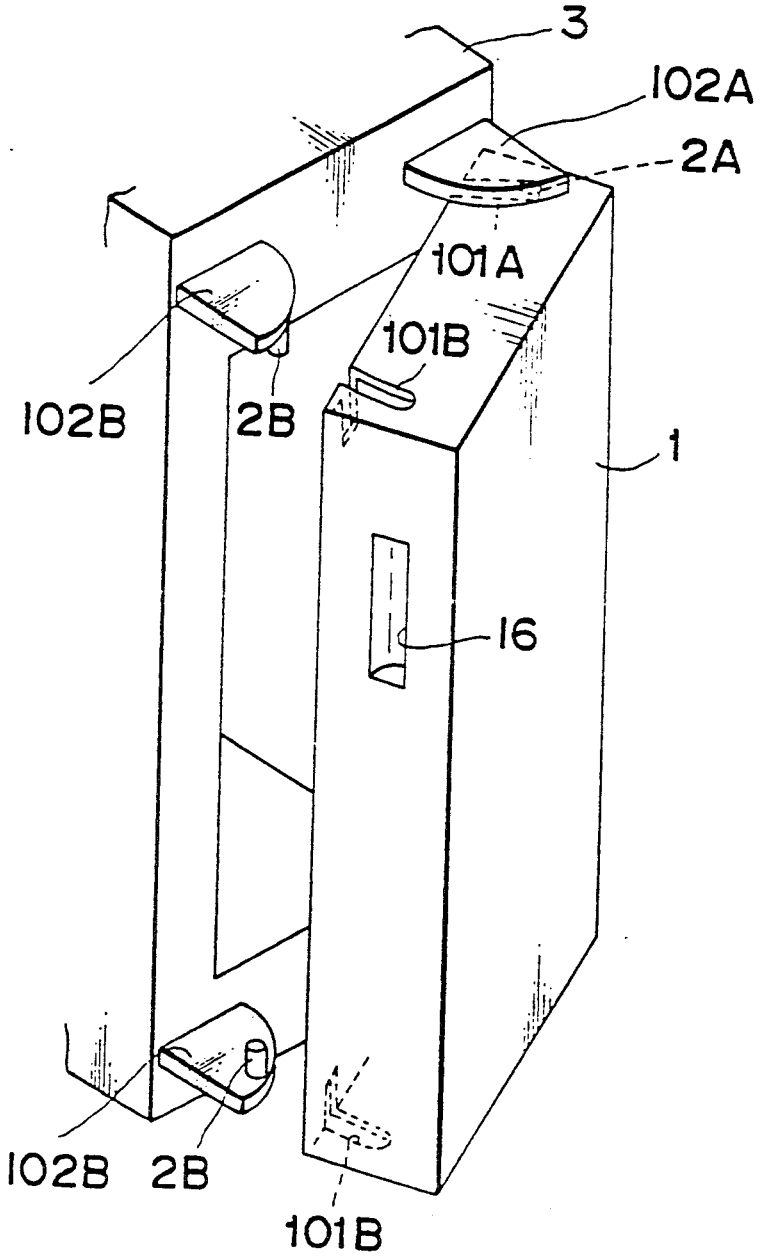
Figure 3:
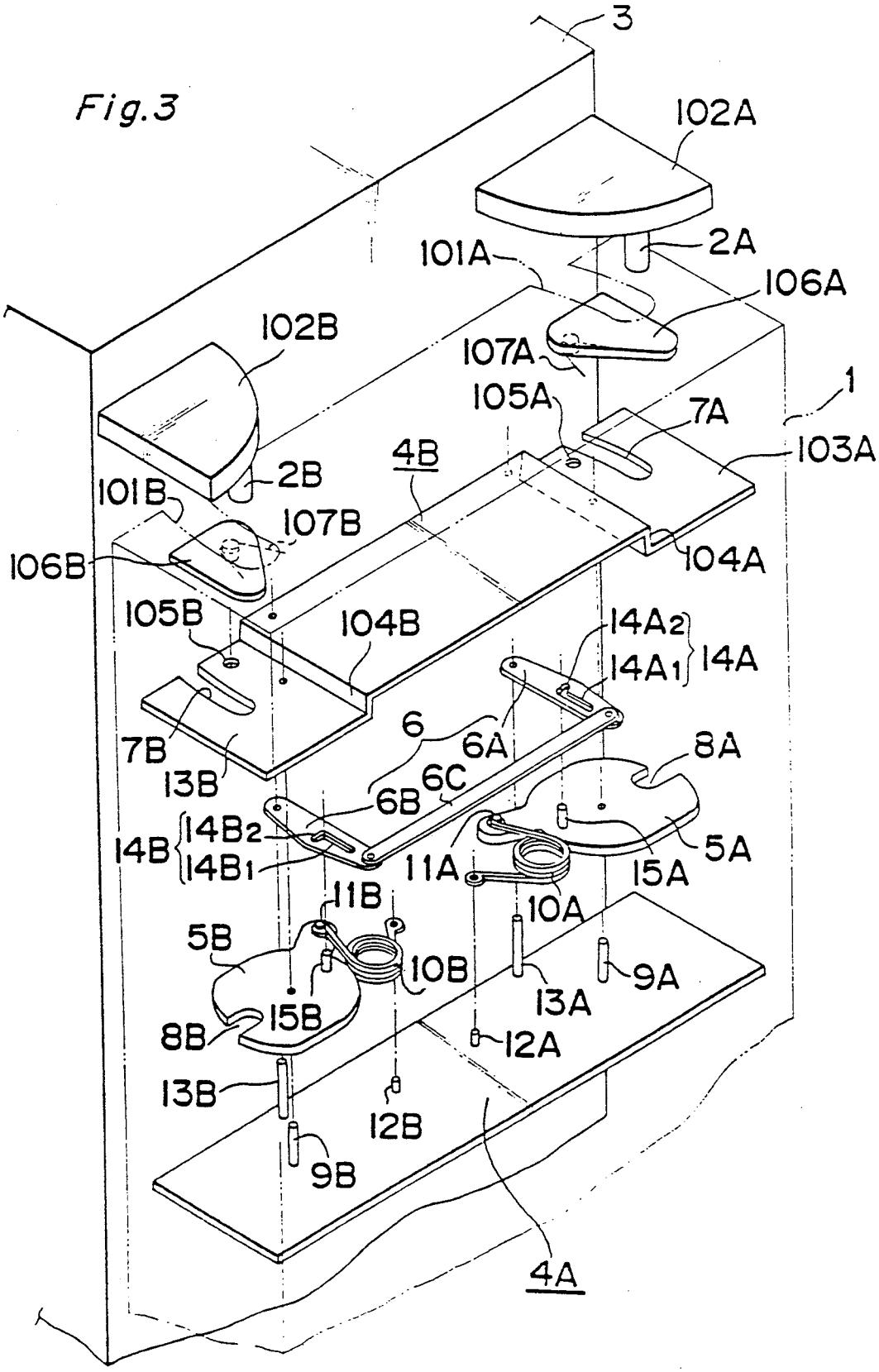

In order to open the door 1 from the left, the concave portion, which is not shown here, but is shown as reference numeral 16 in FIG. 2, is pulled for the left side of the door 1. As it is pulled in a direction along which it goes through the engagement groove 7B from the immovable left-hand hinge pin 2B, clockwise rotating force, i.e., the restraint releasing direction rotating force are applied upon the left-hand side latch plate 5B. At this time, the lock pin 15B disposed on the latch plate 5B is located on the angle portion of the lock groove 14B. The latch plate 5B further rotates clockwise, with the lock pin 15B continuously sliding along the slide guide portion 14B1. When the latch plate 5B passes the half portion of the rotation angle thereof, the spring 10B tries to be spread. The latch plate 5B is forcibly rotated clockwise by the urging force thereof, the opening of the latch groove 8B confirms to the opening of the engagement groove 7B, so that it is possible for the left-hand side hinge pin 2B to be pulled through.

The lock pin 15B of the latch plate 5B slides through the slide guide portion 14B1, so that the right-hand side oscillating link 6A is oscillated clockwise through the coupling link 6C, and the lock pin 15A comes into contact against the end portion of the stopper portion 14A2 of the lock groove 14A1. The right-hand side latch plate 5A cannot move in any direction, with the restraining condition of the right-hand side hinge pin 2A being retained.

Accordingly, the door 1 is opened (see FIG. 5) from the left-hand side with the right-hand side hinge pin 2A as a rotation center. In this condition, as the spreading force of the spring 10B is urged on the left-hand latch plate 5B, the latch plate 5B is retained under the condition as it is. Simultaneously with the disengagement of the engagement groove 7B from the hinge pin 2B, the screening plate 106B is moved by the spreading force of the spring 107A until the engagement pin 108B, which is a support shaft thereof, is completely rotated clockwise as the rotation center so as to completely choke the notch portion 101B of the door 1 (see FIG. 8). Even in the open condition of the door 1, foreign materials may be prevented from being intruded from the notch portion 101B.

The above-described operation is continuously effected.

In order to shut the opened door 1 in such a manner as described hereinabove, the left-had side portion of the door 1 need only be depressed onto the side of the main body 3. The engagement groove 7B and the latch groove 8B are engaged into the hinge pin 2B, so that the latch plate 5B starts its counter-clockwise rotation, contracting the spring 10B by the depressing force of the latch plate 5B with respect to the hinge pin 2B. The lock pin 15B of the latch plate 5B, which is located in the end portion of the slide guide portion 14B1 of the lock groove 14B of the left-hand side oscillating link 6B is moved towards the angle portion of the slide guide portion 14B1 by the rotation force of the latch plate 5B. As the spring 10B tries to be spread when the latch plate 5B passes the half portion of the rotation angle, the latch plate 5B is forcible rotated counter-clockwise by the urging force until the latch 8B crosses the engagement groove 7B so as to restrain the hinge pin 2B in the recesses of the engagement groove 7B. Accordingly, the door 1 is closed, so that the condition is restored to that of FIG. 4. When the engagement groove 7B is engaged with the hinge pin 2B, the screening plate 106B comes into contact against the hinge pin 2B, and the screening plate 106B is driven onto the side of the stage wall 104B of the fixing plate 4B against the elasticity of the spring 107B through the movement onto the recess side of the engagement groove 7B of the hinge pin 2B, so that the engagement groove 7B and the notch portion 101B of the door 1 are opened (see FIG. 2). Even in this condition, the hinges 102B, 102A prevent foreign materials from being intruded from the notch portions 101B, 101A as described hereinabove.

Because the door 1 is opened and, shut from the right-hand side in an operation right-handed operation description will be omitted.

In the above-described embodiment, the hinge pins 2A, 2B are disposed on the main body and the fixing plates 4A, 4B are disposed on the door 1. The embodiment opposite to the above-described embodiment is included in the present embodiment. As the embodiment may be readily realized from the above-described embodiment, the concrete description will be omitted. Besides, if the door 1 is pulled in the opening direction simultaneously at the right and left sides, both the oscillating force in the counter-clockwise direction and that in the clockwise direction act on the links 6A and 6B through the hinge pins 2A and 2B, latch plates 5A and 5B, lock pins 15A and 15B and lock grooves 14A and 14B, and accordingly the coupling means 6 is not oscillated in any direction since the links 6A and 6B of the coupling means 6 are coupled by the coupling link 6C. Therefore, the latch plates 5A and 5B are prohibited from rotating, and the hinge pins 2A and 2B are unable to slip off from the engaging grooves 7A and 7B, so that the door 1 is kept in the closed condition.

When the door 1 is desired to be removed, after the door member 1 opened at the right or the left side, the latch plate 5A or 5B at the side the door 1 is opened is rotated by a stick means such as a screwdriver etc. in the direction reverse to the restriction-releasing direction. By the rotation of the latch plate 5A o 5B at the opening side in the above-described direction, the other latch plate 5B of 5A is released from the rotation-restricted condition, so that the other hinge pin 2B or 2A is able to slip off from the engaging groove 7B or 7A.

Meanwhile, unless the latch plates 5A and 5B are completely restricted, in other words, the coupling means 6 is at the neutral position when the door 1 is closed, the lock pins 15A and 15B cannot move smoothly from the stopper portions 14A2 and 14B2 to slide guide portions 14A1 and 14B1 of the lock grooves 14A and 14B, respectively. Therefore, it may be feared in the above-described case that the opening/closing direction of the door 1 is difficult to be switched to the right or left. However, according to the present embodiment, the latch plates 5A and 5B are arranged to be urged by the springs 10A and 10B so as to be maintained in the restricted position, and accordingly the coupling means 6 is kept at the neutral position at all times, so that the door 1 can be smoothly switched to be opened/-closed at the right from the left, or vice versa.

In the state where the door 1 is opened at one side, if the latch plate 5A or 5B at the opening side is rotated by accident in the restraining direction because of the reaction, etc. brought about when the door member is opened/closed, the other latch plate 5B or 5A is released from the rotation-restricting condition, and it would be feared that the door 1 is unexpectedly removed from the main body of the refrigerator. In practice, however, since the latch plates 5A and 5B are so urged by the springs 10A and 10B so as to be kept in the restriction-releasing position, thereby preventing the door 1 from being taken off from the main body.

According to the present embodiment, although the links 6A and 6B are pivotally fixed to the rear side of the fixed plates 4A,4B and the coupling link 6c is provided at the front side of the fixed plates 4A,4B, the reverse may be possible, that is, the links 6A and 6B are pivotally provided at the front side of the fixed plates 4A,4B and the coupling link 6c is provided at the rear side of the fixed plates 4A,4B. In the above-described latter case, the slide guide portions 14A1 and 14B1 of the lock grooves 14A and 14B are extended in such form as to come close to the end portions of the stopper portions 14A2 and 14B2 to the pivotal shafts 13A and 13B, respectively. The position or the side of the coupling link 6c may be suitably decided, with consideration taken into the design of the door 1, in such case that the handle 16 is provided at the front side of the upper face of the door member 1, etc., or the structure where the coupling link 6C is installed, etc., so that the coupling link 6c is not an obstacle.

Figure 79:
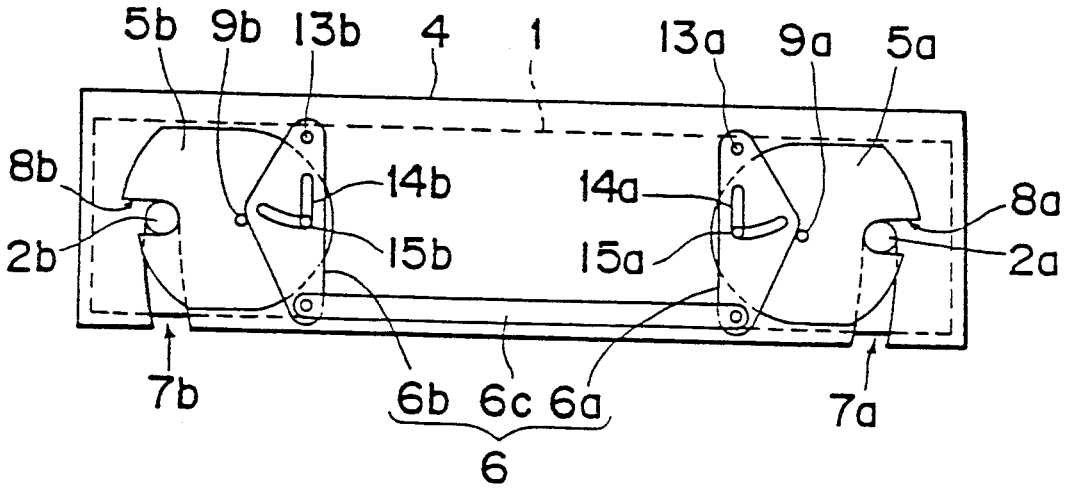
FIGS. 79 to 81 relate to an opening/closing device of a door ,member according to a modified embodiment of the first embodiment.
Figure 80:
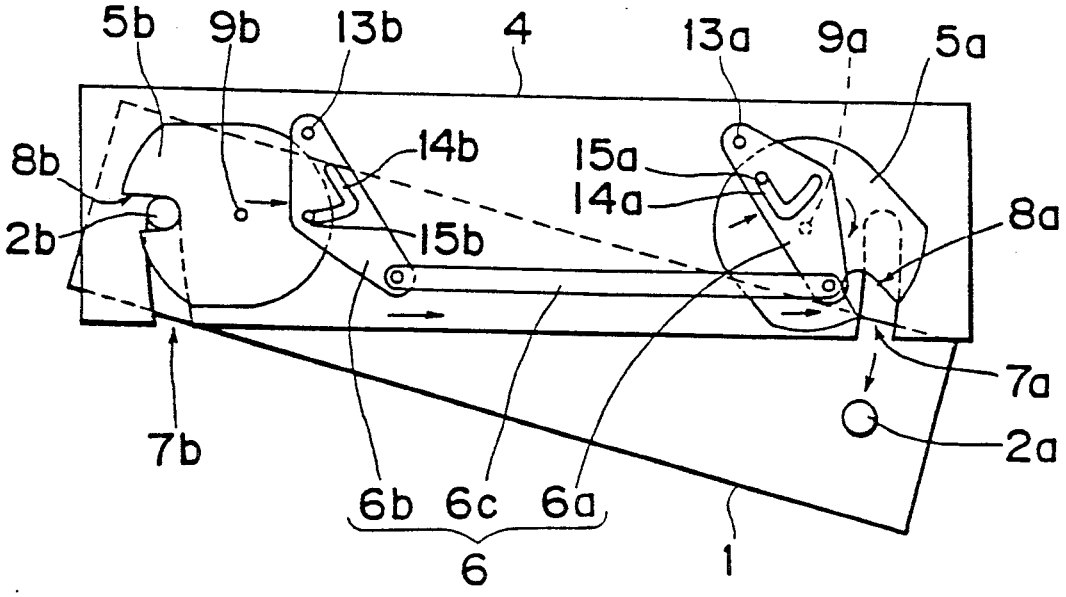
Figure 81:
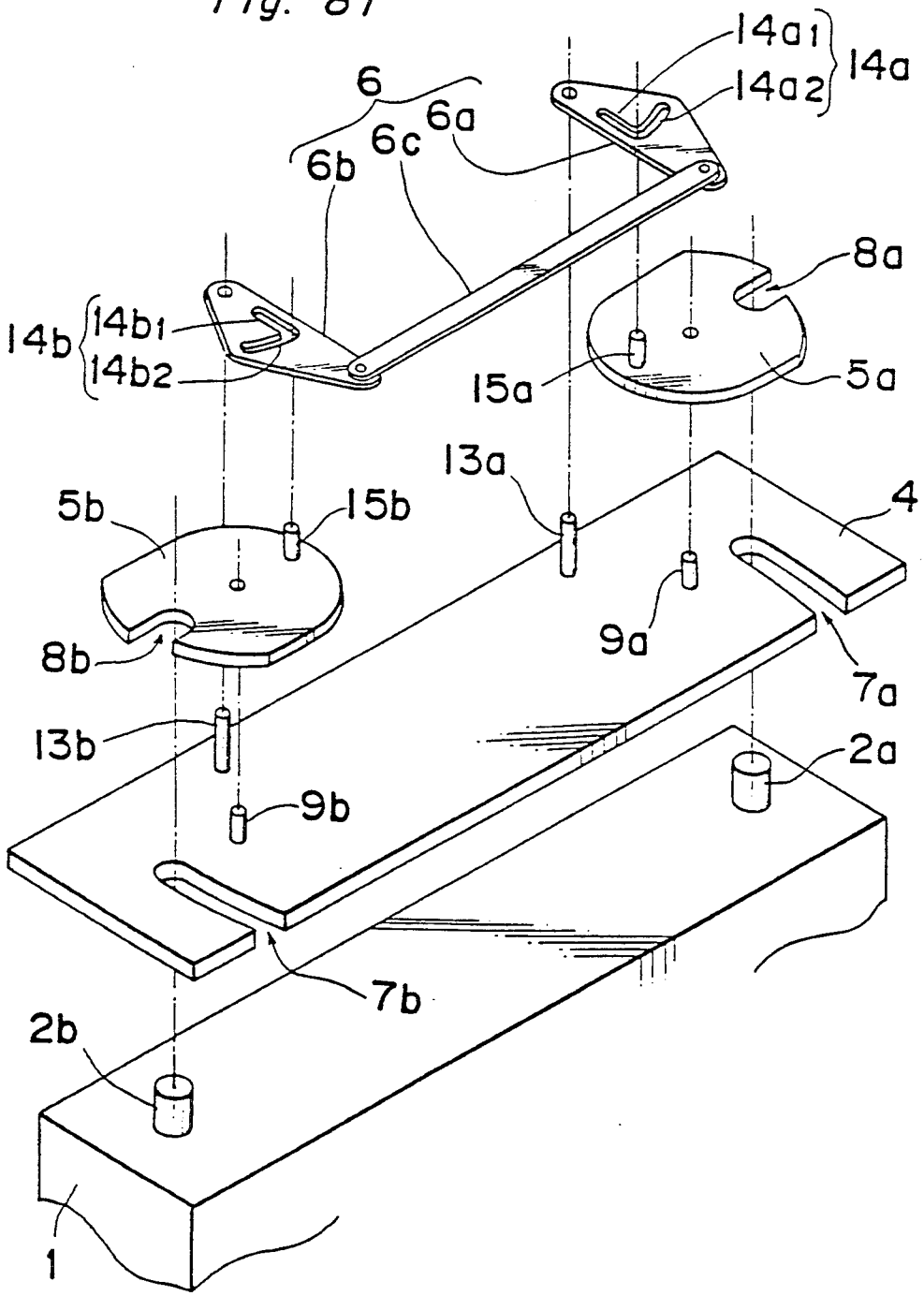

Such modification as referred to above will be shown in FIGS. 79 to 81 as a modified embodiment. Since the embodiment is a modified example of the earlier-described first embodiment, the corresponding parts of the embodiments are designated by the same reference numerals as in the first embodiment.

FIG. 79 is a plane view of a double-openable device of a door member according to the embodiment of the present invention when the door is kept closed. FIG. 80 is a plane view when the door member is kept opened. FIG. 81 is an exploded perspective view. It is to be noted here that the springs 10A,10B are omitted in the drawings. Also, in this modified embodiment, a pair of hinge pins 2A and 2B are provided at the side of door 1, and the fixed plate 4B at the side of the main body 3.

Figure 82:
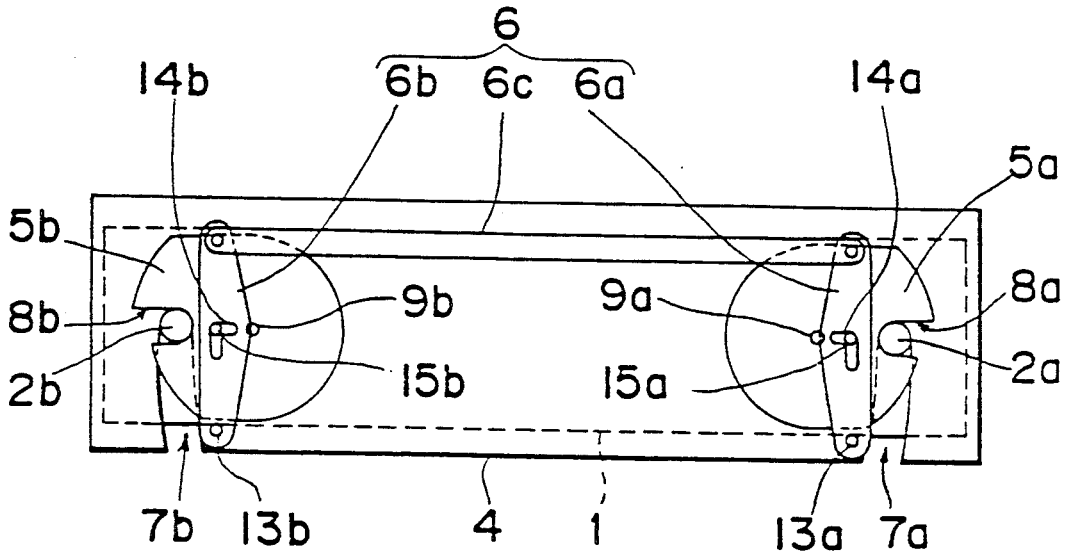
FIGS. 82 to 84 relate to an opening/closing device of a door member according to another modified embodiment of the first embodiment.
Figure 83:
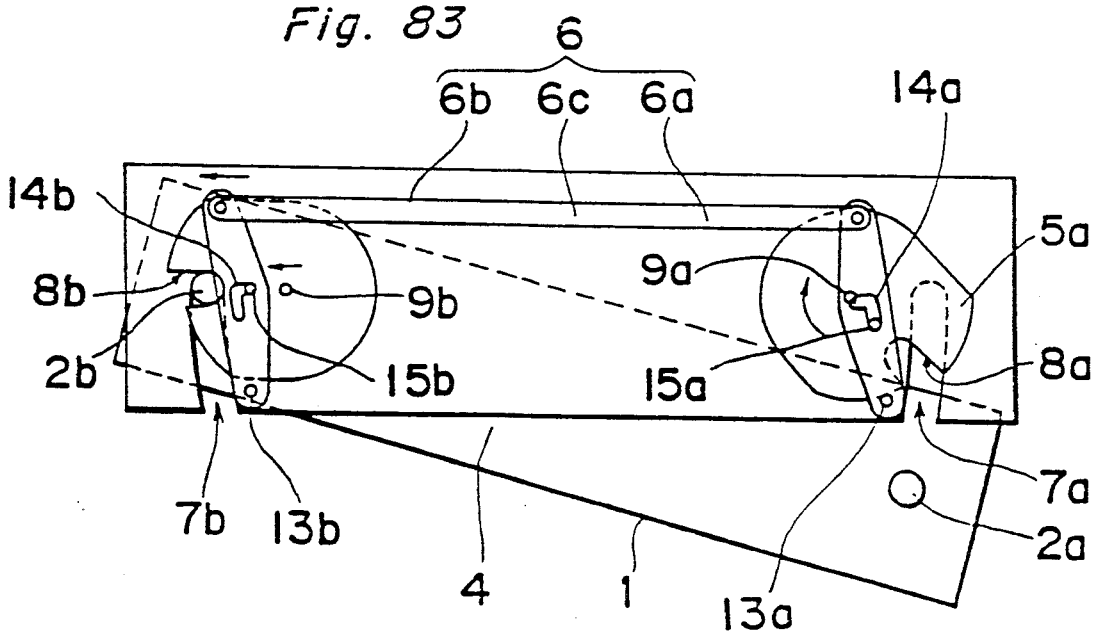
Figure 84:
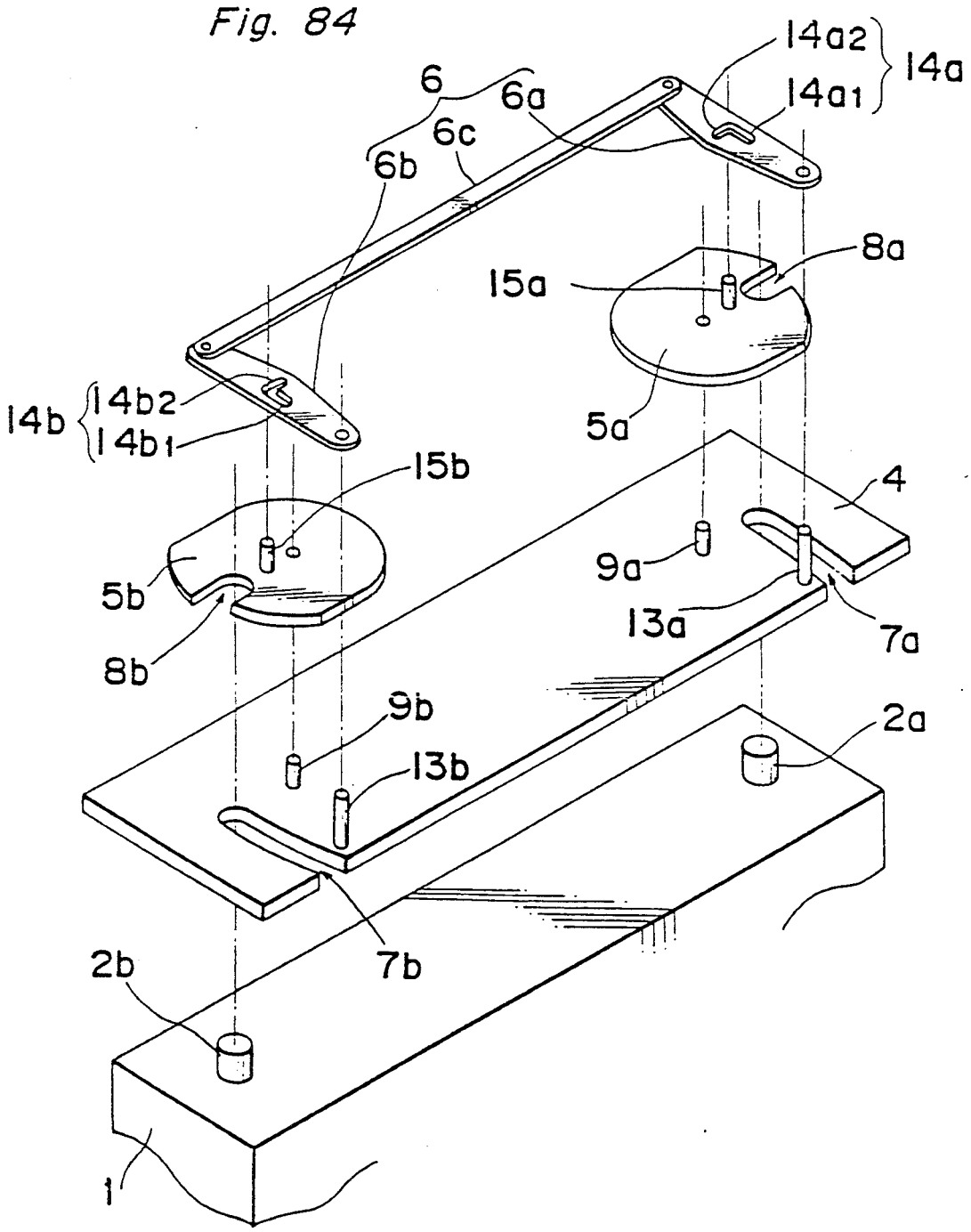

Another modified embodiment of the first embodiment is shown in FIGS. 82 to 84 in which the corresponding parts are designated by the same reference numerals as in the first embodiment. Fig, 82 is a plane view of a double openable device according to the embodiment when the door member is kept closed. FIG. 83 is a plane view when the door member is kept opened. FIG. 84 is an exploded perspective view. In the drawings FIGS. 82–84, the springs 10A,10B are omitted.

Figure 85:
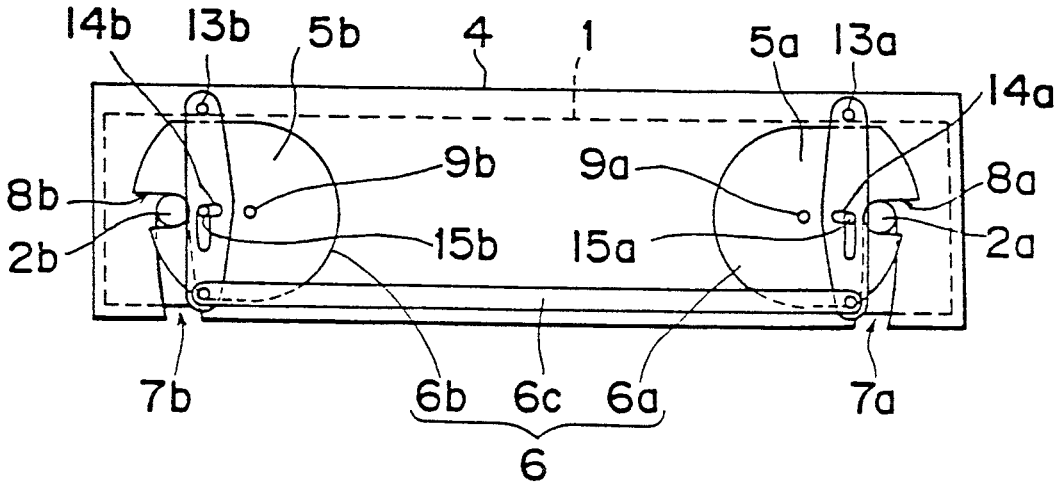
FIGS. 85 to 87 relate to an opening/closing device of a door member according to a further modified embodiment of the first embodiment.
Figure 86:
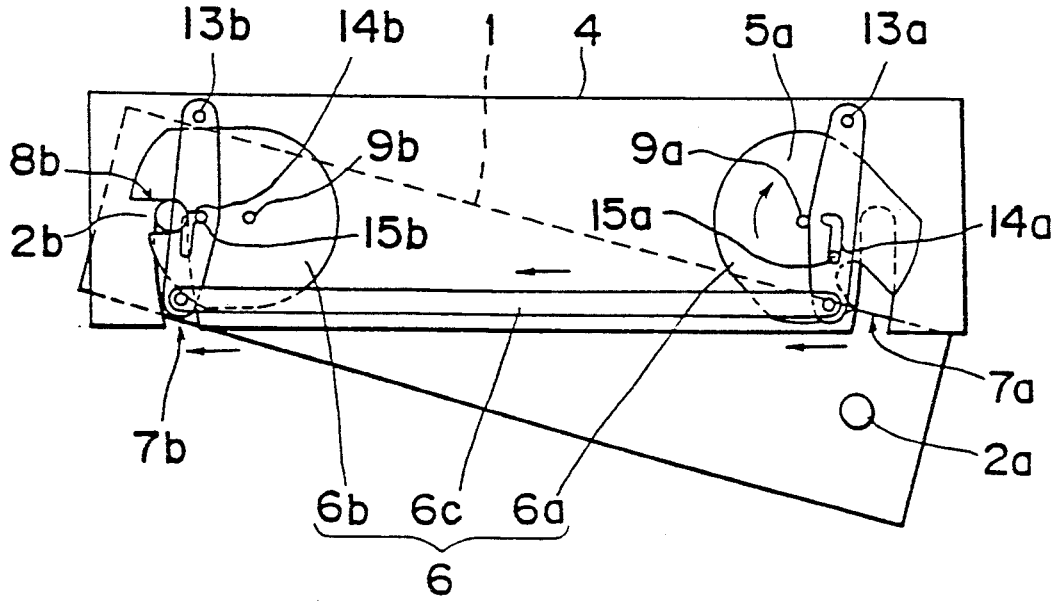
Figure 87:
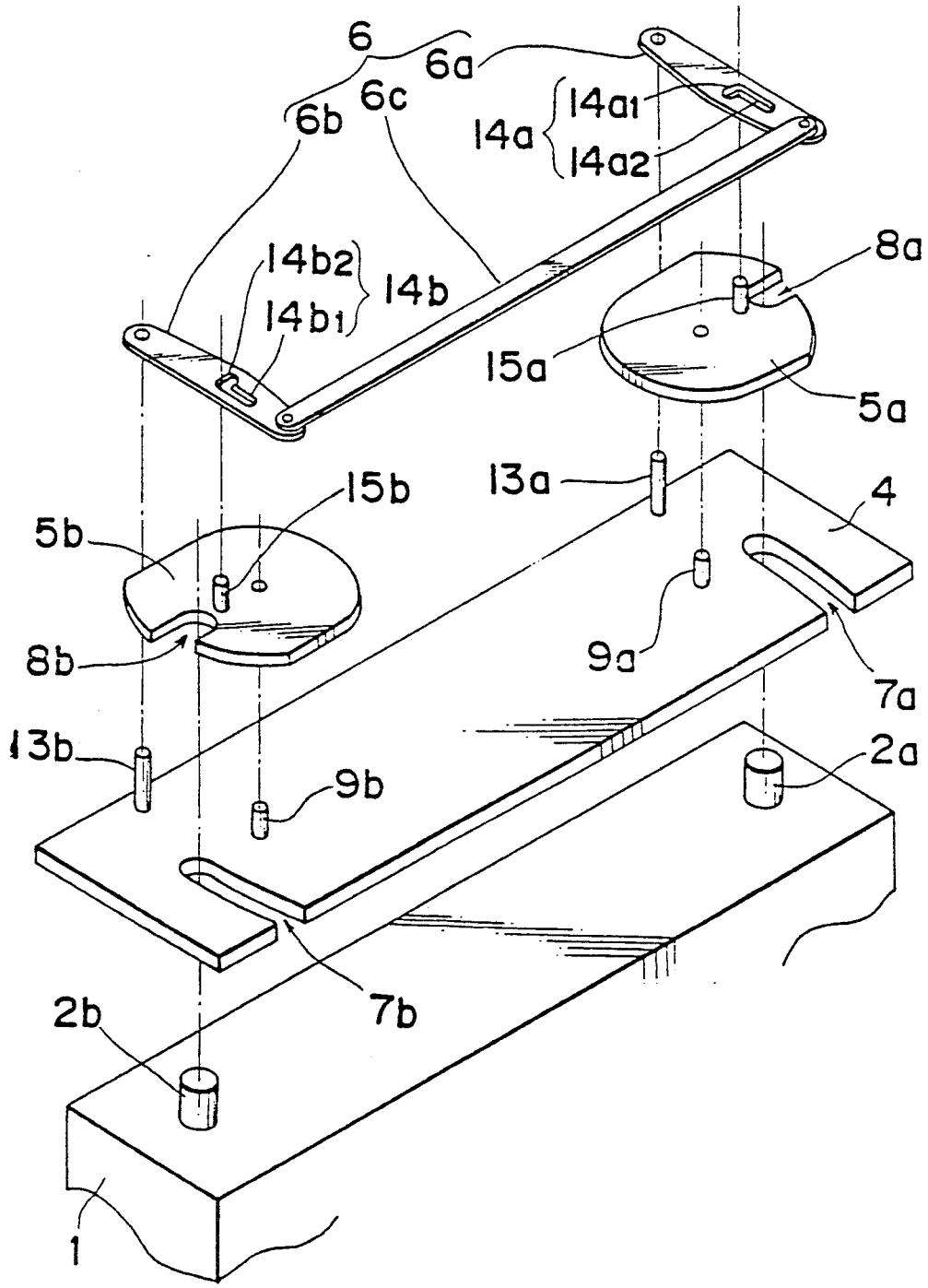

A further modification of the first embodiment is illustrated as an embodiment in FIGS. 85 to 87. In the embodiment which is a modified example of the first embodiment, the corresponding parts are designated by the same reference numerals as in the first embodiment. FIG. 85 is a plane view when the door member is closed. FIG. 86 is a plane view when the door member is opened. FIG. 87 is an exploded perspective view. The springs 10A,10B are omitted in FIG. 85 to 87.

Since the operation of the above construction is the same to that of the first embodiment, the practical explanation thereof is omitted for the sake of brevity.

In the above-embodiment, the screening plates 106A, 106B are mounted on the fixing plate 4B. In the present embodiment, the screening plates 106A, 106B may be mounted on the inner face of the door 1. Also, in the above-described embodiment, the whole thickness is improved not to become thicker if the stage portions 103A, 103B are provided on both the right, left ends of the fixing plate 4B, with the screening plates 106A, 106B being provided. The present embodiment includes the screening plates 106A, 106B mounted on the flat fixing plate 4B. The present embodiment applies not only to the opening, shutting apparatus of the door shown in the above-described embodiment, but also even to the construction in which the springs 10A, 10B are not used. In addition, although the notch portions 101A, 101B of the door 1 are adapted to open, choke through the oscillation in cooperation with the opening, shutting operation of the door 1, it is variably considered that the notch portions 101A, 101B of the door 1 may be opened, choked by the advance or retreat movement of the screening plates 106A, 106B in parallel to the relative moving direction between the hinge pins 2A, 2B and the engagement grooves 7A, 7B through the opening, shutting operation of the door 1.

In the first embodiment, as shown in FIGS. 10 to 14, the engagement pair 202 for raising the door 1 through the engagement immediately before the door 1 is fully closed is disposed on the lower end portion of the door 1 and the refrigerating chamber 203 of the main body 3.

Namely, the engagement pair 202 is projected towards the door closing direction, as indicated in the drawing, from near the approximately central position of the lower end portion of the door 1, i.e., of both right, left hinge pins 2A, 2B so that the roller portion 204 which, is one example thereof, is inserted onto the inner side of the refrigerator during the closure of the door, while the support member 205 which in another example thereof, is disposed in such a position as to be engaged with the roller portion 204 during the door closure on the bottom portion of the refrigerating chamber 203.

The support member 205 which is an approximately trapezoidal column member in the side face is provided on the door side of the top face thereof with a slant face F falling towards the door opening direction (arrow B) and on the recesses of the main body with a slant face G falling towards the door closing direction.

Figure 13:
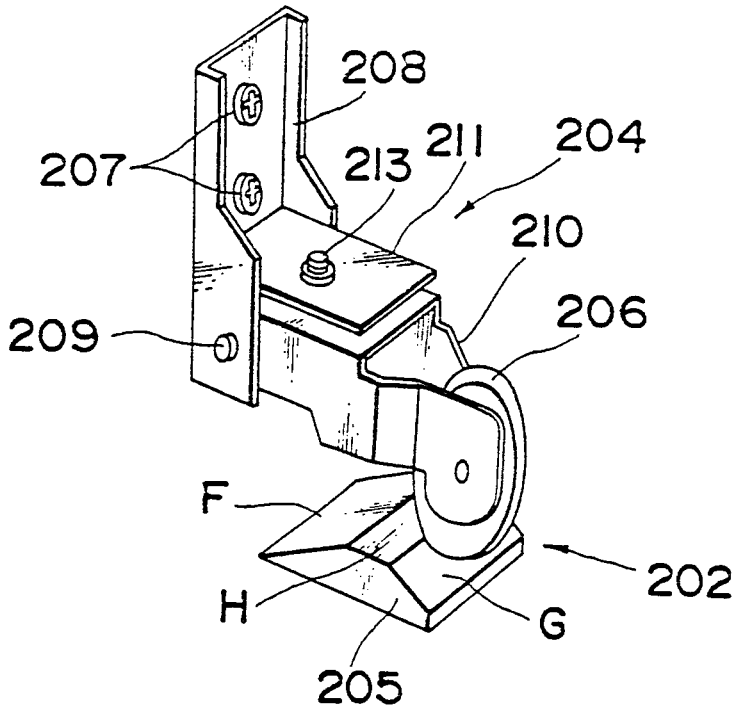
FIG. 13 is a perspective view showing a roller portion and a support member of the engagement pair in FIG. 11.

As shown in FIG. 13, the roller portion 204 is composed of a roller 206 adapted to roll on the top face of the support member 205 to support the load of the door 1 during the door closure, a mounting angle 208 which is an approximately ]-shaped frame member in the plane to be secured on the reverse face of the door 1 with screws 207, a roller holder 210 which is an approximately ]-shaped plate member in the plane to be pivotally supported on the pin 209 that is pivoted at its one end so as to grasp the roller 206 and is provided at its other end in the lower portion of the mounting angle 208, a fixing base plate 211 projected towards the main body side from the central portion of the mounting angle 208, a screw pair for the height position adjustment composed of a screw 212 which is engaged into a tapped hole drilled in the top face of the roller holder 210 with the tip end of the screw advancing direction being provided to be brought into contact against the tip end portion of the fixing base plate 211, and a screw 213 which is engaged into the tapped hole drilled in the fixing base plate with the head portion thereof being adapted to support the roller holder 210.

In such a door opening, closing apparatus 201 as described hereinabove, the opened door 1 is closed towards the door closing direction (arrow A). At this time, first, the roller 206 located at the tip end of the roller portion 204 comes into contact against the slant face F of the support member 205. When the door is pushed, the door 1 is rolled on the slant F so as to upwardly raise the door 1 with the roller portion 204 being secured thereon.

Figure 12:
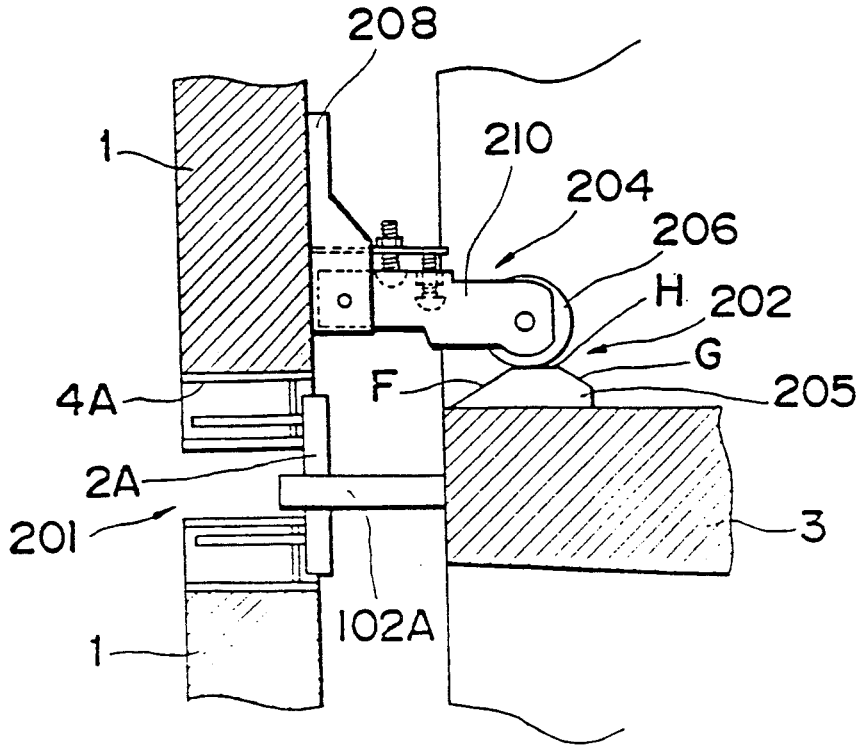
FIG. 12 is a similar view of FIG. 11 showing the operation of an engagement pair provided in the refrigerator.

And when the door 204 has come to the high base face H of the support member 205, the load receiving member 4A of the door 1 is located above the hinge pin 2A disposed on the side of the main body as shown in FIG. 12 so that they do not come into contact against each other.

Figure 11:
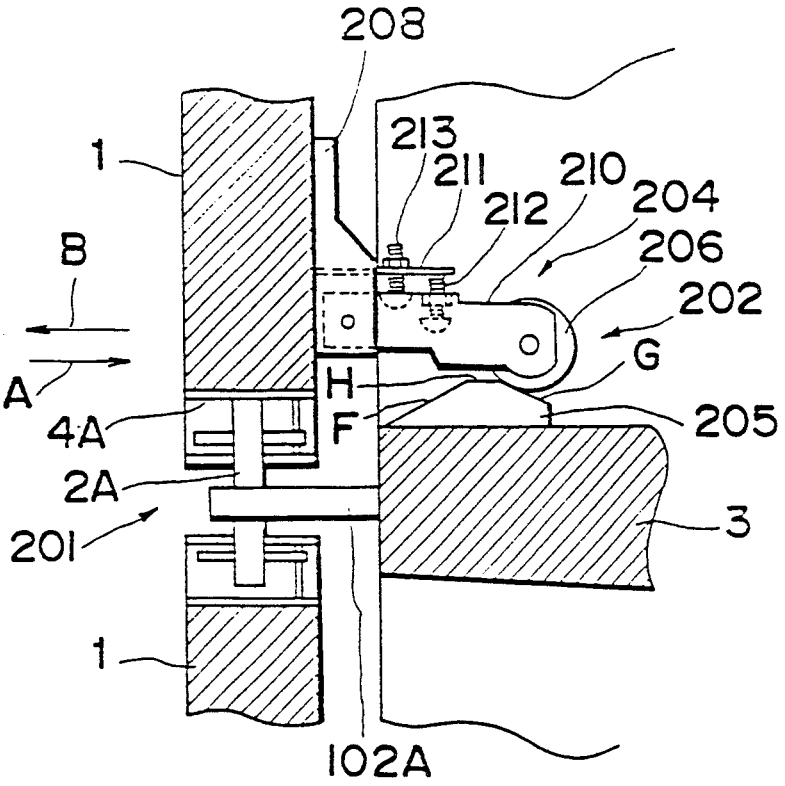
FIG. 11 is a cross-sectional view, on an enlarged scale, showing a portion of the device in FIG. 10.

On further pushing operation of the door 1, the roller 206 lowers on the slant face G of the support member 205 as shown in FIG. 11. Accordingly, the door 1 also lowers to come to the full closure. At this time, the hinge pin 2A comes into contact against the load receiving member 4A to receive the load of the door 1 and also, becomes the shaft during the door closure. Also, the door 1 is urged towards the closing direction (arrow A).

Also, even when the door 1 is opened from the condition of the full closure, the roller 206 rises on the slant face G of the support member 205 to raise the door 1, so that as shown in FIG. 12, the opening, closing operations of the door 1 is smoothly effected without the contacting between the hinge pin 2A and the load receiving member 4A.

Here, the upper evacuation degree of the door 1 is required to be adjusted so that the hinge pin 2A and the load receiving member 4A may not come into contact against each other during the opening, closing operations of the door 1. This operation is effected by the screw pair for height position adjusting use 212, 213 being capable of displacing the roller holder 210 with respect to the fixing base plate 211. Namely, one of the screws adjusts the evacuation degree and thereafter, the other of the screws secures the adjusting position.

The slant G is provided to receive the door load by both the right, left hinge pins 2A, 2B during the door closure so as to prevent the door 1, the engagement pair 202, etc. from being deformed, and to urge the door 1 in the shutting direction (arrow A) so that the door 1 may not be opened unexpectedly during the door closure. The slant face G may be omitted. The support member 205 may be composed of a slant face F and a high base H so that the door load may be received by the roller 206 even when the door 1 has been fully shut.

Also, in the present embodiment, the roller 206 is projected towards the door shutting direction (arrow A) from the inner side of the door 1. In this manner, the door size may be made larger as compared with the case where the roller 206 is provided on the lower face of the door 1. Even when a plurality of doors have been placed one upon the other, the space between the doors does not become wider.

In the above-described embodiment, there are provided the engagement pair 202 with the roller portion 204 being provided on the door 1, and the support member 205 being provided on the main body 3. Another embodiment shows the engagement pair 202A with the support member 205A being provided on the door 1, and the roller portion 204A being provided on the main body 3.

Figure 14:
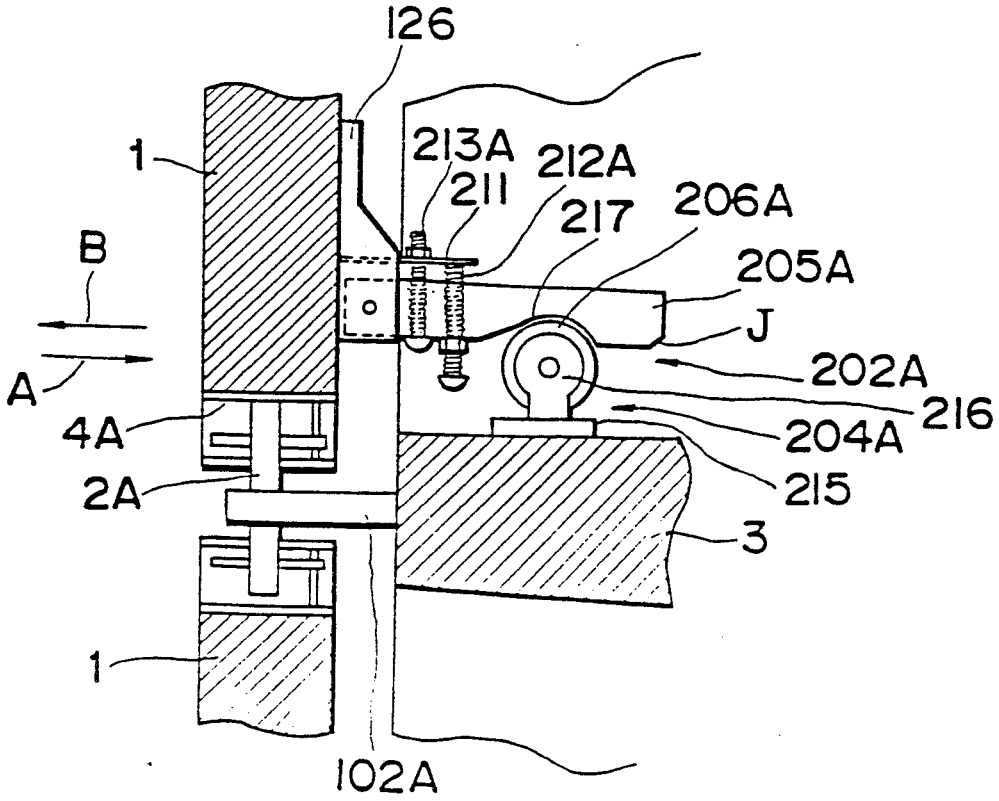
FIG. 14 is a similar view of FIG. 11 showing a modification of the portion of FIG. 11.

In the roller portion 204A of a modified embodiment, as shown in FIG. 14, a pedestal 215 is provided in a position where the support member 205 has been disposed in the previous embodiment, with the roller 206A being rotatably pivoted by a bearing portion 216 projected from the pedestal.

The support member 205A is formed straight in the shutting direction on the bottom face, and is a column shaped member having an approximately circular (in the side face) engagement groove 217 into which the roller 206A is engaged during the door closure. The support member 205A is pivoted to oscillate on the mounting angle 126 with the end portion being secured on the reverse face of the door 1. Furthermore, the height position adjustment of the support member 205A is likewise effected by the screw pair 212A, 213A for height position adjusting operation with respect to the fixing base plate 211 projected from the mounting angle 126.

In the door opening, closing apparatus in accordance with the embodiment, when the opened door 1 is closed, at first, the tip end lower portion J of the support member 205A on the side of the door 1 comes into contact against the upper portion of the roller 206A on the side of the main body 3. Furthermore, the bottom face of the tip end portion of the support member 205A is raised onto the roller by the pushing operation of the door 1. The door 1 coupled thereby to the support member 205A is raised as far as a position with the load receiving member 4A not being not projected from the hinge pin 2A provided on the side of the main body 3.

Continuously, when the roller 206A has been loosely engaged into the engagement groove 217 of the support member 205A, namely, during the full closure of the door 1, the door 1 is lowered so as to support the load receiving member 4A by the upper end portion of the hinge pin 2A. In this manner, the smooth closing operation may be effected during the closing operation of the door 1.

Also, even in the opening operation of the door 1, the roller 206A raises the door 1 in getting away from the engagement groove 217 so that one portion of the door 1 does not come into contact against the hinge pins 2A,2B. Thus, even in the embodiment, the smooth opening, closing operation may be effected during the opening, closing of the door 1.

The opening, closing apparatus of the door 1, described in the respective embodiment may be smoothly opened, closed without unnecessary contacting among the members if the door opening, closing operation is effected from the optional right or left side as described hereinabove. As the degree of evacuating the door 1 upwardly may be adjusted by the engagement pair 202, 202A, the setting operation may be effected into the given position if dispersion is caused in the mounting position of the hinge pins 2A, 2B and the roller portions 204, 204A. Accordingly, the operability during the assembling operation may be improved, with the yield being made better.

In the door opening, closing apparatus described hereinabove, the engagement pair is disposed in the lower end portion of the approximately central position in the interior of the respective door of the refrigerator. It is needless to say that the arrangement position of the engagement pair is not limited to the above description. Namely, the operation effect remains unchanged in the abovedescribed embodiment if they are disposed on the upper end portion of each door, on both the right, left portions or on the side of the optional right or left side.

As described hereinabove, the present embodiment provides an opening, closing apparatus for a door, wherein vertical hinge pins are projected from the right, left end portions of either one from a door and a main body with the door mounted thereon, a load receiving member for supporting the door through contact with the tip ends of the hinge pins during the door closure is disposed on the other one from the door and the main body, the door is supported for its opening, closing operations with the one between the right and left hinge pins as a center. The opening, closing apparatus for the door is characterized in that an engagement pair which immediately engages before the door is fully closed so as to raise the door up to a position where the hinge pins do not interfere with the load receiving member is mounted on each of the door and the main body. Therefore, such simple construction as described hereinabove prevents the hinge pins from contacting against the load receiving member even when the door is opened, shut from the optional right or left direction. Accordingly, the smooth opening, shutting operations of the door may be effected. Furthermore, as the door may be disposed in the given position of the door even if the dispersion is caused in the mounting position for the hinge pins or the like, the operability during the assembling operation, etc. may be improved and also, the yield may be made better.

Figure 15:
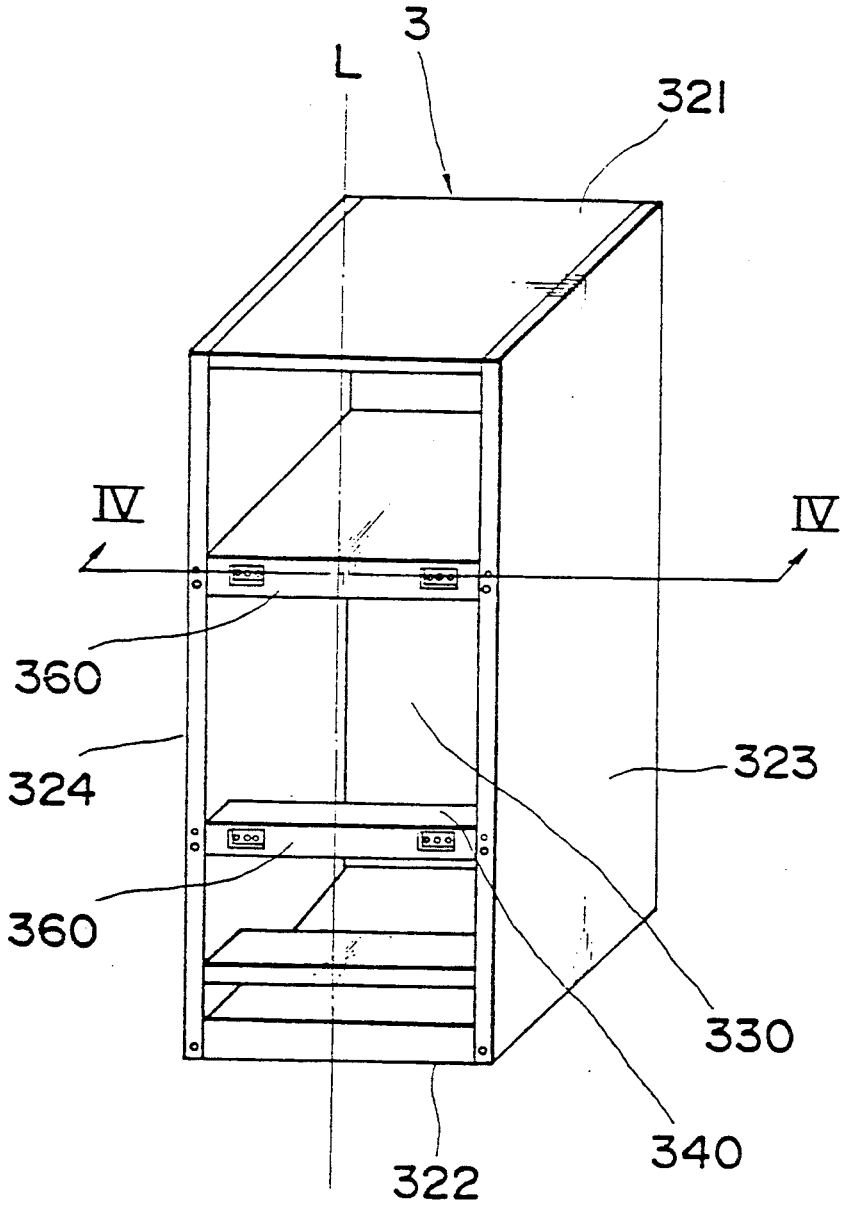
FIG. 15 is a perspective view showing the frame construction of main body of the refrigerator in accordance with the first embodiment.

FIG. 15 is a perspective view showing the outside appearance of a main body of refrigerator provided with the opening/closing device of the door according to the first embodiment of the present invention.

Figure 16:
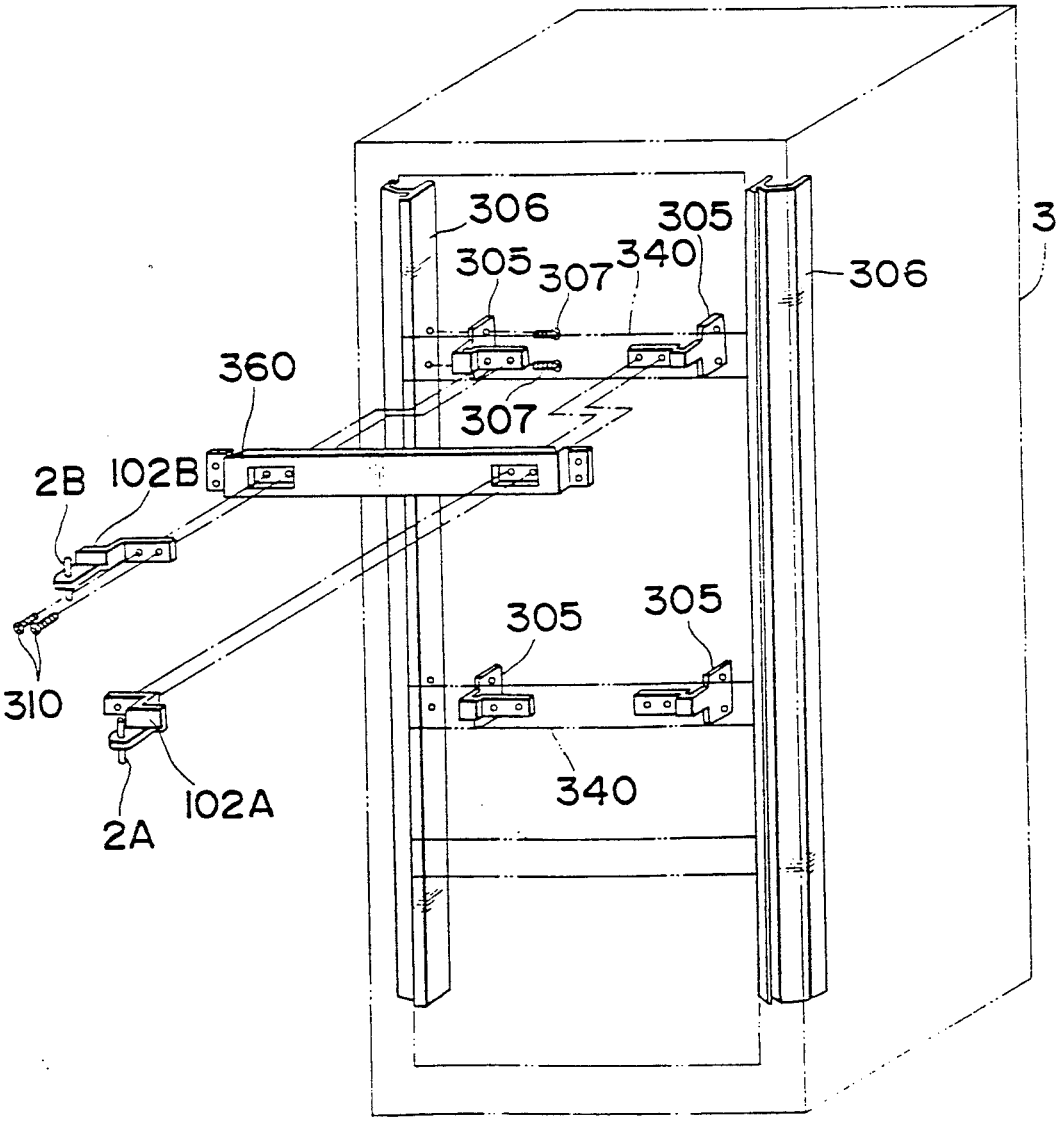
FIG. 16 is an exploded perspective view showing parts of the main body in FIG. 15.

FIG. 16 is a dismantled perspective view for illustrating the mounting condition of the hinge in the first embodiment of the present invention.

Figure 17:
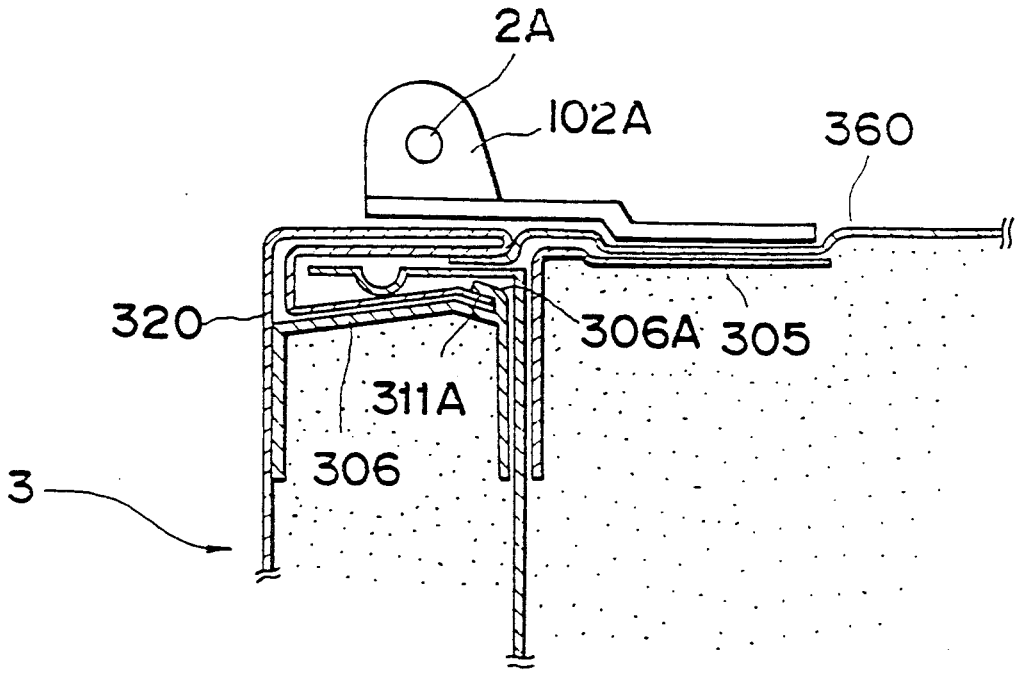
FIG. 17 is a cross-sectional view showing a hinge portion of the main body in FIG. 16.

FIG. 17 is a cross-sectional view of the hinge mounting portion.

The embodiment is a refrigerator, whose door may be opened or close from the optional right or left side. A hinge composed of hinge plates 102A,102B and hinge pins 2A, 2B projected from the hinge plates 102A,102B are mounted through a mounting plate 305 for hinge use on both the right, left end portions of the main body 3. Engagement grooves (not shown) into which the hinge pins 2A, 2B are detachably engaged from the open side of the door 1 are provided on the door.

In the embodiment, in order to have the smooth opening, closing operations of the door, the strength of the hinge portion is increased to reduce the displacement caused by the load of the door 1. As shown in FIG. 17, aluminum sashes 306 as a reinforcing member are fixed along the vertical direction of the main body 3 into the inner wall portion of the so-called right or left flange portion of the outer shell of the main body 3 of the refrigerator, with the mounting plate 305 for hinge use being secured with screws 307 onto the aluminum sashes 306. The aluminum sashes 306 as the reinforcing member are formed by an extrusion molding operation into one with an engagement piece on it so that it may be engaged into the end portion 311A of the outer shell 320 of the main body 3.

The mounting plates 305 for hinge use are secured onto the aluminum sashes 306 with screws 307 and also, are secured with screws onto a compartment portion 340 which partitions the respective chambers such as refrigerating chamber, freezing chamber, etc.

A center plate 360 is mounted to cover the compartment portion 340 onto which the mounting plate 305 for hinges are secured, with the hinges being mounted on the mounting plate 305 for hinge use with screws 310 from above the center plate 360.

In this manner, the mounting plates 305 for hinge use are secured onto the compartment portion 340 and also, are adapted to be mounted onto the aluminum sashes 306 as reinforced members mounted on the inner wall portion of the outer shell 320 of the main body 3, so that the door load to be applied upon the mounting plates 305 for hinge use is dispersed even upon the vertically extending aluminum sashes 306 so as to increase the strength of the hinge portion and reduce the displacement caused through the door load, thus allowing the door to be smoothly opened, closed.

Figure 19:
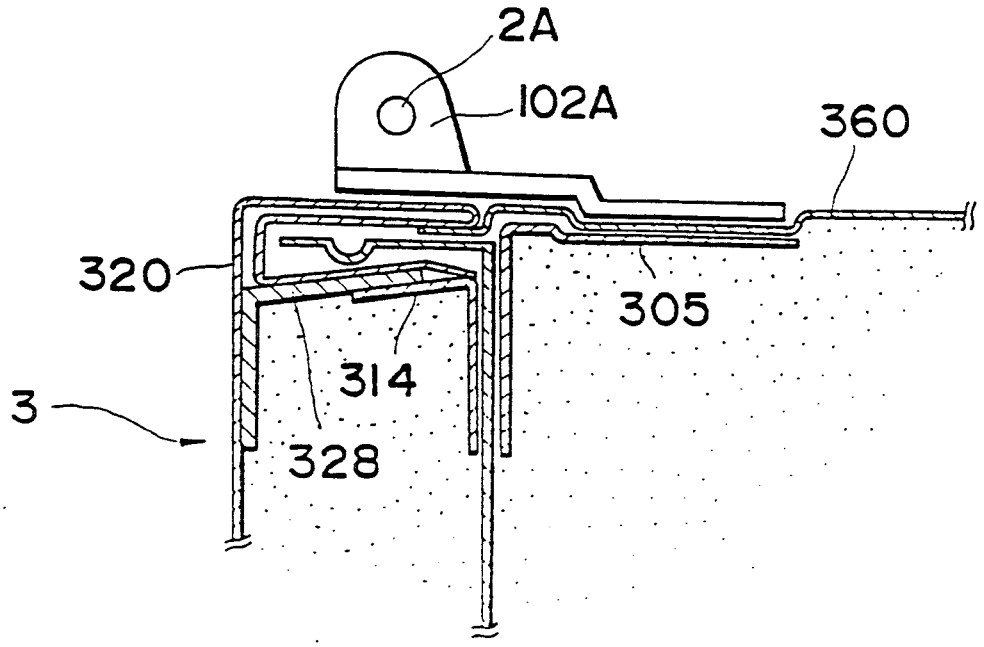
FIG. 19 is a similar view of FIG. 17 showing a hinge portion of the main body in FIG. 18.
Figure 18:
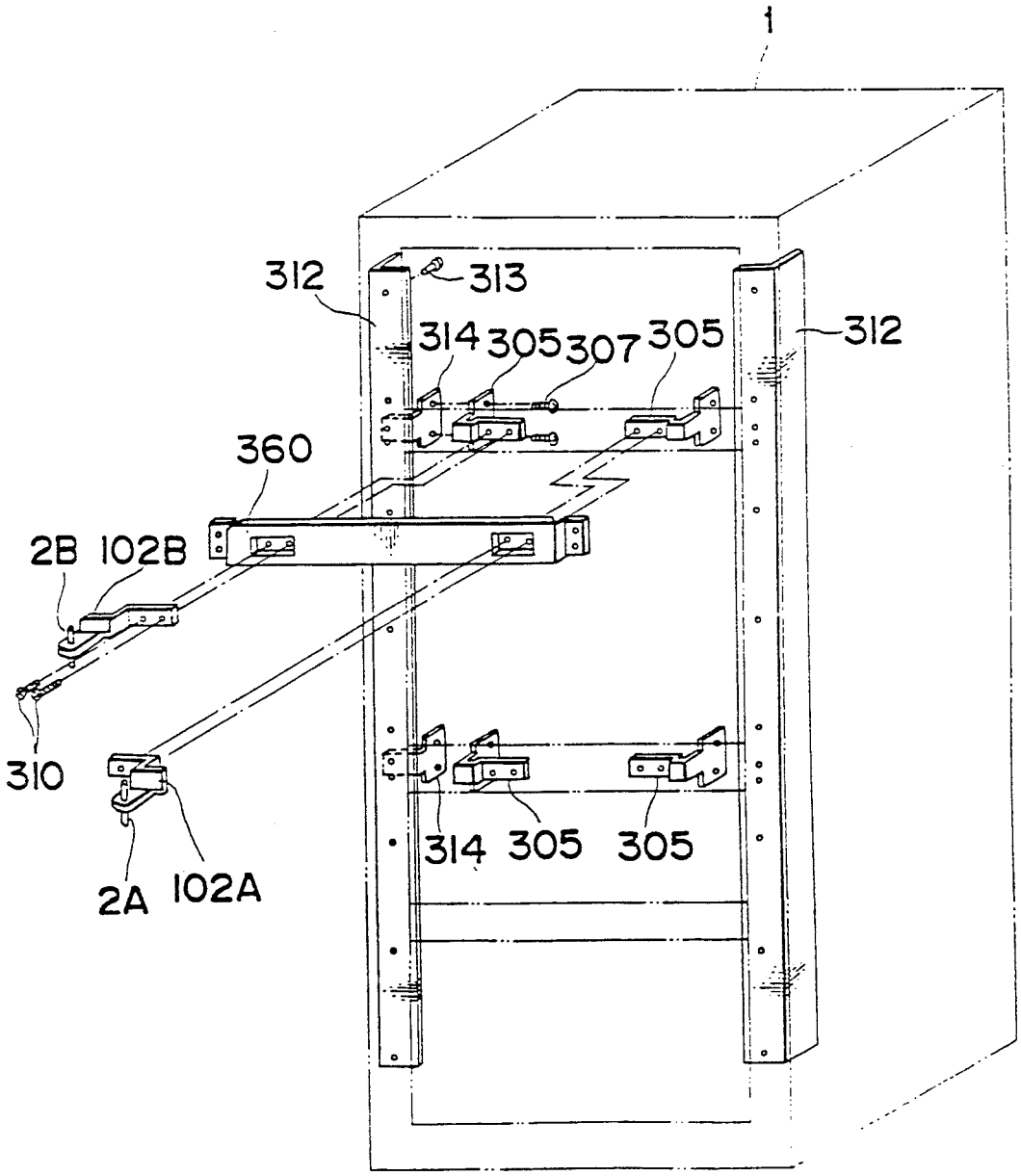
FIG. 18 is a similar view of FIG. 16 showing a modification of the main body of FIG. 16.

FIG. 18 and FIG. 19 are views corresponding to FIG. 16 and FIG. 17 in the other embodiment of the present invention.

In this embodiment, the reinforcing member is bent into ">" shape through a press processing operation into a steel plate 312. The steel plates 312 are mounted on the inner wall portion of the outer shell 320 of the main body 3 with rivets 313, with the mounting plates 305 for hinge use being adapted to be secured with screws 307 onto the steel plates 312 through the plate members 314. The other construction is similar to that of the above-described embodiment.

In addition, the other modified embodiments are shown in FIG. 20 to FIG. 23.

Figure 20:
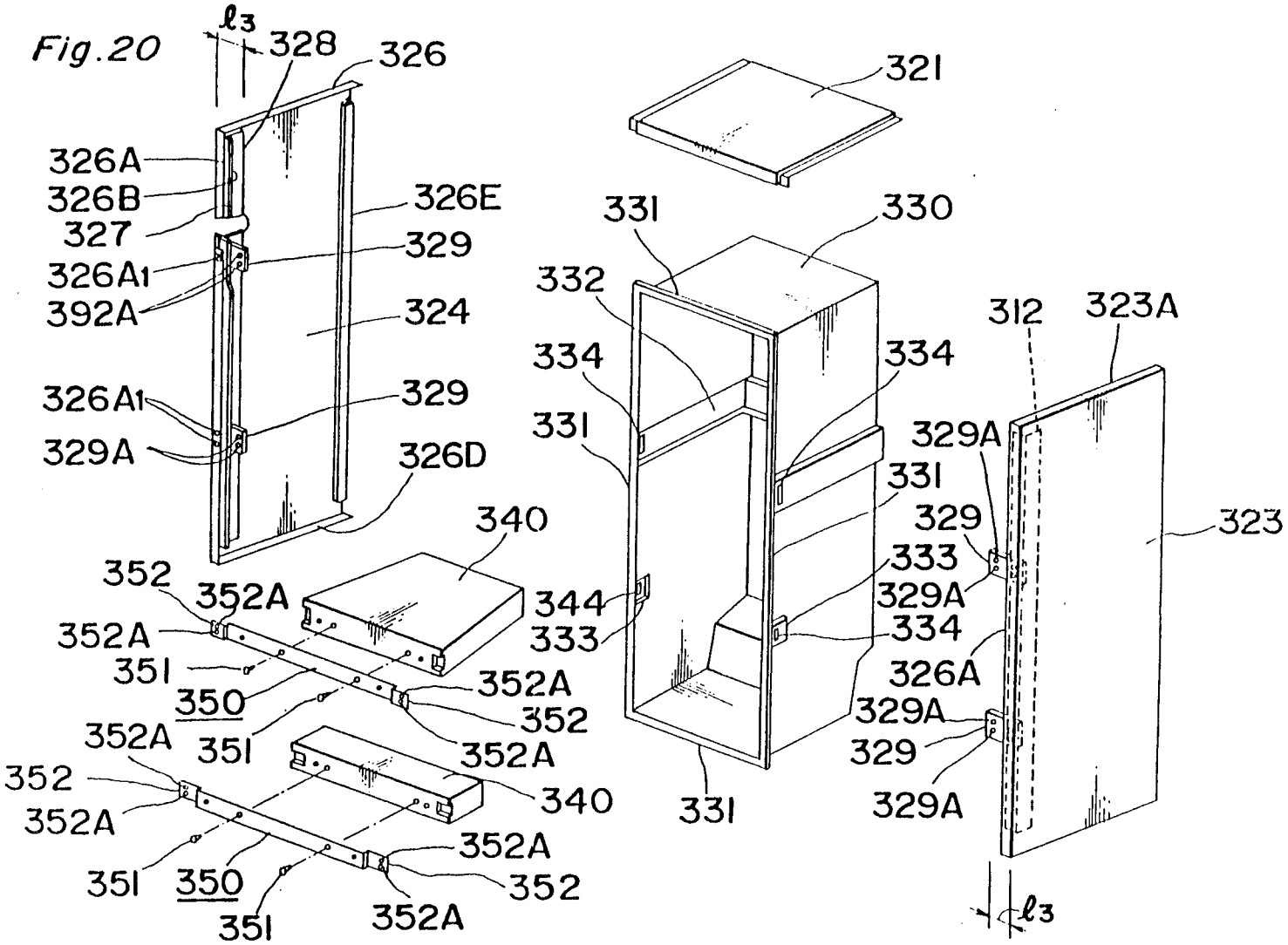
FIG. 20 is an exploded perspective view showing the parts constituting the main body in accordance with the first embodiment.
Figure 21:
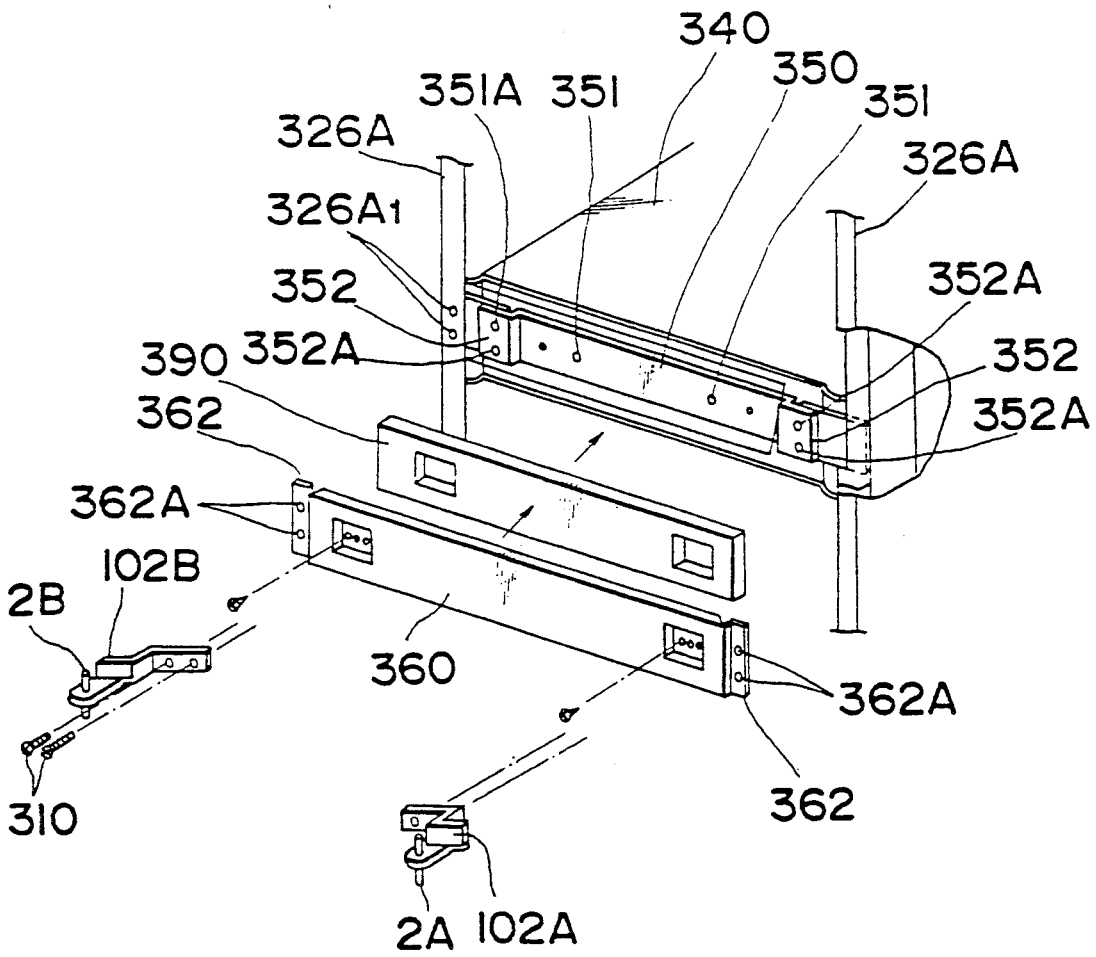
FIG. 21 is an exploded perspective view showing the mounting state of a compartment wall provided in the main body of FIG. 20.
Figure 22:
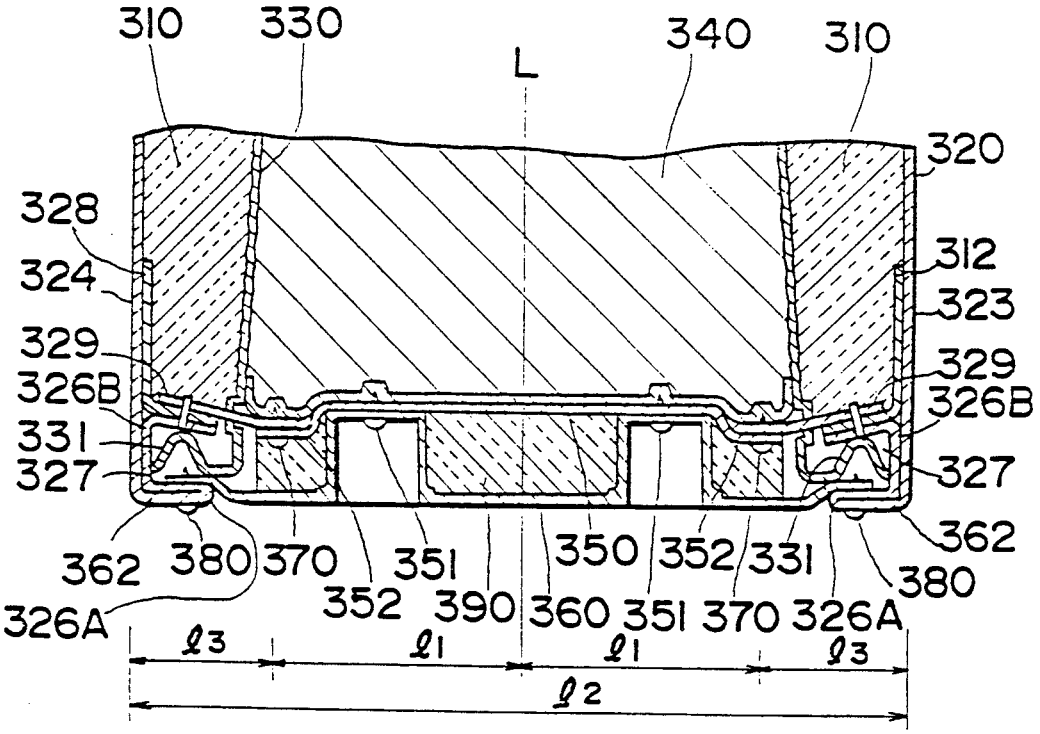
FIG. 22 is a cross-sectional view of the main body taken along line IV—IV in FIG. 15.

FIG. 20 is a perspective dismantled view showing the respective members constituting the main body of a refrigerator in accordance with the present embodiment. FIG. 21 is a partial perspective view showing how the compartment wall is mounted. FIG. 15 is a perspective whole view showing the assembled condition. FIG. 22 shows a sectional view taken along the line IV - IV line of FIG. 15.

In FIG. 20, the main body 3 of a refrigerator has an outer shell with an opening portion in the front face thereof, composed of a top face plate 321, a bottom face plate 322 (see FIG. 15), a right-side plate 323, a left-side plate 324, a rear face plate (not shown), etc. an inner box 330 integrally mounted with composite resin, etc., and having also an opening portion in the front face, a compartment wall 340 for dividing the inner space of the inner box 330 into upper, lower directions to form a plurality of receiving chambers, a compartment reinforcing plate 350 mounted on the front face of the compartment portion 340, and a center plate 360 (see FIG. 21) mounted on the front face of the compartment reinforcing plate 350. It is to be noted that in the present embodiment, an adiabatic material 390 (see FIG. 21) for preventing the dewing is interposed between between the compartment reinforcing plate 350 and the center plate 360.

Double flange portions 326A, 326B projected in the inner direction along the opening face are formed on the peripheral edge of the front face opening portion of the outer shell constructed by the top face plate 321, a bottom face plate 322, right-side plate 323, a left-side plate 324 and a rear face plate. Also, approximately horizontal upper flange 323A and lower flange 326B each being directed inwardly are formed on the upper end edge and the lower end edge of the right-side plate 323 and left-side plate 324 are formed and a rear flange 326E for engaging each of the right, left side edge of the rear face plate are formed on the rear end edge.

Also, the double flange portion 326A, 326B are formed through the bending operation of the respective tip end edges of the top face plate 321, the lower face plate 322, the right-side plate 323 and the left-side plate 324 constituting the outer shell. Namely, as shown in FIG. 22, the tip edge is bent inwardly along the opening face, and also is bent rearwardly to form the front face side flange portion 326A and the tip end portion is extended rearwardly along each plate face and is erected inwardly for forming the rear face side flange portion 326B, resulting in almost ]-shape in section. Namely, the engagement groove 327 is formed by the front face side flange portion 326A and the rear face side flange portion 326B.

Also, the rear face side flange portion 326B formed on the right-side plate 323 and the left-side plate 324 is supported by a long flange reinforcing plate 312 of an approximately L-shaped (in section) which is secured with screws in its one side piece onto the right-side plate 323 and left-side plate 324. The flange reinforcing plate 312 is formed across approximately the whole height of the right-side plate 323 and the left-side plate 324. And a plurality of compartment fixing plates 329 (in the present embodiment, they are provided in two upper, lower locations) projected towards the inner direction are secured with screws in the proper location (described later) of the flange reinforcing plate 312. The tapped holes 329A for screwing the screws into the compartment fixing plate 329 are formed, with the forming position of the tapped hole 329A are set to be located in a given interval (l3) from each plate face of the right-side plate 323 and the left-side plate 324. And when the right-side plate 323 and the left-side plate 324 are mounted on the inner box 330 through the compartment fixing plate 329, the right-side plate 323 and the left-side plate 324 are to be equally divided in the width direction from the central line L (see FIG. 15) of the main body.

The flange portion 331 projected in the external direction along the opening face is formed on the peripheral edge of the opening portion of the inner box 330. As shown in FIG. 22, the flange portion 331 is formed into an inversely U-shaped bend (in section) with the front face side being open. Also, a compartment inserting groove 332 for insertingly supporting three peripheral edges (except for the front face) of the compartment wall 340 is formed in the upper portion thereof. The compartment wall engagement portion 333 for engaging and supporting both the right, left side portions of another compartment wall 340 is formed in the lower portion. An opening portion 334 into which the tip end portion of each compartment fixing plate 329 mounted on the right-side plate 323 and left-side plate is inserted is formed in the front end portion of the compartment wall inserting groove 332 and the compartment wall engagement portion 333.

The compartment reinforcing plate 350 and the dressing plate 360 for positioning (namely, width limit of the main body 3) of the right-side plate 323 and the left-side plate 324 constituting the outer box, preventing the deformation of the main body 3, reinforcing the rigidity thereof are secured onto the front face of the compartment portion 340 with screws 351.

A coupling portion 352 for connection through the compartment fixing plate 329 and screws is formed on both the right, left end portions of the compartment reinforcing plate 350 with tapped holes 352A being formed in the proper positions of the coupling portion 352. The forming position of the tapped hole 352A is set (see FIG. 22) to become equal in interval (l1 in. the width direction from the central line L of the inner box 330, i.e., the box member of the main body 3. The tapped holes 329A formed in the compartment fixing plate 329 is brought into conformity with the tapped holes 352A formed in the coupling portion 352 through the superposition of the compartment fixing plate 329 on the coupling portion 352 of the compartment reinforcing plate 350. The size between the right-side plate 323 and the left-side plate 324 is set to become the required width size l2 [=2X(l1+l3)] of the main body 3 through the engagement of the screws 307 into the tapped holes 329A, 352A.

Namely, the forming position of the tapped hole 329A of the compartment fixing plate 329 and the tapped hole 352A of the coupling portion 352 are correctly determined as described hereinabove so that the right-side plate 323 and the left-side plate 324 may be distributed equally in the width direction from the central line L and the fixing of the required width size (l2) as the main body 3 is to be effected at the same time simply through the mounting of the right-side plate 323 and the left-side plate 324 on the inner box 330 through the compartment fixing plate 329 and the compartment reinforcing plate 350.

A coupling portion 362 for connection through the flange portion 326A on the front face side is formed in the right-side plate 323 and the left-side plate 324, and the screws are formed on both the right, left end portions of the center plate 360, with the tapped holes 362A being formed in the proper locations of the coupling portion 362. Also, the tapped holes 326A are formed even in the flange portion 362A on the front face side corresponding to the coupling portion 362.

The procedure of assembling the refrigerator of such construction as described hereinabove will be described hereinafter.

First, the compartment portion 340 with the compartment reinforcing plate 350 mounted with screws 351, 351 on the front face thereof is inserted into the insertion groove 332 of the compartment portion of the inner box 330. Thereafter, the flange portion 331 formed in the front face opening portion of the inner box 330 is engaged into the insertion groove 327 which is composed of the double flange portion formed on the upper face plate 321, the lower face plate 322, the right-side plate 323, the left-side plate 324 and the rear face plate so as to form the outer shell with the inner box 330 being contained therein. At this time, the tip end portion of the compartment fixing plate 329 mounted on the right-side plate 323 and the left-side plate 324 is provided in the inner box 330 through the compartment wall insertion groove 332 of the inner box 330 and the opening portion 334 formed in the compartment wall engagement portion 333 and is positioned so as to be superposed onto the coupling portion 352 of the compartment reinforcing plate 350 mounted on the front face of the compartment portion 340. The tapped holes 329A formed into the compartment fixing plate 329 is brought into conformity with the tapped holes 352A formed in the coupling portion 350 to engage the screws 370 in the tapped holes 329A, 352A so as to integrally secure the right-side plate 323 and the left-side plate 324 onto both the right, left outer sides of the inner box 330. Accordingly, the right-side plate 323 and the left-side plate 324 are to be mounted with constant interval (l1+l3) in the width direction from the central line L of the main body 3 being maintained and with the required width size l2 [=2X(l1+l3)] of the main body 3 being maintained.

Thereafter, the center plate 360 is mounted with screws 351, 351 on the front face of the compartment reinforcing plate 350 mounted on the front face of the compartment wall 340 through the adiabatic material 390 for preventing dew. At this time, the coupling portion 362 formed on the both the right, left end portions of the center plate 360 is engaged in the engagement groove 327 formed in the right side plate 323 and the left side plate 324 so as to be superposed onto the flange portion 326A on the front face side. The tapped holes 362A formed on the coupling portion 362 are brought into conformity with the tapped holes 326A1 formed in the superposed portion of the flange portion 362A of the front face side so as to fix the dressing plate 360 onto the outer shell through the engagement of the screws 380 with the tapped holes 262A, 326A1.

Namely, the outer shell (here the right-side plate 323 and the left-side plate 324) are secured onto the compartment portion 340 secured on the inner box 330 through the flange reinforcing plate 312, the compartment fixing plate 329 and the compartment reinforcing plate 350, and also, are secured onto the compartment portion 340 even through the center plate 360 and the compartment reinforcing plate 350 so that the whole main body 3 is strictly formed by the mutual operations.

After the main body 3 has been formed in this manner, the vesicatory adiabatic material 310 is filled into the space between the inner box 330 and the outer shell to complete the manufacturing operation of the refrigerator box.

Figure 23:
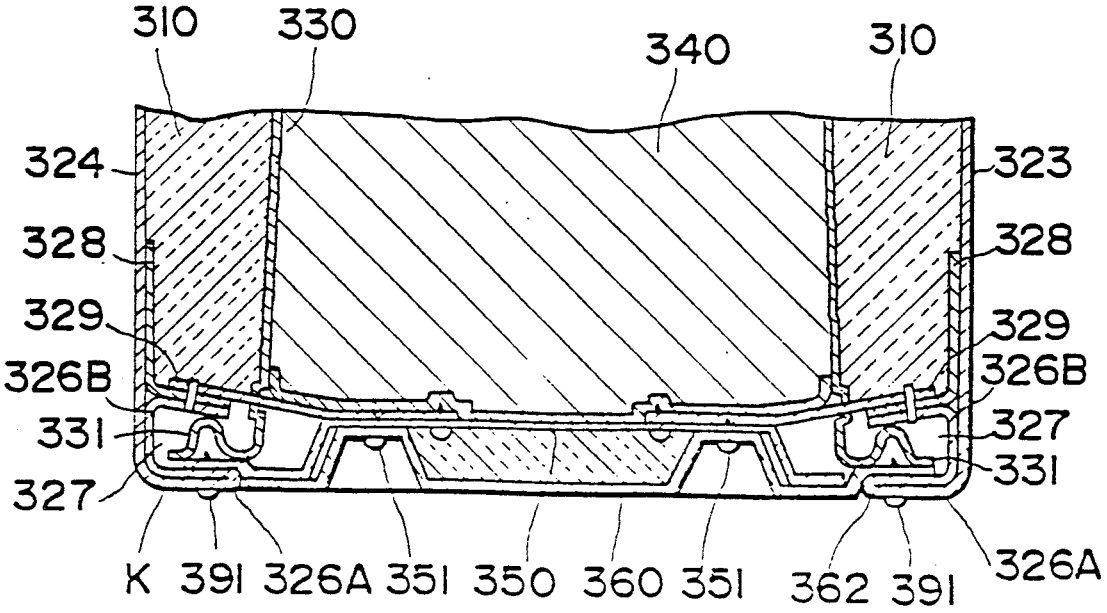
FIG. 23 is a similar view of FIG. 22 showing a modification of the main body of FIG. 22.

FIG. 23 shows the other modified embodiment of the refrigerator of the present invention.

Namely, in order to improve the assembling property of the main body 3, the coupling portion 362 to be formed on the center plate 360 is only one end portion (in the present embodiment, right end portion) of the right side or the left side, with the other end portion being a butt type for the front face side flange portion 326A of the outer shell. Instead, the left end portion of the compartment reinforcing plate 350 is further extended so as to be superposed on the front face side flange portion 326A with the superposed portion K being engaged through the screws 391.

By such construction as described hereinabove, the same effect a in the connection through the flange portion 326A of the respective front face side of the right sideplate 323 and the left-side plate 324, and the screws may be provided with the coupling portion 362 being formed on both the ends of the center plate 350.

As described hereinabove, according to the refrigerator of the present embodiment, one on the rear portion side of two (lines) flange portions formed on the front side edge of the right-side plate and the left-side plate constituting the outer shell is supported by an approximately L-shaped (in section) long reinforcing plate, which is secured in its one side piece onto the right-side plate and the left-side plate. A compartment fixing plate with its tip end portion being projected into the box interior through the side plate portion of the inner box is mounted in a position corresponding to the compartment portion of the flange reinforcing plate. Both the end portions of the fixing plate are integrally secured onto both the end portions of the compartment reinforcing plate with screws, etc. A coupling portion is formed on one end or both end portions of the center plate, and the overlapped portion between the coupling portion and the two (lines) flange portion formed on the right-side plate and the left-side plate are integrally secured with screws, etc. Therefore, the strength of the main body may be sufficiently maintained and also, the shape does not change even by the load burden through the connection and the opening, shutting of the door, by impacts during the packing and the transportation, so that the good appearance may be maintained. In the case of the door being capable for opening/closing at both sides, it is difficult to open or close the door smoothly when pitches between the left and right hinge pins 2A and 2B and between the arrangement grooves 7 and 7B are not kept constant, and the hinge pins of four positions at left and right and top and bottom are not in a given relationship with each other. However, by the employment of the construction of the present embodiment, it is easy to smoothly open or close the door. Also, by the correct determination after the sufficient consideration of the forming position of each tapped hole provided in the tip end of the compartment fixing plate and the coupling portion of the compartment reinforcing plate, the right-side plate and the left-side plate are mounted on the inner box through the compartment fixing plate and the compartment reinforcing plate. Accordingly, the right-side plate and the left-side plate may be divided equally in the width direction from the central line of the main body and simultaneously the adjustment of the width size required as the main body may be effected so that the size accuracy of the main body may be improved. Furthermore, as the size accuracy of the main body may be improved, the load applied on the jig which is used to fill the vesicatory, adiabatic material into the main body is reduced and the aging change of the jig is extremely reduced. Therefore, the completion degree of the main body after filled with the vesicatory material is also improved.

Figure 24:
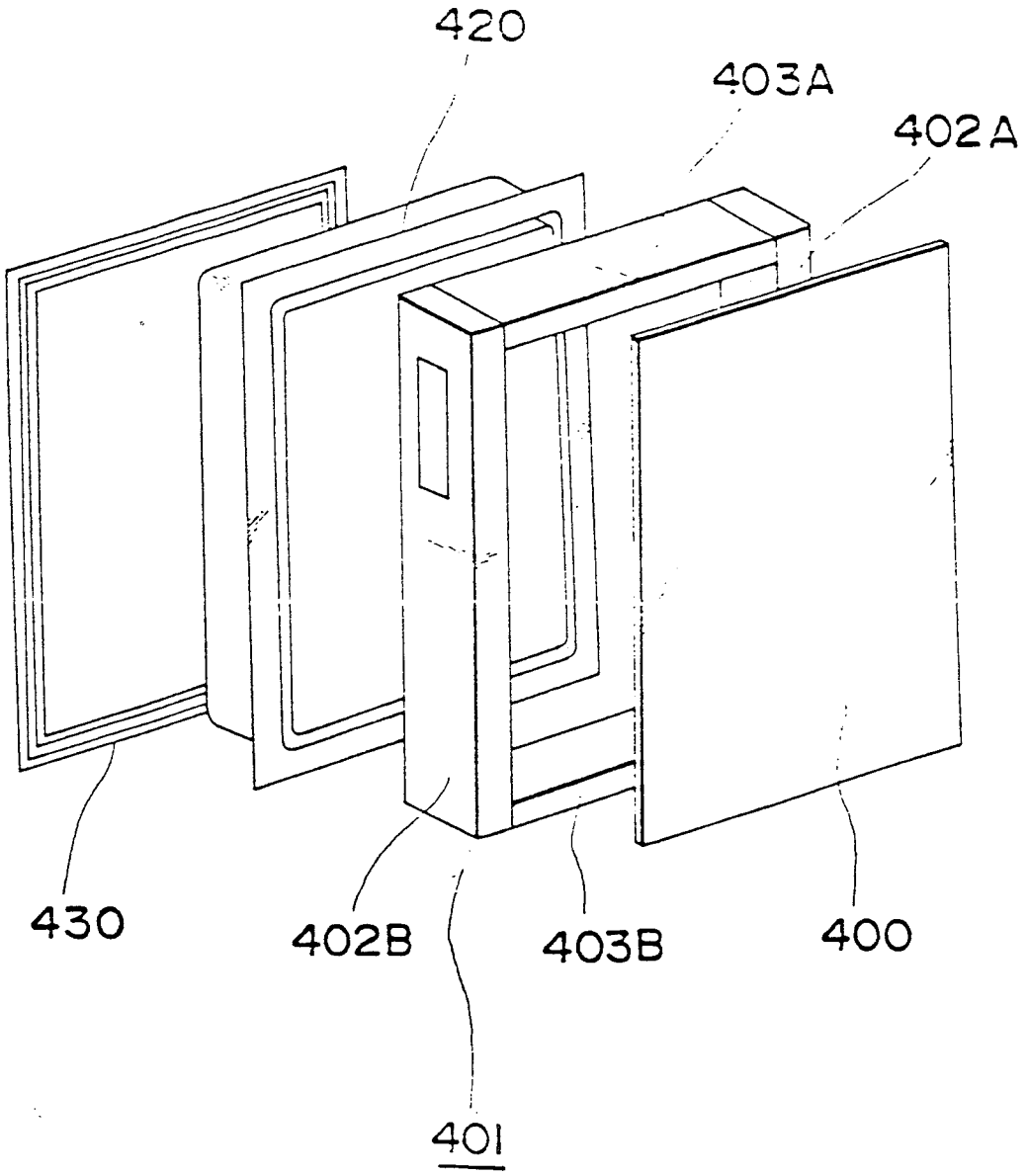
FIG. 24 is an exploded perspective view showing the frame construction of a door member of the refrigerator in accordance with the first embodiment.
Figure 25:
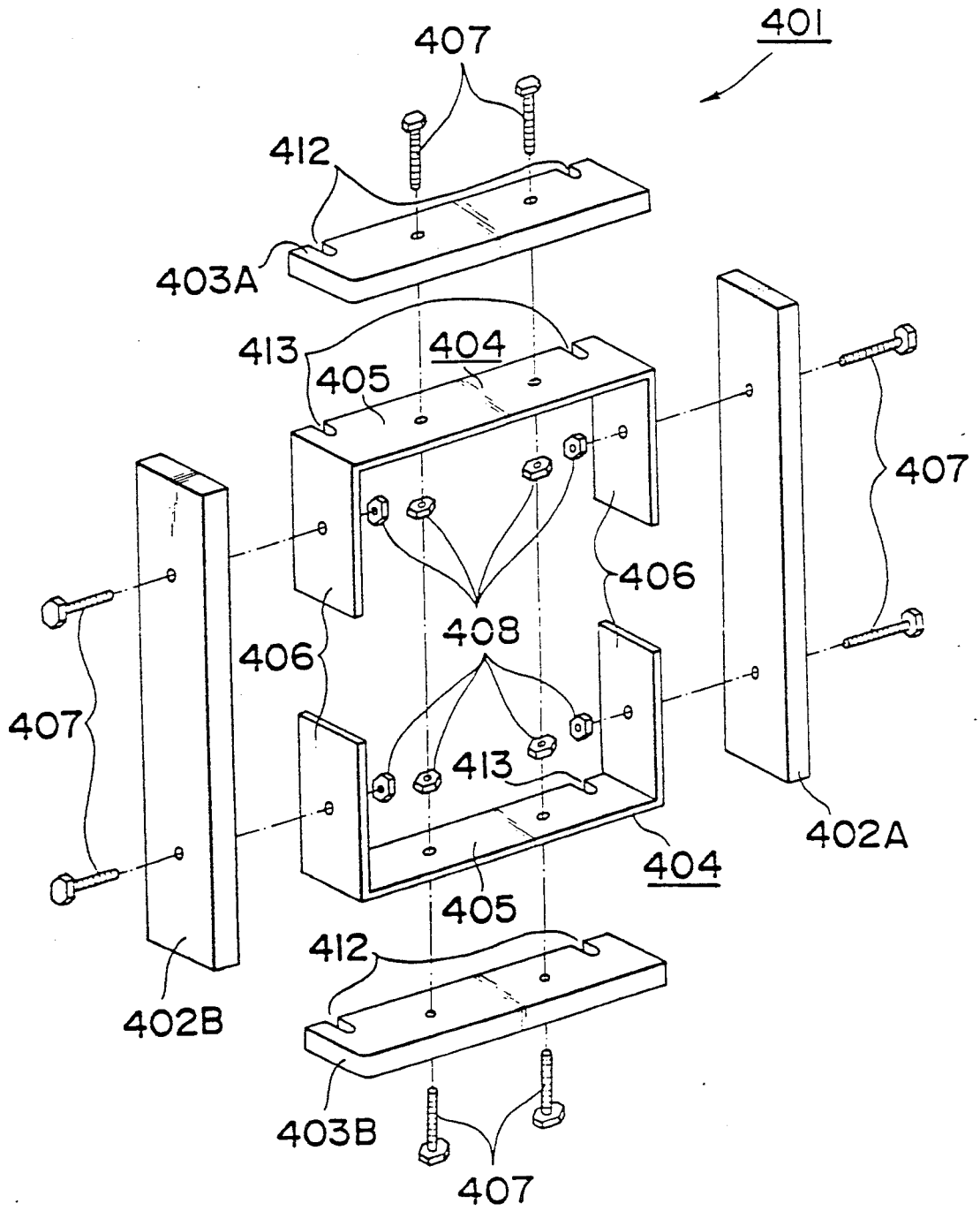
FIG. 25 is an exploded perspective view showing a frame member of the door member in FIG. 24.
Figure 26:
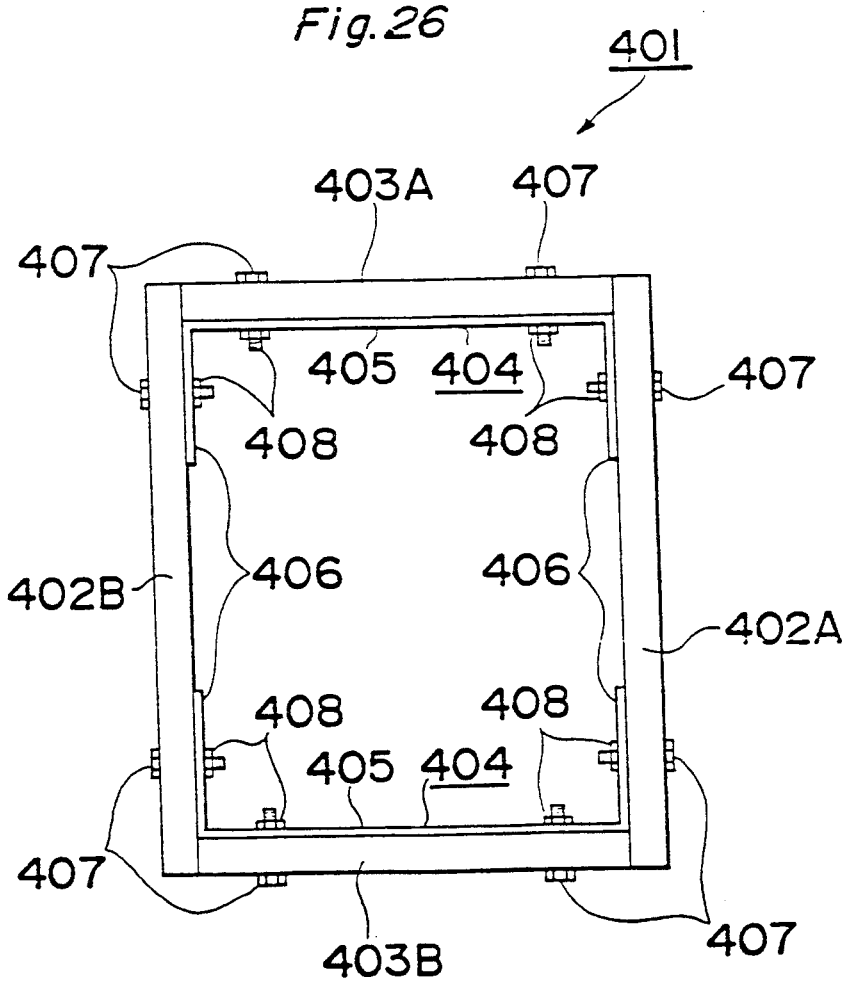
FIG. 26 is a front view of the assembled frame member of FIG. 25.
Figure 27:
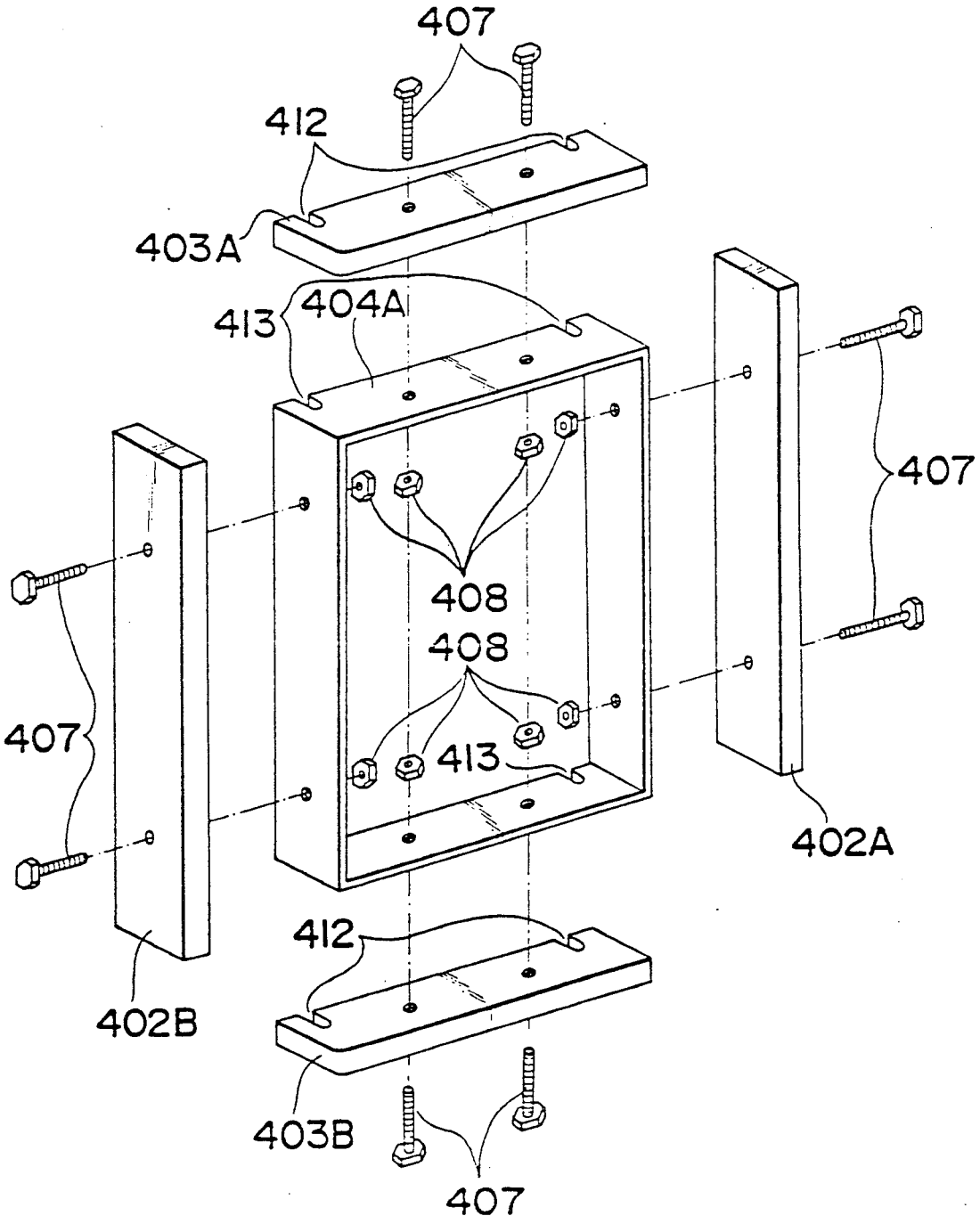
FIG. 27 is a similar view of FIG. 25 showing a modification of the frame member of FIG. 25.
Figure 28:
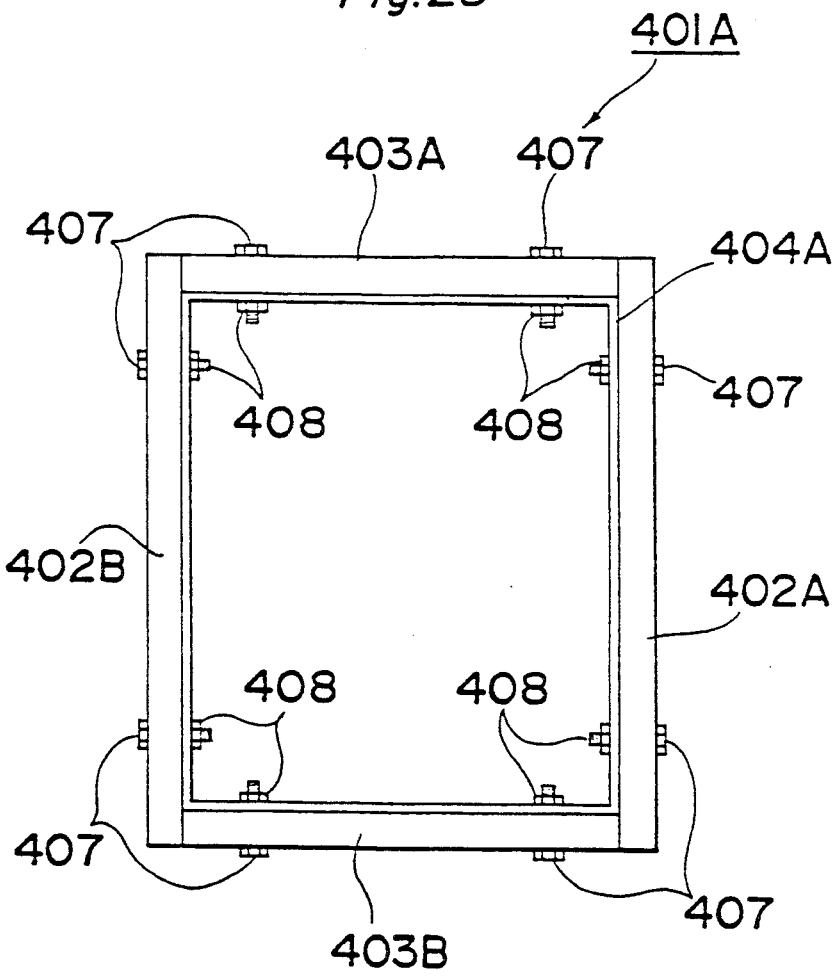
FIG. 28 is a front view of the assembled frame member of FIG. 27.
Figure 29:
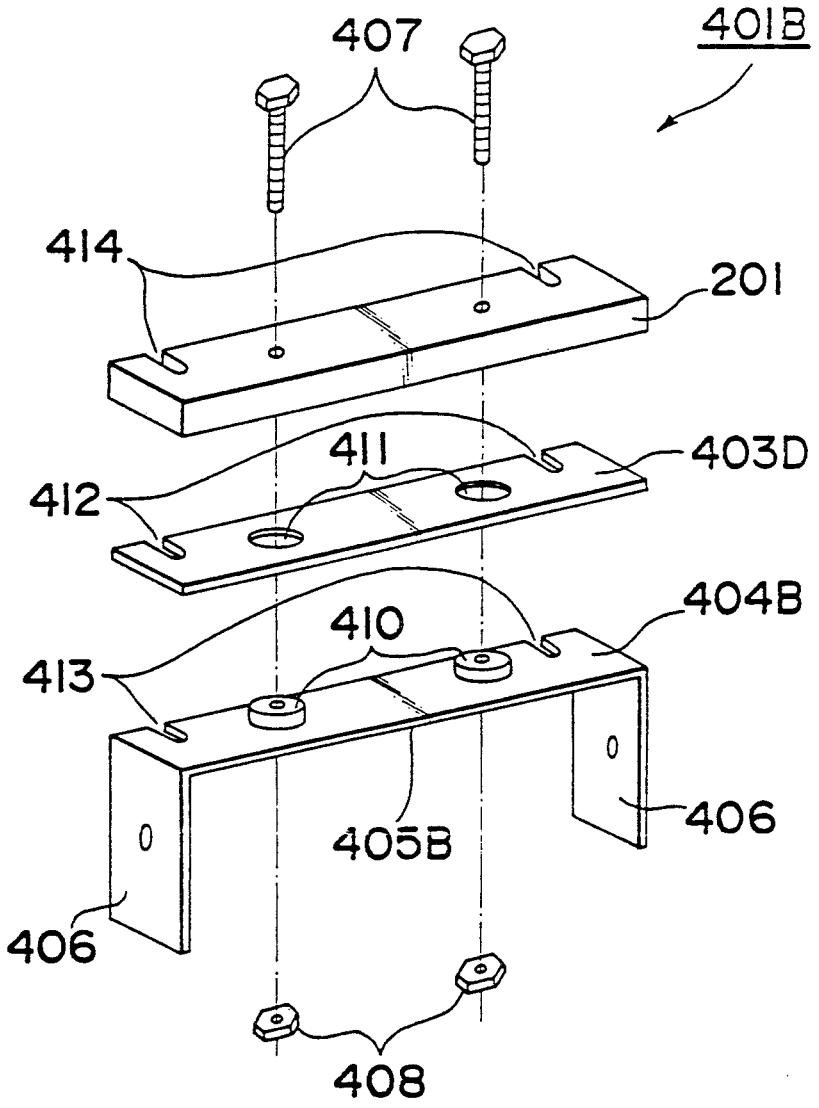
FIG. 29 is a similar view of FIG. 25 showing another modification of the frame member of FIG. 25.
Figure 30:
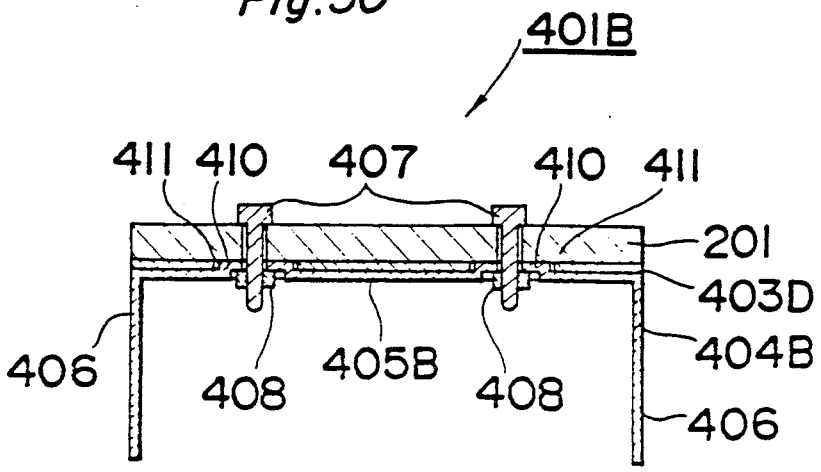
FIG. 30 is a front view of the assembled frame member of FIG. 29.

FIGS. 24 and 25 are respectively perspective dismantled views of the frame member for the refrigerator used in accordance with the first embodiment of the present invention. FIG. 26 is a front view showing the assembling condition of the frame members of the refrigerator door. FIG. 27 is a perspective dismantled view of the frame members for the refrigerator door used in a modified embodiment of the present invention. FIG. 28 is a front face view showing the assembling condition of the frame members. FIG. 29 is a perspective dismantled view showing the upper portion of the frame members of the refrigerator door in accordance with the other modified embodiment of the present invention. FIG. 30 is a sectional view showing the assembling condition in the upper portion of the frame members.

In the present embodiment, the door 1 is constructed to provide a packing 430 for providing a cooling seal between the door 1 and the main body 3 upon fixing the frame member 401 onto the internal plate 420 after the external plate 400 is fitted into the frame member 401, and a foamed thermal insulating material (not shown) is filled into a vacant space formed between the external plate 400 and the frame member 401. The door 1 may be also constructed to provide a packing 430 after a foamed thermal insulating material (not shown) is filled into a vacant space formed among the external plate 400, frame member 401 and internal plate 420.

The frame member 401 is constructed to connect the sashes 402A, 402B together with the sashes 403A, 403B through the re-enforcement angle 404, as shown in FIGS. 25 and 26.

The reinforcing angle 404 is disposed in the horizontal direction and is composed of a flat plate portion 405 which is the same in the longitudinal-direction length as the sashes 403A, 403B and side plate portion 406 formed through the bending operation of both the ends of the flat plate portion 405.

Accordingly, when the frame members 401 of the refrigerator door 1 are assembled, first the sash 403A is disposed on the outer side face of the flat plate portion 405 so that both the ends of the sash 403A may conform in position to the end portions of the flat plate portion 405 of the reinforcing angle 404, with the sash 403A being mutually secured onto the angle 404 with bolts 407 and the nuts 408.

Then, one end portion of the sashes 402A, 402B are disposed on the side plate portion 406 on both the sides of the reinforcing angle 404 so as to be mutually secured. Thus, three sashes 403A, 402A, 402B are integrally secured with the use of one reinforcing angle 404.

Furthermore, the other ends of the sashes 402A, 402B are disposed on the respective side plate portions of the reinforcing angle 404 with the sash 403B being secured on the given position of the flat plate portion 405.

In this manner, opposite two pairs of sashes 402A, 402B, 403A, 403B are integrally secured into the frame member 401 along the outer side shape of the reinforcing angle 404 each having the given size and the given shape.

Accordingly, as it is able to manufacture the door of high rigid structure with excellent precision in dimension in a stable manner by the operation of simple assemblement and adjustment, it is easy to open or close the door smoothly from the left or right side.

The modified embodiment of the present invention will be described hereinafter with reference to FIG. 27 and FIG. 28 about a case where a reinforcing angel 404A is used in one example of the engagement members with the whole being formed into the integral frame shape.

The reinforcing angle 404A is ]-shaped , with all the angles being rectangular, the respective side length of opposite to pairs being equally formed into the given size between the respective upper, lower sashes 403A, 403B and the given size between the respective right, left sashes 402A, 402B.

Two pairs of sashes 402A, 402B, 403A, 403B are integrally secured in the respective given positions or the four sides of the reinforcing angle 404A in order to constitute the frame member 401A of the refrigerator door 1.

Accordingly, the frame member 401A constructed as described hereinabove is made rigider than the frame member 401 disclosed in the previous embodiment with the labor required during the assembling operation being reduced.

Continuously, the other modified embodiment in accordance with the present invention is provided wherein the reinforcing angle 404 in the first embodiment is formed. As shown in, for example, FIG. 29 and FIG. 30, an opening/closing device 201 capable of opening, closing the refrigerator door from the optional right or left side is to be placed on the top face of the ]-shaped reinforcing angle 404B to be placed on the upper side.

The different point between such reinforcing angel 404B as described hereinabove and the reinforcing angle 404 in the first embodiment is that the boss 410 is projected slightly higher upwardly from the top face of the flat plate portion 405D than the width of the sash 403B.

At this time, a hole 411 through which the boss 410 may be inserted is formed in the sash 403D made of composite resin.

In the frame member 401B of such a refrigerator door 1, the sash 403D is placed on the top face of the flat plate portion 405B of the reinforcing angle 404B with the boss 410 being inserted through the hole 411 of the sash 403D. Then the opening/closing device 201 is placed on the top face of the sash 403D so that they are integrally secured with each other.

Furthermore, the sashes 402A, 402B secured with the reinforcing angle 404 on the lower side is additionally provided integrally on the reinforcing angle 404B into the frame member 401B.

Such frame member 401B as constructed as described hereinabove may be made with greater mounting size accuracy for the opening/closing device 409. As the opening/closing device 409 is secured in direct contact against the reinforcing angle 404B, it is possible for the frame member 401B to be made hard to reduce the influences such as deterioration, etc. caused through the dispersion of the molding size of the sash 403B, thermal expansion or thermal contraction.

In the refrigerator door 1 which can be opened, close from the optional right, left side as described hereinabove, it is necessary to form on the end portions of the respective sashes 403A, 403B, 403D the engagement groove 412 into which the hinge pines 2A,2B as the opening, shutting shaft for the door pass.

In the above-disclosed embodiment, three or more sashes are integrally secured with one reinforcing angle in any case. The mutual combination portion among the sashes may be maintained with sufficient strength in spite of the formation of the engagement grooves 412, 413, 414.

As described hereinabove, the present embodiment is a refrigerator door of approximately rectangular shape in front face, wherein the door may be opened, close from the optional right or left side, the frame members are composed of respectively two opposed pairs of sashes, the adjacent sash pair being composed of frame members secured through an engagement member, with three or more sashes being integrally secured with the use of one engagement member. During the assembling operation of a refrigerator door as may be opened or close from the optional right or left side through the simple construction, the frame members superior in size accuracy may be assembled through the simple assembling operation and also, the refrigerator door may have high rigidity and may be stably manufactured. Furthermore, the refrigerator door deformation caused by the dispersion in the size of the sashes, strain or the like may be prevented.

Figure 31:
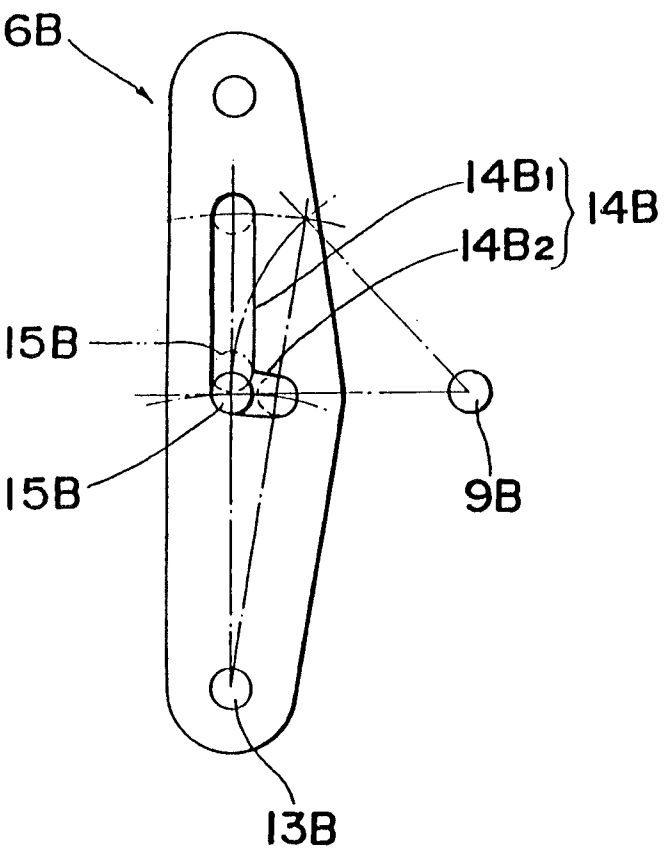
FIG. 31 is an enlarged plane view showing a support shaft having a lock groove employed in the device in accordance with the first embodiment.

FIG. 31 is an enlarged view of a lock groove 14B of the link 6B on the left side in the above-described embodiment. As described hereinabove, in the respective links 6A, 6B the respective lock grooves 14A 14B are formed into an almost "L" shape, with the bending being almost rectangular between the slide guide portions 14A1, 14B1 of the lock grooves 14A, 14B and the stopper portions 14A2, 14B2.

As described hereinabove, in order to smoothly open the door 1 from any right or left direction, the lock pins 15A, 15B of the latch plates 5A, 5B are required to be located in the bent angle portions of the lock grooves 14A, 14B. However, when the assembling accuracy of the door 1 or the main body 3 is worse, the position relation may be twisted in the upper, lower relation of the door 1. In the upper position or the lower position of the door 1, the lock pin 15A is not located in the bent angle portion of the lock groove 14A as shown in the imaginary line of FIG. 31, but is located in the so-called semi-open condition, wherein the lock pin 15A comes into contact with the side wall of the slide guide portion 14A1 even if the door is tried to be opened from the opposite side which would prevent the smooth movement into the stopper portion 14A2 so that the door 1 may not be smoothly opened.

Figure 32:
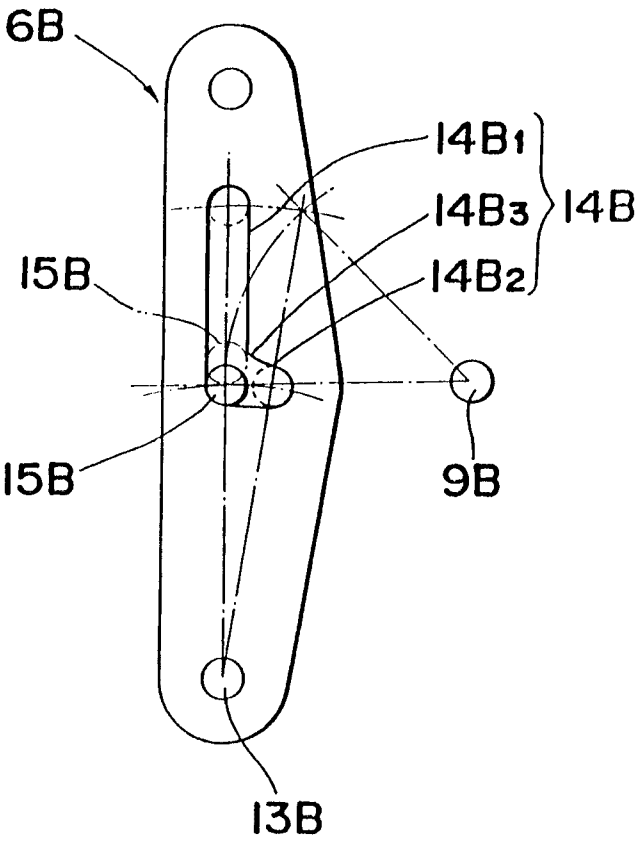
FIG. 32 is a similar view of FIG. 31 showing a modification of the support shaft of FIG. 31.

As shown in FIG. 32, in the modified embodiment of the first embodiment, the inner side portion 14A3 of the bent portion between the slide guide portion 14A1 of the lock groove 14A of the link 6A and the stopper portion 14A2 may be formed into a curved line. In this manner, if the lock pin 15A is not positioned in the bent angle portion of the lock groove 14A, i.e., the door is semi-open as shown in the imaginary line of FIG. 32, the door 1 may be smoothly opened, because the lock pin 15A is guided onto the curved portion 14A3 and is smoothly moved onto the stopper portion 14A2 when the door is tried to be opened from the opposite side. It is to be noted in FIG. 32 that the same thing can be said about the link 6B on the left side through only the link 6A on the right side is shown.

Figure 33:
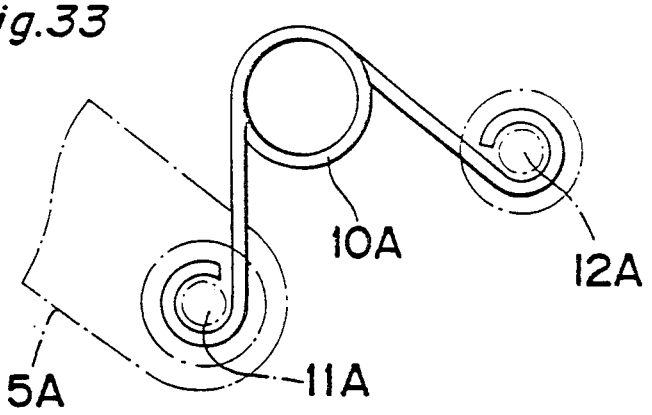
FIG. 33 is an enlarged plane view showing a spring employed in the device in accordance with the first embodiment.

FIG. 33 shows the mounting portion onto the fixing plate 4A of the spring 10B on the right side in the first embodiment or the latch plate 5B, with the same thing being described, also, about the spring 10A on the left side. In the embodiment, the circular portion is to be engaged into the mounting pins 11A, 11B, 12A, 12B of the fixing plate or the latch plates 5A, 5B with the end portions of the springs 10A, 10B being bent circular.

Although the E ring 10 is considered to be engaged into the end portions of the mounting pins 11A, 11B, 12A, 12B with the springs 10A, 10B being engaged therewith so that the springs 10A, 10B mounted in this manner may not be easily disengaged from the mounting pins 11A, 11B, 12A, 12B, the E ring may be disengaged while the door opening, shutting operations are repeated, because the E ring is not too strong with respect to the load in the thrust direction. It is considered that the springs 10A, 10B are inserted into the mounting holes of the fixing plate 4A or the latch plates 5A, 5B and are caulked from the reverse face after the springs 10A, 10B have been engaged with the gib-heated mounting pins with the mounting pins 11A, 11B, 12A, 12B being the gib-heated pins.

The springs 10A, 10B rotate in the mounting portion for each rotation of the latch plates 5A, 5B in the opening, shutting operations of the door 1. Also, the spreading force is always applied upon the springs 10A, 10B. Furthermore, the circular springs 10A, 10B and the mounting pins 11A, 11B, 12A, 12B are in point contact against one another, as they are likely to wear out because of the concentration load, so that the mounting portions of the springs 10A, 10B are likely to break.

Figure 34:
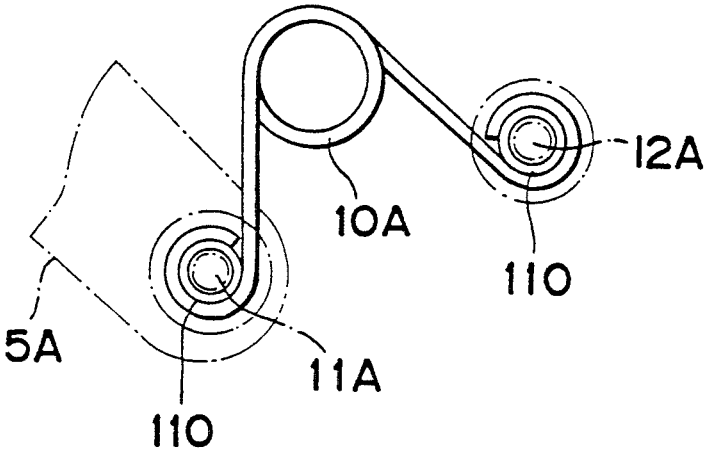
FIG. 34 is a similar view of FIG. 33 showing a modification of the spring of FIG. 33.
Figure 35:
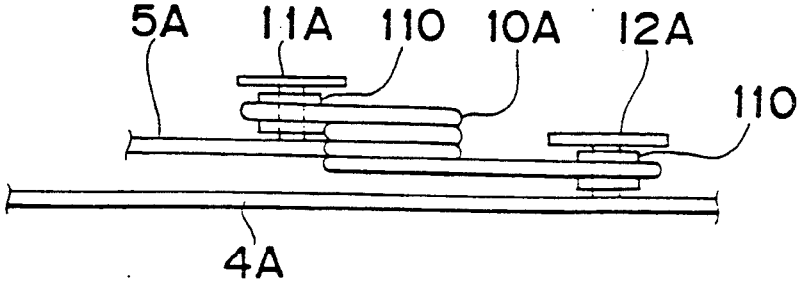
FIG. 35 is a front elevational view of the spring in FIG. 34.

As shown in the plan view of FIG. 34 and the front face view of FIG. 35, in another modified embodiment of the first embodiment, the end portions of the springs 10A, 10B may be wound on the bushings 110 and mounted on the mounting pins 11A, 11B, 12A, 12B. The outer diameter of the cylindrical bushings 110 may be selected somewhat larger than the circular inner diameter of the end portions of the springs 10A, 10B so that the springs 10A, 10B tighten the bushings 110 to secure the springs 10A, 10B. In this manner, the contact area against the mounting pins 11A, 11B, 12A, 12B becomes larger enough to prevent the abrasion and also, the springs 10A, 10B themselves do not wear out so that the springs 10A, 10B are not broken.

Also, the number of the windings onto the bushings 110 of the springs 10A, 10B may be made two or more times or more so that the springs 10A, 10B may be mounted more stably. In this example, the mounting pins 11A, 11B, 12A, 12B are to be gib-headed pins. It is to be noted that in FIG. 34 and FIG. 35, only the spring 10A on the right side is shown, with the spring 10B on the left side being the same.

Figure 36:
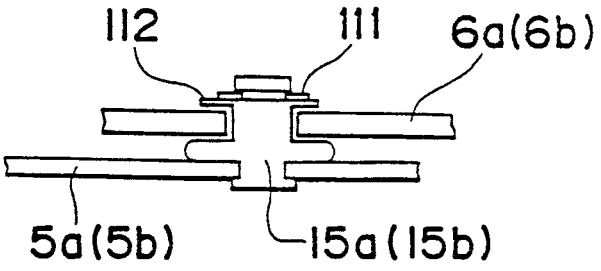
FIG. 36 is an enlarged cross-sectional view showing a lock pin employed in the device in accordance with the first embodiment.
Figure 37:
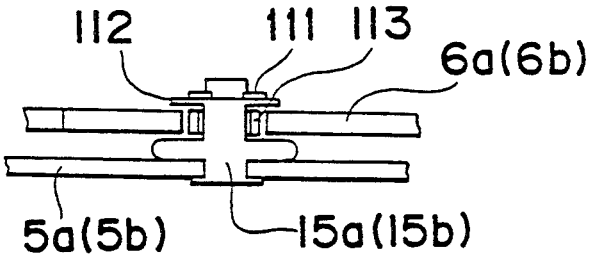
FIGS. 37 to 39 are respectively similar views of FIG. 36 each showing a modification of the lock pin of FIG. 36.
Figure 38:
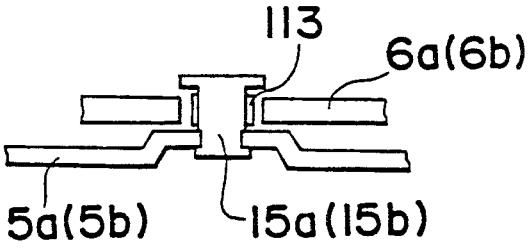
Figure 39:
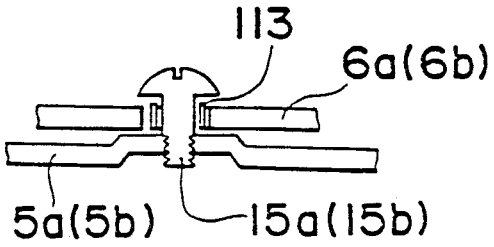

FIG. 36 is an enlarged sectional view of the mounting portion of the lock pins 15A, 15B in the first embodiment. In this FIG. 36, numeral 111 is a retaining ring for preventing detachment of washer 112. During the opening, shutting operation of the door, the lock pins 15A, 15B slide in the lock grooves 14A, 14B of the links 6A, 6B, so that the lock pins 15A, 15B may break due to the abrasion thereof. As shown in FIG. 37, in the modified example of the first embodiment, a rotatable cylindrical sleeve 113 may be loosely engaged with the lock pins 15A, 15B. During the opening, shutting operation of the door, the sleeve 113 rotates to prevent the lock pins 15A, 15B from being worn out. It is to be noted that as shown in FIG. 38, the lock pins 15A, 15B may be used as gib-headed mounting pins, or screws may be used as shown in FIG. 39. In this case, the retaining ring 111 and the washer 112 may be omitted.

In the first embodiment, hinge pins 2A, 2B provided on the side of the main body 3, a fixing plate 4, etc. are provided on the side of the door 1.

The hinge pins 2A, 2B are normally secured through the pressure insertion or the like into the hinge plates 102A, 102B fixed on the main body 3 in such a shape that a round rod member is cut at a right angle in the axial direction thereof by the given length. Accordingly, as shown in FIG. 1, when the door has been opened, the cut faces of the hinge pins 2A, 2B are exposed. It is dangerous when the user collides with the hinge pins 2A, 2B by mistake.

Figure 40:
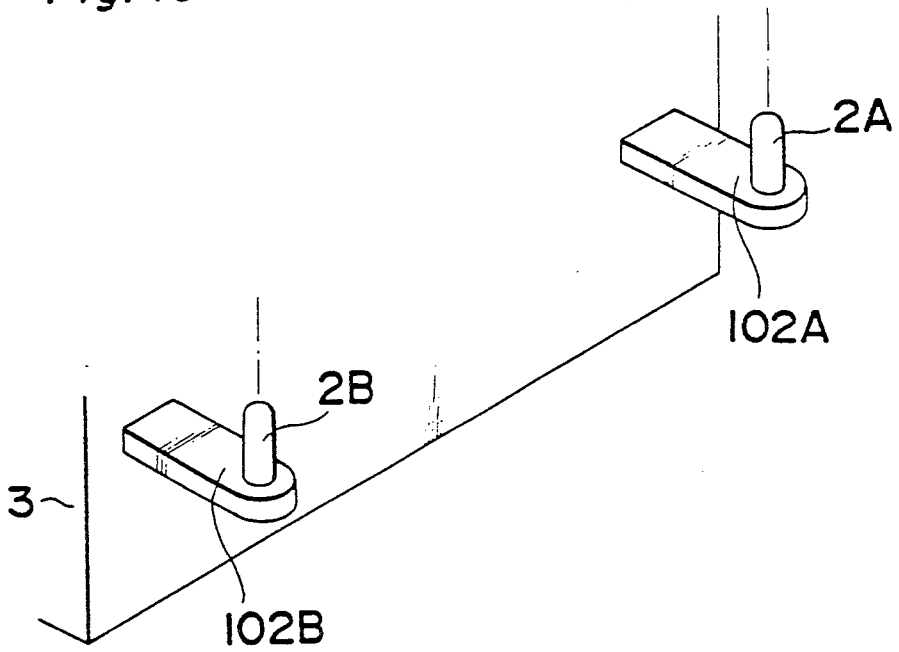
FIG. 40 is a perspective view showing a hinge pin employed in the device in accordance with the first embodiment.
Figure 41:
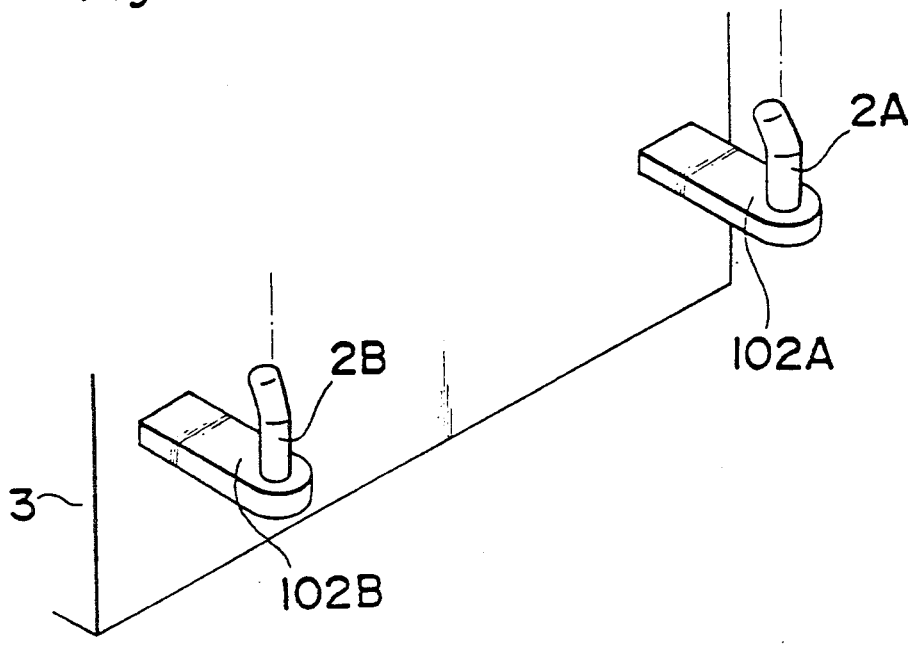
FIGS. 41 and 42 are respectively similar views of FIG. 40 each showing a modification of the hinge pin of FIG. 40.

In the modified example of the embodiment, as shown in FIG. 40, the tip end portion of the hinge pins 2A, 2B may be formed semi-spherical. Or as shown in FIG. 41, the hinge pin may be somewhat bent on the side of the main body 3.

Figure 42:
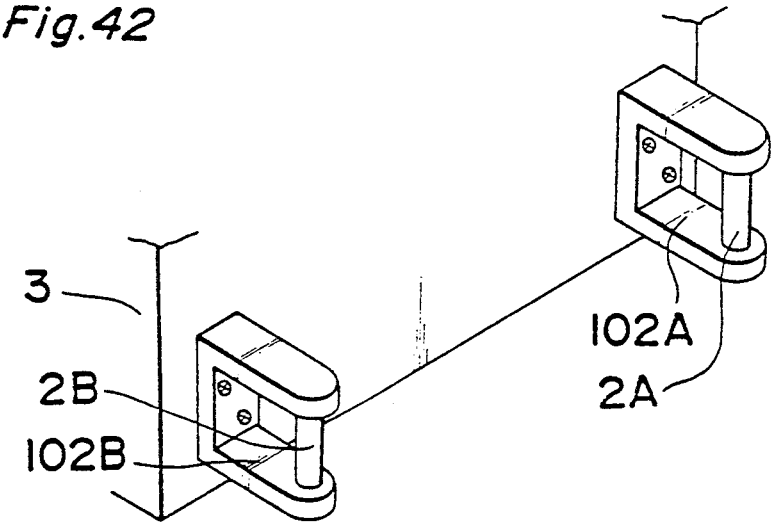
Figure 43:
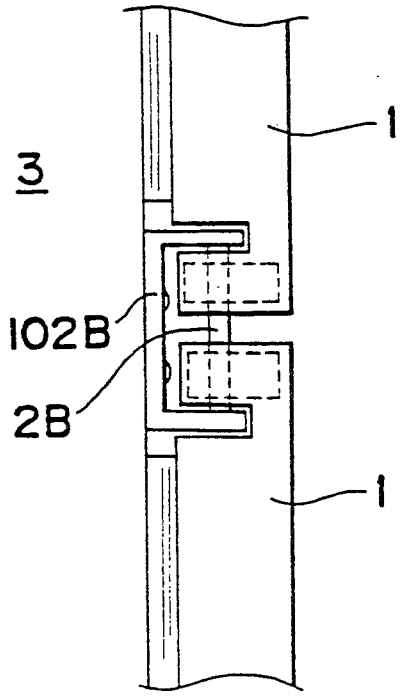
FIG. 43 is a cross-sectional view showing the hinge pin of FIG. 42.

In other words, it may be constructed as shown in FIGS. 42 and 43.

Conventionally the hinge pins 2B support only the one end thereof on the hinge plates, but in the embodiment, in order to improve the strength of the hinge portion, the shape of the hinge plate 2A is formed into a ]-shape so as to support the strength of the hinge 4A portion. The hinge plates 102A,103B are manufactured by the steel-plate bending, die casting or the like.

In this manner, the hinge plate 102B is shaped to support both the upper, lower end portions of the hinge pins 2A to improve the strength of the hinge portion as compared with the conventional example for reduction of the displacement of the hinge portion caused by the door load, thus making it possible to open or close the door smoothly. In the present embodiment, both the end portions of the hinge pin 2A are supported by the hinge plate 102B so as not to expose the cut face, thus improving the safety.

Figure 44:
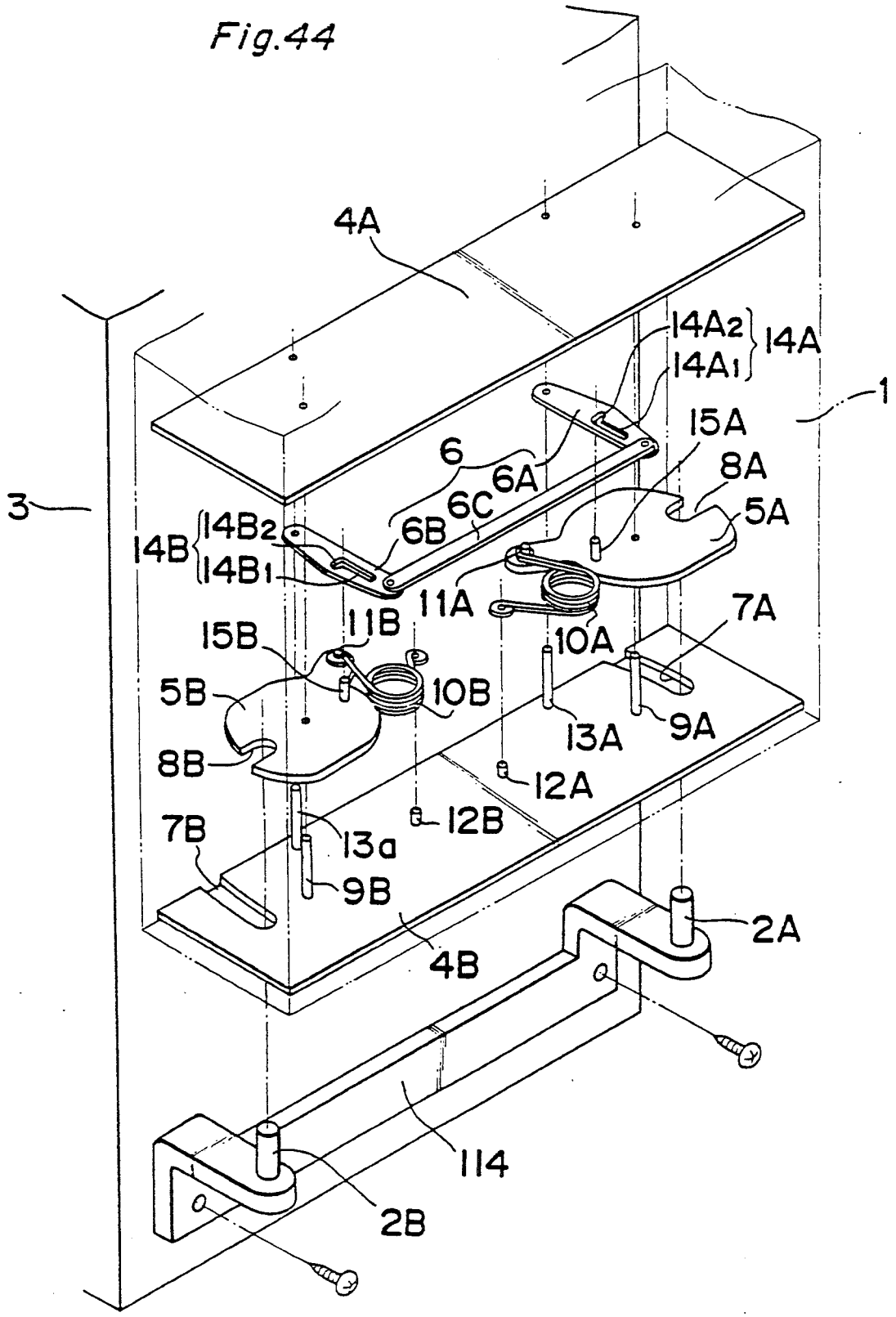
FIG. 44 is an exploded view of a door member showing a modification of the device with respect to the first embodiment.
Figure 56:
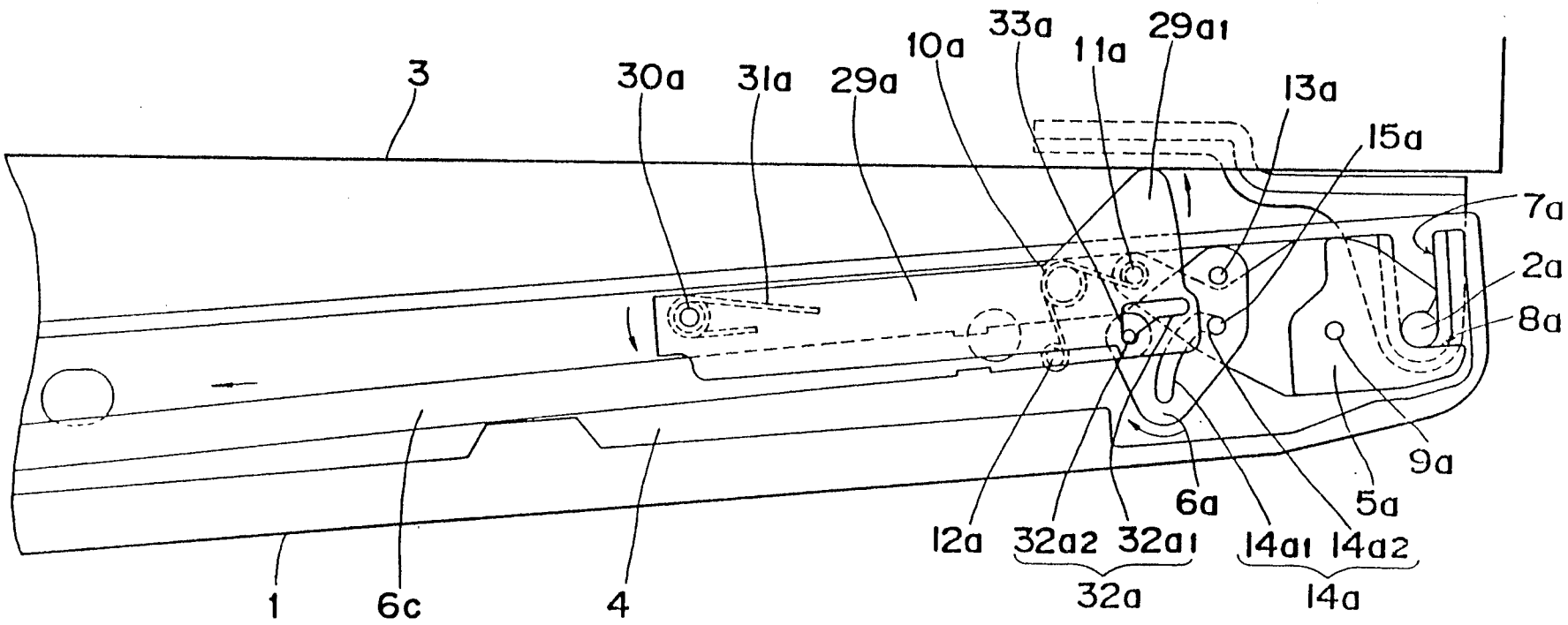
FIG. 56 is an enlarged view of the right part of FIG. 52.

The embodiment shown in FIG. 44, which is a dismantled perspective view of a door, and FIG. 56, which is a plan view of the door is a modified example of the first embodiment, wherein the same reference characters are given to the elements corresponding to those of the first embodiment.

Although the right, left hinge pins 2A, 2B are mounted respectively on the side of the main body 3, as shown in the embodiment, with the individual hinge plates 102A, 102B, it is extremely bothersome to have the interval between the hinge pins 2A, 2B within the given size tolerance (for example, ±0.2 mm) in a construction, wherein the hinge pin is individually mounted right, left as described hereinabove. In the embodiment, a hinge plate 114 with right, left hinge pins 2A, 2B mounted thereon is composed of one piece by sheet metal processing, or the like.

Figure 45:
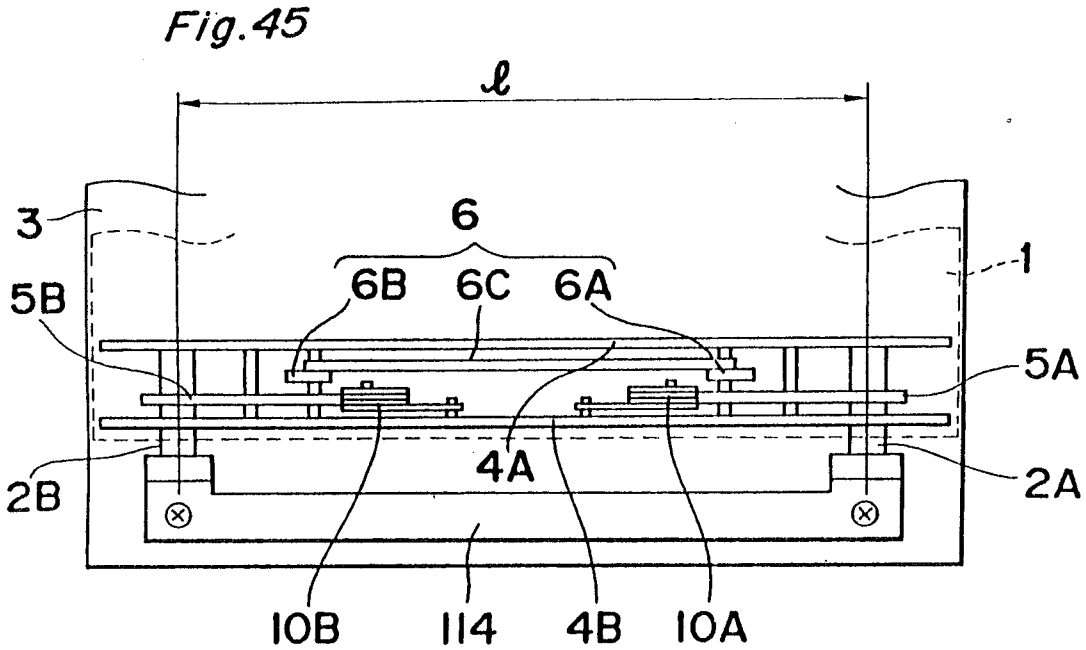
FIG. 45 is a front elevational view of the door member of FIG. 44.

The hinge plate 114 with right, left hinge pins 2A, 2B being mounted in this manner is made as a one piece member so that as shown in FIG. 45, it is possible to easily set at the given size the interval l between the hinge pins 2A and 2B. As the other construction and the operation are the same as those of the first embodiment, the description will be omitted.

Figure 46:
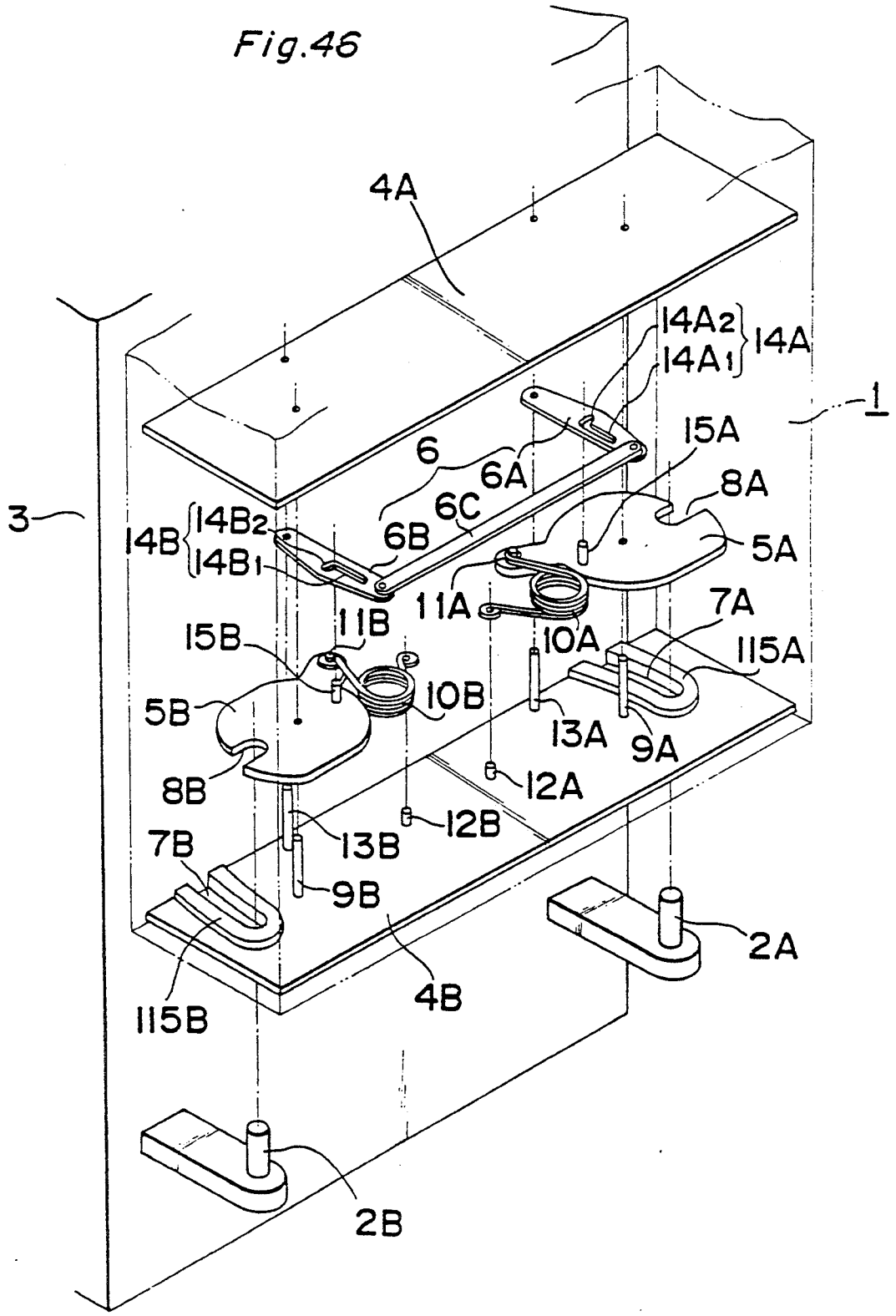
FIG. 46 is a similar view of FIG. 44 showing another modification of the device with respect to the first embodiment.

FIG. 46 is a perspective dismantled view of a door showing a modified example of the first embodiment, wherein the same reference characters are given to elements corresponding to those of the first embodiment.

Normally, the hinge pins 2A, 2B and the fixing plate 4B are metallic. During the opening, closing of the door 1, the hinge pins 2A, 2B collide against the recesses of the engagement grooves 7A, 7B of the fixing plate to causeing noises. In order to reduce the noises caused by the collision, it is considered that both the hinge pins 2A, 2B and the fixing plate are made of resin. However, the strength may be insufficient to support the door load when the hinge pins 2A, 2B are made of resin. Also, when the fixing plate 4B is made of resin, it is hard to have the size accuracy because of the contraction during the molding operation, thus resulting in pitch disarrangement between the right, left hinge pins 2A, 2B and the disengagement grooves 7A, 7B, so that the door 1 may not be opened or shut smoothly.

Figure 47:
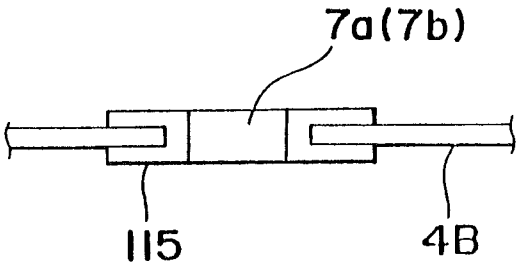
FIG. 47 is a cross-sectional view showing an engagement groove employed in the device of FIG. 46.

Thus, in the embodiment, the hinge pins 2A, 2B and the fixing plate 4B are made of metal, with resin-made buffer members 115A,115B being additionally provided as shown in FIG. 47, on the portion of the engagement grooves 7A, 7B of the fixing plate 4. It is desired to use as a buffer member 115 the resin superior in abrasion resisting property such as polyamide resin, polyacetal resin or the like.

Also, the buffer member 115 molded specially may be engaged into the engagement grooves 7A, 7B of the fixing plate 4B or resin may be inserted into the engagement grooves 7A, 7B of the fixing plate 4B for a forming operation.

In this manner, the hinge pins 2A, 2B and the fixing plate 4B are made of metal, the buffer members 115A,115B are provided into the engagement grooves 7A, 7B of the fixing plate 4B so that the noises may be reduced during the opening and shutting operations of the door without a lass in strength and size accuracy. As the other construction and the operation is the same as those of the first embodiment, the description will be omitted.

Figure 48:
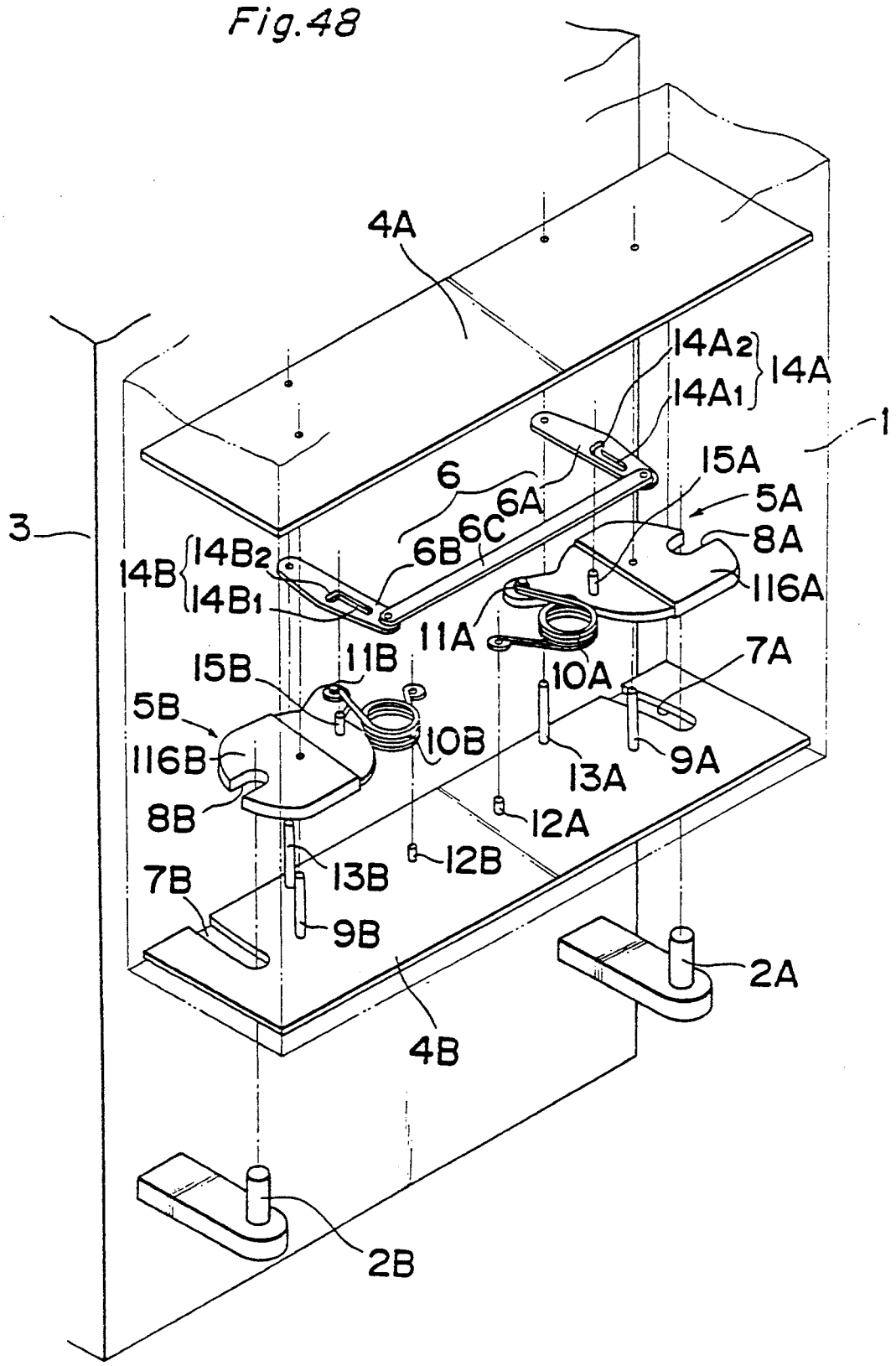
FIGS. 48 and 49 are respectively similar views of FIG. 44 each showing other modification of the device with respect to the first embodiment.

FIG. 48 is a perspective dismantled view of a door showing another modified example of the first embodiment, wherein the same reference characters are given to the elements corresponding to those of the first embodiment.

When the hinge pins 2A, 2B and the latch plates 5A, 5B are made of metal, the hinge pins 2A, 2B collide against the latch grooves 8A, 8B of the latch plates 5A, 5B during the opening, closing operations of the door 1 so as to cause noises. Also, the hinge pins 2A, 2B and the latch plates 5A, 5B wear out to form the metallic powder. In order to reduce the noises caused by the collision and to prevent the latch plates 5A, 5B from wearing out, in the eleventh embodiment, the hinge pins 2A, 2B are made of metal and the latch grooves 8A, 8B portions of the latch plates 5A, 5B are made of resin.

Namely, in the embodiment, the projected portions of the lock pins 15A, 15B further the pivotal portions of the springs 10A, 10B from the rotary shafts 9A, 9B of the latch plates 5A, 5B are made of metallic plate, with the latch grooves 8A, 8B from the rotary shaft portions 9A, 9B being made of resin 116A,116B. In this embodiment, the forming operation is effected by the so-called insertion molding of inserting the metallic plate into the resin 116A,116B. In this manner, the strength of the projection portions of the lock pins 15A, 15B may be retained, and also the pivotal portions of the springs 10A, 10B may be prevented from being deflected by the force of the springs 10A, 10B for the position urging application of the latch plates 5A, 5B. The resin superior in strength and abrasion resisting property such as polyacetal resin or the like is desirable as the resin 116A,116B to be used in the latch grooves 8A, 8B.

When the portions of the latch grooves 8A, 8B are made of resin in this manner, it is possible to reduce the noises in the opening, closing operation of the door and furthermore, the metallic powder is not caused through the abrasion of the hinge pins 2A, 2B and the latch plate 5A, 5B.

When excessive strength is not required in the projected portions of the lock pins 15A, 15B and the pivotal portions of the springs 10A, 10B, the whole latch plates 5A, 5B may be made of resin. As the other construction, the operation is the same as that of the first embodiment, and the description thereof will be abbreviated.

Figure 49:
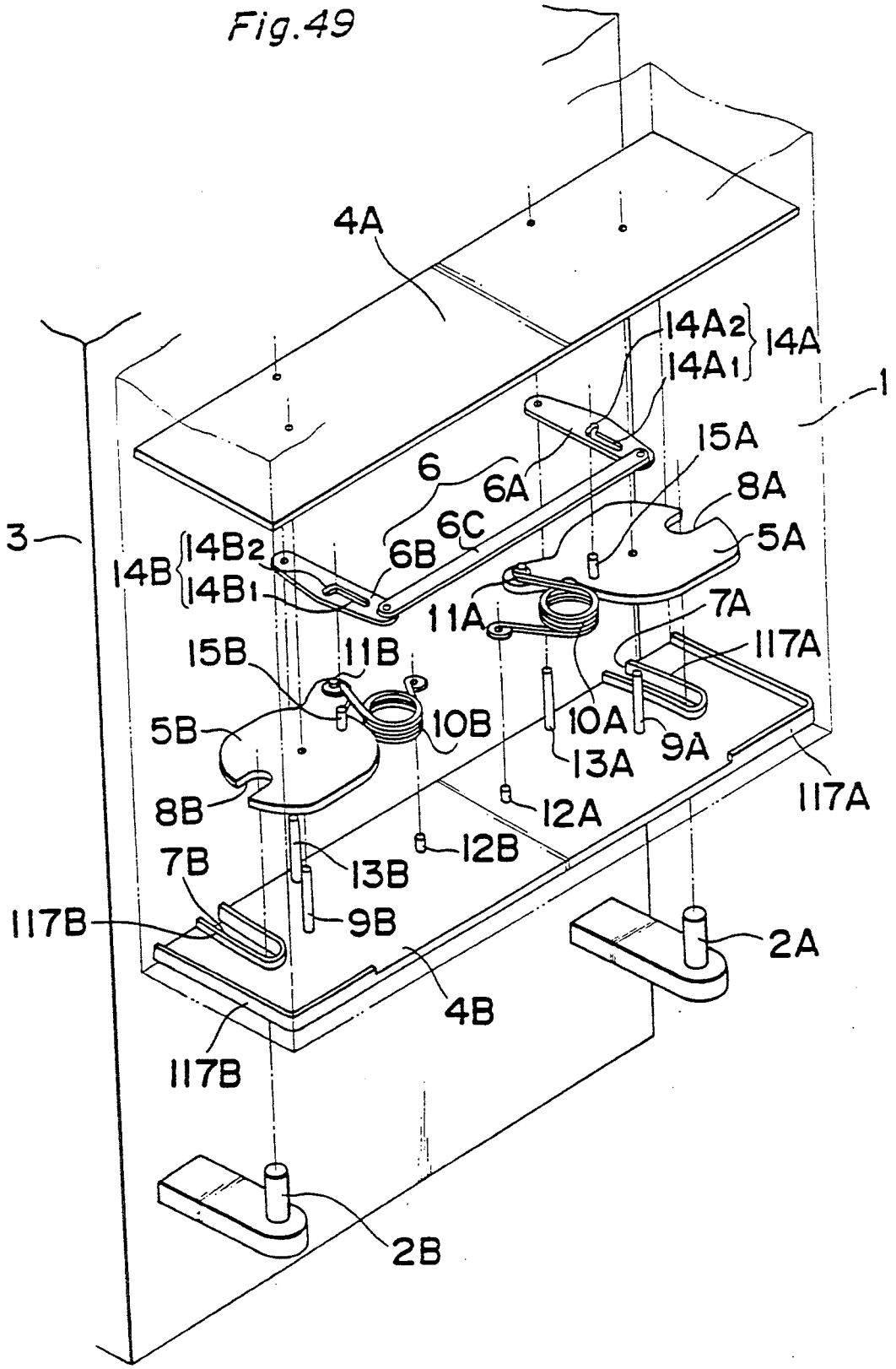

FIG. 49 is a perspective dismantled view of a door showing a further modified example of the first embodiment, wherein the same reference characters are given to the elements corresponding to those of the first embodiment.

In order to engage the hinge pins 2A, 2B by the engagement grooves 7A, 7B of the fixing plate 4B and the latch grooves 8A, 8B of the latch plates 5A, 5B as described hereinabove in the opening, closing apparatus of the door of the present invention, the force of stretching the engagement grooves 7A, 7B is applied upon the engagement grooves 7A, 7A of the fixing plate 4B opposite to the side of the opening by the self-weight, etc. of the door 1 when the door is opened. Also, in order to prevent the door 1 from hitting the main body 3 when the door 1 is opened, the positions of the right, left hinge pins 2A, 2B are required to be located near both the right, left end portions as much as possible, with the size between the respective engagement grooves 7A, 7B of the fixing plate 4B and the right, left end portions becoming smaller, thus resulting in concentrated stress upon the portion. When the large load is applied upon the door 1, the engagement grooves 7A, 7B are deformed to widen the grooves, so that the hinge pins 2A, 2B may be disengaged from the latch grooves 8A, 8B of the latch plates 5A, 5B when opening, shutting operation of the door 1 is not smoothly effected.

In the embodiment, the peripheral portion of the engagement grooves 7A, 7B of the fixing plate 4B and right, left outer peripheral portions of the fixing plate 4B are bent. This bent portion 117A,117B improves the strength through the larger sectional factors, preventing the engagement grooves 7A, 7B of the fixing plate 4B and the end portion of the fixing plate 4B from being easily deformed even if the load is applied upon the door 1 during the opening operation of the door 1.

Figure 50:
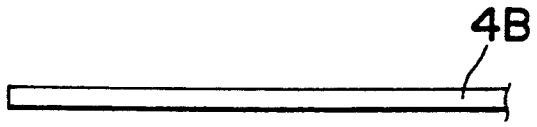
FIG. 50(A) to FIG. 50(C), are schematic, cross sectional views showing a fixing plate employed in the device of FIG. 49 for the purpose of showing processes of manufacturing the fixing plate.
Figure 50:
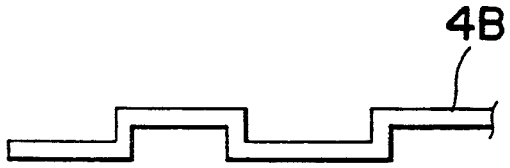
Figure 50:
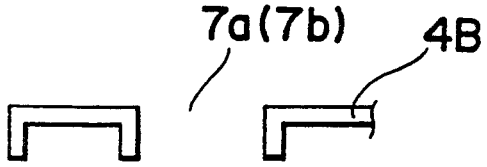

The bent portion 117A,117B of the fixing plate 4B is formed as follows. Namely, as shown in FIG. 50, the portion corresponding to the outer peripheral portion of the peripheral portion of the engagement grooves 7A, 7B and the outer peripheral portion of the fixing plate 4B are press-molded into the stairs shape and thereafter, the groove portion and the outer edge portion are struck so as to form the bent portion 117A,117B, which is accurate in size, without the deformation of the groove portion. As the other construction and operation is the same as those of the first embodiment, the description will be omitted.

Figure 51:
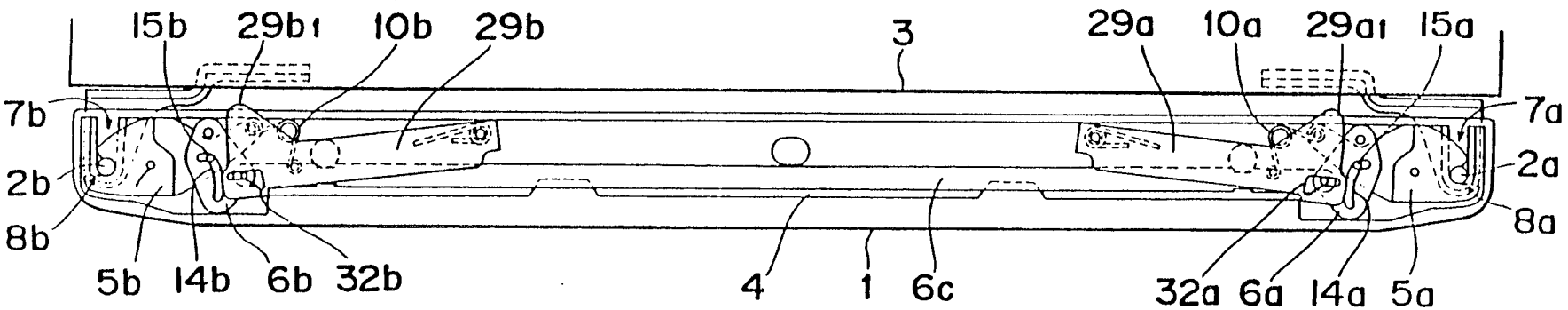
FIG. 51 is a plane view of the device, when the door member is kept closed, in a modification of the first embodiment.
Figure 52:
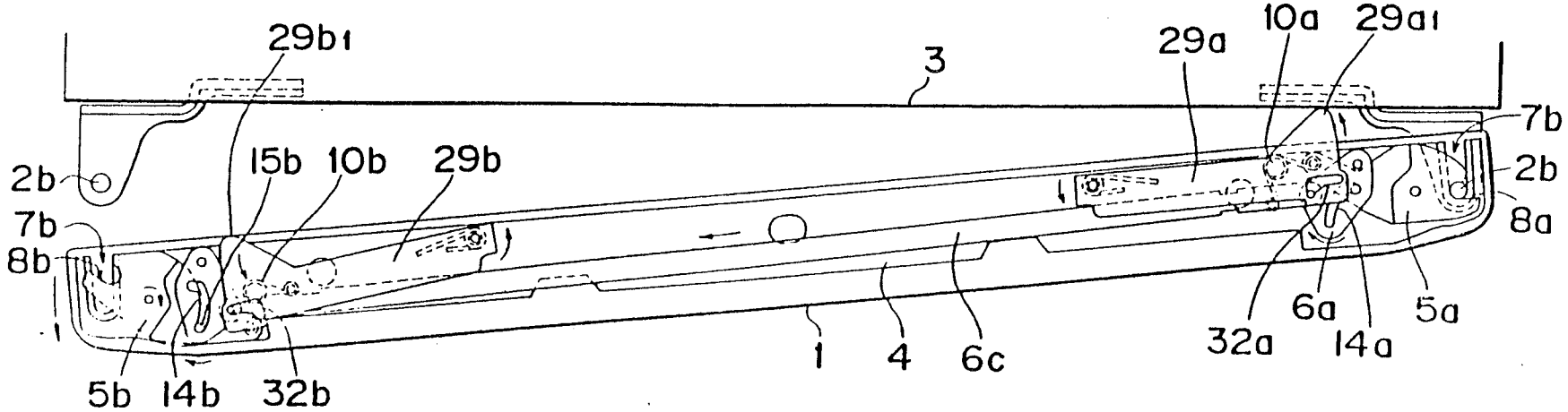
FIG. 52 is a similar view of FIG. 51 showing the device when the door member is kept opened.

FIG. 51 is a plane view of the opening/closing device for use in a refrigerator when the door is kept closed as still another example of the first embodiment. FIG. 52 is a plan view of the device when the door is kept open.

Figure 53:
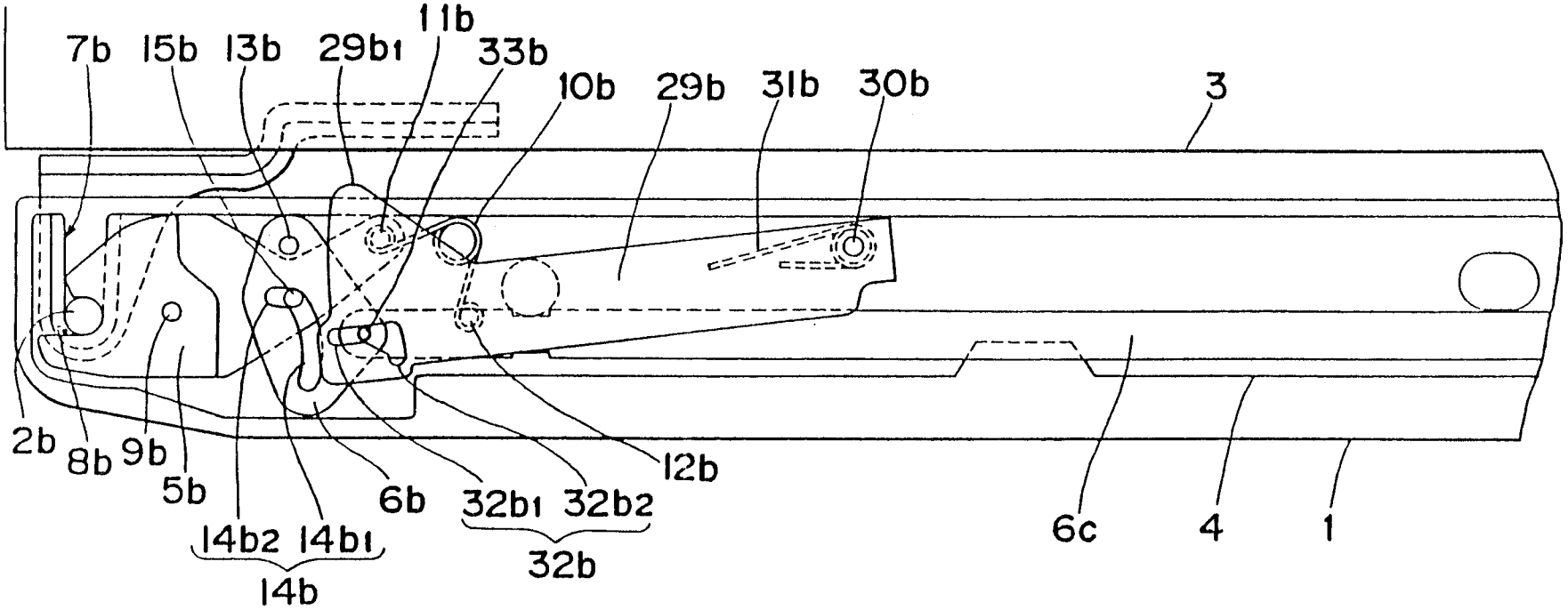
FIG. 53 is an enlarged view of the left part of FIG. 51.
Figure 54:
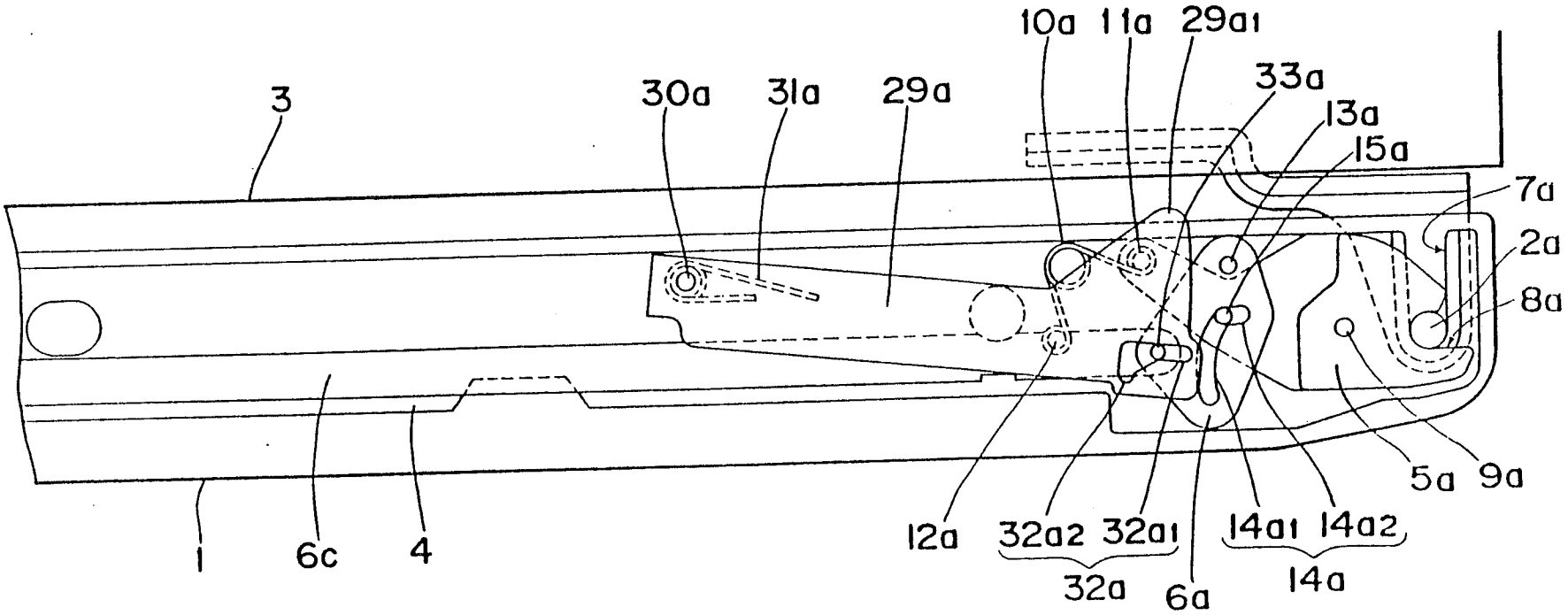
FIG. 54 is an enlarged view of the right part of FIG. 51.
Figure 55:
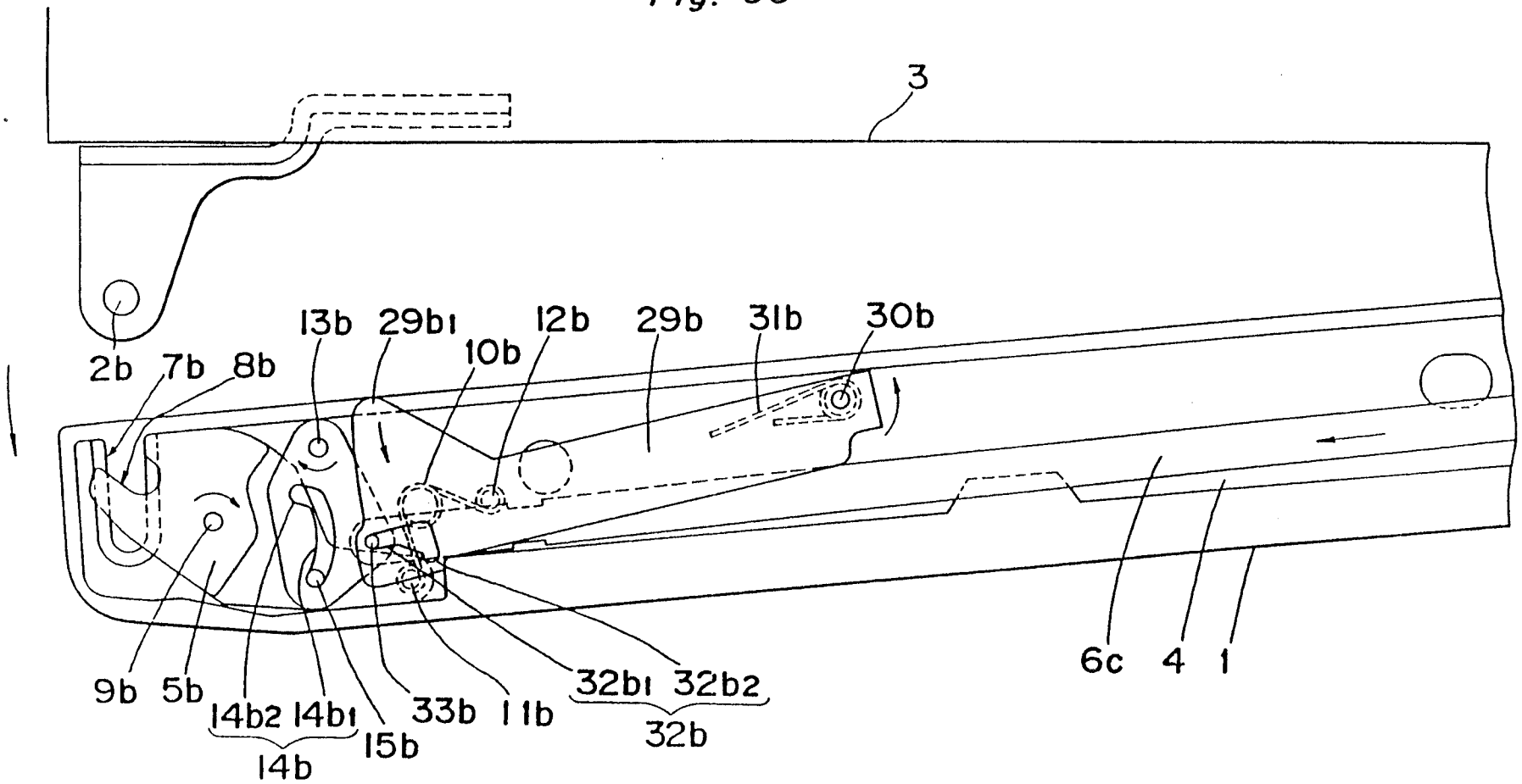
FIG. 55 is an enlarged view of the left part of FIG. 52.
Figure 57:
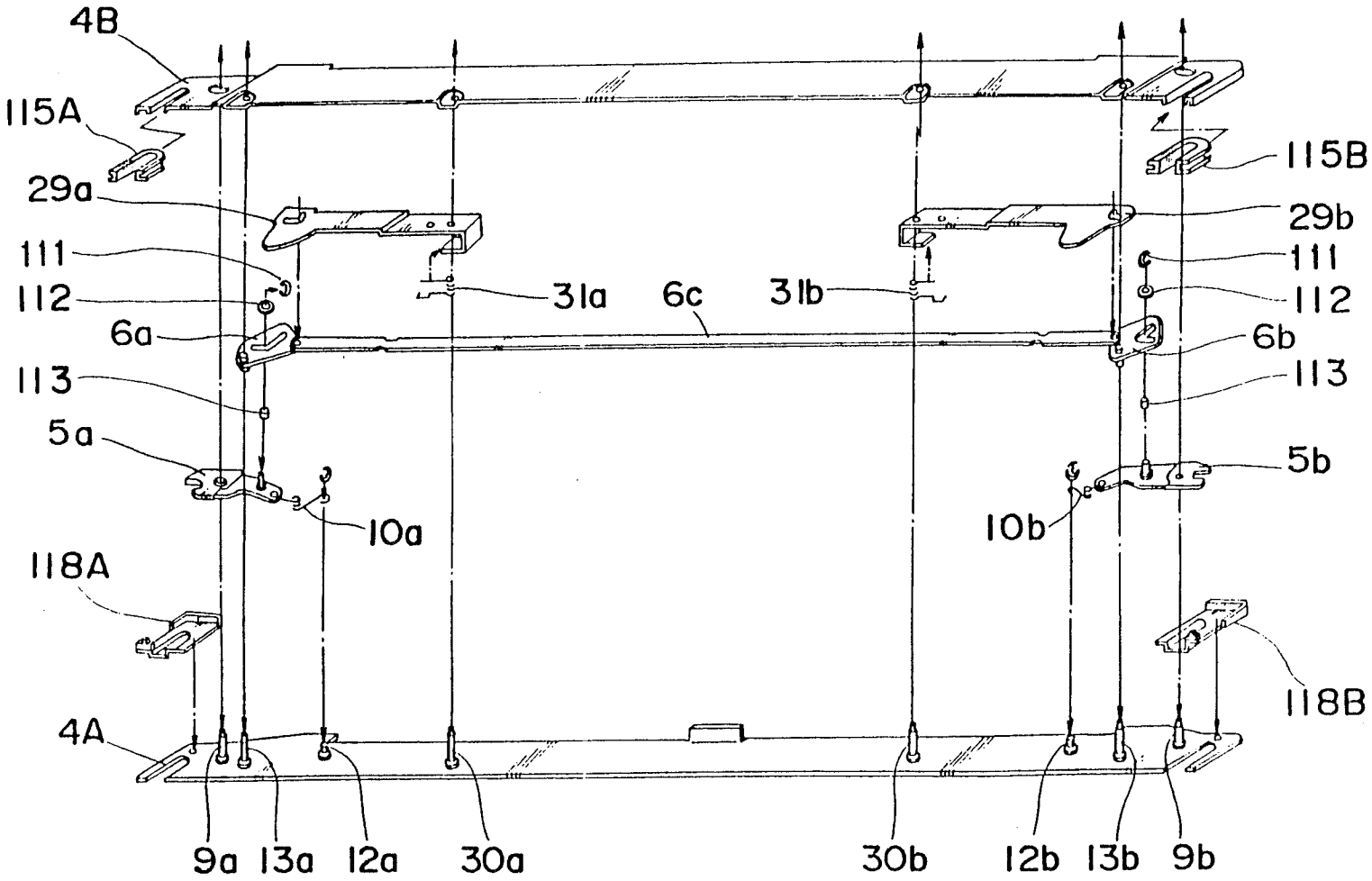
FIG. 57 is an exploded perspective view of FIG. 51.

FIGS. 53 to 56 are enlarged views of the essential portion of the device shown in FIGS. 51 and 52. Specifically, FIG. 53 is an enlarged view of the left part of FIG. 51, FIG. 54 is an enlarged view of the right part of FIG. 51, FIG. 55 is an enlarged view of the left part of FIG. 52, and FIG. 56 is an enlarged view of the right part of FIG. 52. FIG. 57 is an exploded perspective view of FIG. 51.

The links 6A and 6B are pivotally coupled to the coupling link 6C not at the end portions thereof, but in the middle or intermediate portions and moreover at the end portions close to the respective opposite links.

Moreover, the slide guide portions of the lock grooves 14A and 14B are not straight but curved to be convex in the central direction of the fixed plate 4. In order to avoid an erroneous operation of the latch plates 5A and 5B when the door is opened, safety plates 29A and 29B are added.

Further, the links 6A and 6B are pivotally fixed to he coupling link 6C not at the ends thereof, but in the middle of the links and at the end portions near the opposite links is because of the structural restriction when the fixed plate is mounted in the door Since the slide guide portions of the lock grooves 14A and 14B are curved so as to make small the crossing angles of the slide guide portions and the stopper potions, the possibilities that the door 1 is loosened to come frontwards, that is, the loose-state of the door caused by the play between the lock grooves and the lock pins can be reduced, when the door is pulled simultaneously from the right and left sides thereof to be opened.

According to the above-described embodiment, if the latch plate 5A or 5B at the opening side of the door is rotated in the direction reverse to the restriction-releasing direction, the door 1 can be removed. However, if the operation is miscellaneously effected, namely, without the intention to remove the door, or if a child pulls on the door, the door may undesirably drop off. Therefore, in the case where the door is actually desired to be opened, the safety means should be actuated before the latch plate 5A or 5B is rotated. Unless the safety means is operated, the door cannot be removed. Each of the two safety means provided in the vicinity of the latch plate 5A or 5B at the opposite side of the opening side is comprised of a safety plate 29A or 29B projecting to the side of the main body 3 from the door, and a spring 31a or 31B for urging the safety plate to be projected to the side of the main body, so that the movement of the coupling means between the latch plates may be controlled by a safety groove 32A (32A1, 32A2) or 32B (32B1 and 32B2) formed in a crooked shape in the safety plate and, a safety pin 33A or 33B of the link 6A or 6B.

Yet another modified embodiment of the present invention which is a modified example of the foregoing embodiment is shown in FIGS. 136 to 139, wherein the corresponding parts are designated by the same reference numerals as in the first embodiment. FIG. 136 is a plane view of the device when the door is kept closed. FIG. 137 is a plane view of the device when the door is kept opened. FIG. 138 is a front elevational view of the device, and FIG. 139 is an exploded perspective view of the device according to the embodiment.

According to the embodiment, the safety plates 29A and 29B are rotatably and pivotally fixed to the fixed plate 4 in the vicinity of the respective latch plates and, urged by the corresponding springs 31A and 31B so as to be projected towards the main body. The safety grooves 32A and 32B are comprised of stopper portions 32A2 and 32B2 centering the pivotal shafts 30A and 30B of the safety plates and slide guide portions 32A1 and 32B1 extending to the right and left sides of the safety plates from the ends of the stopper portions, respectively. Each of the safety pins 33A and 33B is projected in the link 6A or 6B corresponding to the respective safety groove, which serve also as a pivotal shaft of the link 6A or 6B, and the coupling link 6C. However, the pivotal shafts may be separately provided.

When the door 1 is kept closed, the safety pins 33A and 33B are in the slide guide portions 32A1 and 32B1. By opening the door 1, the latch plate 5A or 5B at the opening side is rotated and the safety pin 33A or 33B is slid in the slide guide portion. The safety pin 33B or 33A in the link opposite to the opening side which is coupled by the coupling link 6C is brought to the bent-corner of the safety groove, and accordingly the safety plate 29B or 29A is rotated by the springs 10A,10B to be projected to the side of the main body. At the same time, the safety pin 33B or 33A is fitted into the stopper portion 32B2 or 32A2, thus restricting the coupling means 6 from being oscillated. Accordingly, the latch plate at the opening side of the door 1 while the door 1 is kept opened cannot be rotated. When the door 1 is being closed, a touch portion 29A1 or 29B1 of the safety plates 29A or 29B strikes the main body 3 which is then pressed back into the door 1. Consequently, the safety pin 33B or 33A is returned back to the bent corner of the safety groove. Accordingly, the coupling link 6C becomes oscillatable again, and the latch plate 5A or 5B is rotated to meet the hinge pin.

Since it is necessary only to release the restriction of the safety pin 33A or 33B inside the bent corner between the stopper portion and the slide guide portion slightly before the door is completely closed, it is preferable to form some notch or clearance in the safety grooves. Since the safety means is actuated in the vicinity of the latch plate at the side opposite to the opening side, and separated from each other, the safety means may be touched simultaneously with considerably reduced possibilities, thereby eliminating the danger that the door is inadvertently removed. In addition, when the door is kept opened, the right and left plates are always fixedly secured. Therefore, the latch plates can be prevented from being unexpectedly rotated by the vibrations when the door is opened/closed, or by some other reasons, so that the door can be opened/closed positively.

2) Second Embodiment

Figure 58:
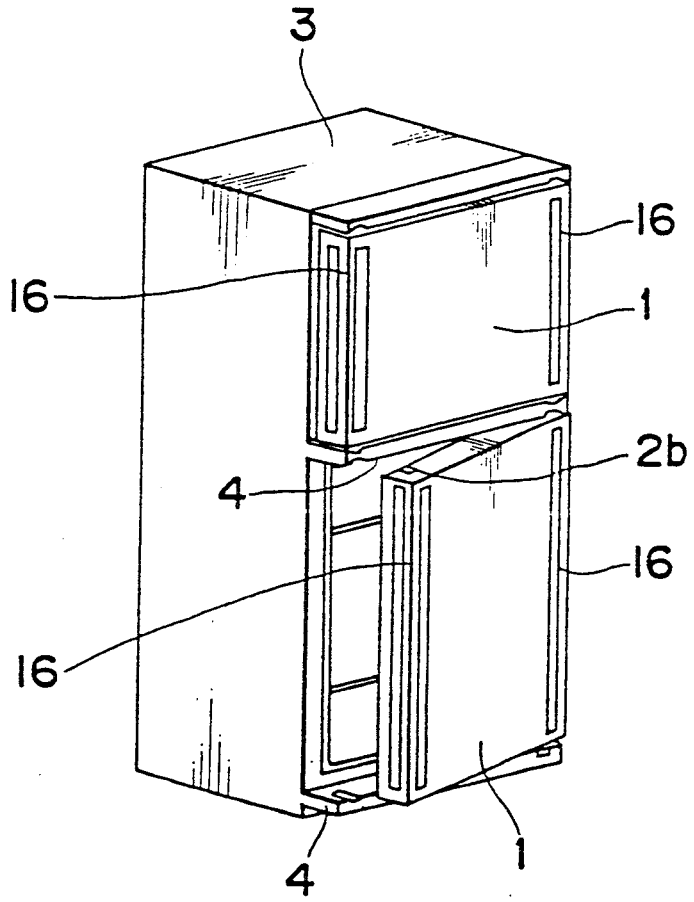
FIGS. 58 to 62 relate to an opening/closing device of a door member according to a second embodiment of the present invention.

FIGS. 58 to 63 show an opening/closing device of a door of a refrigerator according to the second embodiment of the present invention. FIG. 58 is a perspective view of an outer appearance of a refrigerator which is provided with the opening/closing device.

Figure 59:
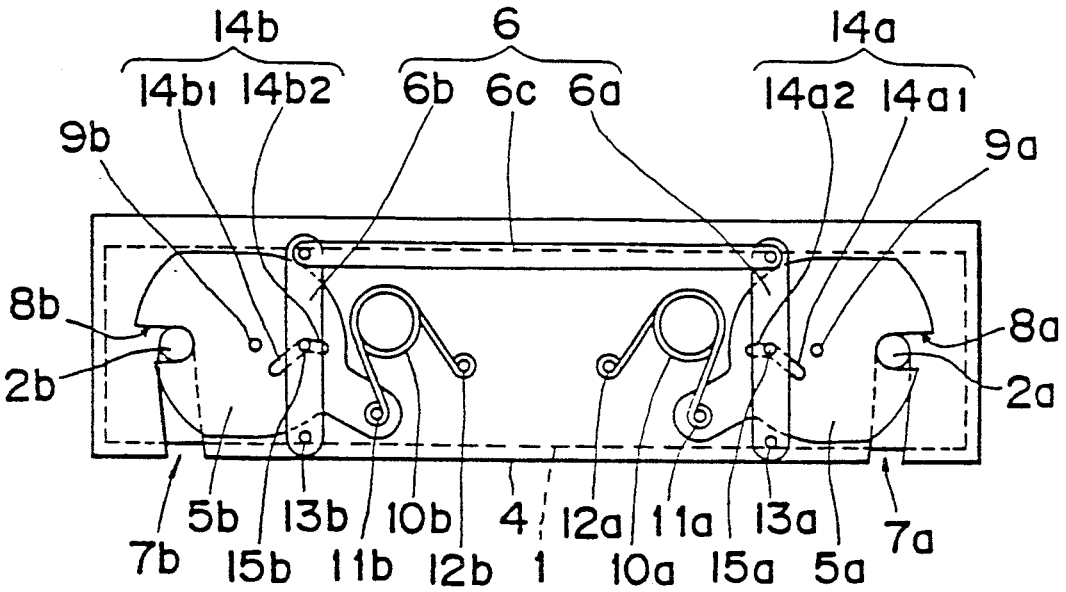
Figure 60:
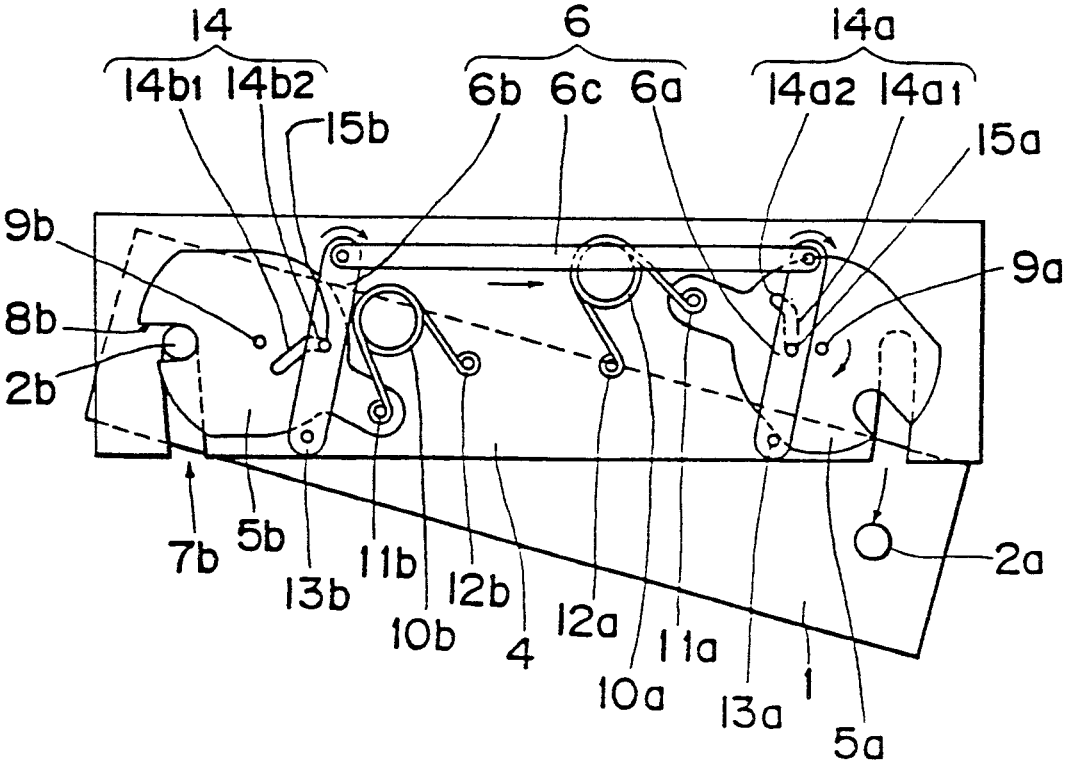
Figure 61:
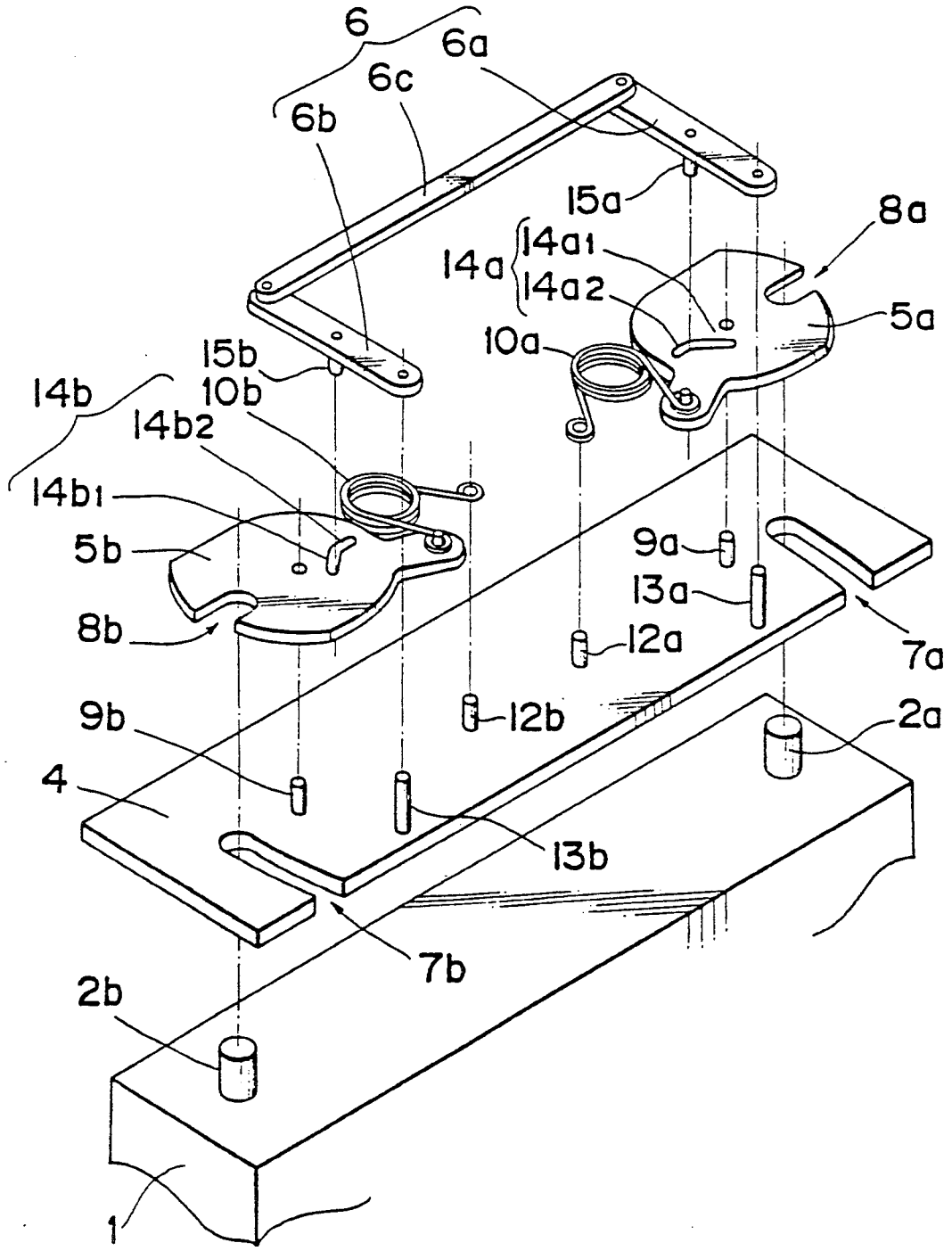

FIG. 59 is a plane view showing the state when the door is kept closed, FIG. 60 is a plane view showing the state when the door is kept opened, and FIG. 61 is an exploded perspective view of FIG. 59.

As seen from these FIGS. 58 to 63, the opening/closing device according to the second embodiment has a pair of right and left hinge pins 2A and 2B protruding at the right and left opposite portions of a door 1, a fixed plate 4B provided in a main body 3 (shown in FIG. 1) in a manner to confront to the upper and lower portions of the door 1, a pair of right and left latch plates 5A and 5B rotatably provided at the right and left sides of the fixed plate 4, and a coupling means 6 installed between the pair of the latch plates 5A and 5B. At the outside of the door 3, a handle 16 is provided for opening or closing the door.

Since the second embodiment is a modified example of the first embodiment, parts of the second embodiment corresponding to those of the first embodiment are designated by the same reference numerals.

The difference between the present second embodiment from the first embodiment is that the lock grooves 14A and 14B are formed in the latch plates 5A and 5B, and the lock pins 15A and 15B ar projectingly provided in the links 6A and 6B, respectively.

Similarly as in the first embodiment, the lock grooves 14A and 14B of the second embodiment are comprised of slide guide portions 14A1 and 14B1 stopper portions 14A2 and 14B2, respectively, bent in generally L-shaped configuration. Moreover, the stopper portions 14A2 and 14B2 are in the form of a circular arc centering pivotal shafts 13A and 13B of the links 6A and 6B, respectively. On the other hand, the slide guide portions 14A1 and 14B1 are drawn close to the rotary shafts 9A and 9B of the latch plates 5A and 5B from the end portions of the stopper portions 14A2 and 14B2 and away from the pivotal shafts 13A and 13B of the links 6A and 6B. Therefore, the slide guide portions 14A1 and 14B1 are extended in slantwise direction.

The operation of the above-described device of the second embodiment is the same as the first embodiment, and therefore the description thereof will be abbreviated here.

Although the slide guide portions 14A1 and 14B1 of the lock grooves 14A and 14B are formed in such a configuration as to be extended in slantwise direction so that the slide guide portions 14A1 and 14B1 come close to the rotary shafts 9A and 9B of the latch plates from the end portions of the stopper portions 14A2 and 14B2, and away from the pivotal shafts 13A and 13B of the links 6A and 6B as is described hereinabove, it may be possible that the slide guide portions 14A1 and 14B1 are arranged to come close to the pivotal shafts 13A and 13B and away from the rotary shafts 9A and 9B from the end portions at the outer diameter side of the stopper portions 14A2 and 14B2. In this case, the links 6A and 6B are rotated in a direction reverse to that of the second embodiment.

In addition, although the links 6A and 6B are pivotally provided at the front side of the fixed plate 4, while the coupling link 6C is provided at the rear side of the fixed plate 4 according to the second embodiment, the links 6A and 6B may be pivotally fixed at the rear side of the fixed plate 4, with the coupling link 6C being provided at the front side of the fixed plate 4.

Figure 62:
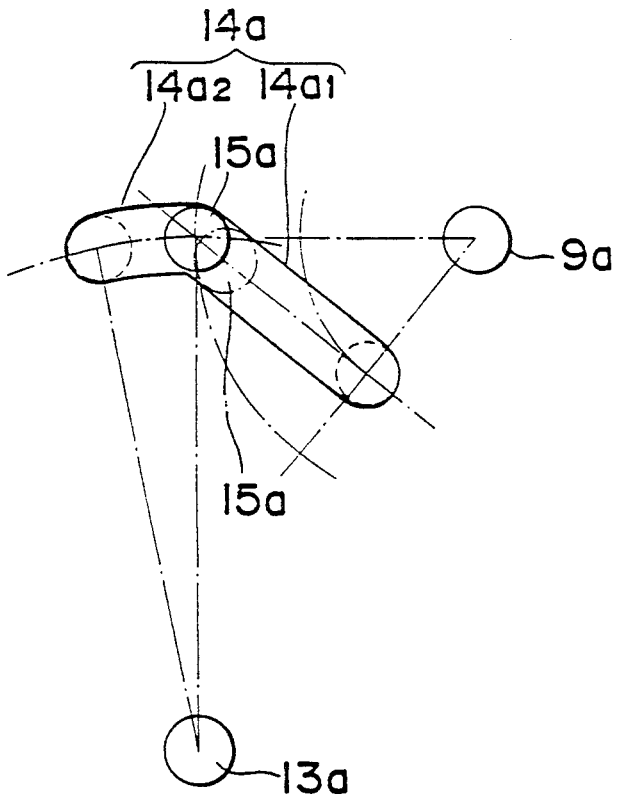
Figure 63:
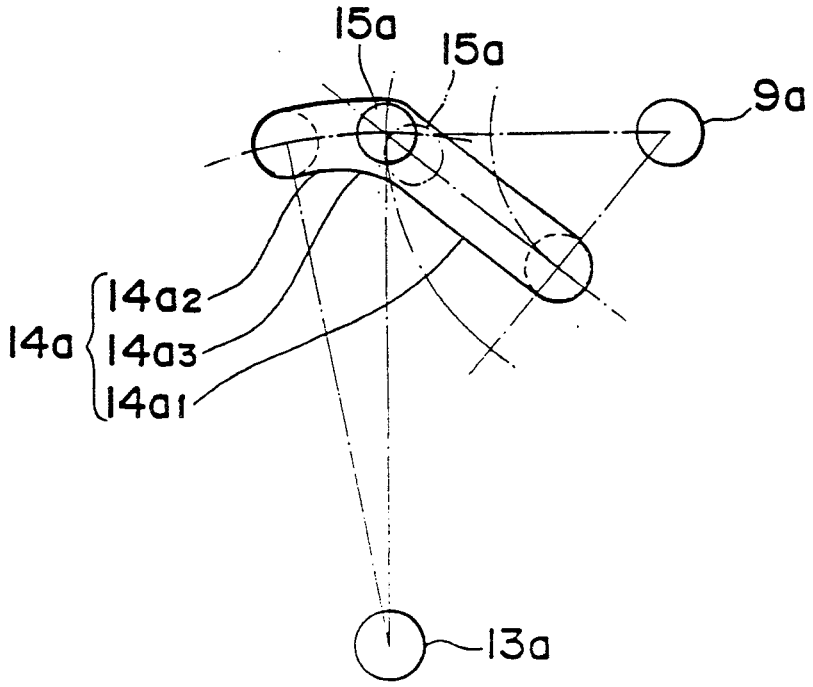
FIG. 63 is a similar view to FIG. 62 showing a modification of the lock groove of FIG. 62.

FIG. 62 is an enlargement view of the lock groove 14A in the second embodiment, wherein the lock groove 14A is bent between the slide guide portion 14A1 and the stopper portion 14A2. As shown in FIG. 63, in the modified example of the second embodiment, the inner side portion 14A3 of the bent portion between the slide guide portion 14A1 of the lock groove 14A and the the stopper portion 14A2 may be curved. In this manner, even if the lock pin 15A is not located in the bent angle portion of the lock groove 14A as shown in the imaginary line of FIG. 63, and even if the condition is so-called semi-open, the lock pin 15A is guided onto the curved portion 14A3 and is smoothly moved onto the stopper portion 14A2 when the door is tried to be opened from the opposite side, so that the door 1 may be smoothly opened.

In FIG. 63, although only the lock groove 14A on the right side is shown, the same thing can be said even about the lock groove 14B on the left side.

Figure 88:
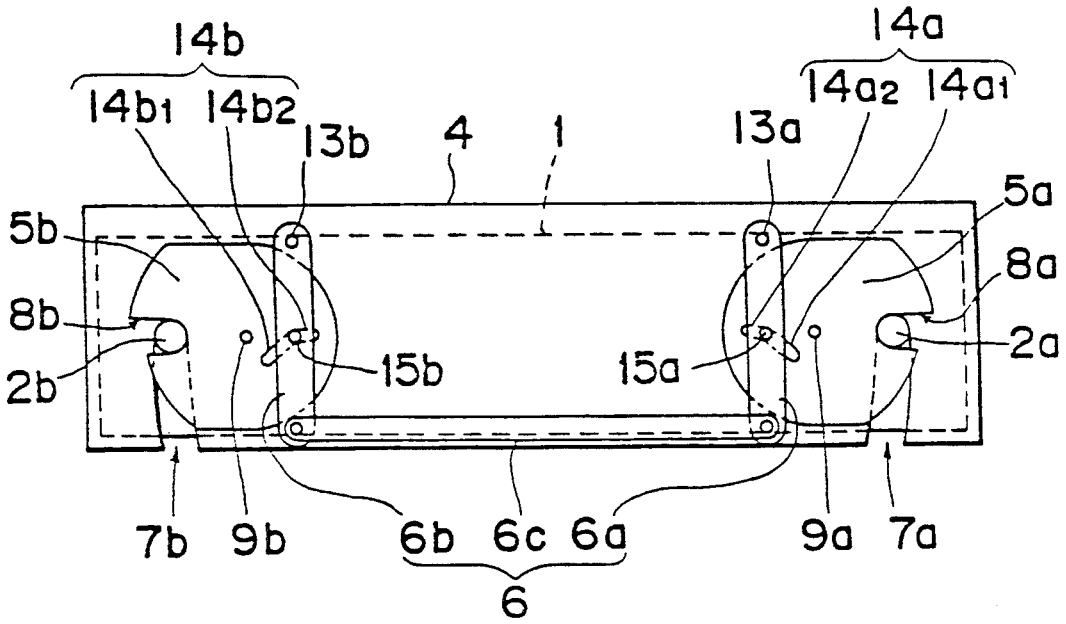
FIGS. 88 to 90 relate to an opening/closing device of a door member according to a modified embodiment of the second embodiment.
Figure 89:
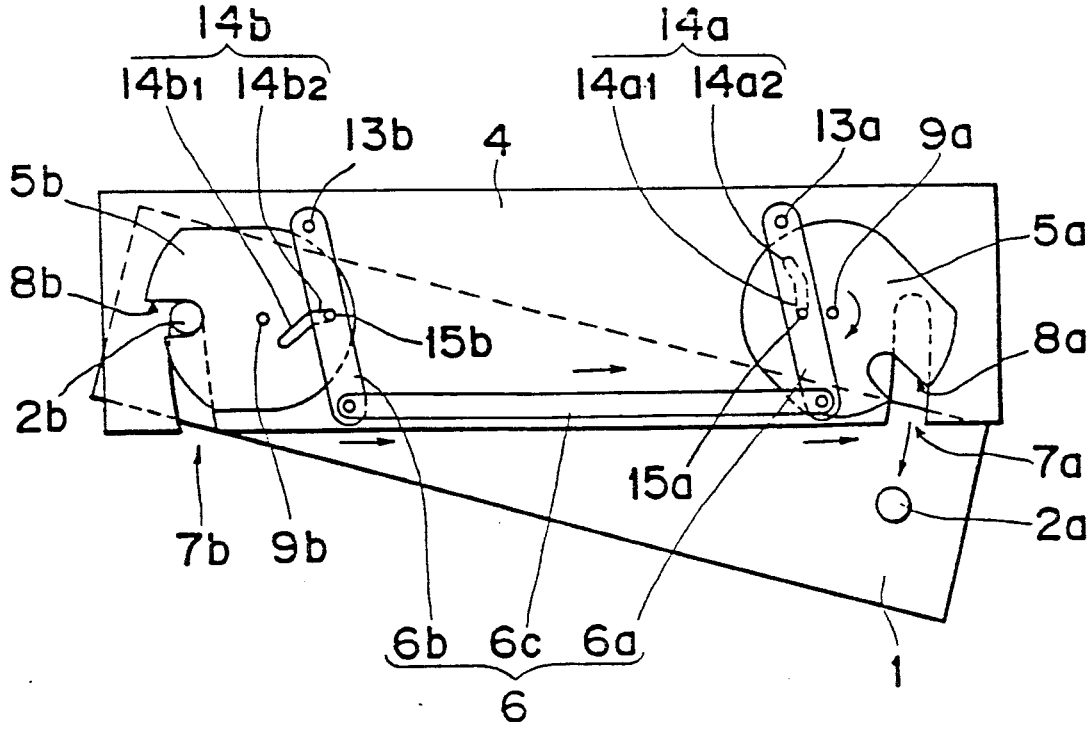
Figure 90:
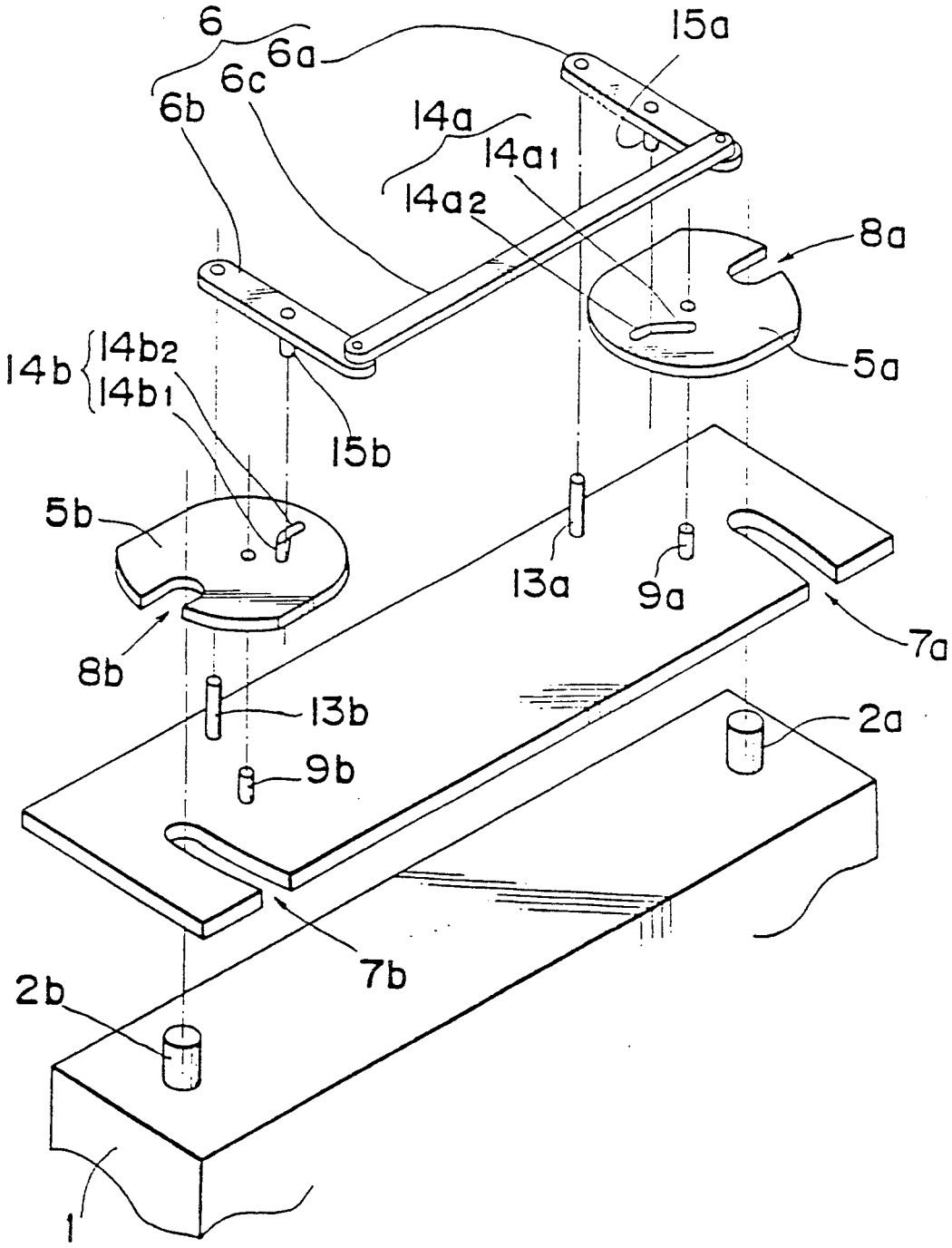

A modified example of the above-described second embodiment is represented in FIGS. 88 to 90, in which the corresponding parts are accordingly designated by the same reference numerals as in the second embodiment. FIG. 88 is a plane view of the device when the door is kept closed. FIG. 89 is a plane view of the device when the door is kept opened. FIG. 90 is an exploded perspective view of the device. The springs 10A,10B are omitted in these FIGS. 88 to 90.

Figure 91:
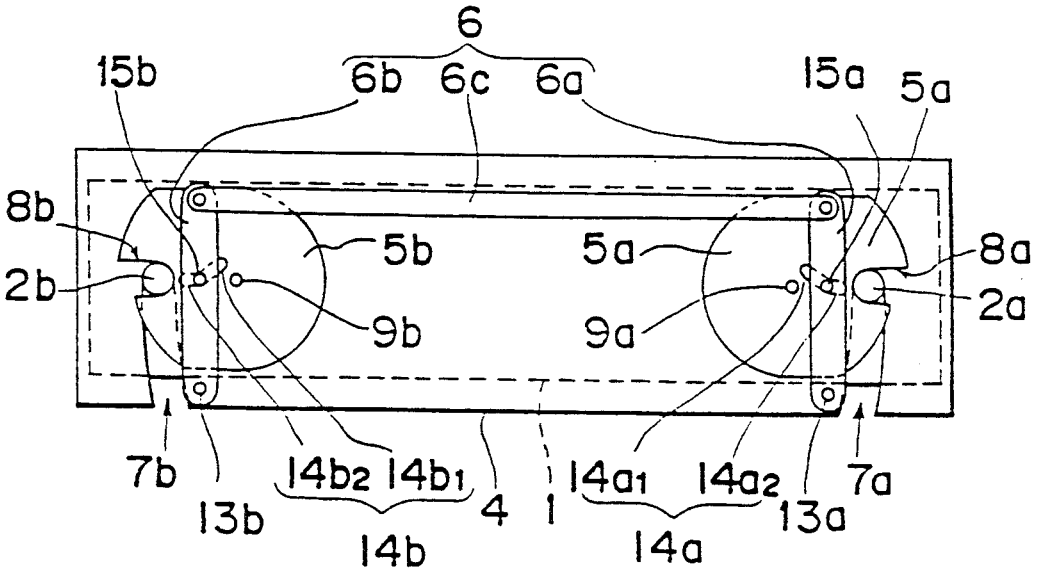
FIGS. 91 to 93 relate to an opening/closing device of a door member according to another modified embodiment of the second embodiment.
Figure 92:
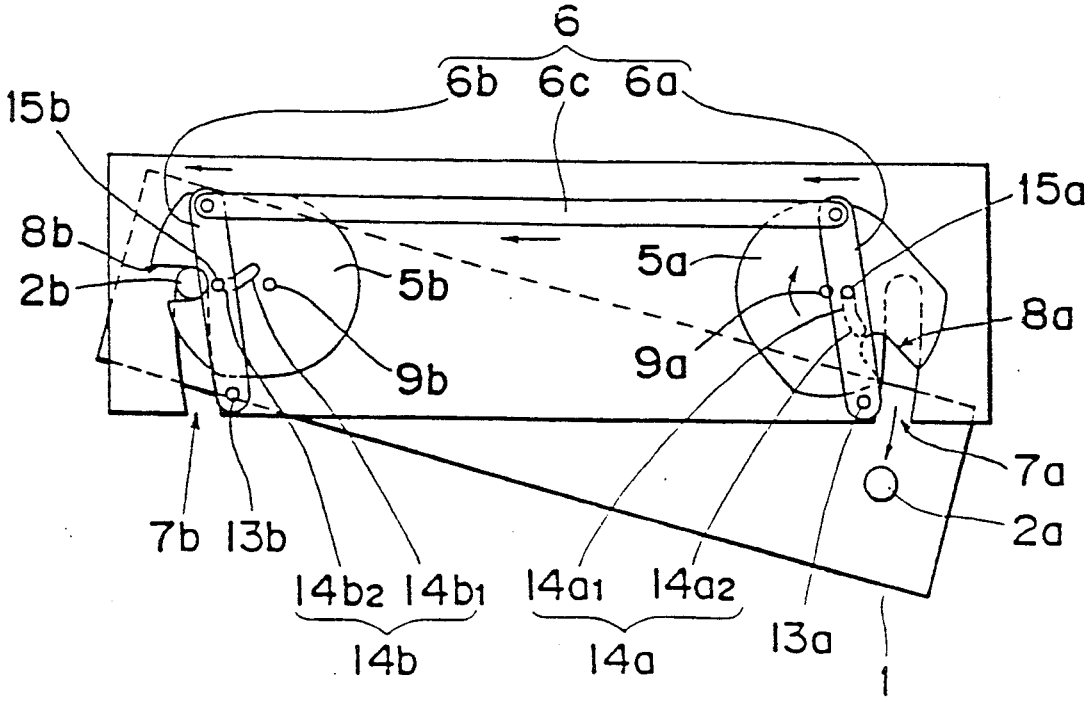
Figure 93:
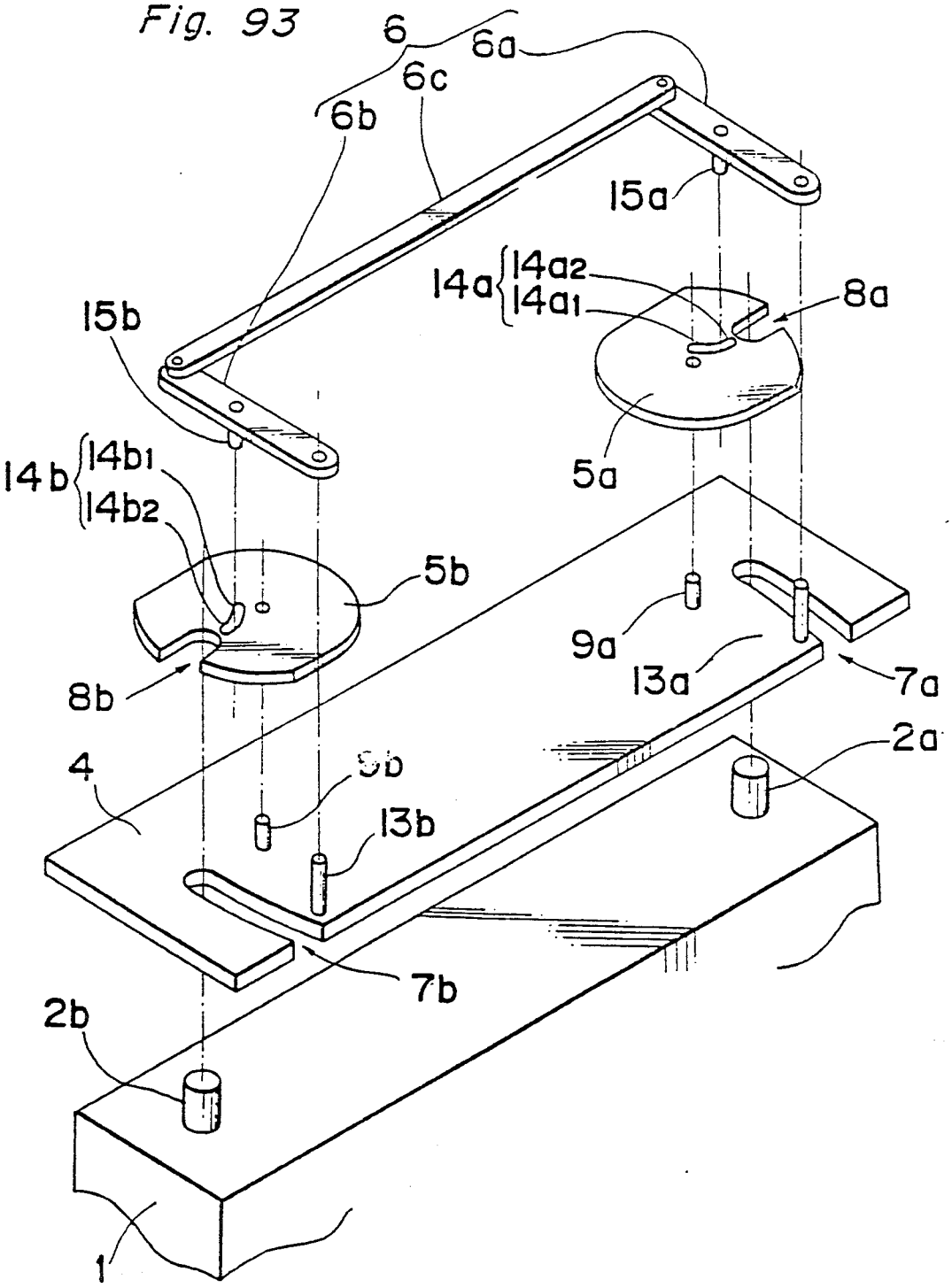

FIGS. 91 to 93 show an embodiment which is another modified example of the second embodiment, and therefore the corresponding parts are designated by the same reference numerals. FIG. 91 is a plane view of a double-openable device when the door is kept closed, whereas FIG. 92 is a plane view when the door is kept opened. FIG. 93 is an exploded perspective view of the device. It is to be noted that the springs 10A, 10B are omitted from FIGS. 91 to 93.

Figure 94:
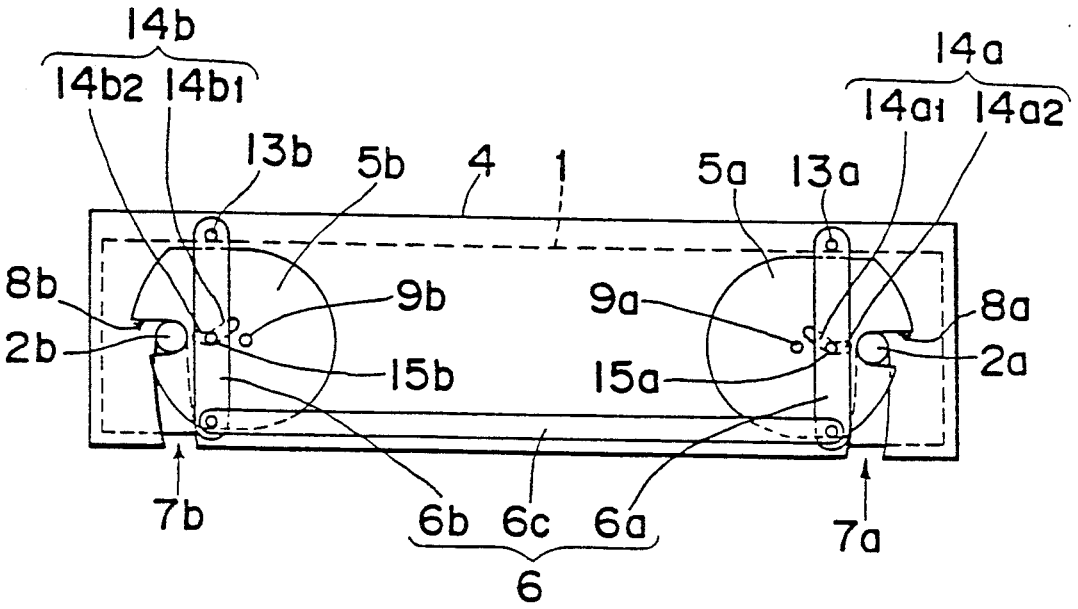
FIGS. 94 to 96 relate to an opening/closing device of a door member according to a further modified embodiment of the second embodiment.
Figure 95:
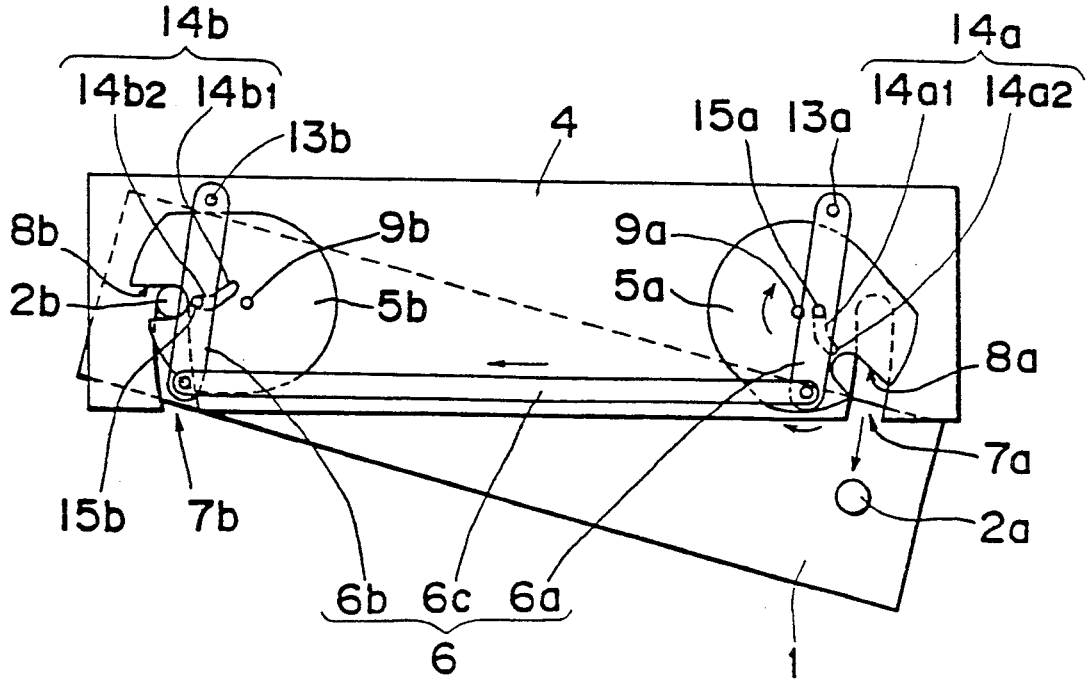
Figure 96:
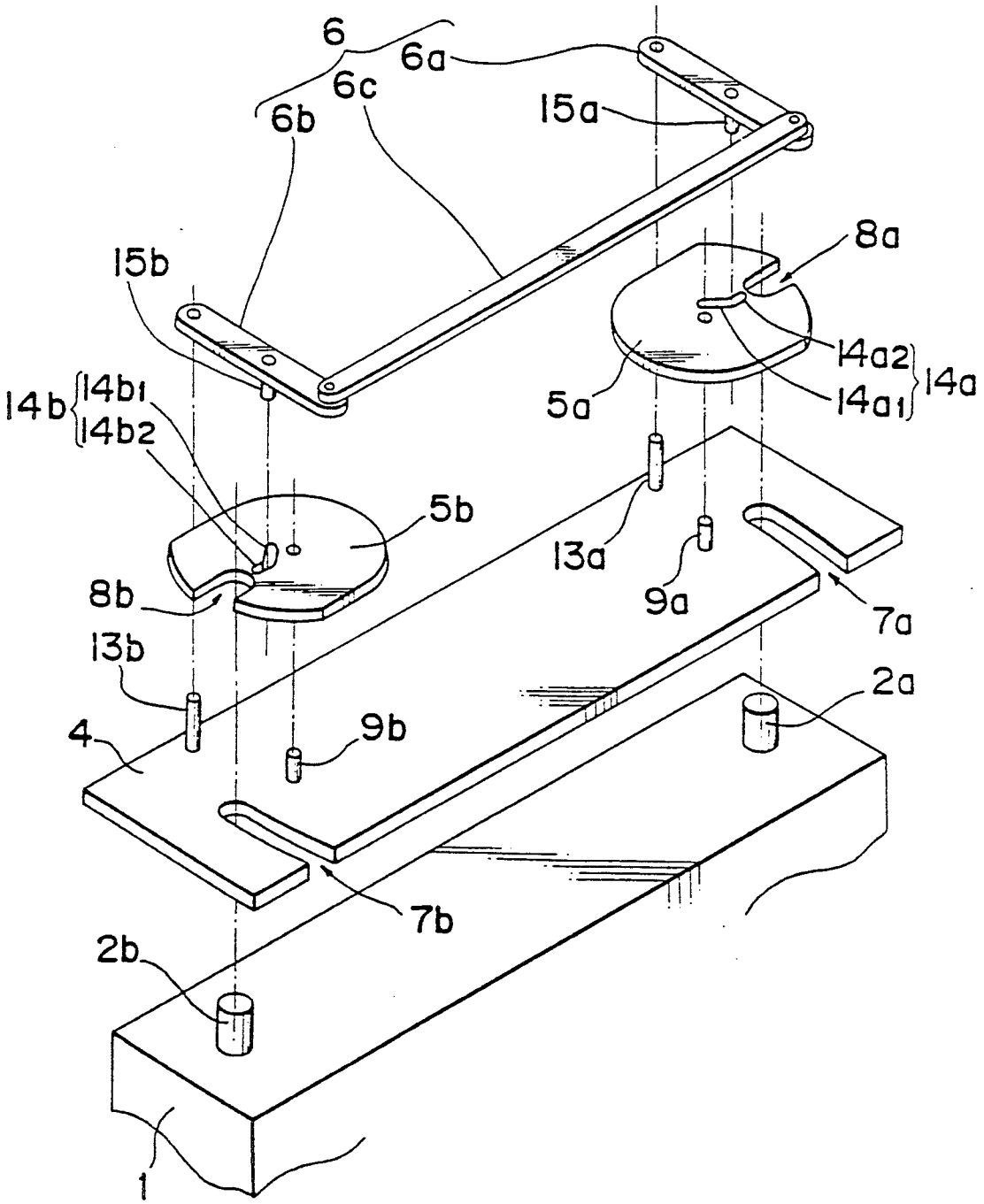

A still modified example, as an embodiment of the present invention, is shown in FIGS. 94 to 96. Since the embodiment is a modification of the second embodiment, parts corresponding to those of the second embodiment are designated by the same reference numerals. FIG. 94 is a plane view of the device when the door is kept closed. FIG. 95 is a plane view when the door is kept opened. FIG. 96 is an exploded perspective view. The springs 10A,10B are omitted in FIGS. 94 to 96.

FIGS. 94 to 96 show a double-openable device of a door according to a third embodiment of the present invention. FIG. 94 is a plane view of the device when the door is kept closed. FIG. 95 is a plane view of the device when the door is kept opened. And FIG. 96 is an exploded perspective view of the device. The springs 10A,10B are omitted in FIGS. 94 to 96.

3) Third Embodiment

Figure 64:
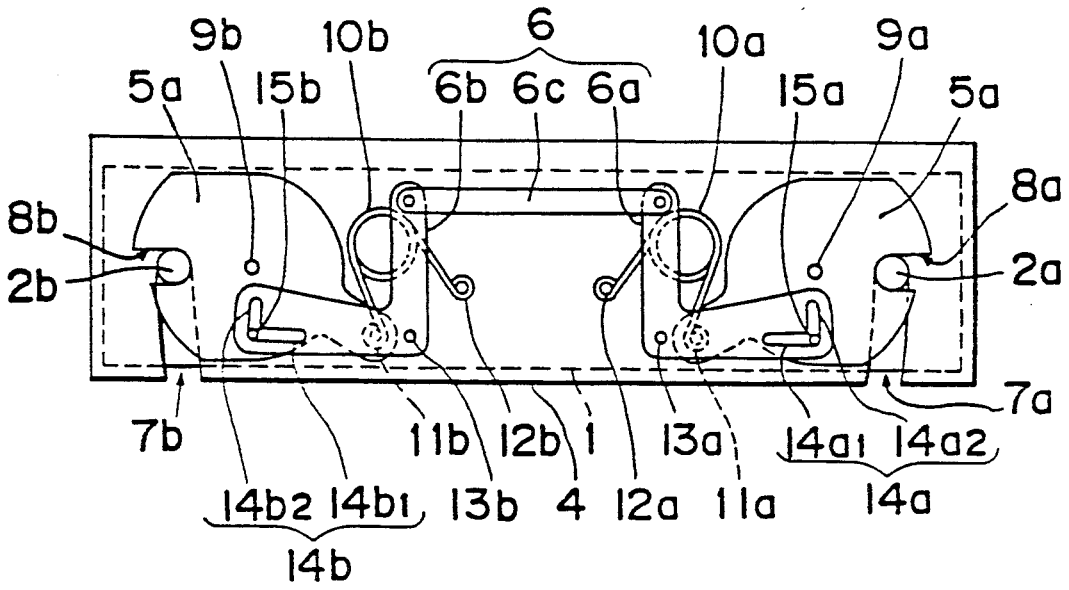
FIGS. 64 to 66 are related to an opening/closing device of a door member according to a third embodiment of the present invention.
Figure 65:
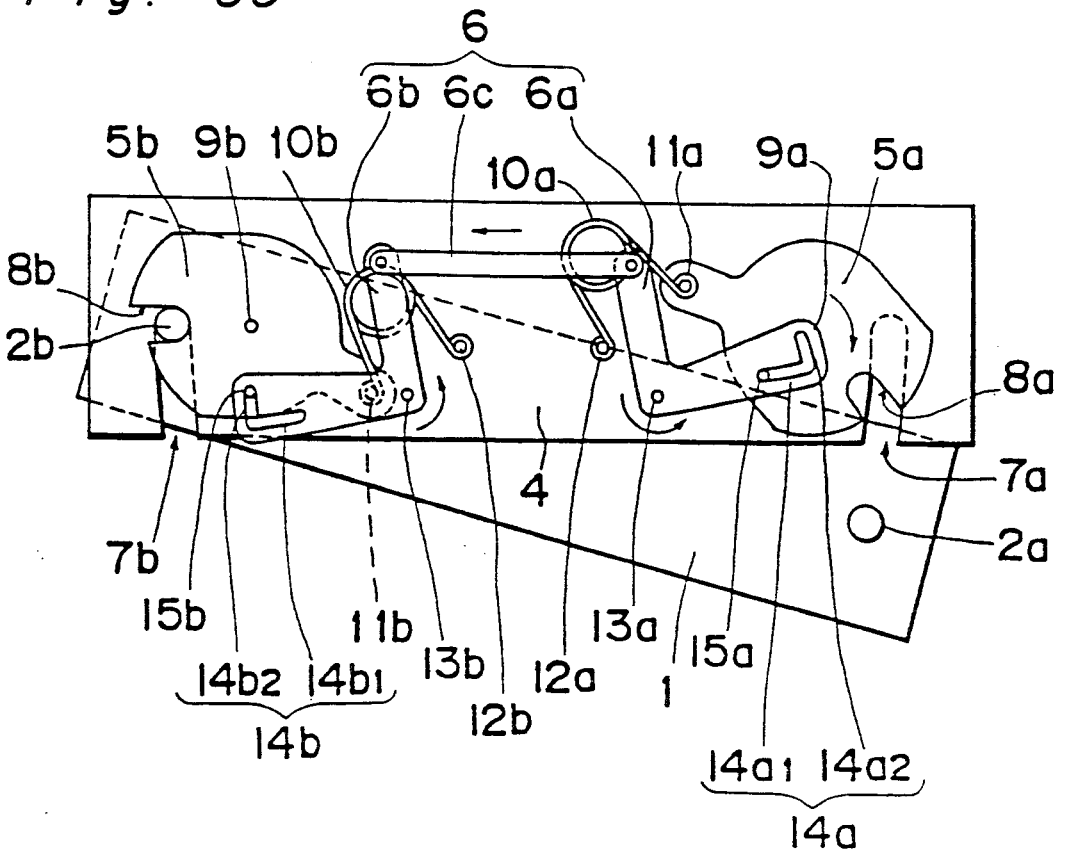
Figure 66:
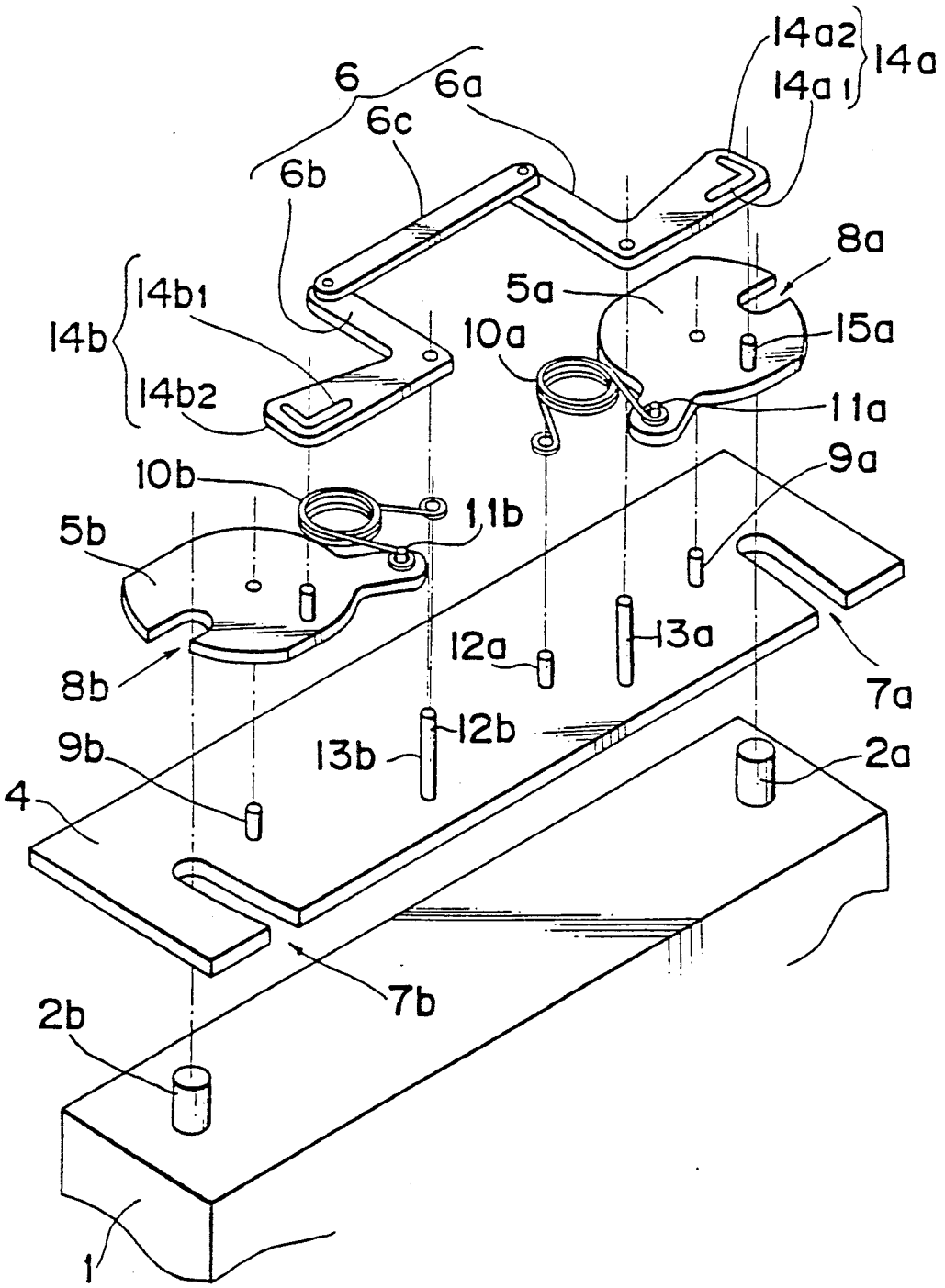

FIGS. 64 to 66 show a door in accordance with a third embodiment of the present invention. FIG. 64 is a plane view showing the door when the door is closed. FIG. 66 is a perspective exploded view of the door.

The third embodiment is a modification of the first embodiment already described earlier, and therefore the corresponding parts thereof to those of the first embodiment are designated by the same reference numerals.

What is different between the third embodiment and the first embodiment is found in the fact that the links 6A and 6B are formed generally in L-shaped configuration, and the lock grooves 14A and 14B are formed at end portions of the links 6A and 6B opposite to coupling portions where the links 6A and 6B are coupled to the coupling link 6C, with pivotal shafts 13A and 13B positioned to be fitted in the center of the links 6A and 6B, respectively. The lock pins 15A and 15B of the latch plates 5A and 5B are projected at the side of the front face of the fixed plate 4.

The stopper portions 14A2 and 14B2 of the lock grooves 14A and 14B are in a circular arc having the pivotal shafts 13A and 13B of the links 6A and 6B as its center, and the slide guide portions 14A1 and 14B1 are in a shape extending from the end portions of the stopper portions 14A2 and 14B2 to the pivotal shafts 13A and 13B, respectively.

The operation of the device of the third embodiment is the same as that of the first embodiment, the description of which will be accordingly abbreviated here.

As is described hereinabove, the links 6A and 6B are pivotally provided at the front side of the fixed plate 4 and the coupling link 6C is provided at the rear side of the fixed plate 4. However, it may be possible that the links 6A and 6B are pivotally provided at the rear side of the fixed plate 4 with the coupling link 6C being at the front side of the fixed plate 4. In this case, the slide guide portions 14A1 and 14B1 of the lock grooves 14A and 14B are extended from the end portions of the stopper portions 14A2 and 14B2 away from the pivotal shafts 13A and 13B of the links 6A and 6B. The rotating direction of the links 6A and 6B becomes reverse to that of the present third embodiment.

Figure 97:
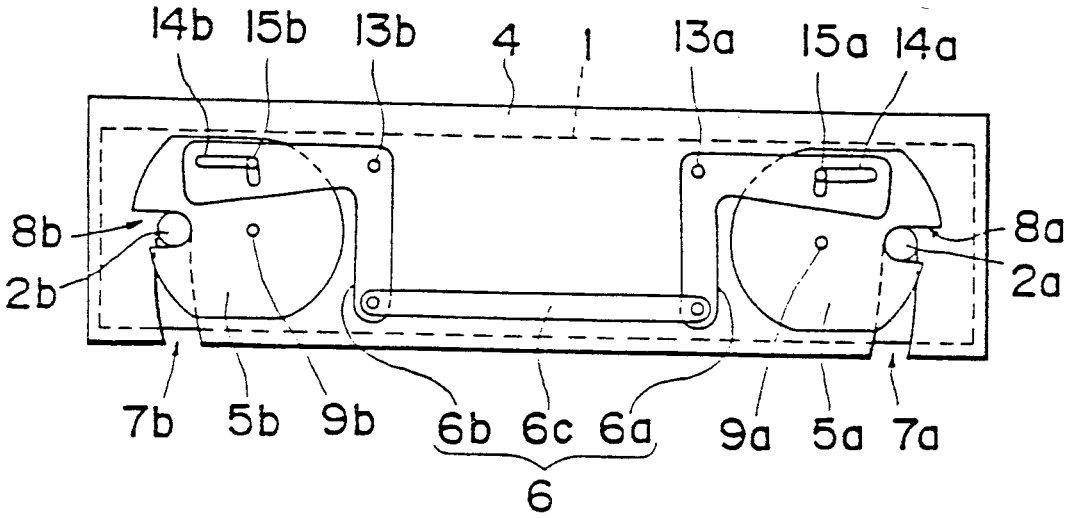
FIGS. 97 to 99 relate to an opening/closing device of a door member according to a modified embodiment of the third embodiment.
Figure 98:
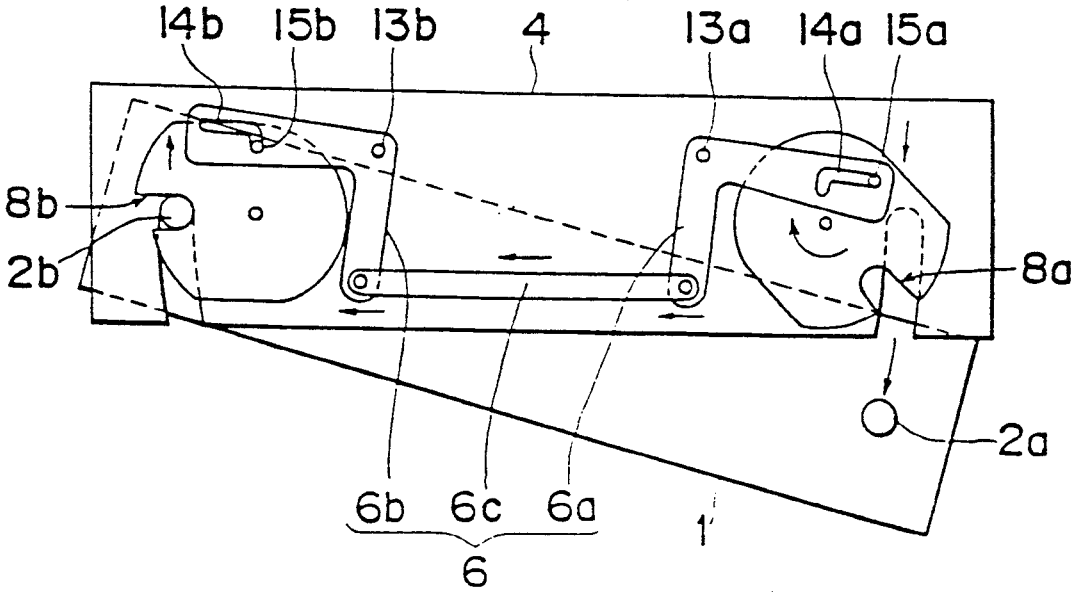
Figure 99:
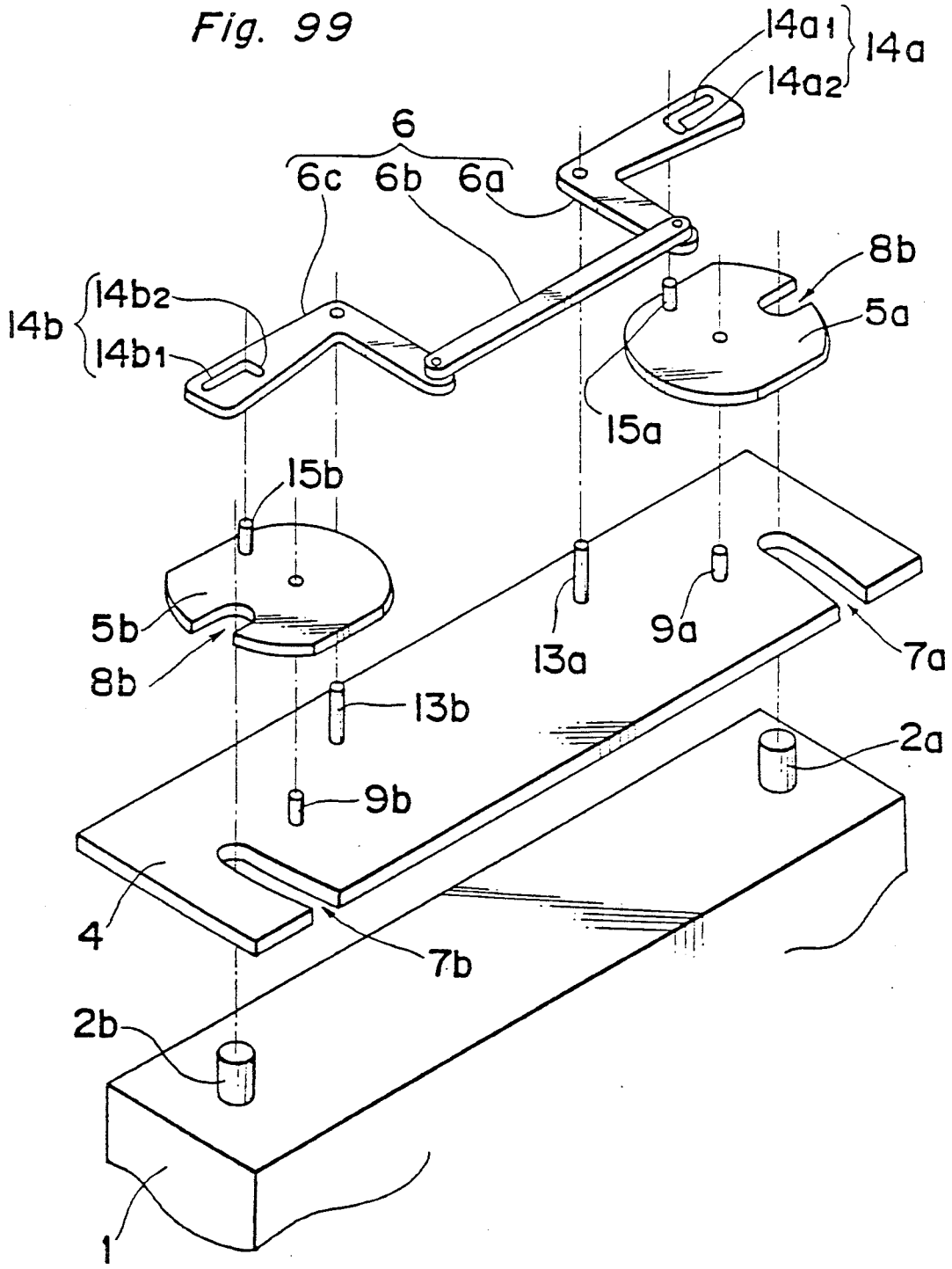

A modification of the third embodiment is disclosed in FIGS. 97 to 99 in which corresponding parts are designated by the same reference numerals as in the third embodiment. FIG. 97 is a plane view of the device, with the door in the closed state. FIG. 98 is a plane view of the device, with the door in the opened state. FIG. 99 is an exploded perspective view of the device. In FIGS. 97 to 99, the springs 10A, 10B are omitted.

Figure 100:
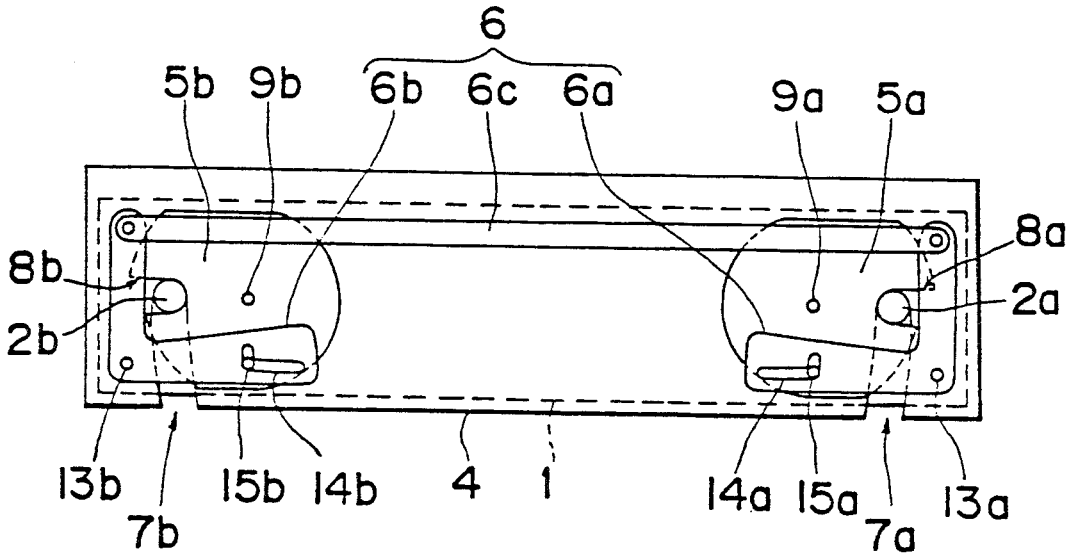
FIGS. 100 to 102 relate to an opening/closing device of a door member according to another modified embodiment of the third embodiment.
Figure 101:
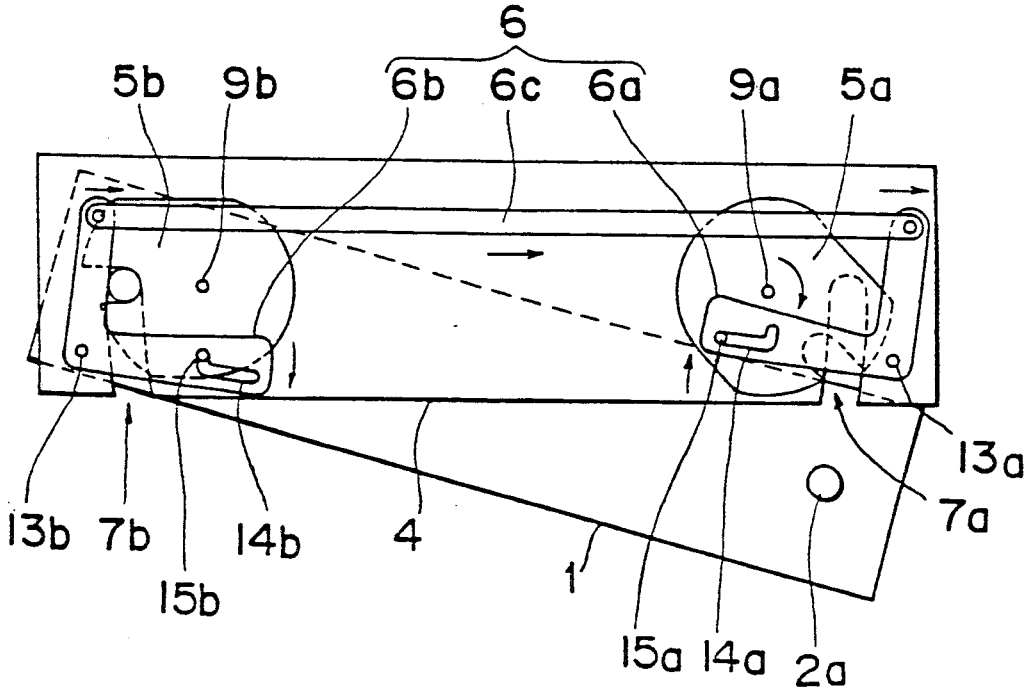
Figure 102:
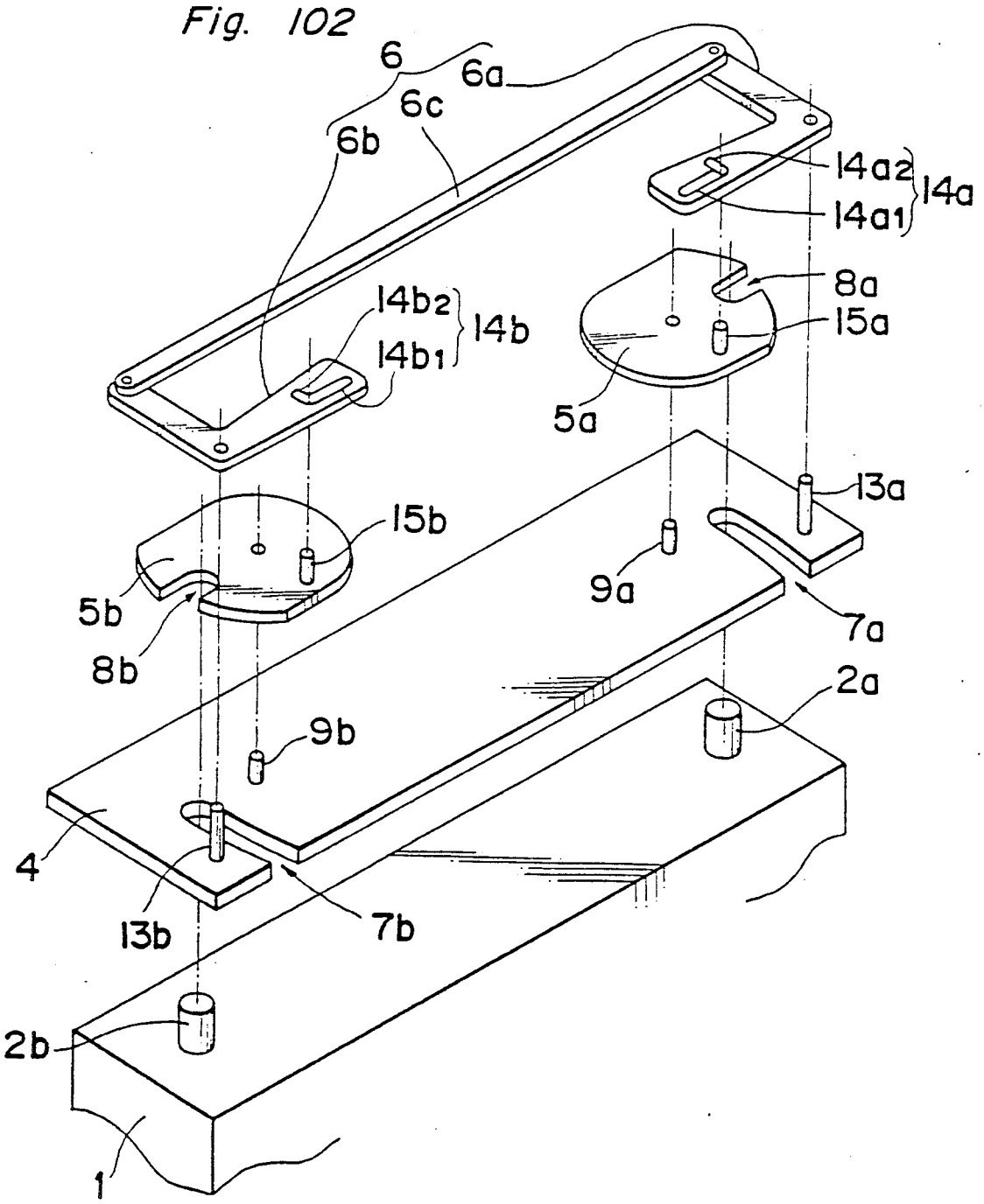

A further modification of the third embodiment is shown in FIGS. 100 to 102 in which corresponding parts are designated by the same reference numerals in FIGS. 100 to 102 as in the third embodiment. FIG. 100 is a plane view of the device when the door is kept closed. FIG. 101 is a plane view of the device when the door is kept opened. FIG. 102 is an exploded perspective view of the device. It is to be noted that the springs 10A,10B are not illustrated in FIGS. 100 to 102.

Figure 103:
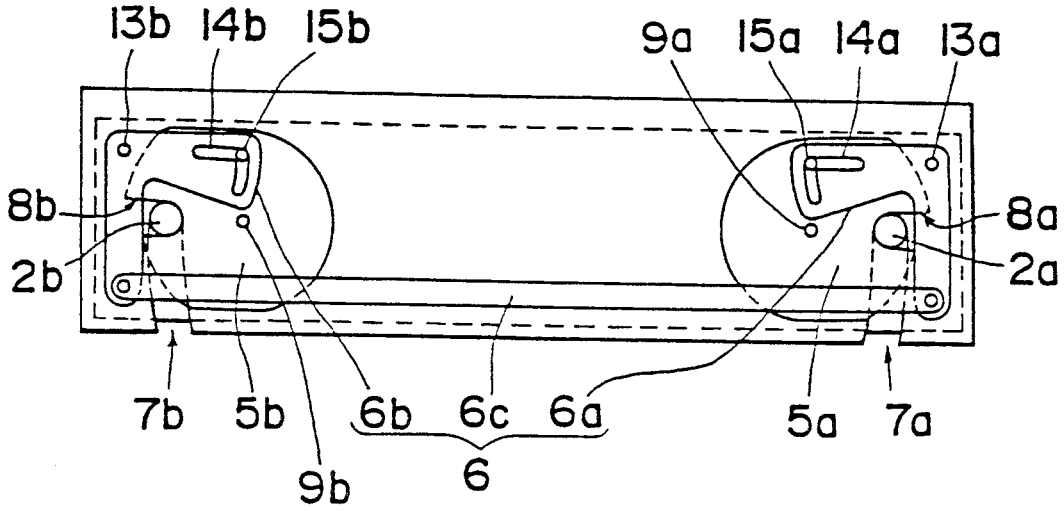
FIGS. 103 to 105 relate to an opening/closing device of a door member according to a further modified embodiment of the third embodiment.
Figure 104:
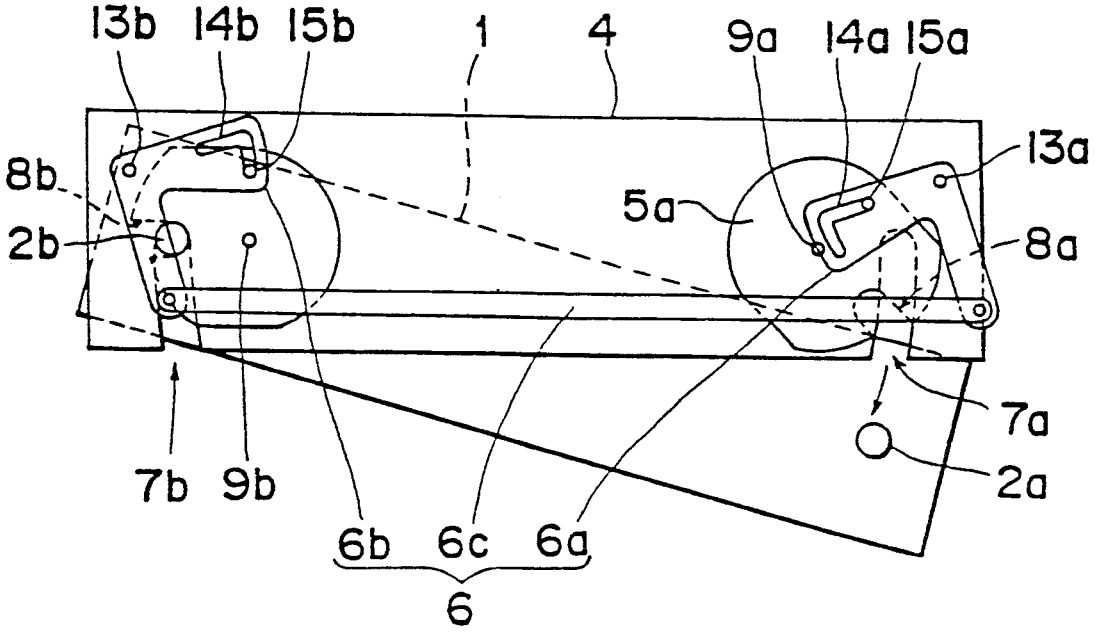
Figure 105:
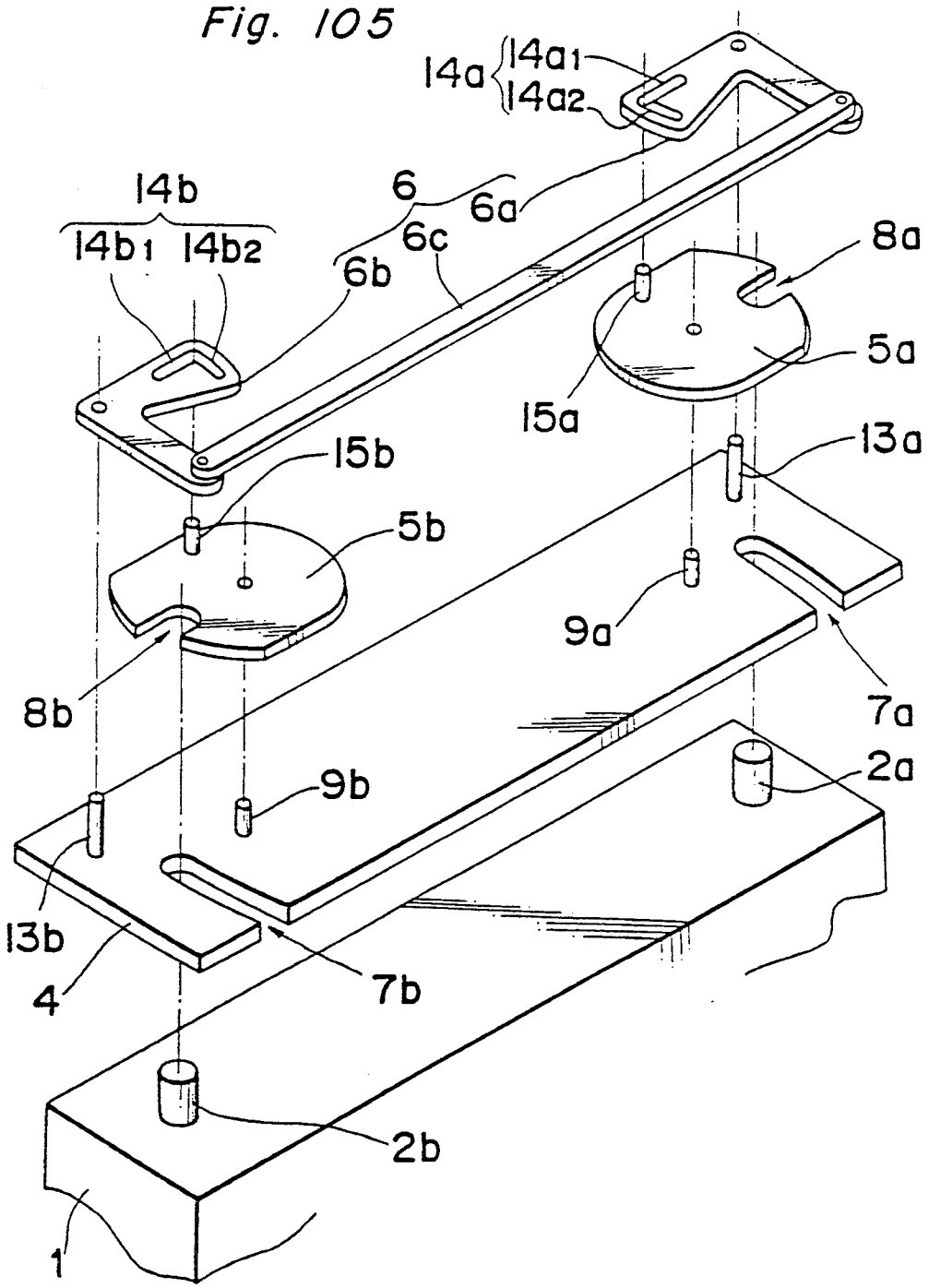

Yet a further modified example of the third embodiment is shown as a embodiment in FIGS. 103 to 105. Since the embodiment is a modification of the third embodiment, the corresponding parts are represented by the same reference numerals. FIG. 103 is a plane view of the device when the door is kept closed. FIG. 104 is a plane view of the device when the door is kept opened. FIG. 105 is an exploded perspective view of the device. The springs 10A,10B are abbreviated in FIGS. 103 to 105.

4) Fourth Embodiment

Figure 67:
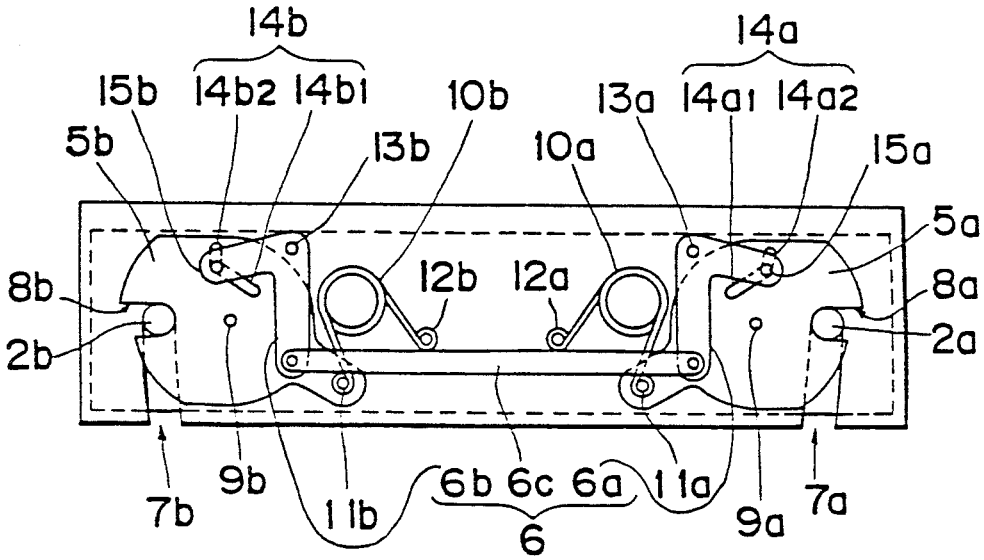
FIGS. 67 to 69 are related to an opening/closing device of a door member according to a fourth embodiment of the present invention.
Figure 68:
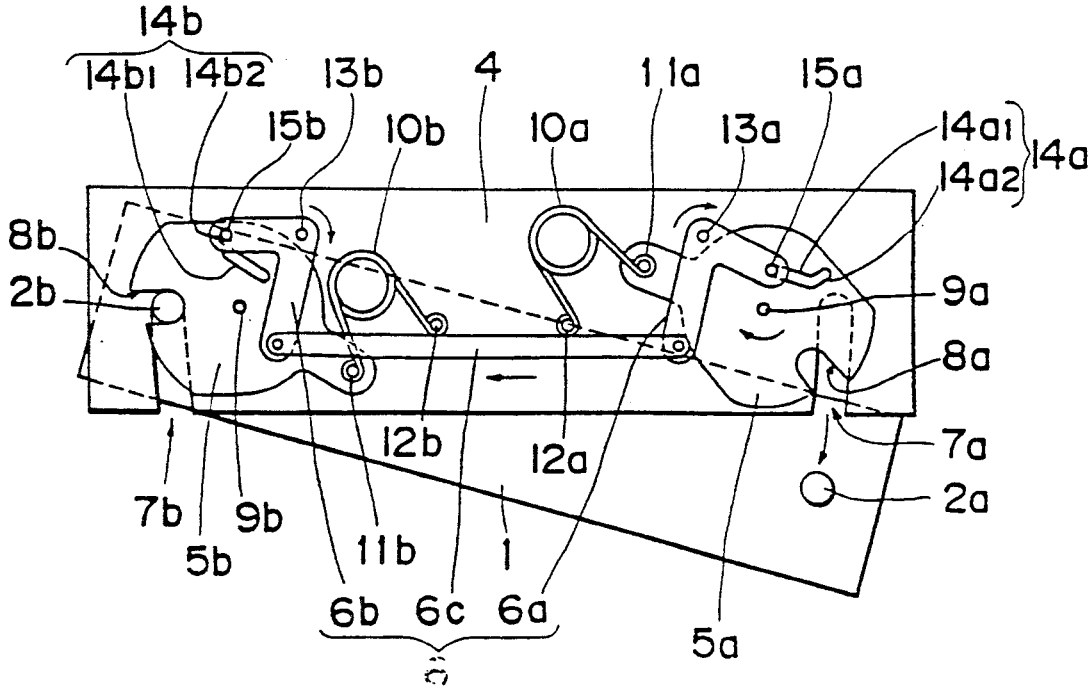
Figure 69:
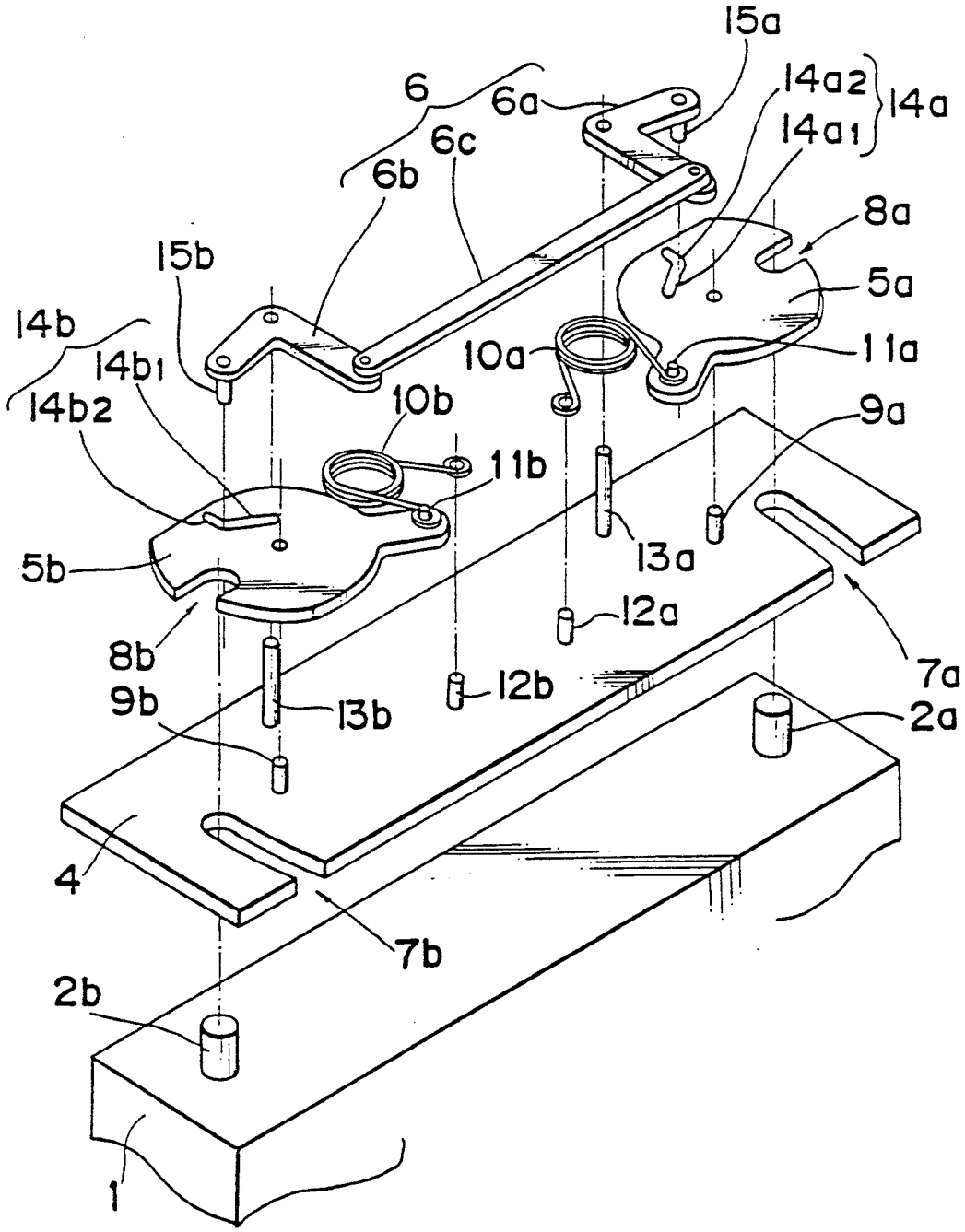

In FIGS. 67 to 69, a double-openable device of a door according to a fourth embodiment of the present invention is illustrated. FIG. 67 is a plane view of the device when the door is kept closed. FIG. 68 is a plane view when the door is kept opened, and FIG. 69 is an exploded perspective view of the device.

The fourth embodiment is a modified example of the above-described third embodiment in which the corresponding parts are represented by the same reference numerals.

The difference between the third and fourth embodiments is that the links 6A and 6B are pivotally fixed to the fixed plate 4 at the rear side thereof, and the lock grooves 14A and 14B are provided in the latch plates 5A and 5B, with the lock pins 15A and 15B protruding from the links 6A and 6B, respectively.

The stopper portions 14A2 and 14B2 of the lock grooves 14A and 14B are formed in a circular arc having the corresponding pivotal shafts 13A and 13B of the links 6A and 6B at its center. The slide guide portions 14A1 and 14B1 are formed to be extended in slantwise direction coming close to the rotary shafts 9A and 9B of the latch plates 5A and 5B and, the pivotal shafts 13A and 13B of the links 6A and 6B from the end portions of the stopper portions 14A2 and 14B2.

Since the device of the fourth embodiment in the above-described construction is operated in the same manner as of the first embodiment, the description thereof will be abbreviated here.

Similarly as in the third embodiment, it can be selected as desired whether the coupling link 6C is provided at the rear side or at the front side of the fixed plate 4, or whether the slide guide portions 14A1 and 14B1 of the lock grooves 14A and 14B are extended from the end portions of the stopper portions 14A2 and 14B2 in slantwise direction coming close to the rotary shafts 9A and 9B of the latch plates 5A and 5B or away from the rotary shafts 9A and 9B. It is more desirable, however, to arrange in such manner as to have the coupling link 6C added with the force in the pulling direction when the door 1 is opened/closed simultaneously at both the right and left sides, from the viewpoint of prevention of the deformation of the coupling link 6C, together with considerations taken into the design of the door 1 and the mounting structure of the door 1, etc.

Figure 106:
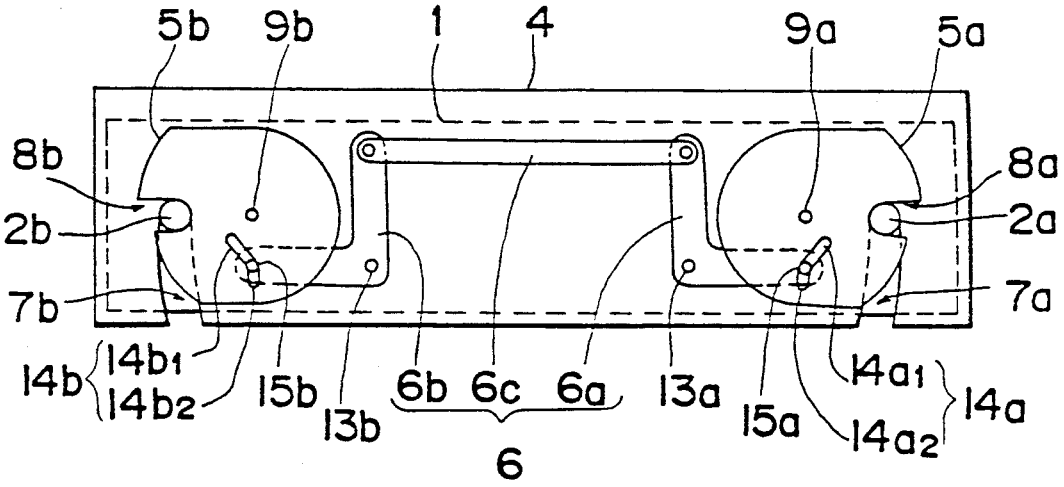
FIGS. 106 to 108 relate to an opening/closing device of a door member according to a modified embodiment of the fourth embodiment.
Figure 107:
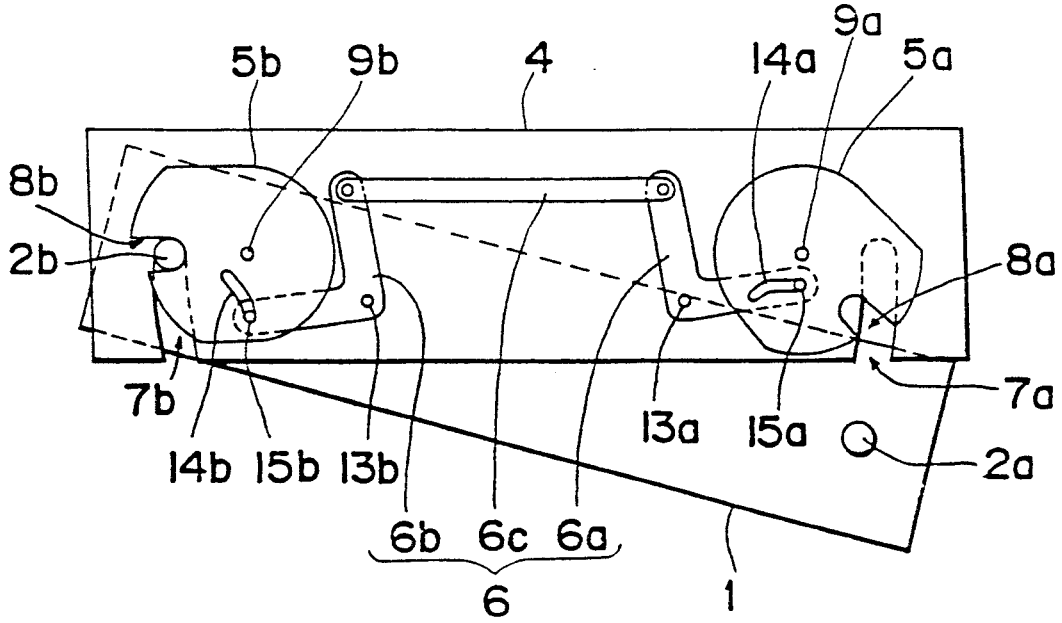
Figure 108:
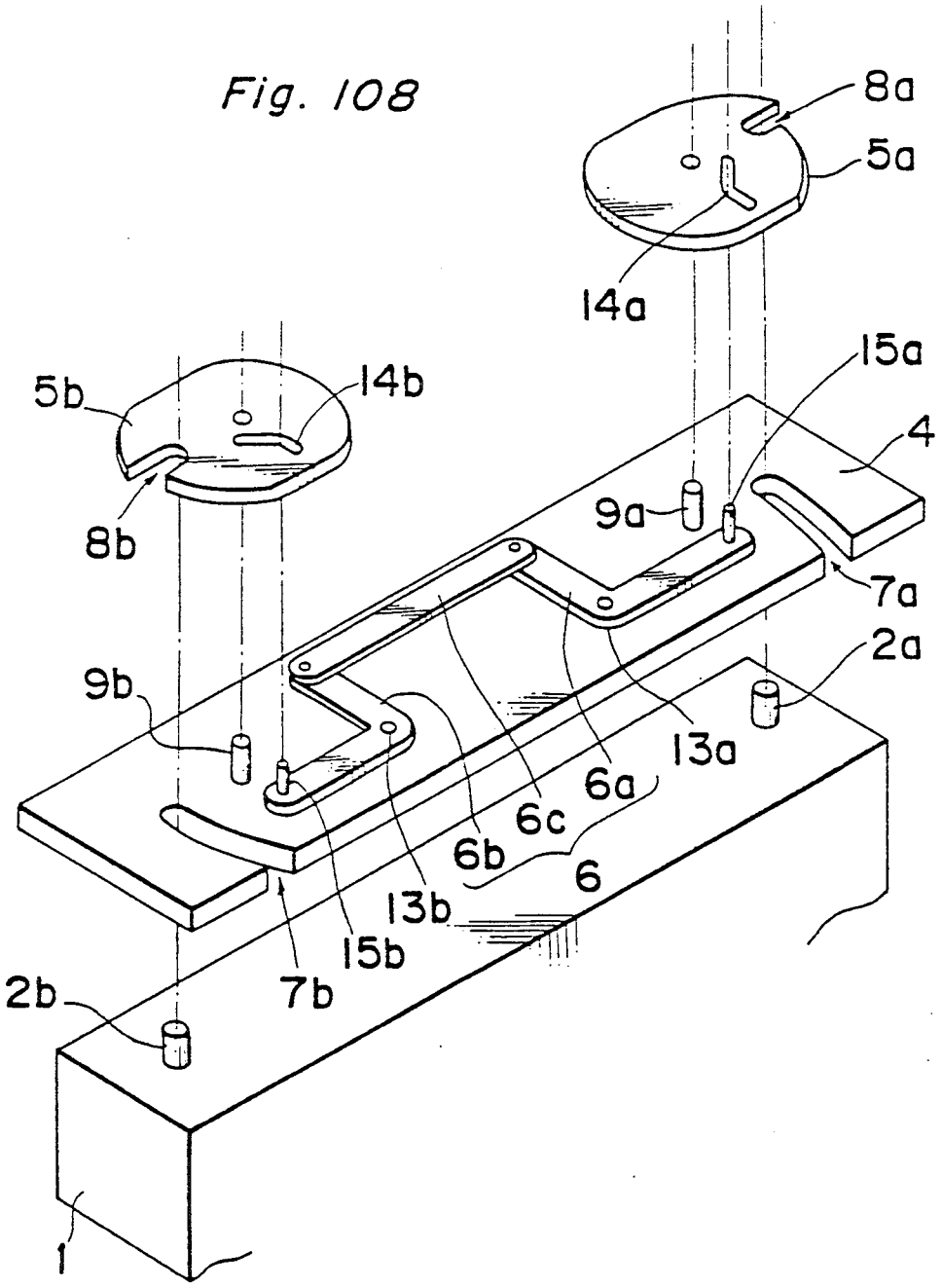

An embodiment which is a modification of the above fourth embodiment is illustrated in FIGS. 106 to 108 in which the corresponding parts are designated by the same reference numerals as in the fourth embodiment. FIGS. 106 to 108 show respectively a plane view when the door is kept closed, a plane view when the door is kept opened, and an exploded perspective view of the device. It is to be noted that the springs 10A,10B are omitted in FIGS. 106 to 108.

A further modification of the fourth embodiment is shown in FIGS. 109 to 111. The corresponding parts to those of the fourth embodiment are designated by the same reference numerals, and FIG. 109 shows a plane view of the device when the door is kept closed, and FIGS. 110 and 111 show a plane view when the door is kept opened and an exploded perspective view, respectively. In these FIGS. 109 to 111, the springs 10A,10B are omitted.

Moreover, a still further modification of the fourth embodiment is shown in FIGS. 112 to 114, which is a modified example o the fourth embodiment and accordingly the corresponding parts are represented by the same reference numerals. FIG. 112 is a plane view of the device when the door is kept closed, FIG. 113 is a plane view when the door is kept opened and FIG. 114 is an exploded perspective view of the device, in which the springs 10A,10B are omitted.

In a modified example of the fourth embodiment, slide guide portions 18A1 and 18B1 of lock grooves 18A and 18B may be extended to the direction close to the rotary shafts 9A and 9B of the latch plates 5A and 5B. In other words, the coupling link may be oscillated in the reverse direction to the fourth embodiment.

Such a modified example as referred to above is shown in FIGS. 115 to 117. The corresponding parts of the embodiment are designated by the same reference numerals as in the fourth embodiment. FIGS. 115 to 117 show respectively a plane view of the device when the door is kept closed, a plane view of the device when the door is kept opened and an exploded perspective view of the device. In these FIGS. 115 to 117, the springs 10A,10B are omitted.

Referring to FIGS. 118 to 120, a further modification of the fourth embodiment is indicated in which the corresponding parts are designated by the same reference numerals as in the fourth embodiment. FIG. 118 shows a plane view of the device when the door is kept closed. FIG. 119 is a plane view of the device when the door is kept opened. FIG. 120 is an exploded perspective view of the device. It is to be noted that the springs 10A,10B are omitted in FIGS. 118 to 120.

A more modified example of the fourth embodiment is shown in FIGS. 121 to 123 as an embodiment of the present invention, having the corresponding parts designated by the same reference numerals as in the fourth embodiment. FIGS. 121 to 123 are respectively a plane view of the device when the door is kept closed, a plane view of the device when the door is kept opened, and an exploded perspective view of the device, with the spring 10 being omitted therein.

An even further modified example of the fourth embodiment, is shown in FIGS. 124 to 126. The corresponding parts of the embodiment are designated by the same reference numerals as in the fourth embodiment. FIG. 124 is a plane view of the device when the door is kept closed. FIG. 125 is a plane view of the device when the door is opened. FIG. 126 is an exploded perspective view of the device. The springs 10A,10B are omitted in FIGS. 124 to 126.

5) Fifth Embodiment

Figure 70:
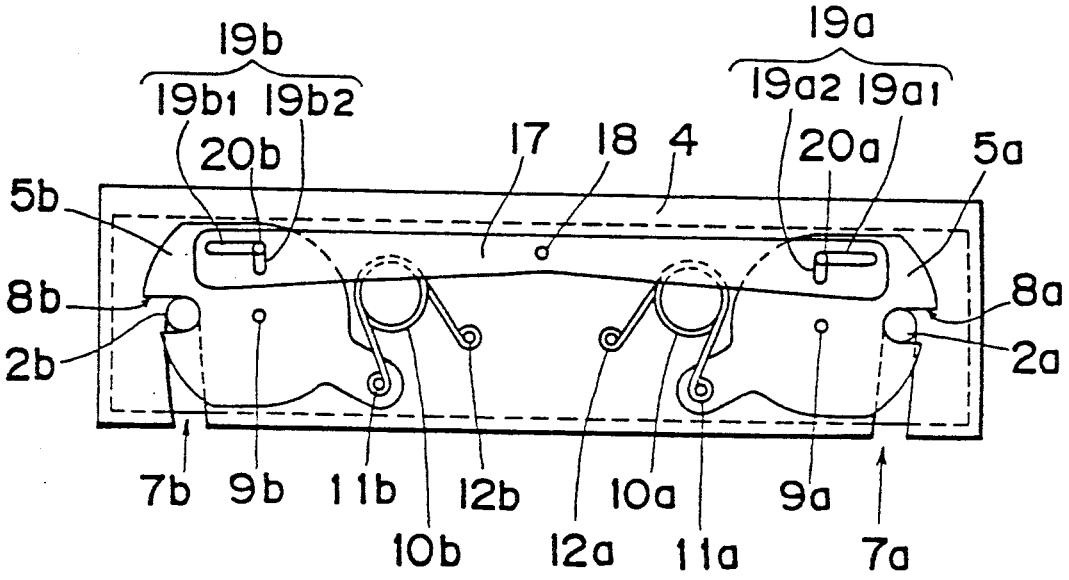
FIGS. 70 to 72 relate to an opening/closing device of a door member according to a fifth embodiment of the present invention.
Figure 71:
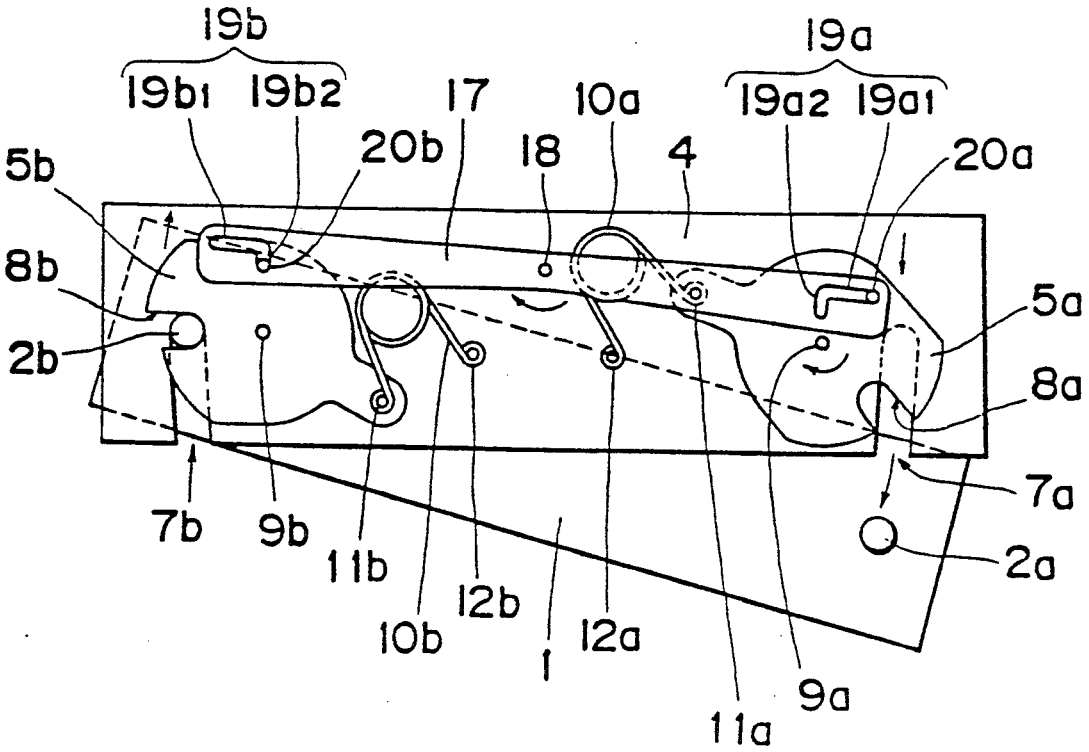
Figure 72:
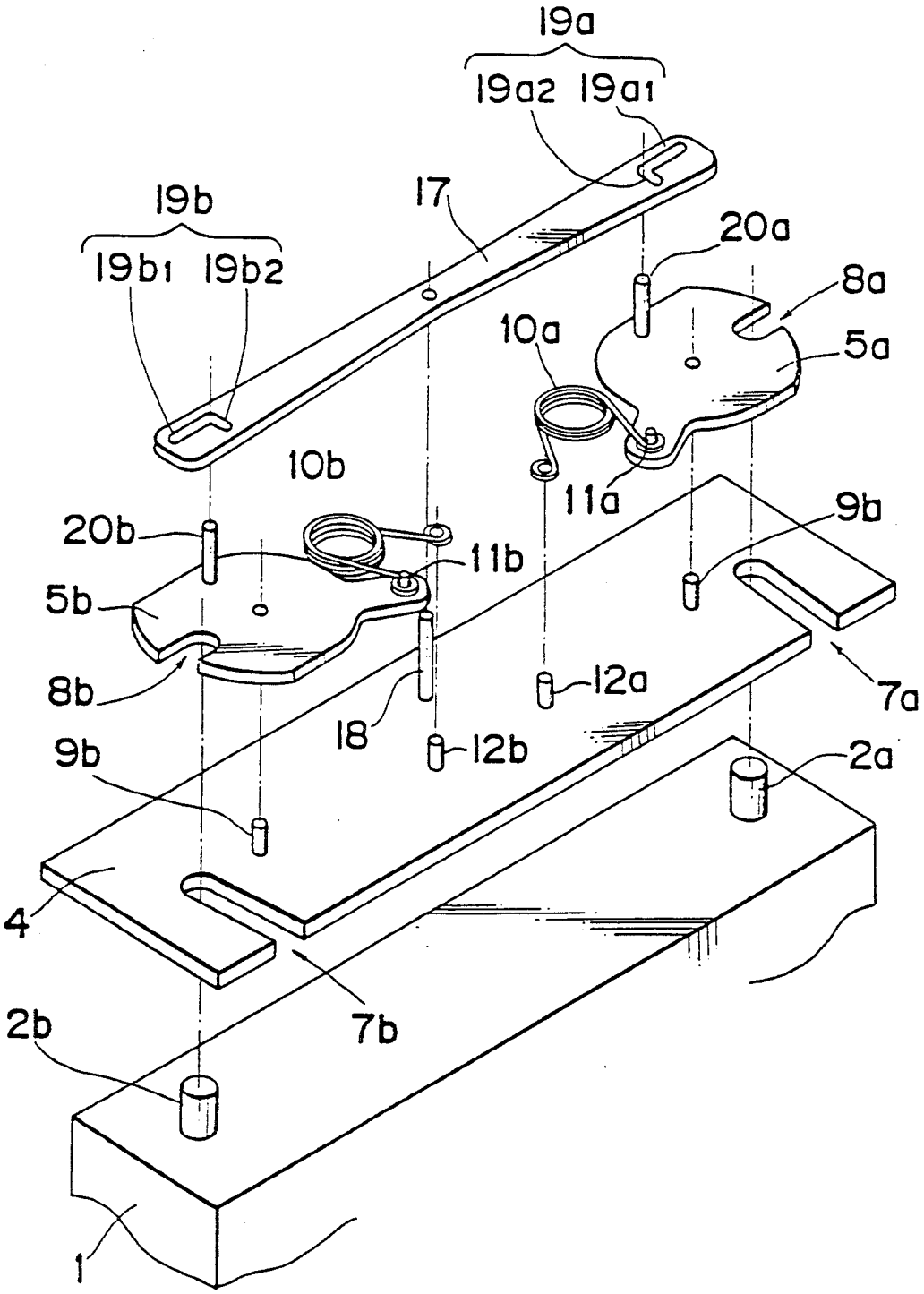

FIGS. 70 to 72 are related to a fifth embodiment of the present invention. FIG. 70 plane view of the device when the door is kept closed, FIG. 71 is a plane view of the device when the door is kept opened and FIG. 72 is an exploded perspective view of the device.

The opening/closing device according to the fifth embodiment of the present invention is the same as the device of the first embodiment in the fact that the opening/closing device of the fifth embodiment includes a pair of hinge pins 2A and 2B protrudingly provided at the opposite right and left sides of the door 1, the fixed plate 4 having engaging grooves 7A and 7B, a pair of right and left latch plates 5A and 5B having respective latch grooves 8A and 8B, and a pair of springs 10A and 10B urging the latch plates 5A and 5B to position the hinge pins 2A and 2B both in the restrained condition and in the restriction-releasing condition. Therefore, the corresponding parts of the fifth embodiment are represented by the same reference numerals as in the first embodiment, and the detailed description will be abbreviated.

What is different from the device of the first embodiment resides in that a coupling means 17 which prohibits the rotation of the one latch plate 5B (5A) in association with the rotation of the other latch plate 5A (5B) of the restriction-releasing direction is comprised of one lever which is pivotally and slidably fixed to the fixed plate 4 by a support shaft 18 in the middle of the right and left latch plates 5A and 5B. At the opposite end portions of the coupling means 17, lock grooves 19A and 19B are formed with which lock pins 20A and 20B respectively protrudingly provided in the latch plates 5A and 5B are engaged. Each of the above-mentioned lock grooves 19A and 19B are generally in L-shaped configuration and have a slide guide portion 19A1 or 19B1 extending away from the support shaft 18 of the coupling means 17 and, a stopper portion 19A2 or 19B2 provided along a circular arc centering the support shaft 18.

In the above-described construction, when the door 1 is opened at the right side, as shown in FIG. 70, the right hinge pin 2A is pulled to slip from the engaging groove 7A, so that the right latch plate 5A is rotated in the clockwise direction, namely, in the restriction-releasing direction. At this time, the lock pin 20A provided in the latch plate 5A slides in the slide guide portion 19A1 of the lock groove 19A thereby oscillating the coupling means 17 in the clockwise direction. At the side of the other latch plate, namely, left latch plate 5B, the end portion of the coupling means 17 is moved away from the latch plate 5B and the lock pin 20B is fitted in the stopper portion 19B2 of the lock groove 19B at the end portion of the coupling means 17. Accordingly, the latch plate 5B is prohibited from rotating, so that the left hinge pin 2B is kept in the restrained state.

In the case where the door 1 is to be opened from the left side, a reverse operation effects the opening of the door member.

The coupling means 17 may also be provided at the front side of the fixed plate 4 in the present embodiment. In this case, the stopper portions 19A2 and 19B2 of the lock grooves 19A and 19B are in a circular arc centering the support shaft 18, while the slide guide portions 19A1 and 19B1 are extended to be close to the support shaft 18 from the end portions at the rear side of the stopper portions 19A2 and 19B2.

.A modified example as referred to above is illustrated in FIGS. 127 to 129, which show a modification of the fifth embodiment. The corresponding parts are designated by the same reference numerals as in the fifth embodiment. FIGS. 127 to 129 show a plane view of the device when the door is kept closed, a plane view of the device when the door is kept opened, and an exploded perspective view of the device, respectively. The springs 10A,10B are omitted in FIGS. 127 to 129.

6) Sixth embodiment

Figure 73:
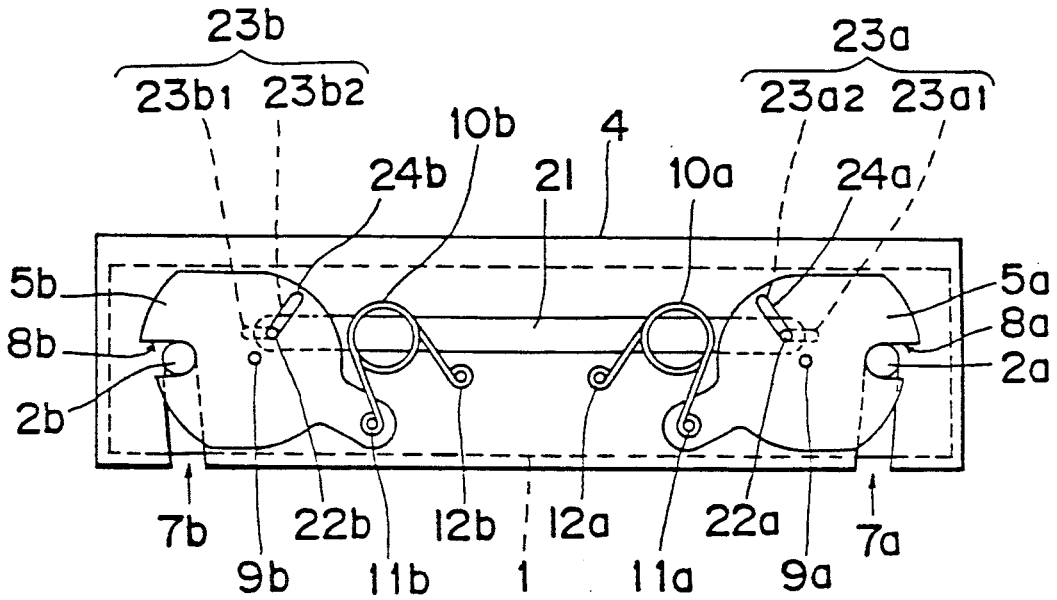
FIGS. 73 to 75 relate to an opening/closing device of a door member according to a sixth embodiment of the present invention.
Figure 74:
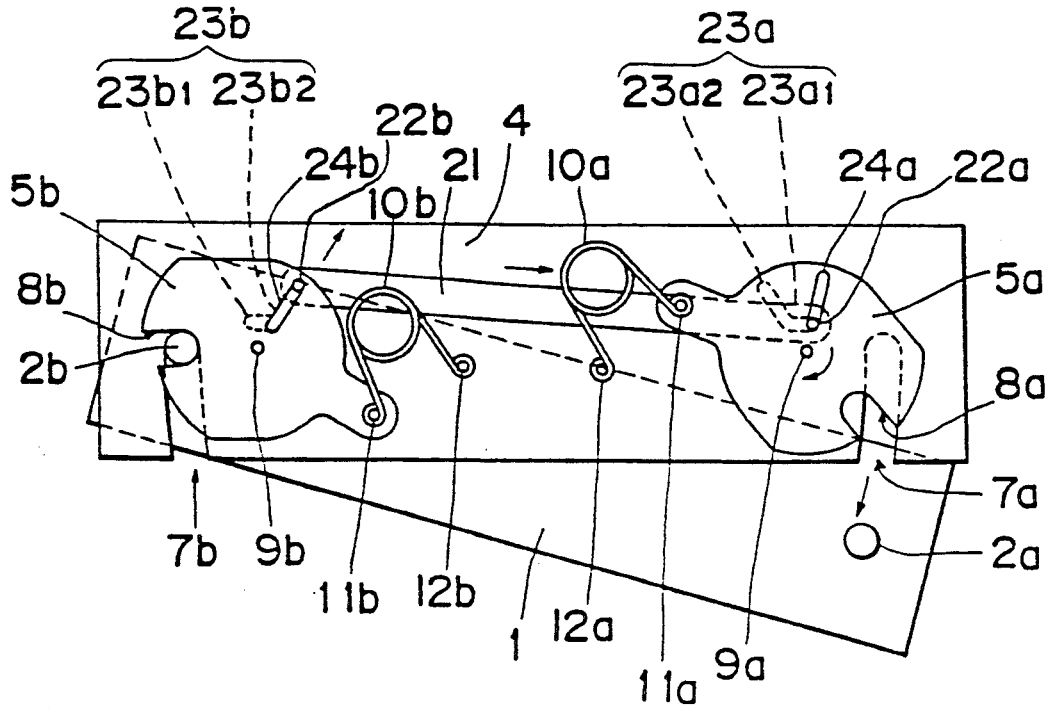
Figure 75:
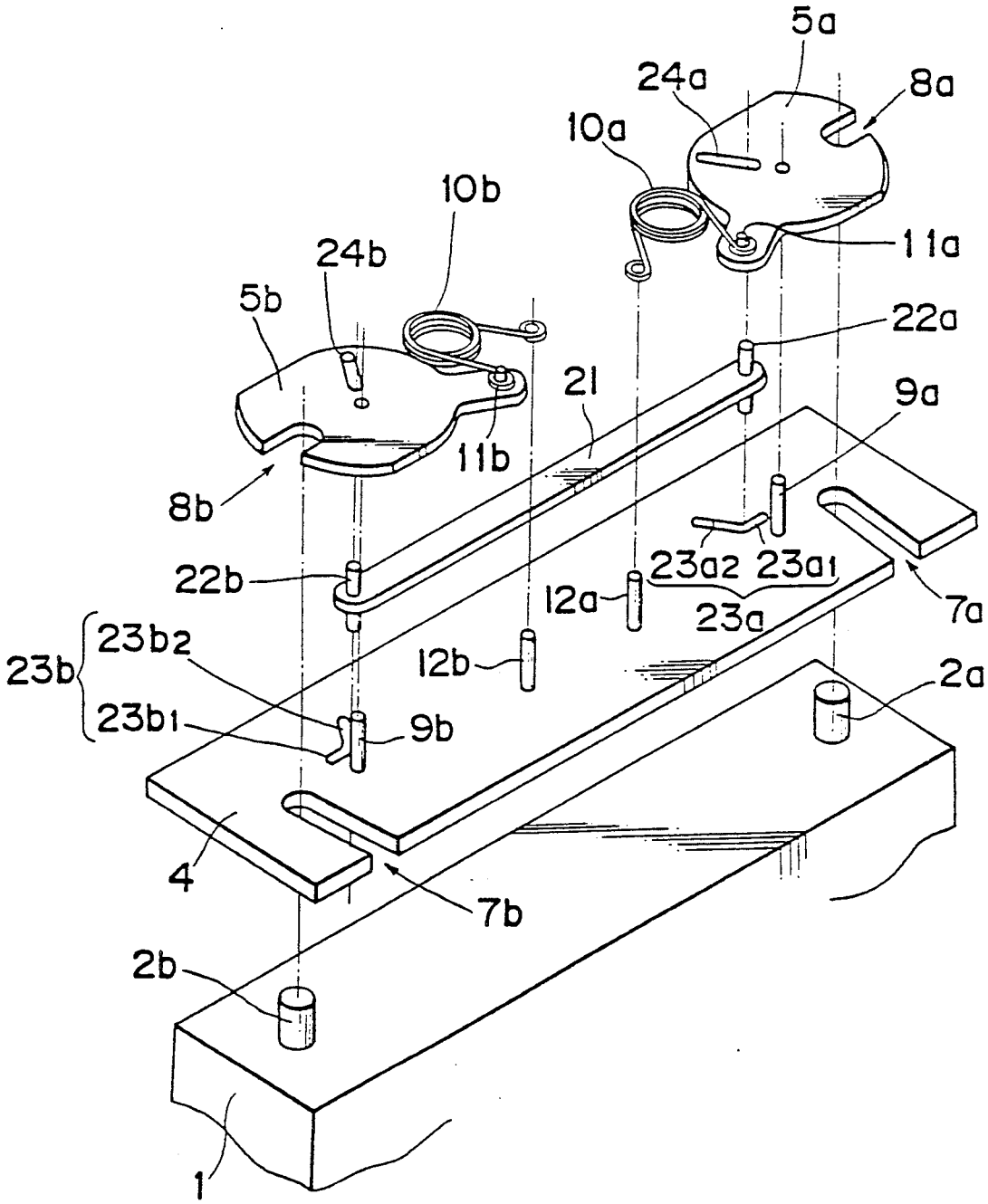

FIGS. 73 to 75 which illustrate an opening /closing device according to a sixth embodiment of the present invention are respectively, a plane view of the device when the door is kept closed, a plane view of the device when the door is kept opened, and an exploded perspective view of the device.

The opening/closing device of the present embodiment is the same as the device of the first embodiment in the fact that the device according to the present embodiment includes a pair of right and left hinge pins 2A and 2B protrudingly provided at the opposite right and left sides of the door 1, the fixed plate 4 having engaging grooves 7A and 7B, a pair of right and left latch plates 5A and 5B having latch grooves 8A and 8B, and springs 10A and 10B urging the latch plates 5A and 5B so as to restrict the hinge pins 2A and 2B and, to release the restriction of the hinge pins 2A and 2B. The same parts of the sixth embodiment as in the first embodiment are represented by the same reference numerals.

Meanwhile, the device of the present embodiment is different from that of the first embodiment in that a coupling means 21 which prohibits the rotation of the one latch plate 5B (5A) in association with the rotation of the other latch plate 5B (5A) in the restriction-releasing direction is comprised of one lever having lock pins 22A and 22B protruding at the opposite right and left end portions thereof. The lock pins 22A and 22B are engaged with respective slide grooves 23A and 23B formed in the fixed plate 4. When the lock pins 22A and 22B are slid in the slide grooves 23A and 23B, the coupling lever 21 is oscillated right and left. The slide grooves 23A and 23B which are bent generally in L-shape are comprised of slide guide portions 23A1 and 23B1 extending in a direction away from the slide grooves 23B and 23A, and stopper portions 23A2 and 23B2 extending in a slantwise direction away from the rotary shafts 9A and 9B of the latch plates 5A and 5B, respectively. Each of the latch plates 5A and 5B is formed with a lock groove 24A or 24B at the position corresponding to the stopper portion 23A2 or 23B2 with which is engaged the other end portion of the lock pin 22A or 22B of the coupling means 21.

In the foregoing construction of the device, when the door 1 is opened from the right side as shown in FIG. 73, the right hinge pin 2A is pulled to slip from the engaging groove 7A. Therefore, the right latch plate 5A is rotated in the clockwise direction, namely, in the restriction-releasing direction. At this time, since the lock pin 22A provided in the coupling means 21 is positioned at the inner end portion of the lock groove 24A and at the corner of the slide groove 23A, while being added the force in the right direction by the lock groove 24A, the lock pin 22A is slid in the slide guide portion 23A of the slide groove 23A, thereby oscillating the coupling means 21 in the right direction. Because of the oscillation of the coupling means 21, the lock pin 22B protruding at the end portion of the coupling means 21 is moved in a direction away from the latch plate 5B, at the side of the left latch plate 5B. Therefore, the lock pin 20B comes to be fitted into the end portion at the outer diameter side of the lock groove 24B and the stopper portion 23B2 of the slide groove 23B. Consequently the rotation of the latch plate 5B is prohibited, and the left hinge pin 2B is held in the restrained state.

When the door 1 is opened from the left side, the reversed operation in the right and left directions will open the door 1.

Also in the instant embodiment, the coupling means 21 may be provided at the front side of the fixed plate 4. In this case, the slide guide portions 23A1 and 23B1 of the slide grooves 23A and 23B are respectively extended in a direction away from the slide grooves 23B and 23A. Moreover, the stopper portions 23A2 and 23B2 are extended from the outer end portions of the slide guide portions 23A1 and 23B1 in a slantwise direction away from the rotary shafts 9A and 9B of the latch plates 5A and 5B. The lock grooves 24 and 24B of the latch plates 5A and 5B are formed at a corresponding position to the stopper portions 23A2 and 23B2 at the front side thereof.

An embodiment of the present invention which is a modification of the sixth embodiment is illustrated in FIGS. 130 to 132 in which the corresponding parts are designated by the same reference numerals. FIG. 130 is a plane view of the device when the door 1 is kept closed. FIG. 131 is a plane view of the device when the door 1 is kept opened. FIG. 132 is an exploded perspective view of the device. In FIGS. 130 to 132, the springs 10A,10B are omitted.

7) Seventh embodiment

Figure 76:
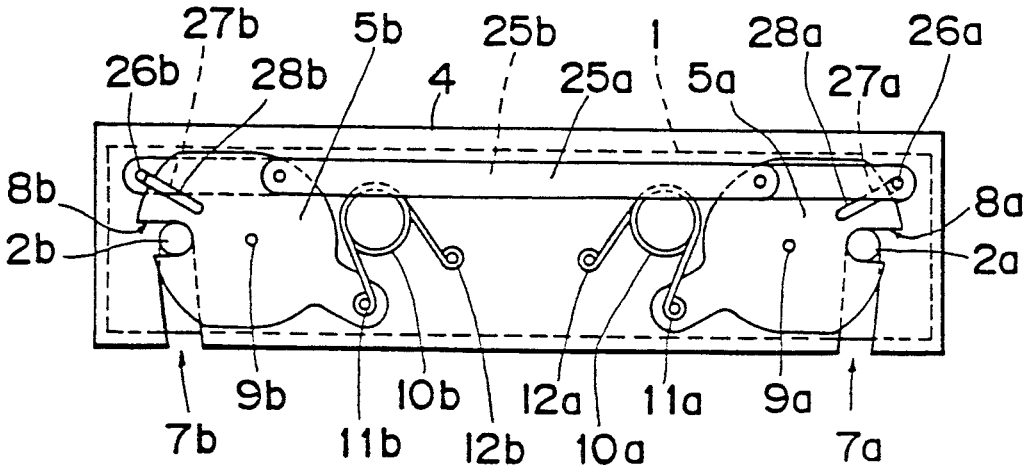
FIGS. 76 to 78 relate to an opening/closing device of a door member according to a seventh embodiment of the present invention.
Figure 77:
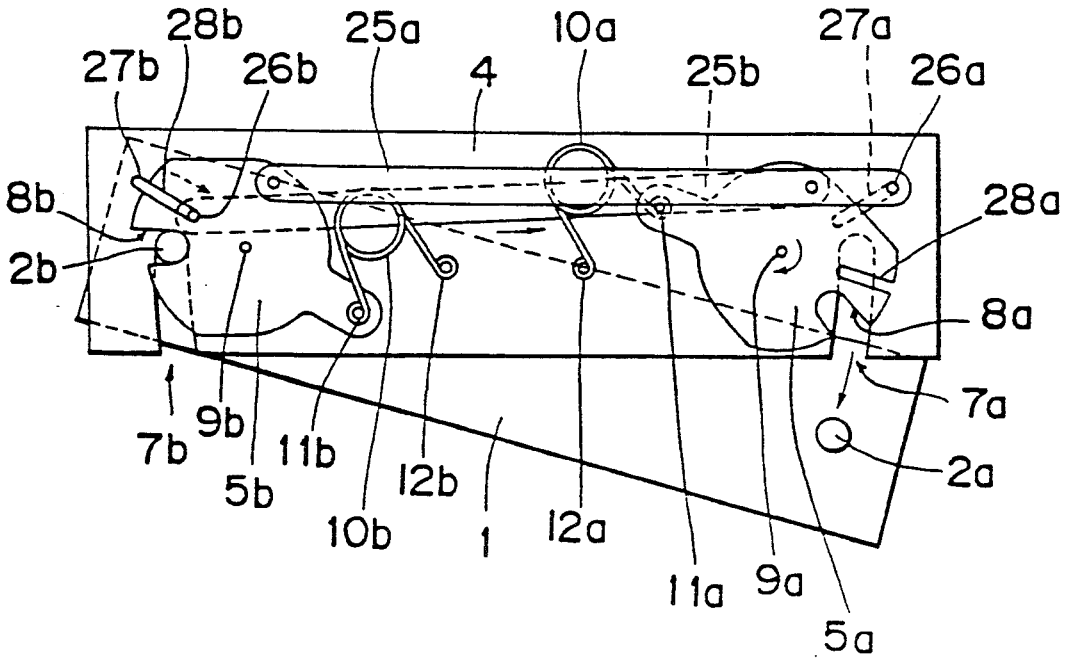
Figure 78:
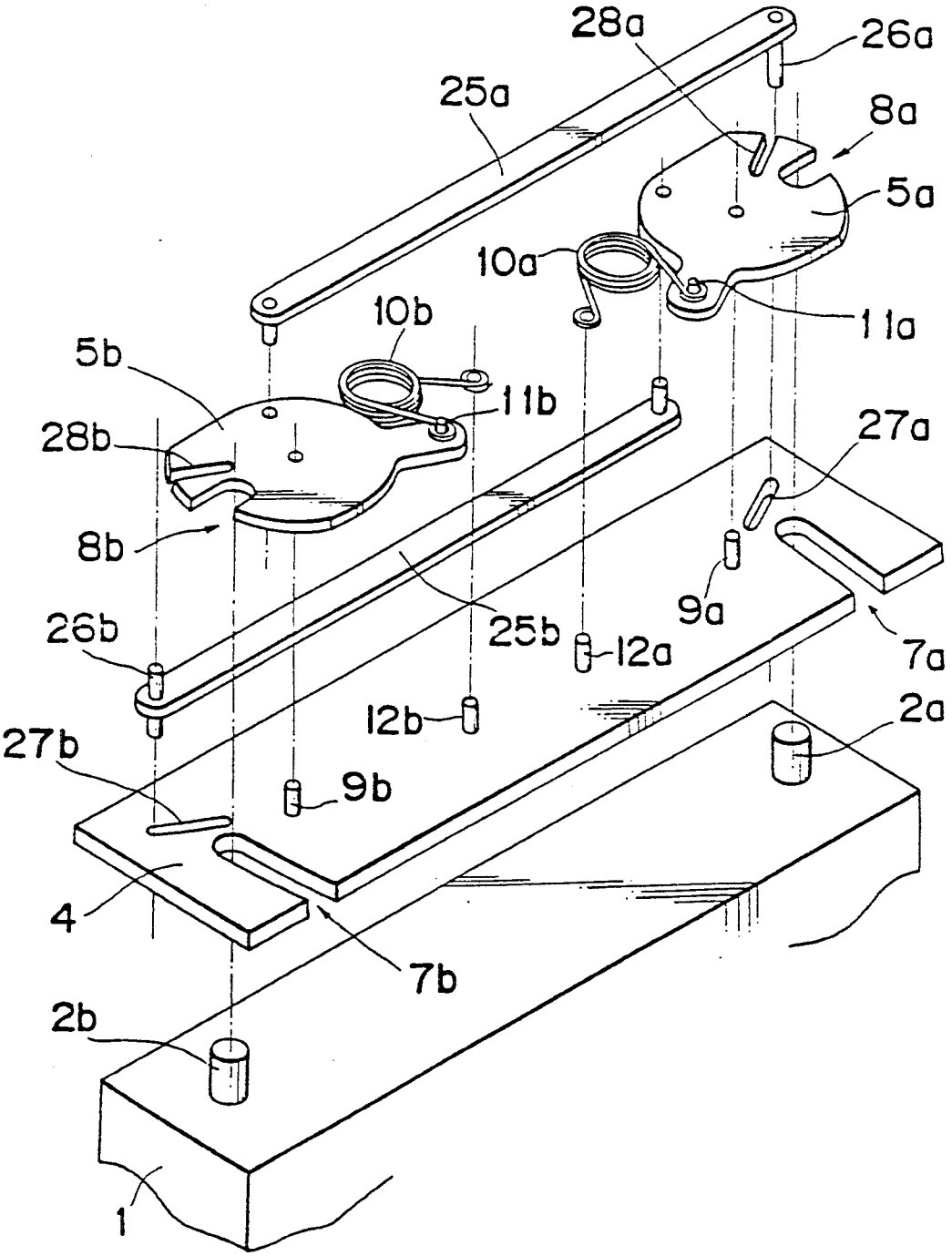

FIGS. 76 to 78 are related to an opening/closing device according to a seventh embodiment of the present invention. FIG. 76 is a plane view of the device when the door member is kept closed, FIG. 77 is a plane view of the device when the door member is kept opened, and FIG. 78 is an exploded perspective view of the device.

The opening/closing device of the present seventh embodiment is the same as that of the first embodiment in that the device includes a pair of hinge pins 2A and 2B protrudingly provided at the opposite right and left sides of the door 1, the fixed plate 4 having engaging grooves 7A and 7B, a pair of right and left latch plates 5A and 5B having respective latch grooves 8A and 8B, and a pair of springs 10A and 10B urging the latch plates 5A and 5B to position the hinge pins 2A and 2B in the restrained condition and in the restriction-releasing condition. Therefore, the same parts of the seventh embodiment as in the first embodiment are designated by the same reference numerals, and the detailed description will be abbreviated.

The difference between the device of the present embodiment from that of the first embodiment is that a coupling means 25 which prohibits the rotation of the one latch plate 5B (5A) in association with the rotation of the other latch plate 5A (5B) in the restriction-releasing direction is comprised of a pair of two coupling levers 25A and 25B.

The coupling lever 25A which is positioned above the latch plates 5A and 5B in the drawings is pivotally fixed at the left end thereof to the peripheral portion of the left latch plate 5B, whereas at the right end of the coupling lever 25A a lock pin 26A is protruded which is fitted in a slide guide groove 27A formed in the fixed plate 4, so that the lock pin 26A is guided in a radius direction of the latch plate 5A by the slide guide groove 27A. There is formed a lock groove 28A opening to the outer-diameter side in the latch plate 5A correspondingly to the slide guide groove 27A. When the latch plate 5A is at the position to restrict the hinge pin 2A, the lock groove 28A is overlapped with the slide guide groove 27A.

The other coupling lever 25B which is lower than the latch plates 5A and 5B has the construction reversed to the above-described coupling lever 25A in the right and left sides. The right end of the coupling lever 25B is pivotally fixed to the peripheral portion of the right latch plate 5A, and the left end of the coupling lever 25B is provided with a protruding lock pin 26B. A slide guide groove 27B for leading the lock pin 26B is formed at the left side of the fixed plate 4. Further, a lock groove 28B is formed opening to the outer diameter side in the left latch plate 5B.

In the above-described construction, when the door member is kept closed, as shown in FIG. 76, the lock pins 26A and 26B of the coupling levers 25A and 25B are out of the lock grooves 28A and 28B, respectively, enabling the latch plates 5A and 5B to be rotated.

Then, when the door 1 is opened from the right side, as shown in FIG. 77, the right hinge pin 22A is pulled to slip from the engaging groove 7A, and the right latch plate 5A is rotated in the clockwise direction, that is, in the restriction-releasing direction. In accordance with the rotation of the latch plate 5A, the lower coupling lever 25B is pulled rightward, and the lock pin 26B protruding at the left end of the coupling lever 25B is fitted into the lock groove 8B of the left latch plate 5B. Accordingly, the left latch plate 5B is prohibited from rotating. In this case, the upper coupling lever 25A is not displaced in spite of the rotation of the right latch plate 5A since the lock pin 26A is not fitted in the lock groove 28A, thereby being maintained in the original state.

When the door 1 is desired to be opened from the left side, it can be done by the reverse operation in the right and left directions.

Although the coupling lever 25A is pivotally fixed at the rear side to the latch plates 5A and 5B according to the present embodiment, it may be pivotally fixed at the front side. In this case, the slide guide grooves 27A and 27B of the fixed plate 4, and the lock grooves 28A and 28B formed in the latch plates 5A and 5B should be formed from the center of the fixed plate 4.

A modified example of the seventh embodiment is shown in FIGS. 133 to 135 in which the corresponding parts are designated by the same reference numerals as in the seventh embodiment. FIG. 133 is a plane view of the device when the door member is kept closed. FIG. 134 is a plane view of the device when the door member is kept closed. FIG. 134 is a plane view of the device when the door member is kept opened, and FIG. 135 is an exploded perspective view of the device. The springs 10A,10B are omitted in FIGS. 133 to 135.

8) Other Embodiments

In each of the foregoing embodiments described above, the hinge pins 2A and 2B are provided in the door 1 and the fixed plate 4 is provided in the main body 3. On the contrary to this, the hinge pins 2A and 2B may be provided in the main body 3 and the fixed plate 4 may be provided in the door 1.

Moreover, the fixed plate 4 is not necessarily formed by one plate, but may be divided into the right and left parts. Or, the fixed plate 4 may be formed by two plates so as to sandwich the latch plates 5A and 5B, and the coupling means 6, 17, 21 and 25 from up and down.

The present invention is not restricted to the above-described embodiments, but can be applied widely in general door members other than for a refrigerator. Various modifications may be possible within the scope of the present invention. For instance, one end of each of the springs 10A and 10B is rotatably and pivotally fixed to a shaft 11A or 11B protruding at an end portion of the latch plate 5A or 5B opposite to the latch groove 8A or 8B, and the other end of the spring 10A or 10B is also rotatably and pivotally fixed to a check shaft 12A or 12B protrudingly provided in the fixed plate 4.

Each of the check shafts 12A and 12B is mounted in such a portion as to be approximately in the center of the angular area defined by the shafts 11A or 11B and, rotary shafts 9A or 9B when the latch plates 5A and 5B are rotated between the position where the latch plates 5A and 5B restrict the hinge pins 2A and 2B and, the position where the restriction of the hinge pins 2A and 2B by the latch plates 5A and 5B is released.

Each of the springs 10A and 10B is arranged to apply pressure in such a direction that the opposite ends thereof are always extended outwards.

Accordingly, the springs 10A and 10B are provided to press the door 1 toward the main body 3, and it is not necessary to provide a magnet within a packing 430 of the door, as shown in FIG. 140. The packing 430 provided on the inner side of the door 1 provides a plurality of hermetic compartments each reversing air therein for the purpose of adiabatic effect, and an external surface to be attached with the outer surface of the main body, which is formed of slight convex to be deformed to make a hermetic seal between the door and the main body when the door is closed. Accordingly, the packing 430 is simple to design without providing a magnet, and in adiabatically effective in providing a plurality of hermetic compartments.

According to the present invention, the door can be opened only by pulling the door from the desired right or left side, without necessities for rotating an operating handle therefor. Therefore, the door can be freely designed according to the present invention without restrictions. Moreover, the door can be opened/closed from the inside of the refrigerator according to the present invention, whereby a dangerous accident of an infant being confined within the refrigerator can be prevented.

Moreover, the device according to the present invention can be incorporated in the upper and lower edge portions of the door, or in the corresponding parts of the main body, and no special mechanism is required to be provided inside the door. Accordingly, the inner construction of the door is unchanged, and the adiabatic efficiency is never deteriorated.

Although the present invention has been fully described in connection with the preferred embodiments thereof with reference to the accompanying drawings, it is to be noted that various changes and modifications are apparent to those skilled in the art. Such changes and modifications are to be understood as included within the appended scope of the present invention as defined by the appended claims unless they depart therefrom.

What is claimed is:

1. An opening/closing device of a door member which comprises hinge pins projected from and mounted on both the right and the left end portions of a main body on which said door member is mounted and engaging grooves being provided in the door member into which the hinge pins are detachably engaged from an open side of the door member, the door member being optionally opened or closed from one of the right and left sides thereof, and the door member including frame members composed of two pairs of opposed sashes, adjacent sash pairs being respectively secured through an engagement member, and at least more than three sashes being integrally secured with the engagement member.

2. An opening/closing device for a door member provided on a main body, the device comprising:

hinge pins mounted on right and left end portions of the main body, said door member being mounted on said hinge pins;

engaging grooves provided in said door member, said hinge pins being received in the grooves and being removable therefrom such that said door member is optionally openable and closable from one of a right and left side;

two pairs of opposed sashes defining an outer periphery of the door, the engaging grooves being provided in at least one of the sashes; and an engagement member to which the sashes are mounted, the engaging grooves also being provided in the engagement member in mating configuration with the engaging grooves in the at least one of the sashes.

3. The opening/closing device for a door member as defined in claim 2, wherein the two pairs of opposed sashes are mounted to sides of the engagement member to form a generally rectangular shape, the engaging grooves being provided in at least one of a top and bottom of the at least one sash and the engagement member.

4. The opening/closing device for a door member as defined in claim 2, further comprising an internal plate and an external plate, the internal plate being mounted on an inside face of the engagement member while the external plate is mounted on an outer face of the engagement member, a space being formed by the external plate, engagement member and internal plate and an insulating material being filled in the space.

5. The opening/closing device for a door member as defined in claim 4, further comprising a packing for providing a seal between the door member and the main body when the door member is closed, the packing being provided on the internal plate.

6. The opening/closing device for a door member as defined in claim 2, wherein the engagement member has two generally U-shaped angles, one of the two pairs of opposed sashes being attached to opposed sides of both of the angles while another of the two pairs of opposed sashes has a first and second sash, the first sash being attached to one of the angles while the second sash is attached to another of the angles whereby said sashes and angles generally have a rectangular configuration.

7. The opening/closing device for a door member as defined in claim 6, wherein the sashes are in engagement with the angles of the engagement member.

8. The opening/closing device for a door member as defined in claim 6, further comprising a panel provided on at least one of the first and second sashes, the panel having the engaging grooves defined therein, the engaging grooves in the panel being in mating configuration with the engaging grooves in the engagement member and the at least one of the sashes.

9. The opening/closing device for a door member as defined in claim 8, further comprising bosses provided through openings defined in the at least one first and second sash, the bosses being mounted onto the angle to which the at least one first and second sash is attached and the bosses contacting the panel.

10. The opening/closing device for a door member as defined in claim 9, further comprising attachment means for connecting the panel, the at least one first and second sash and the angle, the attachment means extending through each of the bosses.

11. The opening/closing device for a door member as defined in claim 2, wherein the engagement member generally has a rectangular configuration and is a one-piece structure, the two pairs of sashes being attached to opposed, outer sides of the engagement member.

* * * * *